United States Patent [19]

Midorikawa et al.

[11] 4,435,074

[45] Mar. 6, 1984

[54] CLEANING APPARATUS FOR ELECTROPHOTOGRAPHY COMPRISING LUBRICANT FILM APPLICATOR MEANS

[75] Inventors: Akira Midorikawa; Kenji Kojima; Kazuo Uchimura, all of Tokyo, Japan

[73] Assignee: Ricoh Company, Ltd., Tokyo, Japan

[21] Appl. No.: 255,190

[22] Filed: Apr. 17, 1981

[30] Foreign Application Priority Data

Apr. 23, 1980 [JP] Japan ..... 55-53790

[51] Int. Cl.[3] ..... G03G 21/00

[52] U.S. Cl. ..... 355/15; 15/256.52; 118/652

[58] Field of Search ..... 355/15, 3 R; 118/652; 15/256.5, 256.51, 256.52

[56] References Cited

U.S. PATENT DOCUMENTS 2,889,758 6/1959 Bolton ..... 355/15 X 3,940,282 2/1976 Hina ..... 355/15 X

*Primary Examiner*—Richard L. Moses

*Attorney, Agent, or Firm*—David G. Alexander

[57] ABSTRACT

After a photosensitive drum is cleaned of residual toner by a scraper blade, a lubricant film is applied to the drum to maintain the coefficient of friction between the drum and blade constant and thereby ensure efficient cleaning and printing density without damage to the drum. The film forming material is in the form of a block and is applied to the drum by a rotary brush. The brush is selectively moved into and out of engagement with the drum to control the amount of film application. The engagement of the brush with the drum is controlled in accordance with a sensed parameter such as a number of copies produced, the coefficient of friction between the drum and a sensor blade, etc.

11 Claims, 96 Drawing Figures

| |
|---|
| Fig. 42 A |
| Fig. 42 B |
| Fig. 42 C |

| |
|---|
| Fig. 43A |
| Fig. 43B |

3
13

"SCAN" ROUTINE CALL
PULSE = 7 ?
N
Y
FORWARD CL OFF
N
PULSE = 8 ?
Y

RETURN CL ON
RESET PULSE 3 "0"
SET 1.5 SET TIMER
FREE RUN OR JAM OFF ?
Y
N
Y
PAPER END ?
SHEET FEED CL ON
N
Y
TONER END ?
N
N
KEY COUNTER SET ?
Y
N
REPEAT END ?
Y
N
1 TO 1 COPY ?
Y

| | KT0(H) | KT1(H) | KT2(H) | KT3(H) |
|---|---|---|---|---|
| KIN0(H) | KEY 0 | KEY 4 | KEY 8 | |
| KIN1(H) | KEY 1 | KEY 5 | KEY 9 | |
| KIN2(H) | KEY 2 | KEY 6 | UP CASSETTE SELECT KEY | INTERRUPT KEY |
| KIN3(H) | KEY 3 | KEY 7 | LOW CASSETTE SELECT KEY | CLEAR STOP KEY |

| Fig. 83 A | Fig. 83 B |
|---|---|

HOME POSITION SW (SWHP)
REGIST SW (SWRG)
BLADE SOLENOID (SOL B)
MAIN MOTOR (SSR 3)
FIX END SOLENOID (SOLF)
TRANS, SEPARAT, DISSPAT (PPD)
CHARG. P.P. (PPM)
HAL LAMP (REG)
FEED CLUTCH (CLFU)
FEED SENSOR (CLFL)
FEED CLUTCH (SWF)
LAMP BEFORE TRANS (MCC)
REGIST CLUTCH (LMS)
BIASING (CLRG)
RETURN CLUTCH (BS)
DISCHARGE SW (MCR)
(SWT)

0.3S
40ms
JAM TIMING
REPEAT CYCLE

CLEANING APPARATUS FOR ELECTROPHOTOGRAPHY COMPRISING LUBRICANT FILM APPLICATOR MEANS

BACKGROUND OF THE INVENTION

The present invention generally relates to electrophotographic copying machines and, more particularly, to a cleaning apparatus included in such a machine which applies a film-forming material of a small coefficient of friction onto a photosensitive element while removing a toner residual thereon by means of a cleaning blade.

An electrophotographic copying machine to which the present invention is applicable is of the type which forms a latent image electrostatically on a surface of a photosensitive element, processes the latent image with a toner powder into a visible toner image, transfers the toner image onto a sheet material to form a copy, and cleans the photosensitive element to remove residual particles of the toner therefrom so that the photosensitive element becomes prepared for another copying cycle.

In this type of copying machine, transfer of a powdery toner image from the photosensitive element to a sheet is under the influence of a relative humidity. Particularly, it is adversely affected by high relative humidities. When the relative humidity is high, an electrostatic force, Van der Waals force and other various influential forces cause a major part of the powder to constitute deposits adhered to the photosensitive element. This not only lowers the density of an image reproduced on a sheet but allows the toner image to remain on the photosensitive element. Therefore, complete image transfer and complete removal of the residual toner image in a copying cycle are key factors to the prevention of a ghost image during image transfer in the next copying cycle as well.

It is well known to clear residual toner particles from the surface of the photosensitive element using a cleaning blade. A cleaning effect attainable with a cleaning blade is excellent because the cleaning blade has its leading end or edge usually held in positive pressing contact with the photosensitive element to remove toner particles by intense friction. However, where use is made of a photosensitive element formed of a relatively soft material, the cleaning blade tends to damage the surface of the photosensitive element and/or cause wear of the same surface resulting in a short service life of the photosensitive element. An expedient to settle this problem may be the use of a cleaning blade formed of polyurethane rubber or like highly wear resistant material and a photosensitive element formed of a material which stands relatively intense friction. This expedient still fails to preclude incomplete cleaning due to wear of an edge portion at the leading end of the cleaning blade. Experiments showed that an expected cleaning effect becomes unattainable when the edge portion of such a cleaning blade wears by 20–50 microns.

Japanese Patent Publication No. 51-22380/1976 for instance discloses a method designed to eliminate such drawbacks inherent in the cleaning system of the type using a blade while promoting efficient transfer of a toner image from the photosensitive element to a sheet and efficient removal of a residual toner image by the blade. According to this method, a certain film-forming material having a small coefficient of friction is applied to a surface of the photosensitive element at the cleaning station so as to serve as a kind of lubricant. Zinc stearate is generally accepted as a film-forming material which gives a favorable result. Another example of such a material may be a metal salt which is dense, hydrophobic and with a stable fatty acid. Various kinds of dense and hydrophobic metal salts with stable fatty acids are stated in Japanese Patent Publication No. 51-22380/1967. A problem encountered here is that, the larger the amount of application of such a material onto the photosensitive drum, the greater the cleaning efficiency grows but, at the same time, the lower the image density becomes because the total amount of toner allowed to adhere to the photosensitive element during development is limited; the smaller the amount of the material, the poorer the cleaning efficiency though the higher the image density due to an increase in the total amount of toner adhesion during development.

It has been a common practice to apply a film-forming material of the type described either periodically or continuously, all in a fixed amount. With this mode of application, however, whether a current amount of the material supplied to the photosensitive element is proper cannot be known at all. If the amount of supply is short, the image density becomes excessive and, if the amount of supply is excessive, the image density becomes short.

SUMMARY OF THE INVENTION

A principle concept of the present invention resides in that, though the image density and cleaning efficiency show opposite tendencies with respect to the amount of supply of a film-forming material, both of them can be improved to satisfactory levels by controlling the amount of material supply to a certain appropriate one.

A cleaning apparatus according to the present invention is operable in an application mode in which a brush is in a first position engaged with a photosensitive element or in a non-application mode in which the brush is disengaged from the photosensitive element. In the first position, the brush applies a film-forming material to a surface of the photosensitive element undergone a major cleaning operation so as to increase the cleaning efficiency of the cleaning apparatus. The brush comprises a rotary brush held in pressing contact with a moulded mass of film-forming material. The amount of application of the material is controlled to a proper one by adjusting a time period of contact of the brush with the photosensitive element, an amount of contact of the brush with the photosensitive element, an amount of contact of the brush with the agent or like factor in matching relation with a number of rotations of the photosensitive element, a number of copy sheets produced and/or a coefficient of friction on the surface of the photosensitive element.

A cleaning apparatus for an electrophotographic copying machine embodying the present invention comprises a photosensitive member, scraper blade means engaging with the photosensitive member to scrapingly remove residual toner particles therefrom, applicator means for applying a film-forming material onto the circumference of the photosensitive member, and drive means for moving the applicator means into and out of contact with the photosensitive member in dependence on a parameter indicating a varying operating condition of the photosensitive member, whereby a proper amount of the film-forming material is applied onto the circumference of the photosensitive member under a varying operating condition of the photosensitive member.

It is an object of the present invention to provide a cleaning apparatus for electrophotography which attains an improved cleaning efficiency by applying an appropriate volume of film-forming material having a small coefficient of friction uniformly onto a photosensitive element.

It is another object of the present invention to provide a generally improved cleaning apparatus for electrophotography.

Other objects, together with the foregoing, are attained in the embodiments described in the following description and illustrated in the accompanying drawings.

BRIEF DESCRIPTION OF THE PREFERRED EMBODIMENTS

While the cleaning apparatus for electrophotography of the present invention is susceptible of numerous physical embodiments, depending upon the environment and requirements of use, substantial numbers of the herein shown and described embodiments have been made, tested and used, and all have performed in an eminently satisfactory manner.

Figure 1:
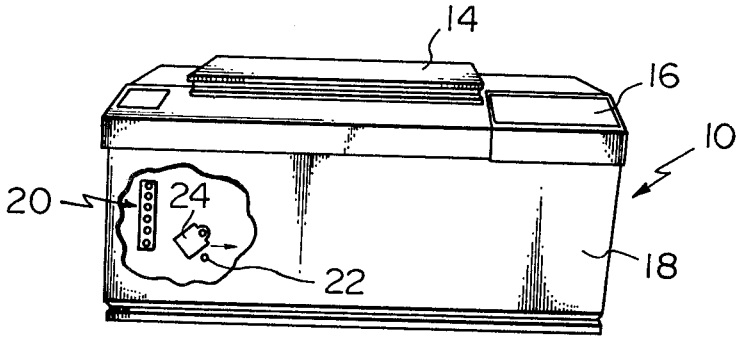
FIG. 1 is a partly broken away perspective view of an example of an electrophotographic copying machine to which the present invention is applicable.
Figure 2:
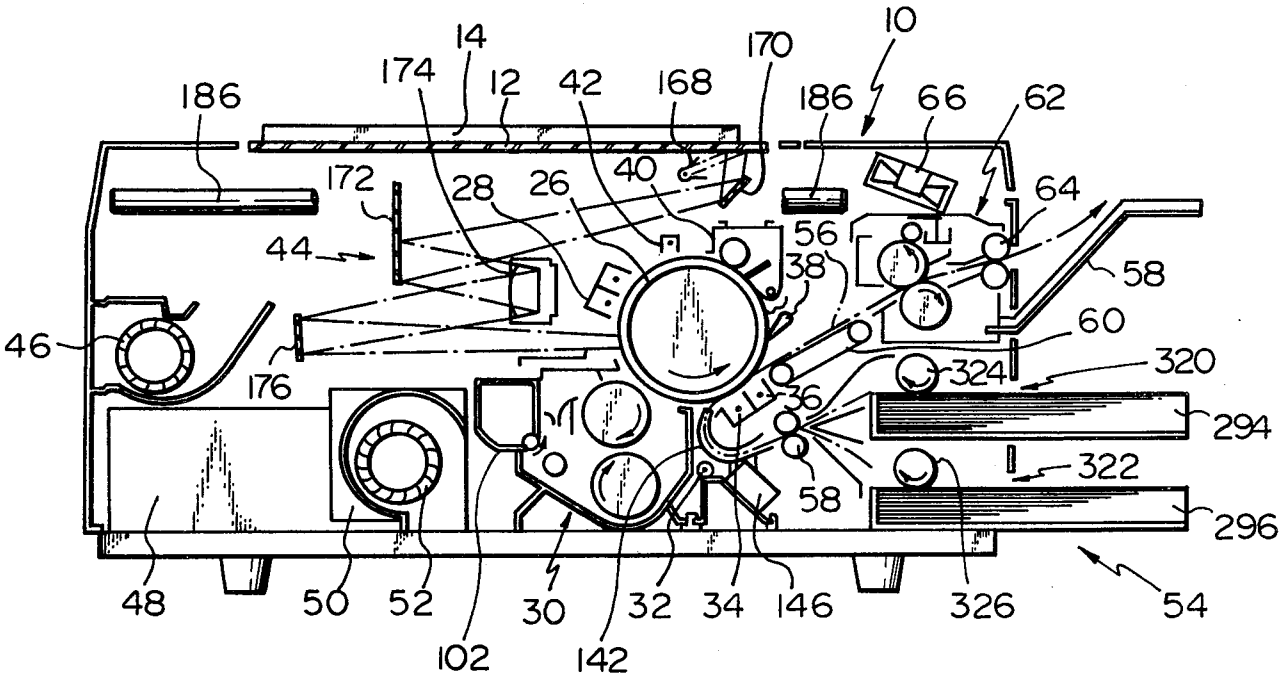
FIG. 2 is a sectional front elevation of the machine.

Before entering detailed description of the invention a reference will be made to an exemplary electrophotographic copying machine which is optimum for practicing the method of the present invention. Referring to FIGS. 1 and 2, a copying machine generally designated by the reference numeral 10 is provided with a document presser plate 14 on its top which is hinged thereto to uncover a glass platen 12 when desired. A control panel 16 is mounted on a rightward part of the top of the machine 10. A cover 18 is openably disposed at the front of the machine 10. Mounted in the machine 10 are a light emitting diode or LED display plate 20 and a developer agitating switch 22 which will become accessible when an operator opens the front cover 18. When out of use, the switch 22 is sheltered by a cover 24.

As viewed in FIG. 2, a photosensitive drum 26 is disposed below the glass platen 12 and rotatable in a direction indicated by an arrow. Located around the photosensitive drum 26 are a charger 28 for depositing an electrostatic charge on the drum 26, a developing unit 30, a quenching lamp 32, a transfer charger 34, a separation charger 36, a separation pawl 38, a cleaning unit 40 and a second quenching lamp 42.

A optical system 44 for exposure is interposed between the glass platen 12 and drum 26. In a lower leftward area of the machine 10, there are mounted a fan 46 for cooling mainly the optical system 44, a power pack 48 for generating a high voltage, a main motor 50 for driving the machine and a second fan 52 directly connected an output shaft of the motor 50 to cool the developing section.

The machine 10 also has a sheet feed section 54 in its lower rightward portion. A sheet fed out from the sheet feed section 54 is moved through a sheet passage 56 over to a tray 58 adapted to receive copy sheets. Arranged along the sheet passage 56 are a pair of registration rollers 58, an endless conveyor belt 60, a fixing unit 62 and a pair of sheet discharge rollers 64. A third fan 66 is positioned above the fixing unit 62 to avoid an increase in the temperature inside the machine.

Figure 3:
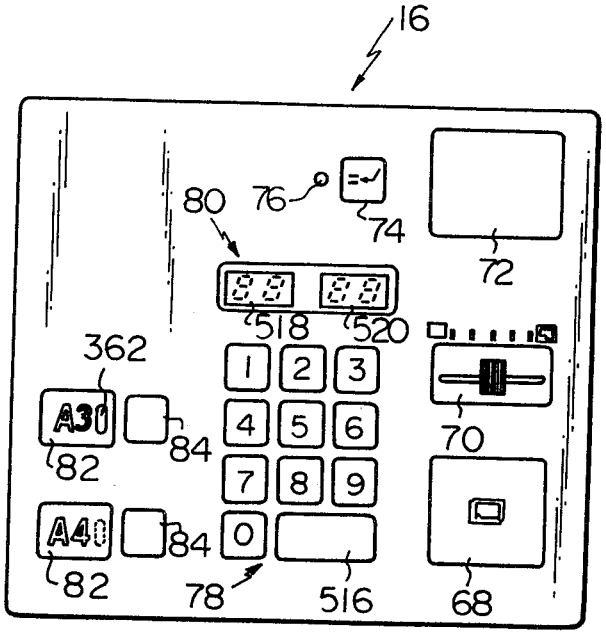
FIG. 3 is a plan view of a control panel.

As shown in FIG. 3, the control panel 16 comprises a flat panel provided with a print button 68, a lever 70 for the adjustment of an amount of exposure and a failure display section 72 which provides visual indication of a paper jam, a short supply of toner, a service call, a non-set condition of a key counter or that of doors, a stand-by condition (e.g. "WAIT") etc. The control panel 16 also comprises an interruption button 74 for setting and resetting an interruption copy mode and an interruption display section 76 for indicating an interruption copy mode of the machine. The control panel 16 further comprises ten keys 78 for setting a desired number of copies, a sheet number display section 80 for indicating a preset number of copies by segments, sheet size display sections 82 for indicating sizes of transfer sheets with which the sheet feed section 54 is loaded, and sheet selection buttons 84 for selecting sheets in the sheet feed section.

Figure 4:
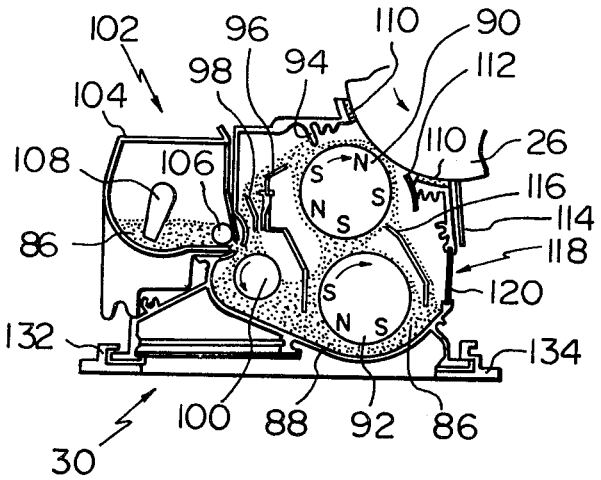
FIG. 4 is section of a developing unit.
Figure 5:
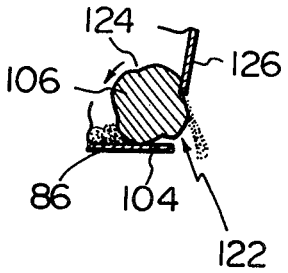
FIG. 5 is a fragmentary sectional front elevation of a toner supply mechanism.

Details of the developing unit 30 are illustrated in FIG. 4. The developing unit 30 includes a casing 88 which stores a developer 1 made up of a toner and a carrier (iron powder). A developing roller 90 is rotatably supported by the casing 88 to supply the drum 26 with the toner. A drawing roller 92 draws the developer up from the bottom of the casing 88 and supplies it to the developing roller 90. A doctor blade 94 is adapted to regulate the height of the nib of a magnetic brush by removing an excessive part of the developer on the developing roller 90. The developer removed by the doctor blade 94 is guided by a scraper 96 back into the bottom of the casing 88. Mounted to a part of the scraper 96 is a toner density sensor 98 which consists of a bobbin allowing a part of the developer guided by the scraper 96 to flow down therethrough and a coil. A shaft 100 agitates the developer flown down into the casing 88. A toner supply mechanism 102 is adapted to supply a supplementary amount of toner into the casing 88. As shown, the toner supply mechanism 102 comprises a container 104 storing a toner 86 therein, a roller 106 located adjacent to an opening of the container 104 and driven for rotation by a toner supply command signal as will be described, and an agitator 108 functioning to prevent toner particles in the container 104 from being solidified. The mechanism 102 is rigidly mounted to the casing 88 with its opening aligned with a toner supply opening of the casing 88 which is located above the agitator shaft 100. The edges of the casing 88 which define an opening facing the drum 26 are provided with a seal member 110 made of sponge rubber or the like and thin flexible seal plates 112 and 114 made of Miler (trade name) or the like. A scraper 116 spans the developing and drawing rollers 90 and 92 with its intermediate portion inclined relative to a side wall of the casing 88. A rightward side wall of the casing 88 is formed with a developer discharge opening 118 which is usually closed by a plate 120. As viewed in FIG. 5, the toner supply roller 106 is located in a position where it blocks an opening 122 of the container 104. Axial channels or recesses 124 extend on the periphery of the rollers 106 such that they deliver toner particles 86 from the opening 122 of the container 104 in accordance with the rotation of the roller 106. Each recess 124 is so shaped as to be rubbed by a rubber blade 126 and thereby supply a constant amount of toner particles into the casing 88 of the developing unit.

Figure 6:
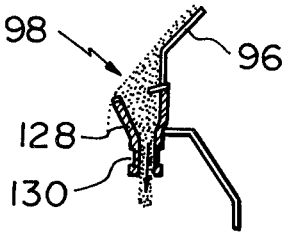
FIG. 6 is a sectional front elevation of a toner density sensor.

As shown in FIG. 6, the toner density sensor 98 comprises a bobbin 128 secured to a part of the scraper 96 and a coil 130 wound on a lower portion of the bobbin 128.

Figure 7:
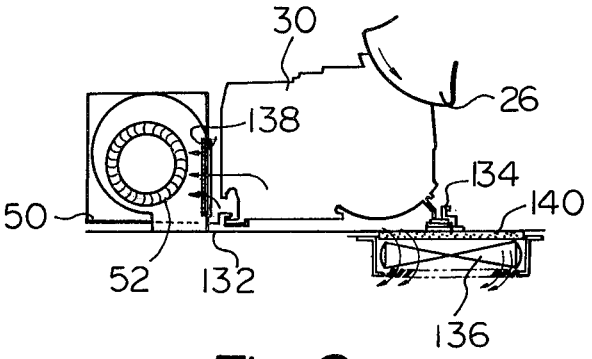
FIG. 7 is a front view showing positions of cooling fans.

As shown in FIG. 4, a pair of guides 132 and 134 are fixed to the machine body so that the developing unit 30 can be pulled out from the machine body therealong. As indicated in FIG. 7, the cooling fan 52 cools the developing unit 30 from a side while an additional cooling fan 136 cools it from below. The fans 52 and 136 are provided with detachable filters 138 and 140 at their suction openings, respectively.

The guide 134 serves also as a guide for the quenching lamp 32 (see FIG. 2). The lamp 32 is fixed to a common frame together with a turn guide plate 142 (see FIG. 2) and it can be moved out of the machine body along the guide 134 and a second guide 144.

Figure 8:
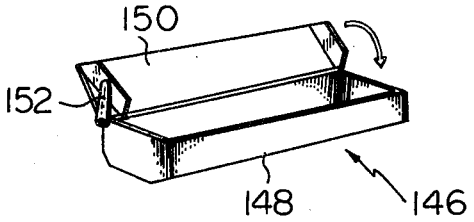
FIG. 8 is a perspective view of a container for collecting a developer therein.
Figure 9:
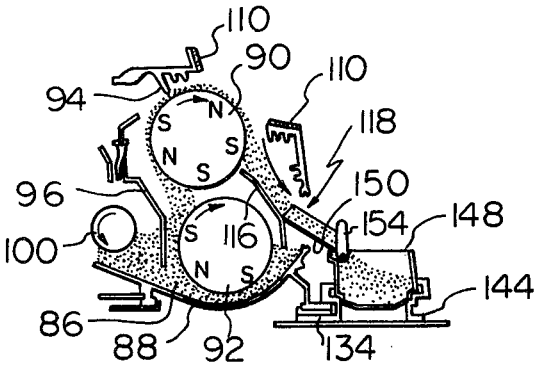
FIG. 9 demonstrates an operation for collecting the developer into the container.

The developer 86 in the developing unit 30 is collectable without demounting the unit 30 from the machine body. As shown in FIG. 8, a collecting box 146 is usually accommodated within the frame formed by the lamp 32 and turn guide 142. The box 146 comprises a body 148, a lid 150 openably hinged to the body 148 and a lever 152 for opening and closing the lid 150. The box 146 is detachable from the machine body along the guides 134 and 144. To collect the developer 86, the quenching lamp 32 is pulled out from the machine body and the cover plate 120 (see FIG. 4) is removed from the developing unit 30 whereupon the collecting box 146 is drawn out from the frame consisting of the lamp 32 and turn guide 142 and then inserted into the machine body along the guides 134 and 144 as viewed in FIG. 9. Subsequently, the lever 154 is manipulated until the lid 150 enters the casing 88 via the opening 118 into abutting engagement with the scraper 116. Under this condition, the switch 22 (see FIG. 1) is turned on so that the rollers 90 and 92 and the shaft 100 are driven individually in the directions of arrows to draw up the developer in the casing 88 and discharge it into the box 148 via the scraper 116 and lid 150.

Figure 10:
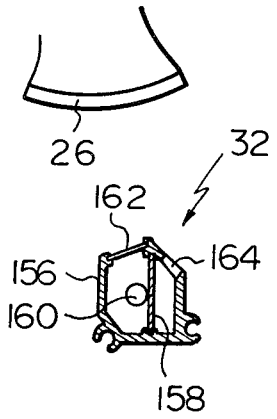
FIG. 10 is a sectional front elevation of a quenching lamp for lowering a potential on a photosensitive drum before image transfer.

The quenching lamp 32 is adapted to illuminate a toner image on the drum 26 before the toner image advances to a transfer station and thereby lower a potential on the drum, facilitating removal of a transfer sheet from the drum 26. As seen in FIG. 10, the quenching lamp 32 comprises an assembly made up of a casing 156, a support plate 158 detachably mounted to the casing 156, a tungsten lamp 160 securely mounted on the support plate 158 and a filter 162 disposed in an opening or window of the casing 156. The casing 156 is formed with a second opening 164.

Figure 11:
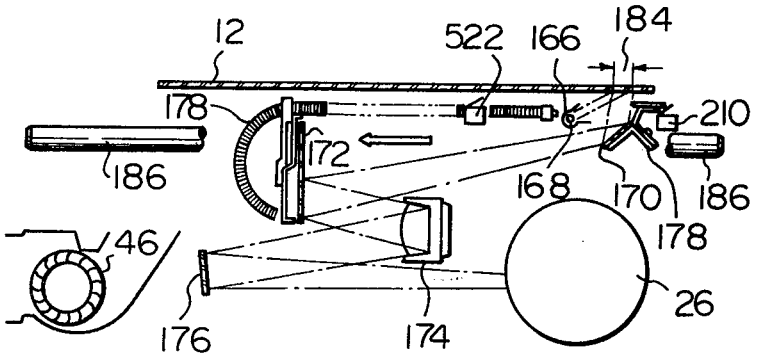
FIG. 11 is a front view of an optical exposure system.
Figure 12:
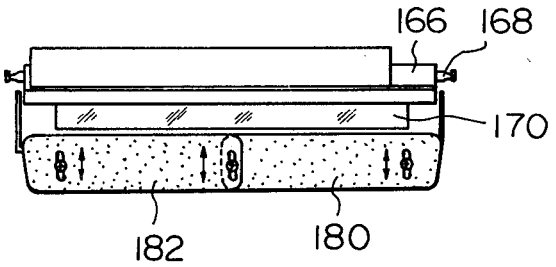
FIG. 12 is a plan view of a mechanism adapted to compensate for an irregular light intensity distribution.
Figure 13:
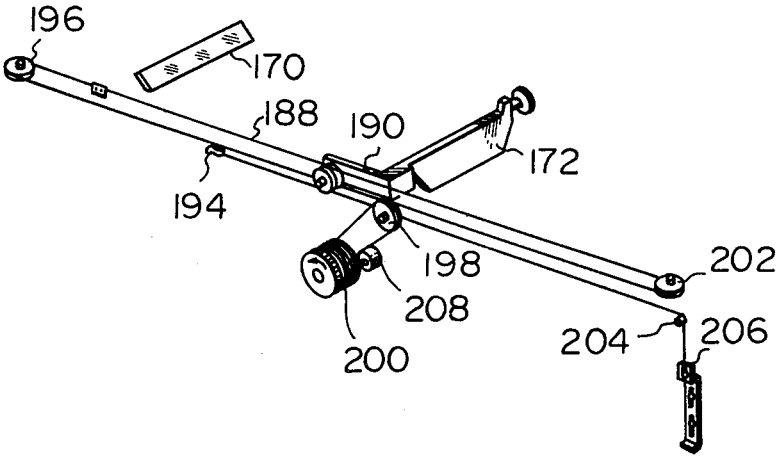
FIG. 13 is a perspective view of a mechanism for driving the optical system.

The optical exposure system 44 functions to transmit an image on a document layed on the glass platen 12 to the photosensitive drum 26. The system 44 comprises, as shown in FIG. 11, a halogen lamp 168 having a reflector 166 therewith, a first mirror 170 movable with the lamp 168 at a velocity V to the left in the drawing, a second mirror 172 movable at a velocity $\frac{1}{2}$ V in the same direction as the first mirror 170, an in-mirror lens 174 fixed in place, a fourth mirror 176 also fixed in place and a drive line which will be described. Power is supplied to the halogen lamp 168 by leads 178 which are surrounded by a coil spring as illustrated. A light image of the document formed by the halogen lamp 168 is transmitted to the photosensitive drum 26 via the first mirror 170, second mirror 172, in-mirror lens 174 and fourth mirror 176 successively. The halogen lamp 168 illuminates the document through an elongate slit. A problem encountered here is that, since a slit-shaped light image of the document passes through the lens before reaching the drum 26, opposite end portions of the slit shape become darker than the other portion when projected onto the drum 26; an uneven distribution of illumination intensity is brought about though the halogen lamp 168 is controlled to compensate for such an uneven distribution. With this in view, the illuminating section of the optical system 44 is designed to adjust the intensity of illumination at opposite ends of a slit. As seen in FIGS. 11 and 12, the first mirror 170 is supported on a carriage 178 which is provided with a pair of light intersepting plates 180 and 182 each of which is movable toward and away from a slit 184 independently of the other. Screws are engaged in elongate slots of the respective plates 180 and 182 such that, when lossened, they permit the plates 180 and 182 to be moved either linearly or angularly until a proper illumination intensity distribution is established. After the adjustment, the screws will be tightened to fix the plates 180 and 182 in selected positions.

The first and second mirror 170 and 172 are movable along a guide rod 186 (see FIG. 11) in parallel with the glass platen 12 on the principle of a running pulley. The carriage 178 (see FIG. 11) for the first mirror 170 is fixed to a wire 188 whereas a carriage 190 for the second mirror 172 supports a running pulley 192. The wire 188 is fixed at one end 194 to a stationary member, passed over the running pulley 192 to be turned thereby, fixed to the first mirror 170, turned by a standing pulley 196, passed over an idle pulley 198, wound several turns on a main pulley 200, again passed over the idle pulley 198, passed over a second standing pulley 202 to be turned thereby, passed over the running pulley 192, and fixed at the other end 206 to a second stationary member through a guide 204. A tightener 208 imparts a suitable magnitude of tension to the wire 188. The reference numeral 210 denotes a home position switch which functions to detect arrival of the optical system at a home position (rightmost position in FIG. 2).

Figure 14:
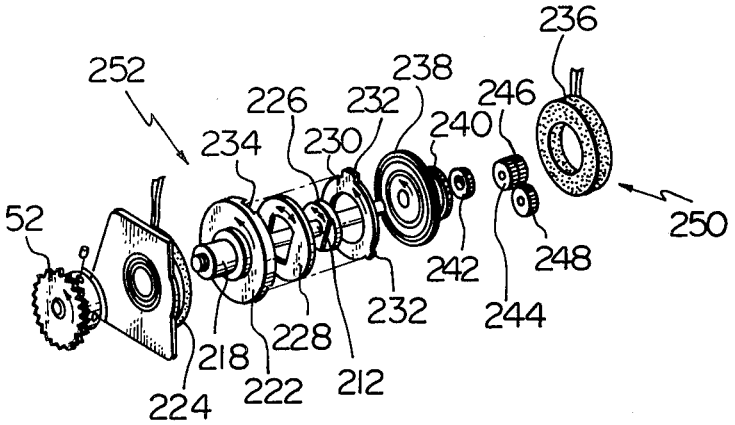
FIG. 14 is an exploded perspective view of a reversible clutch mechanism associated with the drive system.
Figure 15:
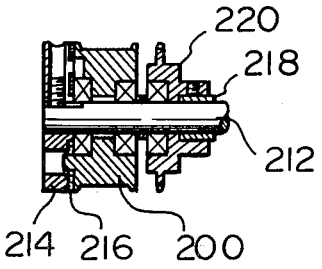
FIG. 15 is a fragmentary sectional side elevation of the reversible clutch mechanism.

FIG. 14 illustrates a reversible clutch mechanism for driving the wire 188 selectively in forward and reverse directions. The clutch mechanism includes a shaft 212 on which a disc 214 is fixedly mounted. The main pulley 200 is connected with the disc 214 through a damper 216. As viewed in FIG. 15, a sleeve 218 is free to rotate on the shaft 212. Fastened to an end portion of the sleeve 218 is a sprocket 220 which is connected with a drive source (not shown) to be driven therefrom as indicated by an arrow. Also fastened to the sleeve 218 is a disc 222 which faces a coil for forward rotations. An output shaft 226 is rigid on the shaft 212 while first and second armature plates 228 and 230 sandwitch the output shaft 226 and are freely rotatable about the shaft 212. The armature plate 228 is engagable with a projection on the output shaft 226. The armature disc 230 has lugs 232 on its periphery which are coupled in respective notches 234 formed in the disc 222. A disc 238 is free to rotate on the shaft 212 together with a coil 236 for reverse rotations. A gear element 242 is rigidly connected to the disc 238. A gear element 242 is securely mounted on an end of the shaft 212. Interposed between the gear elements 240 and 242 is a gear train comprising a gear element 244 meshing with the gear element 240, a gear element 246 coaxial and integral with the gear element 244 and a gear element 248 meshing with the gear elements 242 and 246.

Figure 16:
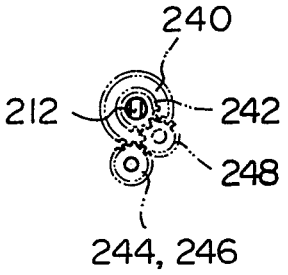
FIG. 16 is a front view of a gear train of the reversible clutch mechanism.

Rotations of the sprocket 220 are usually transmitted to the disc 222 and armature plate 230. For a scan stroke for exposure, the coil 224 is energized so that the disc 222 in rotation attracts the armature plate 228 thereonto to drive the output shaft 226 engaged with the armature plate 228 in a forward direction. The rotations of the output shaft 226 are transferred by the shaft 212 to the main pulley 200 which then moves the first and second mirrors 170 and 172 via the wire 188. At the end of a scan stroke, the coil 224 is deenergized and, instead, the coil 236 is energized to attract the other armature plate 230 onto the disc 238. Then the armature plate 230 has its lugs 232 held in engagement with the notches 234 of the disc 222. Under this condition, rotations of the sprocket 220 are transmitted to the shaft 212 via the disc 222, armature plate 230, disc 238, gear 240, gears 244 and 246, gear 248 and gear 242 whereby the main pulley 200 is driven for reverse rotations. During this reverse drive, it will be seen from the gear train shown in FIG. 16 that the rotation speed of the sprocket 220 is transmitted to the main pulley 200 after being increased and, accordingly, the first mirror 170 and other components of the optical system are returned to the home position at a speed higher than that of a scan stroke. In the exploded perspective of FIG. 15, the reference numeral 250 indicates the reverse side of the clutch which will be referred to as a return clutch hereinafter while the reference numeral 252 indicates the forward side which will be referred to as a forward clutch. If shocks are imparted to the drum 26 at forward starts and returns of the optical system, projection of a light image onto the drum 26 and/or transfer of a toner image onto a sheet will be disturbed. To avoid this, the rubber damper 216 and disc 214 intervene between the main pulley 200 and shaft 212 to serve as shock absorbers.

Figure 17:
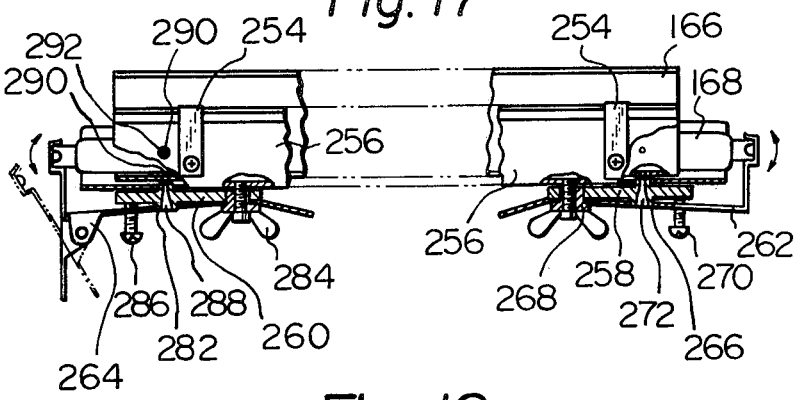
FIG. 17 is a partly sectional fragmentary plan view of a mechanism for positioning the filament of an exposing lamp.
Figure 18:
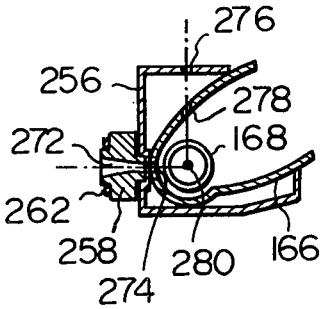
FIG. 18 is a section of the positioning mechanism shown in FIG. 17.
Figure 19:
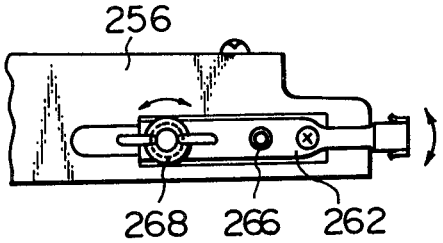
FIG. 19 is a fragmentary side elevation of the same positioning mechanism.

The filament of the halogen lamp 168 for illuminating a document must be positioned strictly in parallel with the slit 184 along the length of the latter. Since the relative position of the tube and filament may differ from one halogen lamp to another, it is undesirable to attain the parallelism by simply adjusting the tube of the halogen lamp. In order to facilitate such positioning of the filament, the reflector 166 is formed with holes and provided with means for adjusting the position of the filament. As shown in FIGS. 17 and 18, the reflector 166 is secured to a support 256 by fixtures 254. A lamp holder 262 is provided to one end of the support 256 through an insulator 258. Likewise, a lamp holder 264 is provided to the other end of the support 256 through an insulator 260. The halogen lamp 166 is retained by the lamp holder pair 262, 264. The insulator 258 has a short stub 266 about which the lamp holder 262 is angularly movable. More specifically, the lamp holder 262 moves angulary about the stub 266 when a thumb piece 268 is rotated because, as shown in FIG. 19, a part of the thumb piece 268 engaged with the lamp holder 262 constitutes an eccentric cam. Stated another way, one end of the halogen lamp 168 is movable in the vertical direction. A screw 270 for adjustment is threaded into the lamp holder 262 such that, when driven, it moves one end of the lamp 168 in the horizontal direction. The insulator 258 partly extends throughout the support 256 and, in this part, it is formed with a peep hole 272. The reflector 166 is formed with a peep hole 274 concentric with the peep hole 272 of the insulator 258. The support 256 is formed with a peep hole 276 as seen in FIG. 18 while the reflector 166 is formed with a peep hole 278 concentric with the peep hole 276. These peep holes are adapted to properly position the halogen lamp 168, more particularly its filament 280, and constitute coactive aims and foresights a target of which is the filament 280. When an operator cannot find the filament 280 looking through the peep hole 276, he or she will move the lamp 168 in the horizontal direction by manipulating the adjusting screw 270; when the filament 272 is absent within the visual range through the peep hole 272, the thumb piece 268 will be manipulated to move the lamp 168 up or down. A position of the lamp where its filament 280 is visible in the two directions indicates the proper filament position.

Likewise, the other lamp holder 264 is swingable about a short stub 282 of the insulator 260. Turning a thumb piece 284 causes the corresponding end of the lamp 168 to move up or down whereas driving an adjusting screw 286 causes it to move in the horizontal direction. The insulator 260 is formed with a peep hole 288 and the reflector 166 with a peep hole 290 concentric with the peep hole 288; these peep holes 288 and 290 will be used to position the filament 280 in the vertical direction. The support 256 and reflector 166 are formed at their other end with concentric peep holes 290 and 292 similar to the peep holes 276 and 278 (see FIG. 18) in order to facilitate positioning of the filament 280 at the other end. The lamp holders 262 and 264 are commonly formed of an electroconductive resilient material. The lamp holder 264 comprises two independent members which are pivoted to each other for replacement of the lamp. In the event of lamp replacement, one of the two members will be swinged to a position indicated by a dot-and-dash line in FIG. 17.

The filament 280 of the halogen lamp 168 will be in a position parallel to the slit both horizontally and vertically when aligned visually through the individual peep holes at the opposite ends thereof. With this position of the filament 280, the halogen lamp 168 will illuminate a document uniformly.

Figure 20:
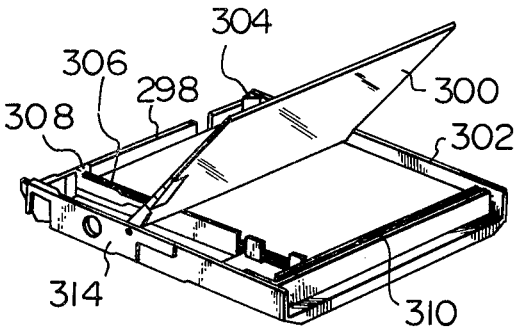
FIG. 20 is a perspective view of a sheet cassette.

As shown in FIG. 2, the sheet feed section 54 can accommodate two different sheet cassettes 294 and 296 at the same time. Sheets can be fed selectively from the two sheet cassettes 294 and 296. Though the sheet cassettes 294 and 296 are common to each other concerning the overall size or the widthwise dimension only, partition plates within the sheet cassettes can be located to store various formats of sheets from A3 to B5 for example. As seen in FIG. 20, each of the sheet cassettes 294 and 296 comprises a body 298 and a cover 300 pivoted to the body 298. One side wall 302 of the body 298 defines a reference side edge position for sheets and has a corner pawl 304 pivoted thereto. A side fence 306 regulates the other side edge of sheets and can have its position varied in the widthwise direction of the sheet cassette. A corner pawl 308 is pivoted to the side fence 306. An end fence 310 regulates the rear edge of sheets. Sheets are directly layed on a bottom plate 312 (see FIG. 21) which is swingable relative to the body 306. A release lever 316 (see FIG. 22) is pivoted to the other side wall 302 of the body 306 to move the bottom plate 314 to a predetermined release position. A size detector knob 318 (see FIG. 23) is fixed to the outer surface of the side wall 314.

Figure 24:
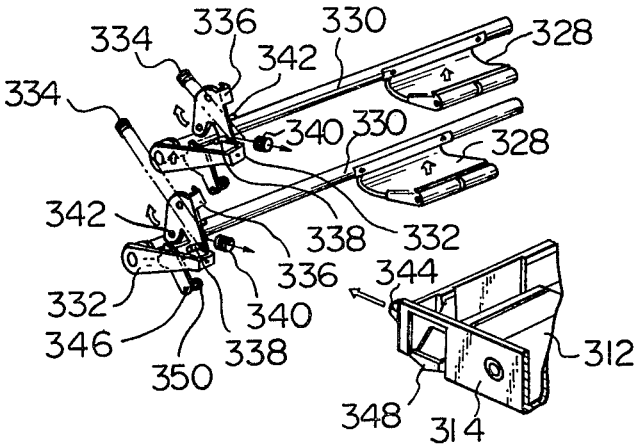
FIG. 24 is a perspective view of a mechanism for pressing a bottom plate of the sheet cassette.

The sheet feed section 54 and the sheet cassettes 294 and 296 are so designed that the latter can be mounted in the former without any manipulation of levers, that is, the sheet cassettes 294 and 296 can assume predetermined sheet feed positions if inserted simply into the machine through openings or mouths 320 and 322 (see FIG. 2). Sheet feed rollers 324 and 326 are arranged in the individual openings 320 and 322 as shown in FIG. 2 such that sheets stored in the sheet cassette 294 and 296 are automatically engaged by the rollers 324 and 326 when the sheet cassettes are placed in the machine. This type of sheet pressing mechanism is commonly employed by upper and lower arrangements of the sheet feed section 54 and, therefore, only one of the sheet pressing mechanisms will be described with components of the other denoted by the same reference numerals. As indicated in FIG. 24, a presser shoe 328 is rigidly mounted on a support shaft 330 and serves to press a sheet atop a stack in the sheet cassette 294 or 296 into contact with the sheet feed rollers 324 or 326 while abutting against the bottom plate 312 (see FIG. 21) from below. A lever 332 is rigid on one end of the shaft 330 and retains one end of a spring 334 so that the presser shoe 328 on the shaft 330 is biased in a direction to push up the bottom plate 312. The shaft 330 is rotatably journalled to a side plate (not shown) to which a retainer 336 is pivoted. The retainer 336 formed as a double arm angled lever has a pin 338 studded on its one arm, the pin 338 abutting against the free end of the lever 332. A spring 340 biases the retainer 336 such that the latter tends to move angularly pushing the lever 332 against the tendency of the lever 332. When the upper or lower subsection of the sheet feed section 54 is empty, the retainer 336 holds the lever 332 and, therefore, the presser shoe 328 in a position which does not interfere with insertion of a sheet cassette. Studded on the other arm of the lever 336 is a relatively long pin 342 adapted to be engaged by a lug 344 on the front end of a sheet cassette when the sheet cassette is placed in the machine. Also secured to the shaft 330 is a pressure release arm 346 on which a pin 350 is studded. One end of the release lever 348 on the body 298 of a sheet cassette is exposed to the outside through the side wall 314 so as to be engagable with the pin 350 on the pressure release arm 346.

In FIG. 24, when a sheet cassette is inserted in an opening of the machine body, its lug 344 engages the pin 342 on the retainer 336 to push the retainer 336 against the action of the spring 340 until the lever 332 is released. Then the lever 332 swings under the action of the spring 334 whereby the bottom plate 312 of the sheet cassette is pushed upward by the presser shoe 328 causing a sheet atop the stack thereon into abutment against the sheet feed rollers 324 or 326. Simultaneously the presser release arm 346 is caused to swing into engagement with one end 348 of the release lever 316 as viewed in FIG. 22 to thereby swing it. When the print button 68 is depressed thereafter, a main drive mechanism drives the sheet feed rollers 324 or 326 via a sheet feed clutch (not shown) to feed sheets in the sheet cassette one by one from the stack to the registration roller pair 58.

Where it is desired to manually feed sheets into the machine while a copying operation is under way, the pressing action on the bottom plate 312 must be released. When in FIG. 22 the cover 300 is moved as indicated by an arrow, a lever 352 integral therewith engages an upper edge of the release lever 316 through a lever 354 pivoted to the side wall 314 and thereby urges the release lever 316 counterclockwise. This angular movement of the release lever 316 pushes the pressure release arm 346 clockwise about the shaft 330 until the presser shoe 328 becomes unable to exert any pressure on the bottom plate 312. Then a sheet on top of the sheet stack becomes spaced from the sheet feed rollers 324 or 326 to permit desired sheets to be inserted manually onto the top sheet from below the opened cover 300. Closing the cover 300 to its original position frees the pressure release arm 346 from restraint and, thus, the presser shoe 328 again presses the bottom plate 312 until a manually inserted sheet on top of the stack abuts against the sheet feed rollers 324 or 326.

When the sheet cassette 294 or 296 has its body 298 pulled out a bit from the machine, the lug 344 is disengaged from the pin 342 on the retainer 336 so that the retainer 336 swings under the action of the spring 340. Upon another bit of outward pull of the body 298, the bottom of the sheet cassette moves the presser shoe 328 to a non-pressing position while the other pin 338 on the retainer 336 is brought into engagement with the lever 332 to maintain the non-pressing condition.

Figure 23:
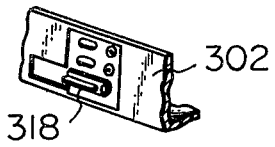
FIG. 23 is a fragmentary perspective view of a knob which joins in the detection of a sheet size.
Figure 25:
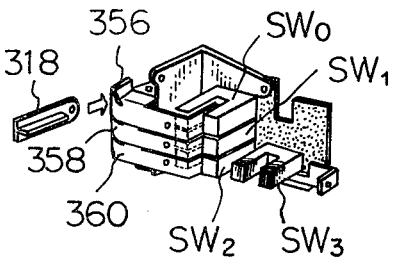
FIG. 25 is a perspective view of a sheet size detecting mechanism which is coactive with the knob of FIG. 23.

The sheet feed section 54 is provided with a mechanism for detecting a size or format of transfer sheets. This mechanism includes a plurality of adjacent near-by switches fixed on the machine body, switches $SW_0$, $SW_1$ and $SW_2$ in this example as shown in FIG. 25. Actuators 356, 358 and 360 are associated with the switches $SW_0$, $SW_1$ and $SW_2$, respectively, to be capable of angular movements. These actuators 356, 358 and 360 are located at positions which will neighbor the outer surface of the side wall 302 of the cassette body 298. As shown in FIG. 23, the outer surface of the side wall 302 carries a knob 318 securely therewith. Up to three knobs 318 can be fitted to the side wall 302 though only one is shown fixed to the lowermost position in FIG. 23. A plurality of knobs can be combined together in various ways in accordance with formats of sheets. For example, only one knob fixed to the lowermost position as in FIG. 23 may indicate that the sheet cassette is loaded with sheets of format A3. When a sheet cassette with the single knob 318 is inserted into the opening 320 of the machine body, the switch $SW_2$ will be actuated by the knob 318 to indicate the format A3 on the sheet size display 82 on the control panel 16 (see FIG. 3). If under this condition a sheet cassette loaded with a stack of A4 sheets is mounted in the other opening 322 (see FIG. 2), a knob arrangement predetermined for said sheet format will selectively actuate the switches $SW_0$–$SW_2$ to provide a visual indication of the A4 format on the same sheet size display 82. The sheet size display 82 therefore indicates that sheet cassettes loaded with A3 sheets and A4 sheets individually are mounted in the machine body. If an operator desires the A3 sheets, he or she will depress the "UPPER" selection button 84. This causes a lamp 362 displaying the selected sheet cassette side to glow and, upon depression of the print button 68, sheets are fed one by one from the sheet cassette loaded with the A3 sheets.

Figure 26:
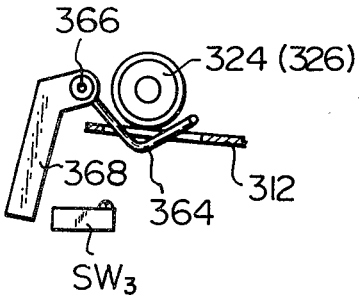
FIG. 26 is a front view of a paper end detecting mechanism adapted to check whether a sheet cassette is loaded with sheets.
Figure 27:
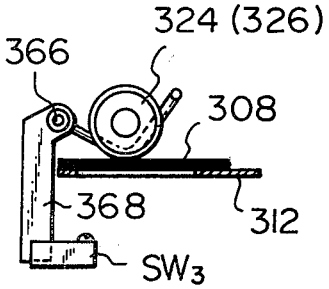
FIG. 27 is a view similar to FIG. 26 but showing another position of the paper end detecting mechanism.

FIGS. 26 and 27 illustrate a paper end detection mechanism which is located adjacent to each set of sheet feed rollers 324 and 326 and adapted to check whether a corresponding sheet cassette is full or empty. A paper end feeler 364 is pivoted to a stationary member such that, when a sheet cassette is absent or a sheet cassetted mounted runs out of sheets, the feeler 364 swings about a pivot shaft 366 to a position shown in FIG. 26 where its lower end is located below the sheet feed rollers 324 or 326. An actuator 368 is integral with the feeler 364 to turn on and off a paper end detection switch $SW_3$ which is a near-by switch. As seen in FIG. 25, this switch $SW_3$ neighbors the aforesaid switches $SW_0$–$SW_2$.

When a sheet cassette storing a desired format of sheets is mounted in the sheet feed section 54, a sheet atop the stack abuts against the sheet feed rollers 324 or 326 while urging the feeler 364 about the pivot shaft 366 to a position shown in FIG. 27. Then the actuator 368 operates the switch $SW_3$ to produce a paper present signal. Under the paper end condition shown in FIG. 26, the switch $SW_3$ produces a paper end signal which causes the sheet size display section 82 on the control panel 16 (see FIG. 3) to display that sheets have run out. At this instant, the format display and selection display will disappear.

Figure 21:
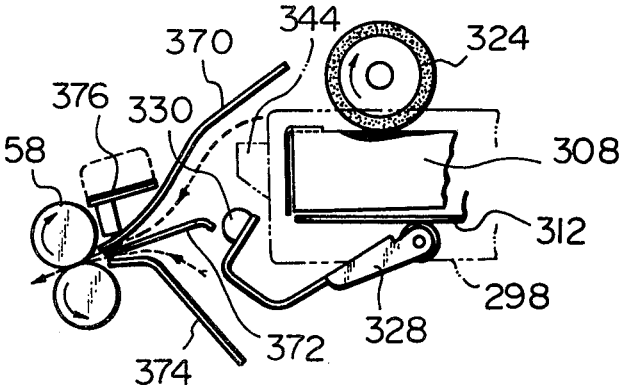
FIG. 21 is a schematic front elevation of a sheet feed section.
Figure 22:
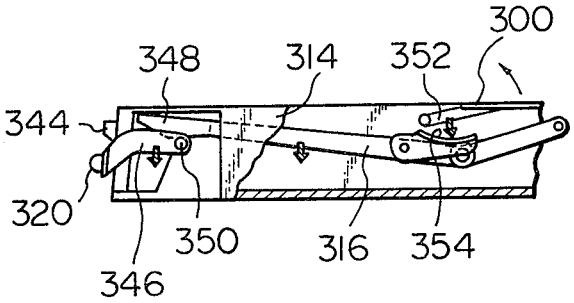
FIG. 22 is a front elevation of a pressure release mechanism.

The sheet feed section 54 further includes an upper guide plate 370, an intermediate guide plate 372 and a lower guide plate 374 as shown in FIG. 21. These guide plates 370–374 are adapted to guide sheets selectively fed by the upper and lower sheet feed rollers 324 and 326 over to the registration roller pair 58.

When the print button 68 is depressed, the sheet feed rollers 324 or 326 associated with a selected sheet cassette are driven to advance a sheet to the registration roller pair 58 and stop it temporarily thereat. The main drive mechanism drives the registration roller pair 58 through a registration clutch (not shown) at a timing which will allow the leading end of the sheet to register with a toner image on the drum 26 at a transfer station, thereby feeding the sheet further to the transfer station. It is preferable to maintain the stand-by position of a sheet at the registration roller pair 58, that is, the amount of sheet feed by the rollers 324 or 326 at predetermined one with a view to promoting stable registry of a toner image and a sheet. To meet this, a photosensor 376 is positioned adjacent to the registration roller pair 58. The photosensor 376 serves to detect an entry position of each sheet and control the rotation of the rollers 324 or 326 in accordance the detected entry position to suppress irregularity in the amount of sheet feed, thereby setting up a constant stand-by position of sheets at the registration roller pair 58 which suppresses irregular registration. Another function of the photosensor 376 consists in sensing jams of sheets in its neighborhood. As the photosensor 376 detects a paper jam, the failure display 72 on the control panel 16 provides an indication representing a paper jam.

Figure 28:
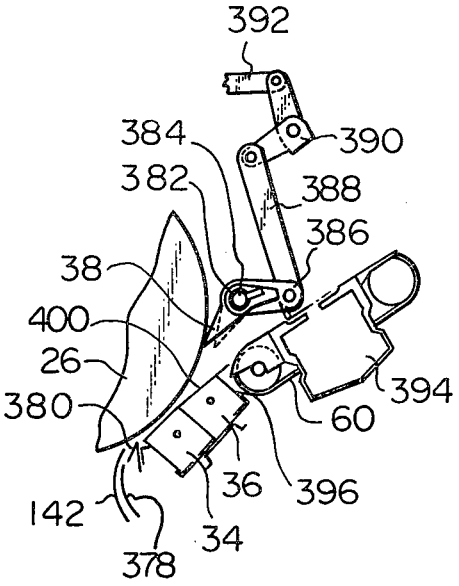
FIG. 28 is a front view of a transfer, separation and conveyance section.
Figure 29:
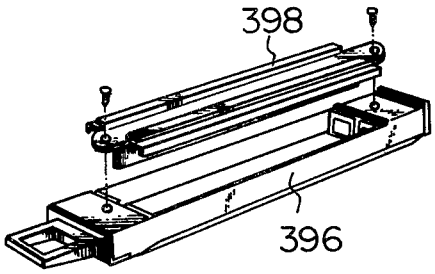
FIG. 29 is an inverted perspective view of a transfer and separation charger assembly.

FIG. 28 illustrates a section of the machine for image transfer, sheet separation and sheet conveyance. A sheet fed out from the registration roller pair 58 is routed by the turn guide 142 and a turn guide 378 fixed together with the turn guide 142 until it is brought into intimate contact with the surface of the drum 26. The transfer charger 34 deposits on the back of the sheet an electrostatic charge opposite in polarity to that on the toner to thereby attract the toner on the drum onto the sheet. The separation charger 36 applies an AC corona charge to the sheet to expel the charge on the sheet, removing the sheet clear of the drum surface. A farther guide plate 380 is disposed to an inlet side of the transfer charger 31 to extend along the length of the drum 26 at a constant parallel spacing of 1–2 mm. A sheet is guided by this guide plate 380 into even and intimate contact with the drum surface throughout its area. The guide plate 380 thus serves to prevent the rear end of a sheet from being left white. The separation pawl 38 assists the separation charger 36 in separating a sheet from the drum surface and, when out of operation, it remains spaced from the drum surface as indicated by a phantom line in the drawing. The pawl 38 is mounted on a shaft 384 through a holder 382 to be swingable through a predetermined angle. The shaft 384 is connected operatively with a plunger of a solenoid by way of a lever 386, a link 388, a lever 390 and a link 392. When the link 388 is moved, the shaft 384 rotates a predetermined angle in the clockwise direction through the linkage mentioned. This rotation of the shaft 384 causes the holder 382 to rotate by gravity to bring the pawl 38 into light contact with the surface of the drum 26. When the link 392 is returned, the shaft 384 is rotated counterclockwise to rotate the holder 382 in the same direction until the pawl 38 becomes spaced from the drum surface.

The endless conveyor belt 60 conveys a sheet separated from the drum over to the fixing unit 62 while sucking it by vacuum 394. The transfer charger 34 and separation charger 36 are mounted in a common casing 396 which is in turn detachably mounted on the machine body. A back cover 398 forming the bottom of the casing 396 is detachably fitted to the casing 396. With this construction, the chargers 34 and 36 can have their wires cleaned by removing the back cover 398 from the casing 396. A guide member 400 extends on that side of the casing 396 which faces the drum 26 to prevent ingress of a sheet into the chargers 34 and 36, which makes cleaning of their wires quite troublesome. Such a problem can also be settled by the provision of a detachable back cover 398.

A sheet carrying a toner image is moved from the transfer station to the subsequent fixing station where the toner image is fused on the sheet under heat and pressure.

Figure 30:
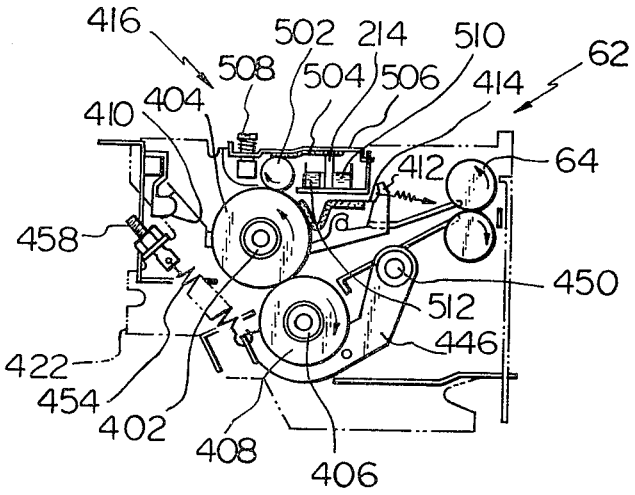
FIG. 30 is a sectional front elevation of a fixing unit.

As shown in FIG. 30, the fixing unit 62 includes a fixing roller 404 with a heater 402 built therein, a pressurizing roller 408 which has a heater 406 therein and moves into and out of contact with the fixing roller 404, and a thermistor 410 adapted to measure a temperature at the fixing roller 404. Also included in the fixing unit 62 are a pawl 412 for preventing a sheet from being wound on the fixing roller 404 or from being jammed in the fixing unit, a piece of cleaning felt 414 for removing toner and/or sheet particles adhered to the surface of the fixing roller 404, an offset prevention mechanism 416 for supplying an anti-offset liquid onto the surface of the fixing roller 404 and a mechanism 418 (see FIG. 31) for pressurizing and depressurizing the roller 408.

The fixing roller 404 comprises an aluminum roller whose peripheral surface is applied with an anti-offset layer. The heater 402 inside the roller 404 is controlled to a predetermined temperature by the thermistor 410 which senses the surface temperature of the roller 404. The pressurizing roller 408 comprises a roller made of a heat-resistive resilient material. The heater 406 inside the roller 408 remains deenergized while the halogen lamp 168 is being turned on, but it is energized during a return stroke of the optical system for exposure. During the other periods, the heater 406 is energized and deenergized in synchronizm with energization and deenergization of the heater 402, thus saving electric power consumed by the fixing unit. Concerning the separator pawl 412, a plurality of such pawls 412, six for example, are arranged at spaced locations along the length of the fixing roller 404. Of these pawls 412, four at a reference side for the passage of sheets are engaged with the fixing roller 404 but not the other two at the other side. Should sheets of a relatively small size be passed continuously through the fixing unit 62, a comparatively large amount of anti-offset liquid would be left on the surface of that side of the roller 404 opposite to the reference side. The two pawls 412 on the side opposite to the reference side serve to remove the residual part of the liquid for thereby avoiding deposition of the liquid on a relatively large size sheet which may be passed through the fixing unit after the continuous passage of relatively small sheets.

Figure 32:
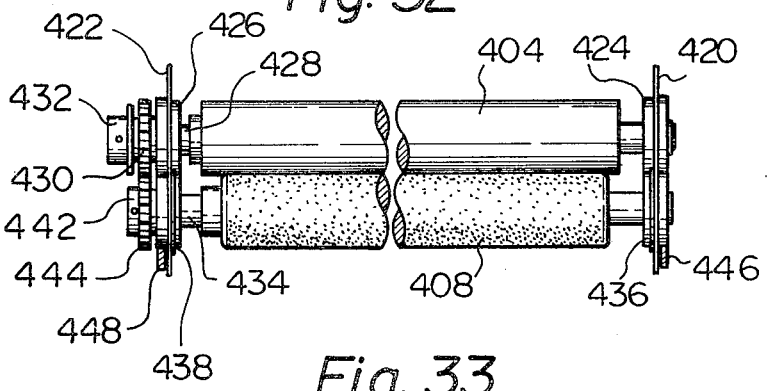
FIG. 32 is a fragmentary side elevation of the fixing unit.

As indicated in FIG. 32, the fixing roller 404 is rotatably journalled to opposite side panels 420 and 422 of the fixing unit by bearings 424 and 426 having a diameter which is larger than that of the roller 404. A hollow shaft 428 on which the roller 404 is mounted carries rigidly therewith a gear 430 operatively connected with a drive source (not shown) and a sprocket 432 connected to the discharge rollers 64.

Figure 31:
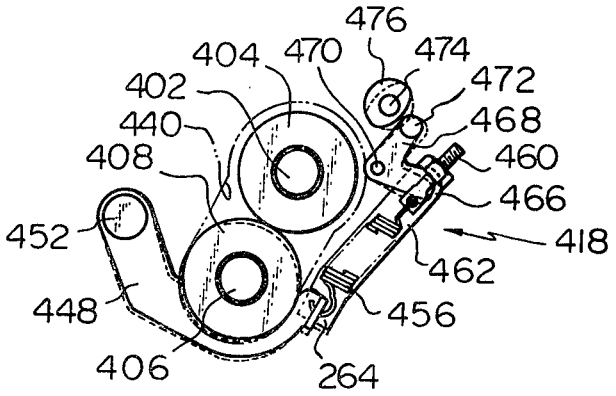
FIG. 31 is a rear view of a pressure release mechanism associated with the fixing unit.

The pressurizing roller 408 is mounted on a hollow shaft 434 which has its opposite ends supported by flanged bearings 436 and 438. As viewed in FIG. 31, the bearings 436 and 438 are movably engaged in elongate slots 440 formed in the individual side panels 420 and 422 of the unit and extending therefrom toward the axis of the fixing roller 404. One end of the hollow shaft 434 carries a gear 444 which selectively meshes with the gear 430 on the shaft 428 through a clutch 442. Presser levers 446 and 448 abut against the individual bearings 436 and 438 from below as shown in FIG. 32. As seen in FIGS. 30 and 31, the presser levers 446 and 448 are individually pivoted to shafts 450 and 452 on the side panels 420 and 422 while springs 454 and 456 are retained at their one end by the free ends of the shafts 450 and 452. The other end of each spring 454 and 456 is anchored to an adjusting screw 458 or 460 threaded into the corresponding side panel 420 or 422. The roller 408 therefore is held in pressing engagement with the roller 404 by the springs 454 and 456. It will be seen that the nipping width of the rollers 404 and 408 is adjustable to a desired optimum width by manipulating the adjusting screws 458 and 460.

A pressure release mechanism 418 is engaged with each of the pressurizing levers 446 and 448 to cancel the pressing contact between the rollers 404 and 408. The pressurizing lever 448 is shown in FIG. 31 engaged by one end 464 of an arm 462 of the pressure release mechanism 418. The other end 466 of the arm 462 is pivoted to one arm of a bell crank lever 468 which is pivotally supported by the side wall 420. A cam follower 472 is carried on the other arm of the bell crank lever 468. Though not shown, a similar arrangement of an arm, a bell crank lever and a cam follower is associated with the other pressurizing lever 446. Disposed to an upper rightward area of the fixing roller 404 is a shaft 474 which is rotatably journalled to the side panels 420 and 422 of the fixing unit (see FIG. 32). The shaft 474 carries a cam 476 coactive with the cam follower 472 included in the mechanism 418. As viewed in FIG. 33, a gear 480 is mounted on the shaft 474 through a spring clutch 478 and meshed with the gear 430 on the hollow shaft 428.

Figure 33:
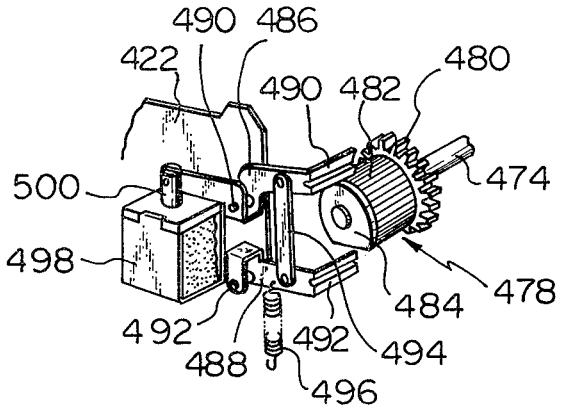
FIG. 33 is a perspective view of a half rotation clutch mechanism also associated with the fixing unit.

Forming a part of a half rotation clutch mechanism, the spring clutch 478 includes a ratchet wheel 482 which has a boss member 484 secured to an end thereof. The boss member 484 is partly cut away at its circumferential edge as shown in FIG. 33. An upper lever 486 and a lower lever 488 are pivoted to the side panel 422 by shafts 490 and 492, respectively. These levers 486 and 488 are connected together by a cross bar 494. The levers 486 and 488 have angled pawl portions 490 and 492 which are located above and below the ratchet wheel 482, respectively. A spring 496 is anchored at one end thereof to the lower lever 488 to pull the lower lever 488 downward whereby the upper lever 486 is provided with a tendency to pivot downward about the shaft 490 through the cross bar 494 until its pawl portion 490 becomes engaged with the ratchet wheel 482. Connected with the other end of the upper lever 486 is a plunger 500 which extends out from a solenoid 498.

The pressure release mechanism shown in FIG. 31 functions to avoid deformation of the pressurizing roller 408 and facilitate removal of jammed sheets out of the fixing unit. Another function of the mechanism consists in keeping the roller 408 spaced from the fixing roller 404 under stand-by conditions of the fixing unit so that heat transfer from the roller 404 to the roller 408 may be substantially prevented. When the solenoid 498 is deenergized, the upper lever 486 is pulled by the spring 496 through the lower lever 468 and cross bar 494 until its pawl 490 is engaged with the ratchet wheel 482 to hold the shaft 474 stationary. In this situation, the cam 215 on the shaft 474 assumes an angular position indicated by a phantom line in FIG. 31 in which the bell crank lever 468 is moved clockwise about the shaft 470 to a position also indicated by a phantom line. At this position of the bell crank lever 468, the pressurizing lever 448 remains in a position swinged about the shaft 452 through the arm 462 to maintain the roller 408 spaced from the roller 404. Upon energization of the solenoid 498, the upper lever 486 is operated by the plunger 500 to pivot to a position where its pawl 490 releases the ratchet wheel 482 accompanying a pivotal movement of the pawl 492 of the lower lever 488 into locking engagement with the ratchet wheel 482. Thus, the ratchet wheel 482 is rotated one half of a full rotation and then locked again. The shaft 474 is therefore stopped after one half of its full rotation; at this instant, the cam 476 stops in a position indicated by a solid line in FIG. 31. With the cam 476 held in the solid line position, the pressurizing lever 448 is urged by the spring 456 counterclockwise about the shaft 452 whereby the roller 408 is caused into pressing contact with the roller 408. A sheet discharge sensor is located adjacent to the sheet discharge rollers 64 as viewed in FIG. 30 in order to check a sheet jam thereat.

Figure 34:
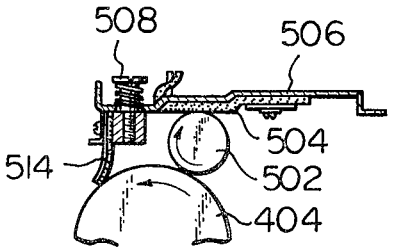
FIG. 34 is a front view of an oil applying mechanism also included in the fixing unit.

The anti-offset mechanism 416 is employed to preclude offsetting attributable to toner particles by supplying the surface of the fixing roller 404 with such an anti-offset liquid as silicone oil. Turning back to FIG. 30, an oil applying roller 502 is engaged with the periphery of the fixing roller 404 to be selectively driven thereby. An upper surface of the roller 502 is engaged by a piece of oil applying felt 504. The roller 502 and felt 504 are provided to an upper plate 506 of the mechanism 416. A screw 508 is threaded into the upper plate 506 to adjust the contact pressure of the roller 502 on the roller 404 and, therefore, the amount of oil applied to the roller 404. The felt 504 extends from the roller 502 to an area above a container 512 which stores silicone oil 510 therein. Another piece of felt 514 spans the felt 504 and oil container 512 to form an oil supply path from the container 512 to the felt 504. The silicone oil 510 is drawn by a solenoid operated pump (not shown) from a reservoir to the container 512 while a part of the oil 521 overflown the container 512 is recirculated back to the reservoir. When the amount of oil on the fixing roller 404 becomes short resulting in an increase in the friction between the rollers 404 and 502, the roller 502 is driven by the roller 404 due to the friction so as to apply the silicone oil onto the surface of the roller 404. After the supply of a given amount of oil, the roller 502 has its rotation interrupted by the friction with the felt 504 while slipping on the surface of the roller 404. In this way, the supply of anti-offset liquid onto the roller 404 can be controlled automatically without resort to any control mechanism. The mechanism 416 additionally includes a member 514 (see FIG. 34) disposed to the downstream side relative to the roller 502 with respect to the direction of rotation of the fixing roller 404. This member 514 is adapted to be engated with the surface of the roller 404 so that a layer of oil on the roller surface formed by the roller 502 is leveled out all over the roller surface.

The cleaning unit 40 (see FIG. 2) serves to remove toner particles which may remain on the drum 26 after the transfer of a toner image, getting the drum 26 prepared for the next copying cycle.

The subject matter of the present invention resides in the novel and unique cleaning unit 40. The construction and operation thereof will be described in detail hereinafter.

Figure 35:
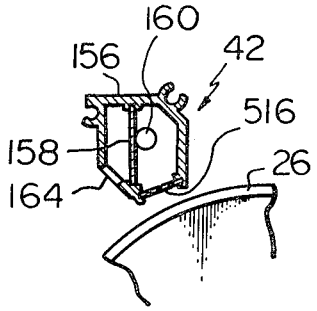
FIG. 35 is a sectional front view of a quenching lamp which removes a charge from the drum after cleaning.
Figure 36:
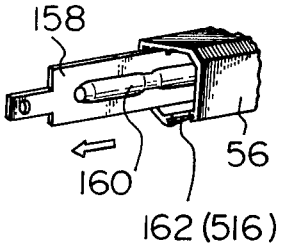
FIG. 36 is a fragmentary perspective view of a quenching lamp.

Though the drum 26 is free from residual toner particles after a cleaning step, a negative image may remain due to the action of the separation charger 36. To remove the residual potential on the drum 26, the drum 26 is illuminated after each cleaning step. The quenching lamp 42 shown in FIG. 35 has exactly the same construction as that of the quenching lamp 32 shown in FIG. 10 except for the optical transmissibility of its filter 516. For this reason, description of the lamp 42 will be omitted herein with the same reference numerals employed for the lamp 42. In any of the quenching lamps 32 and 42, the tungsten lamp 160 can be pulled out of the casing 56 together with the support plate 158 as depicted in FIG. 36.

Now, the electrophotographic copying machine described hereinabove and illustrated in the drawings is controlled by two different 1-chip central processing units or CPU. An electric arrangement of the machine will be discussed hereafter.

Figure 37:
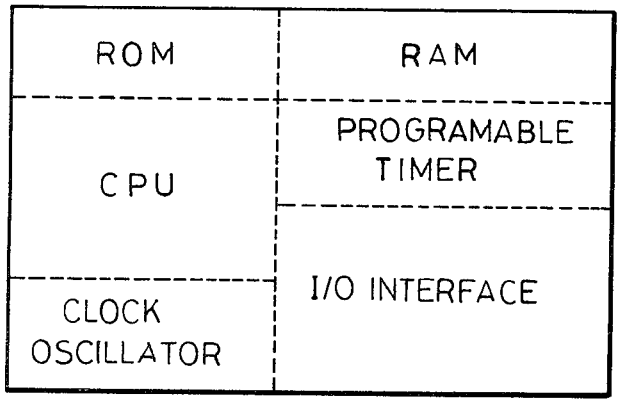
FIG. 37 shows a construction of a 1-chip central processing unit.
Figure 38:
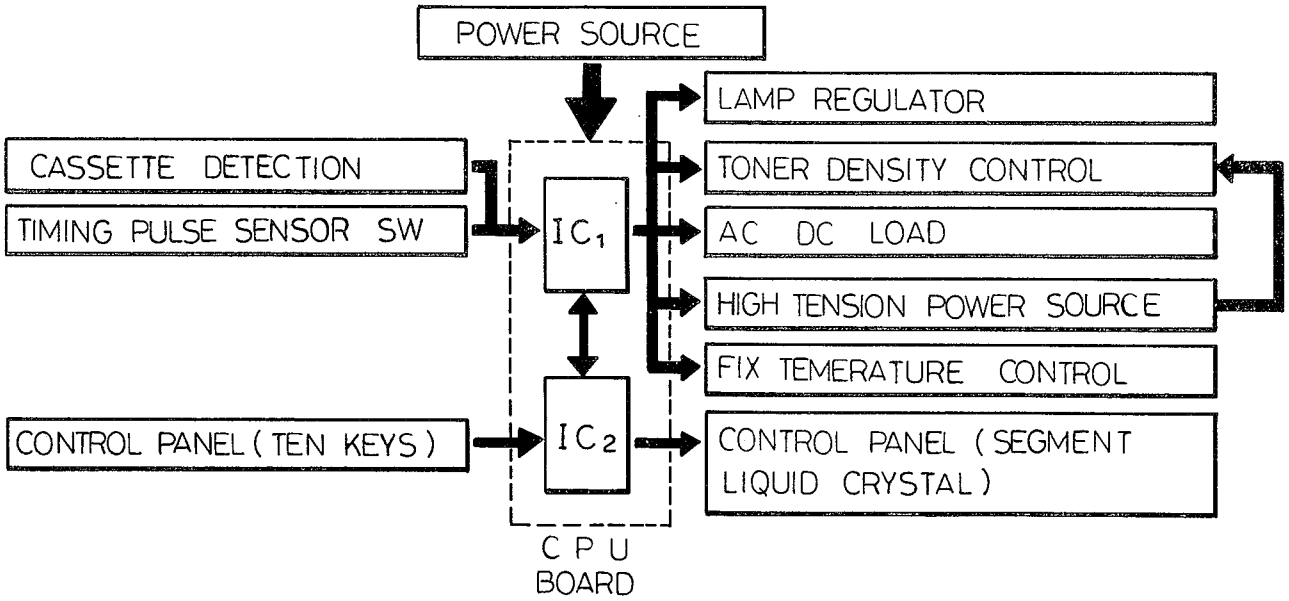
FIG. 38 indicates a relationship between mechanical actions and inputs and outputs at a control section and central processing units.

Referring to FIG. 37, there is shown a 1-chip CPU which is made up of a 4-bit CPU, a read-only memory or ROM, a random access memory or RAM, a programable timer and a clock pulse oscillator integrated into a single chip. One of the two 1-chip CPU's is used for controlling mechanical actions of the machine and the other for controlling inputs and outputs of the control section. Thus, the two CPU's control the mechanical actions and the inputs and outputs of the control section at the same time. Such a manner of control is illustrated in FIG. 38.

Figure 39A:
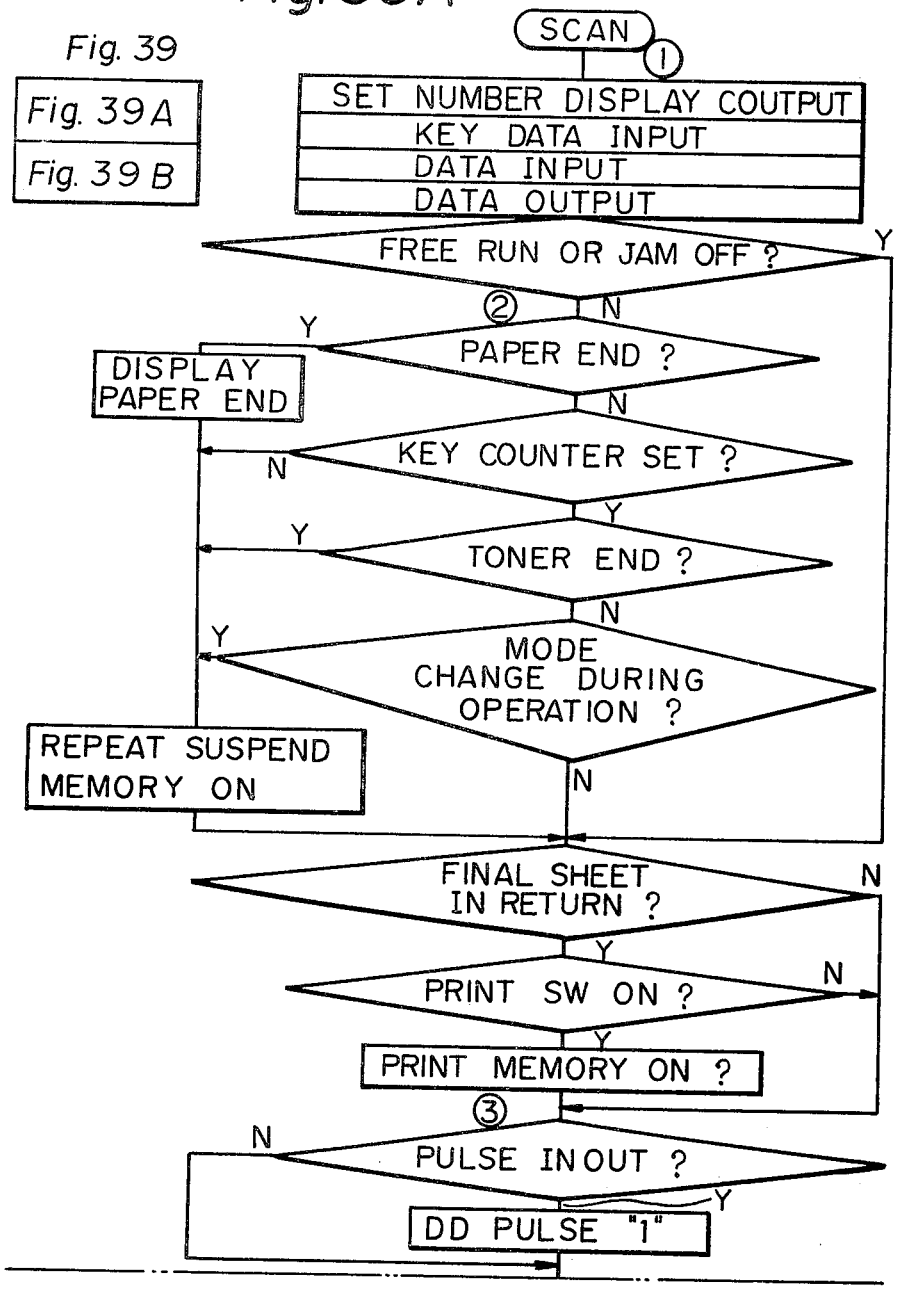
FIG. 39 is a flowchart showing subroutines.
Figure 39B:
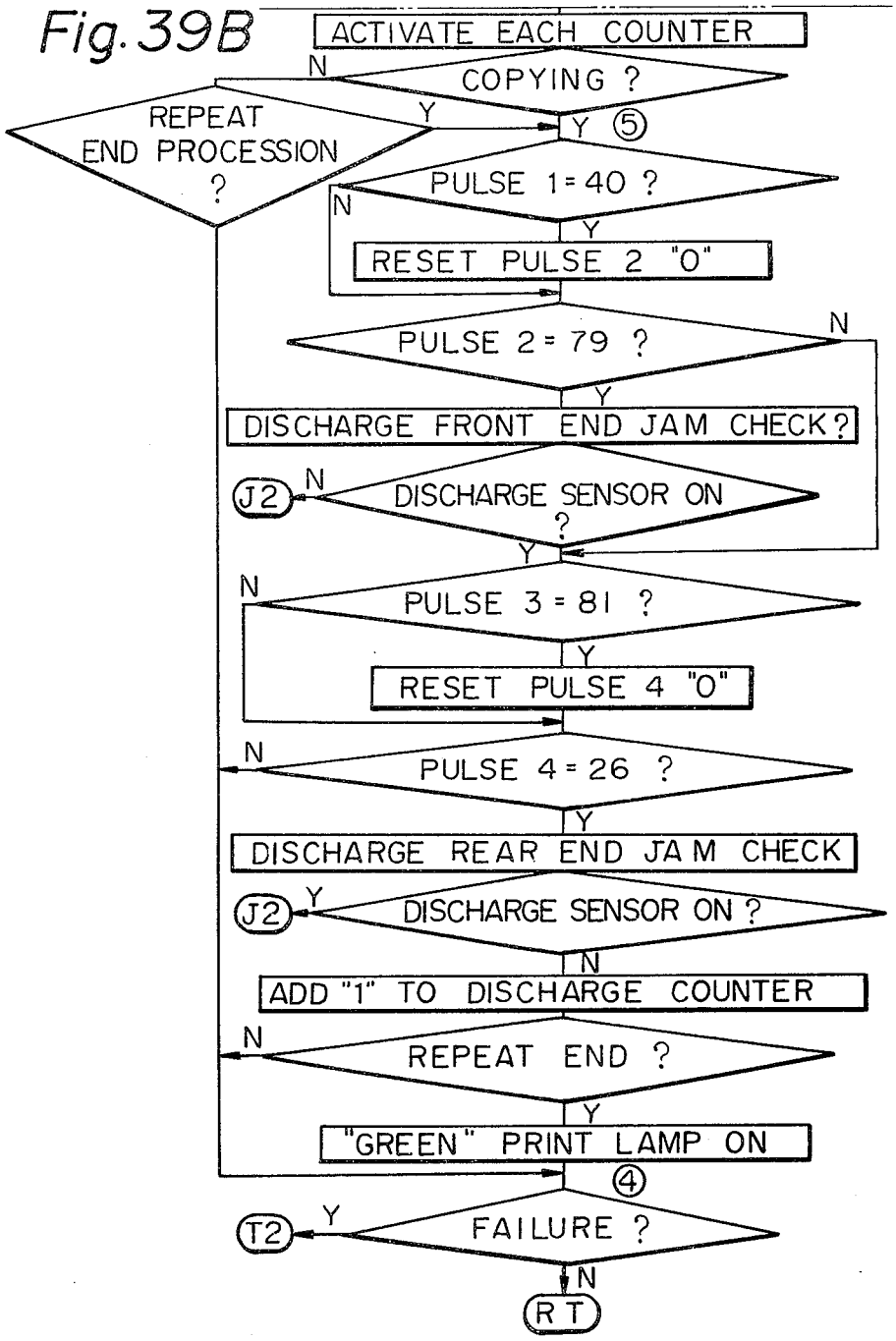
Figure 40:
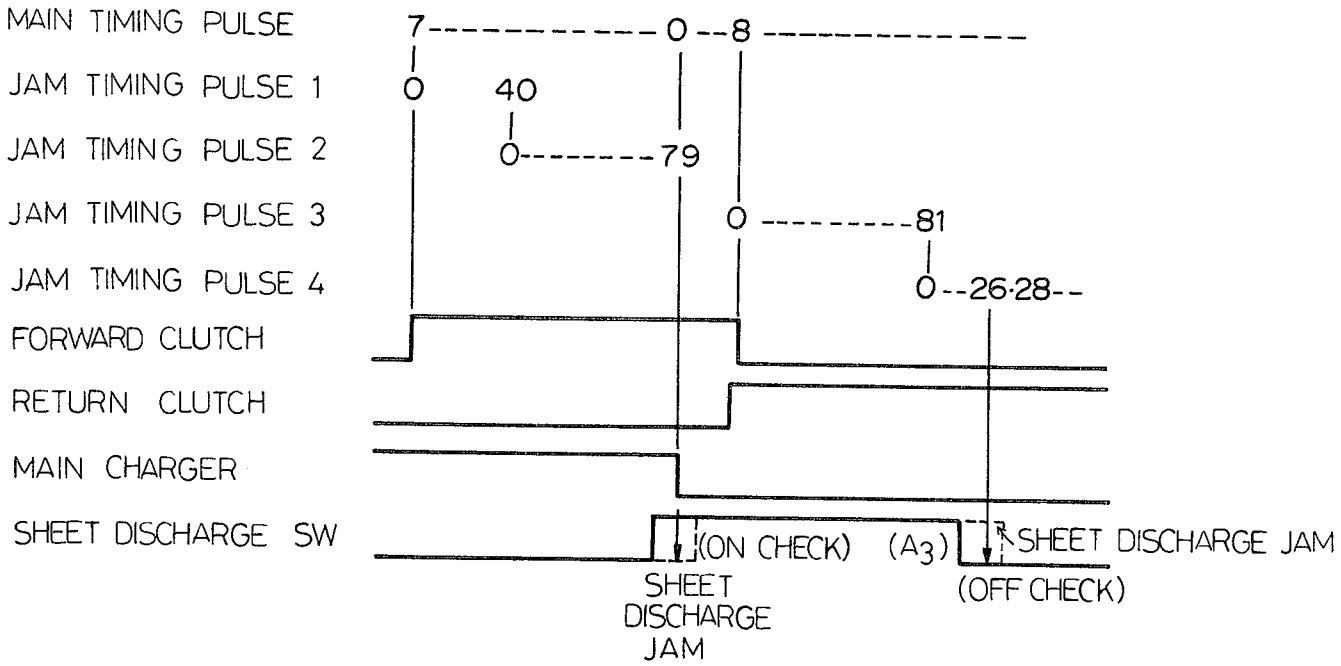
FIG. 40 is a timing chart showing a subroutine.
Figure 41A:
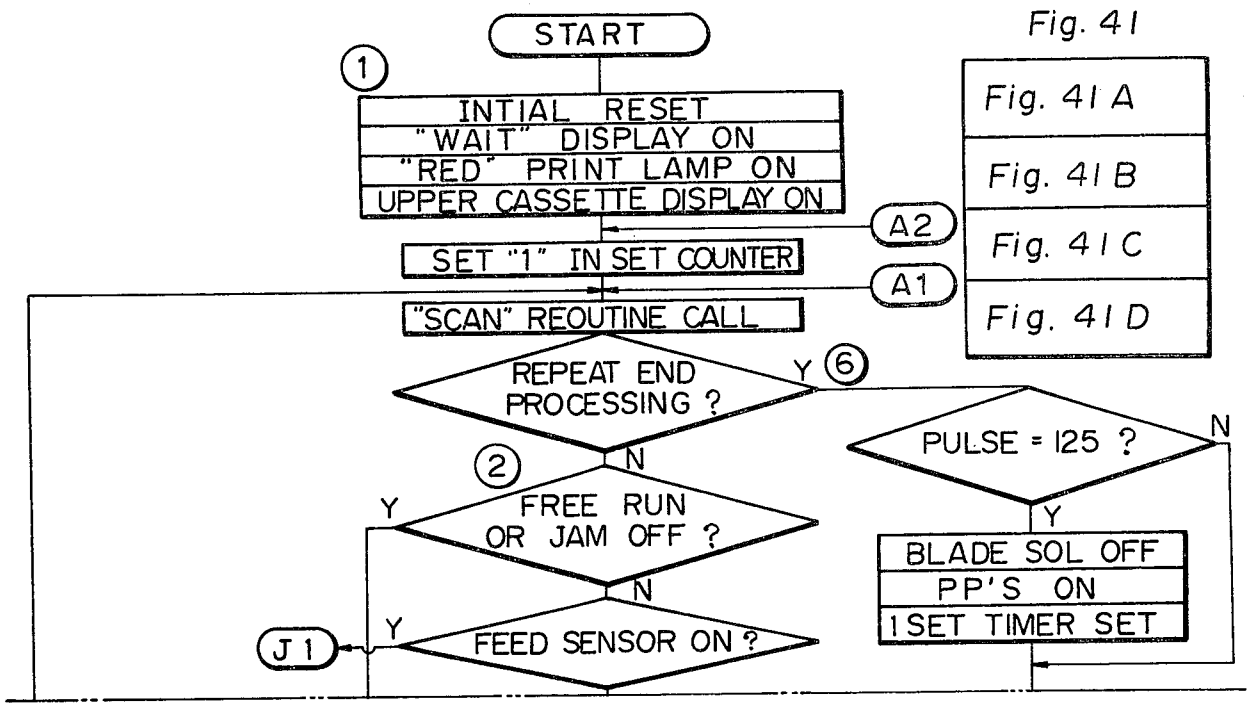
FIGS. 41–44 are flowcharts showing main routines.
Figure 41B:
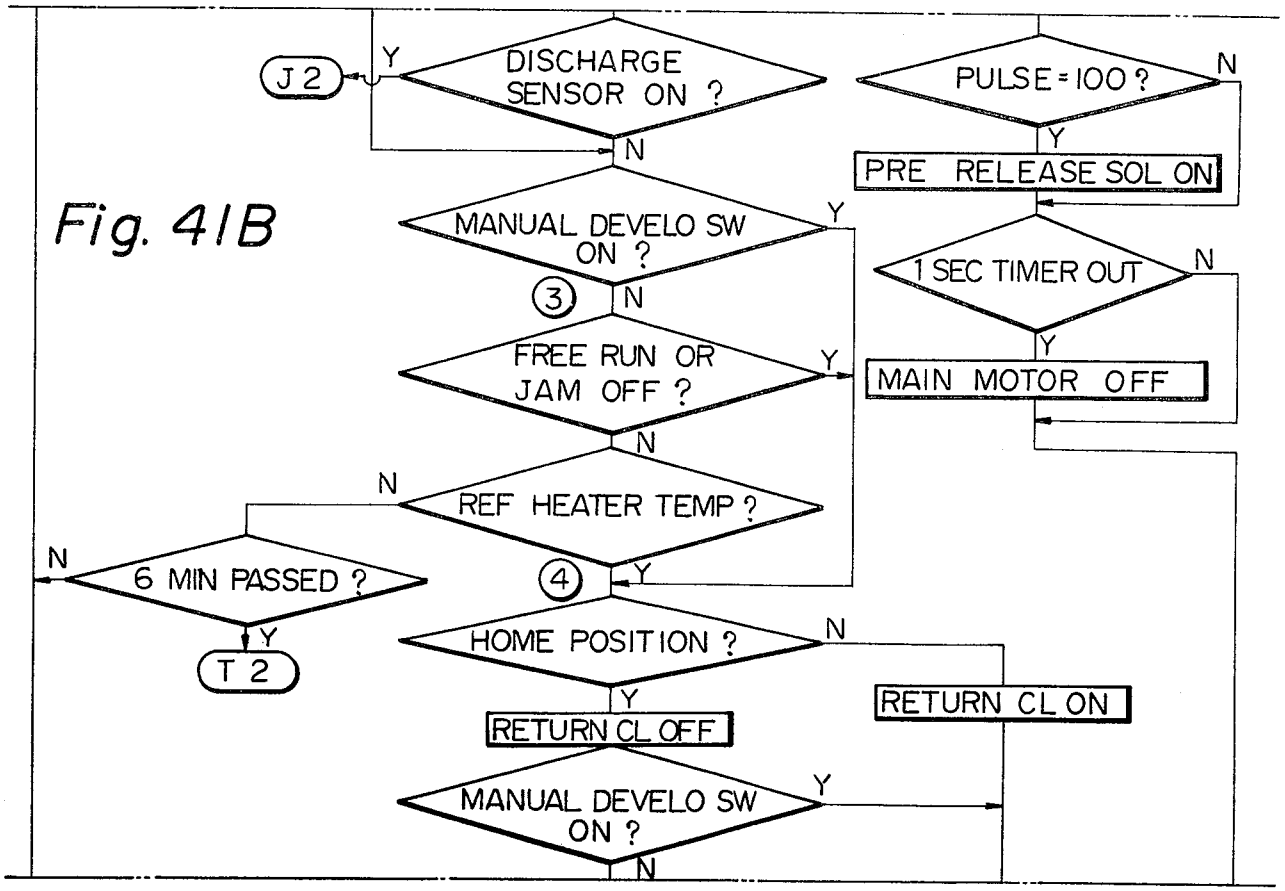
Figure 41C:
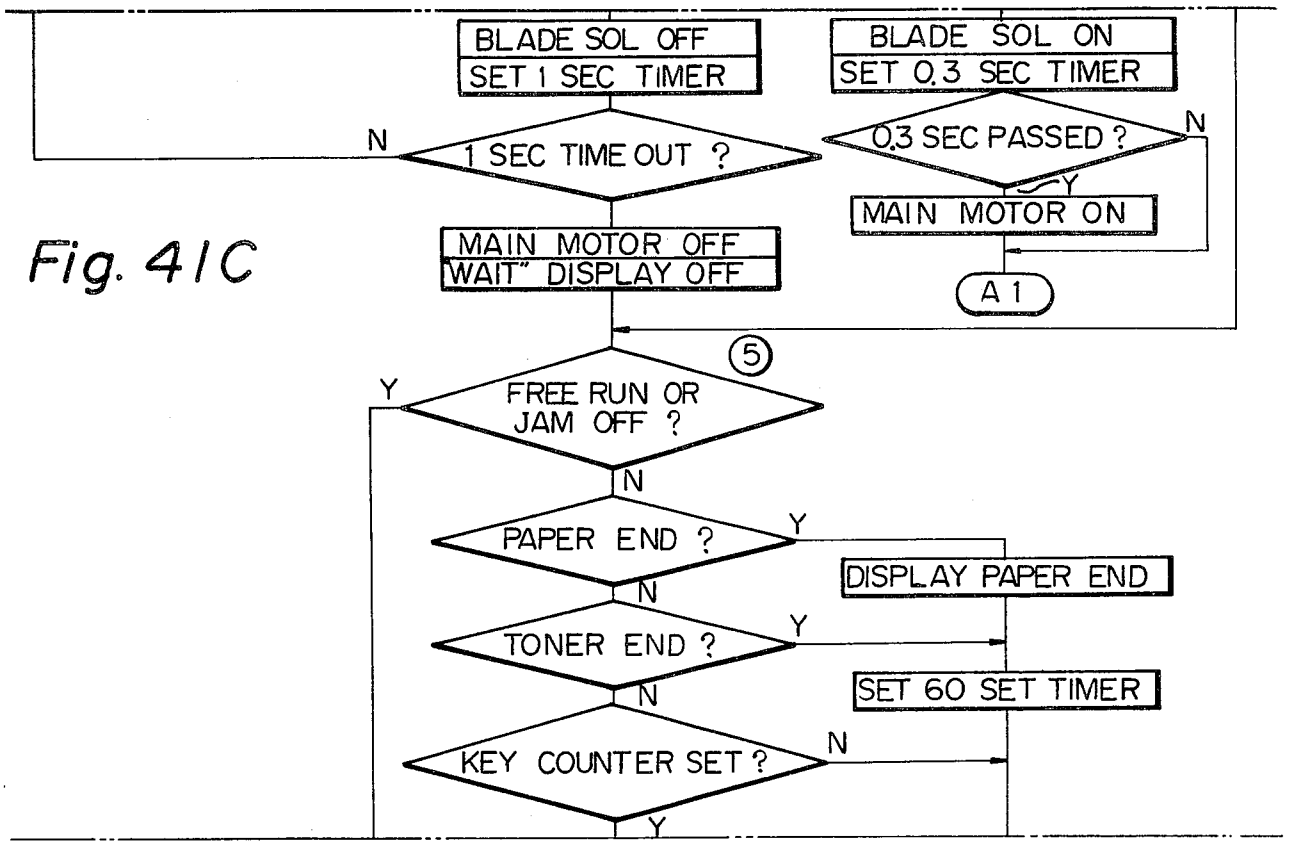
Figure 41D:
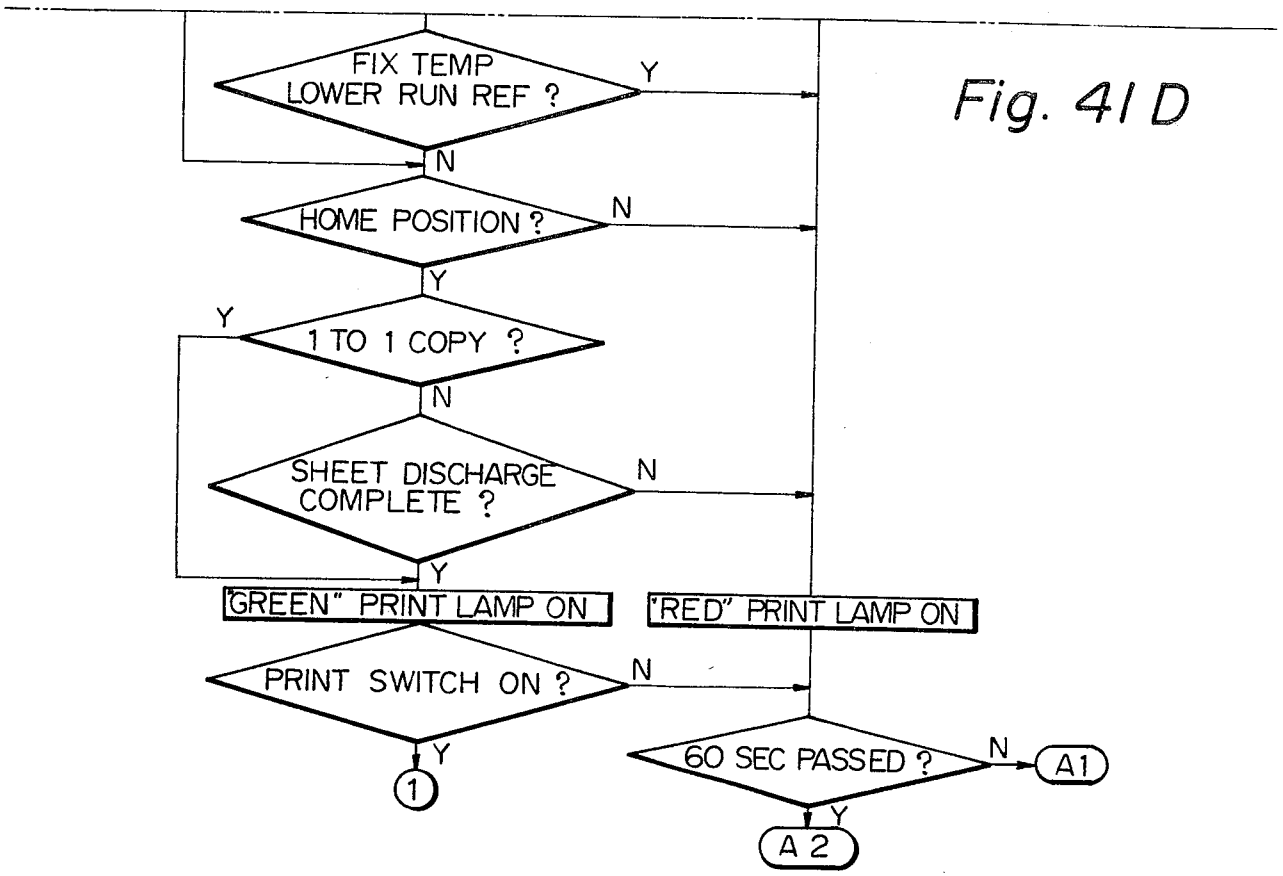
Figures 42, 42A:
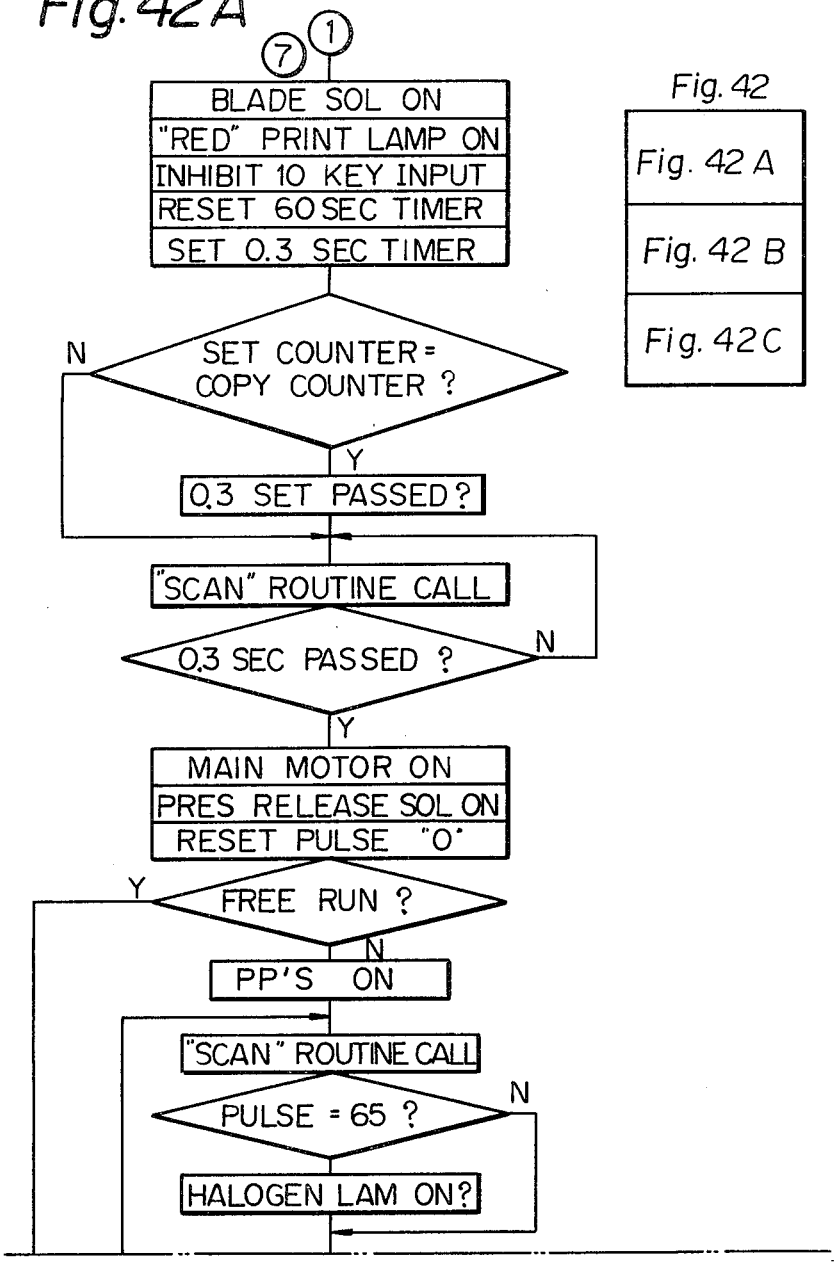
Figure 42B:
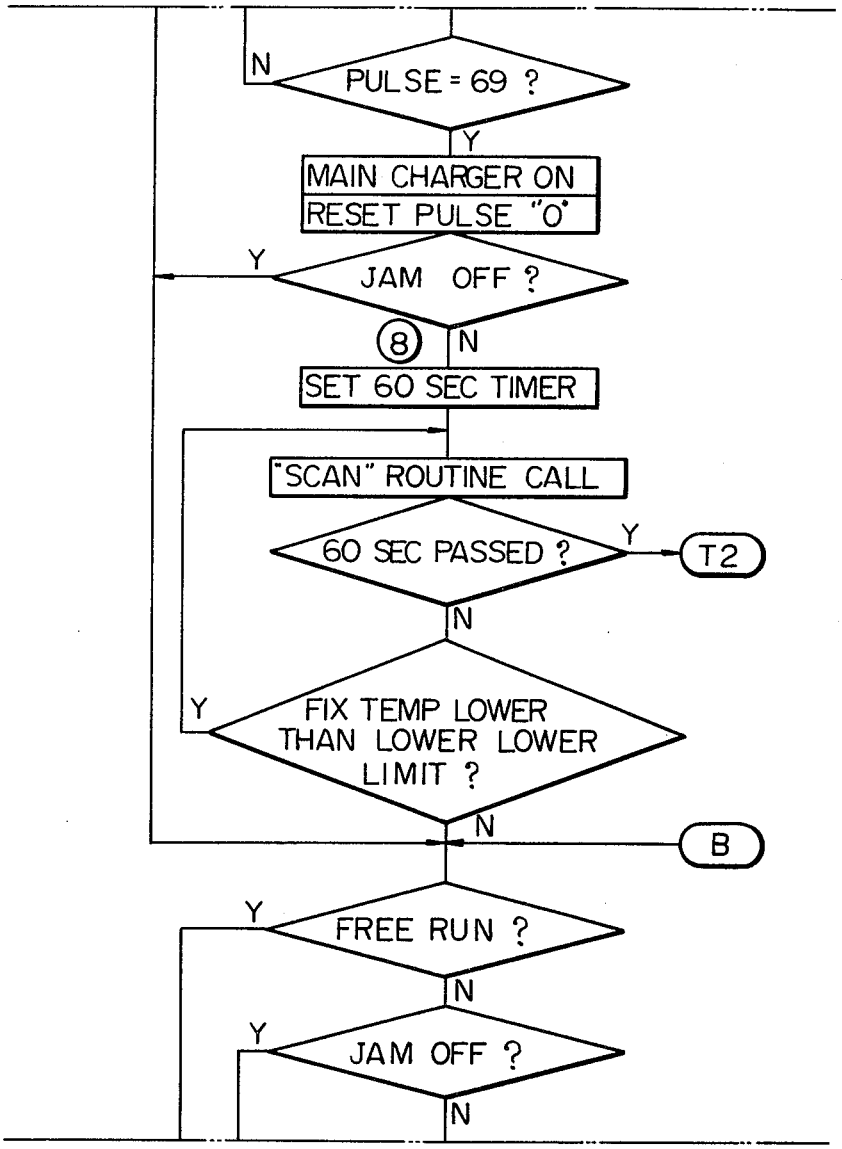
Figure 42C:
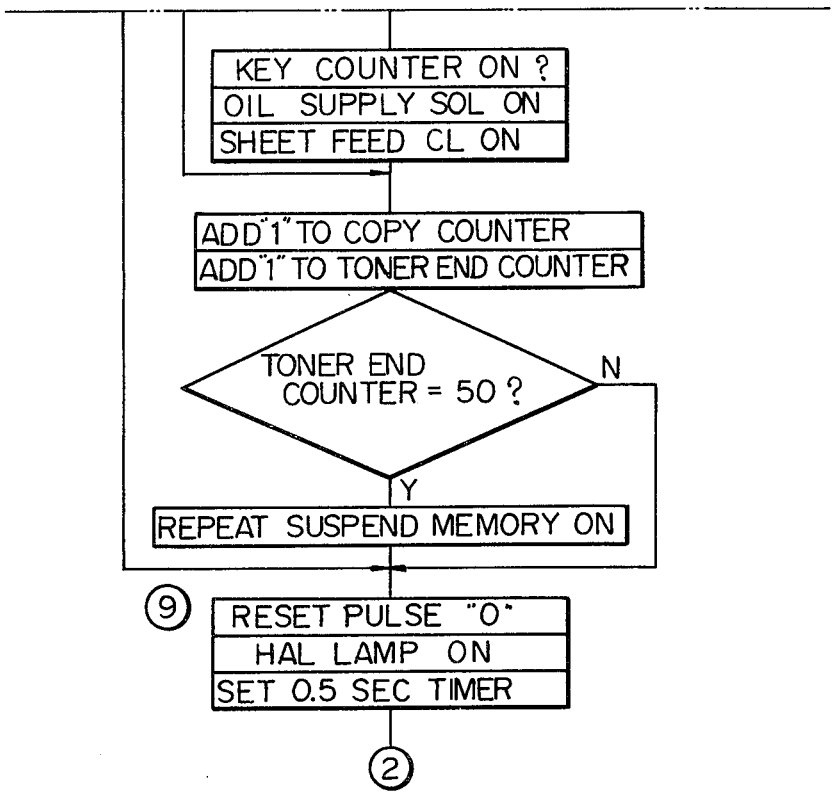
Figures 43, 43A:
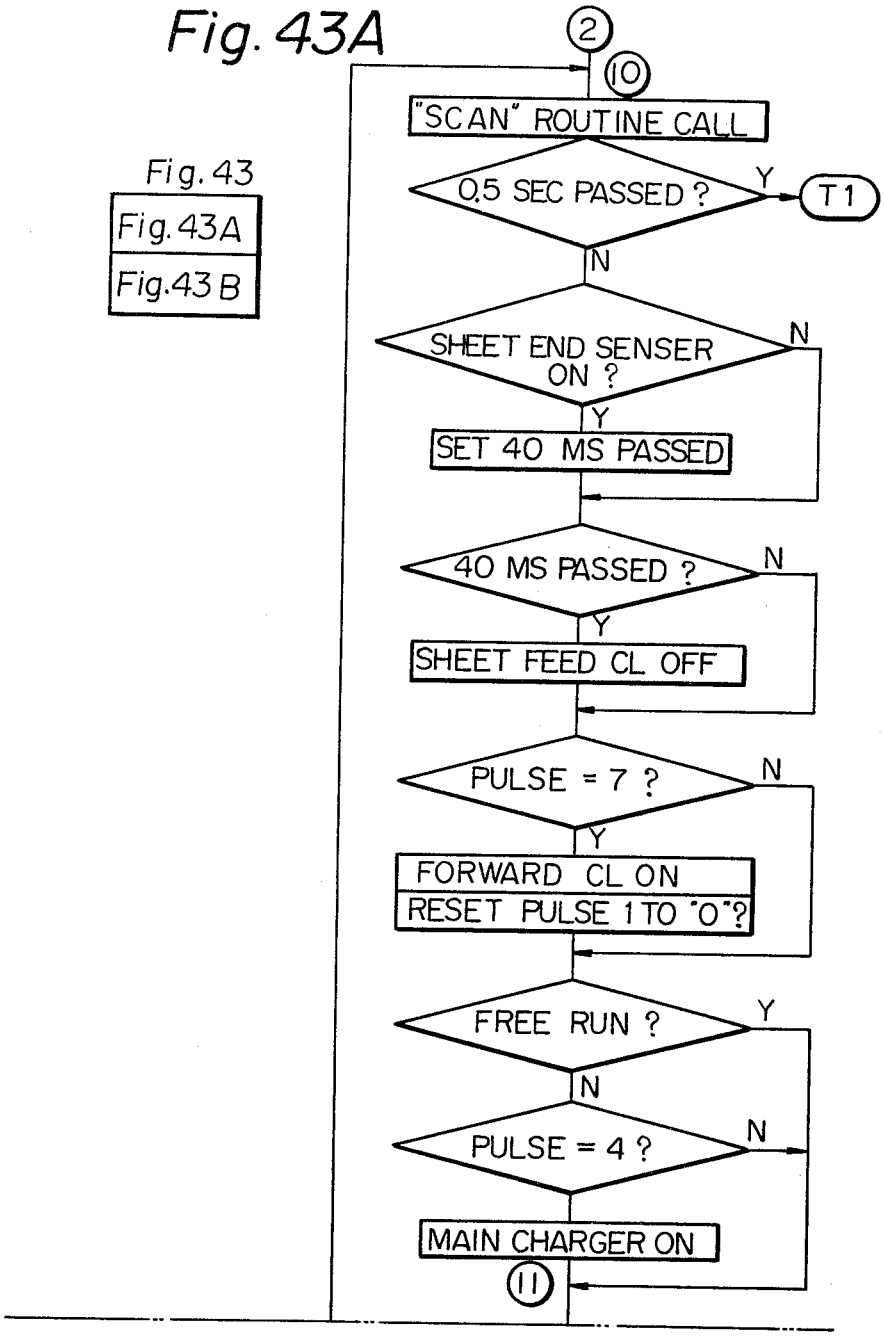
Figure 43B:
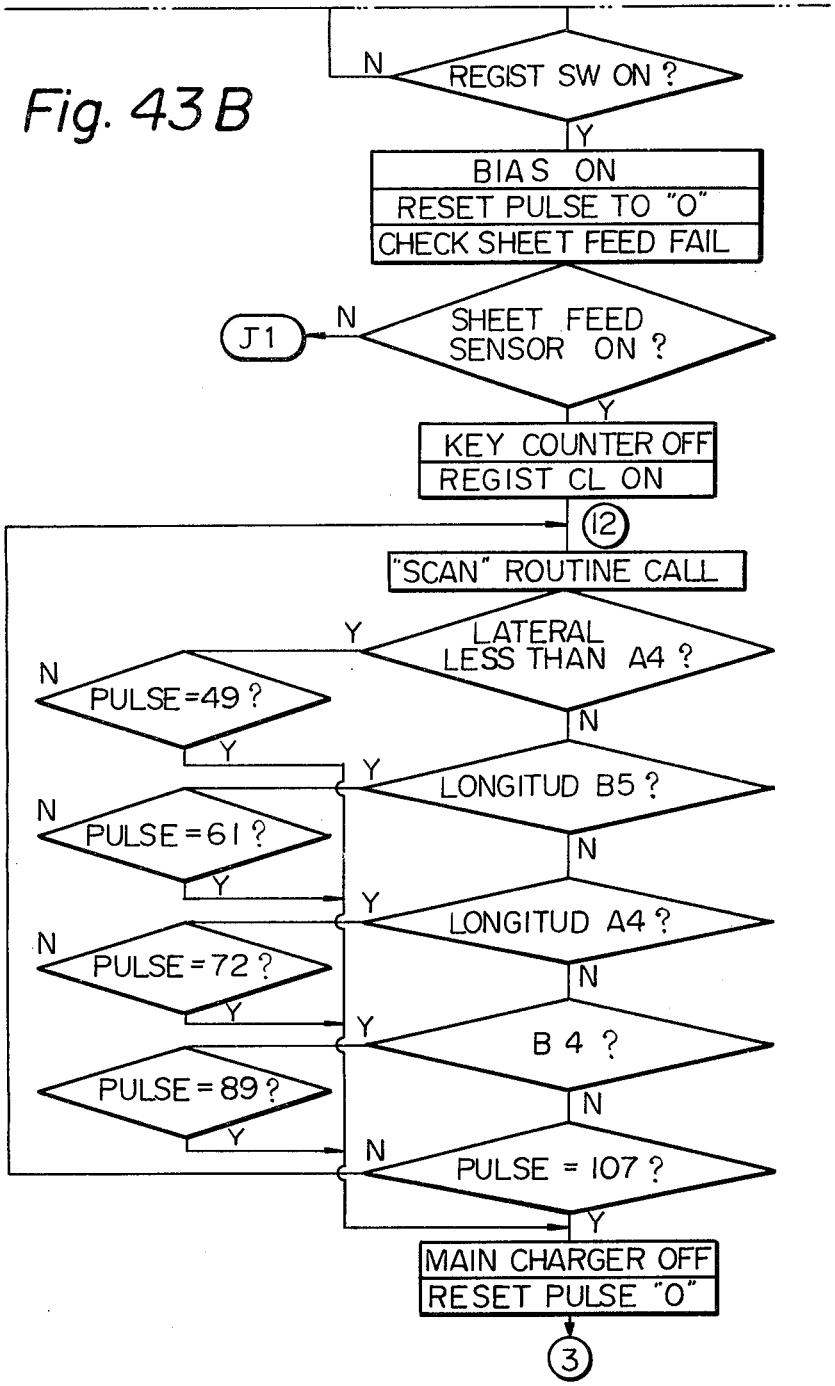
Figures 44, 44A, 44B:
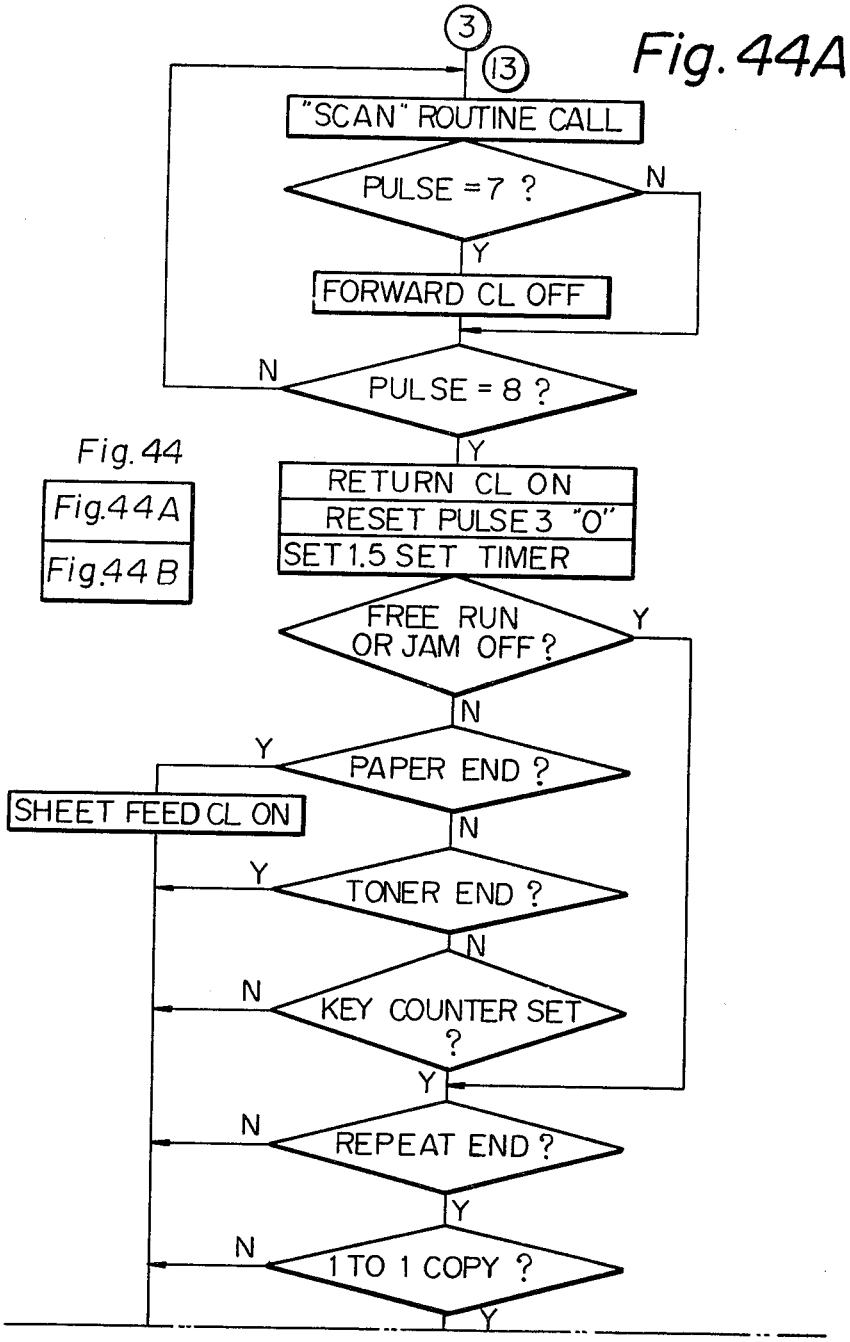
Figure 44B:
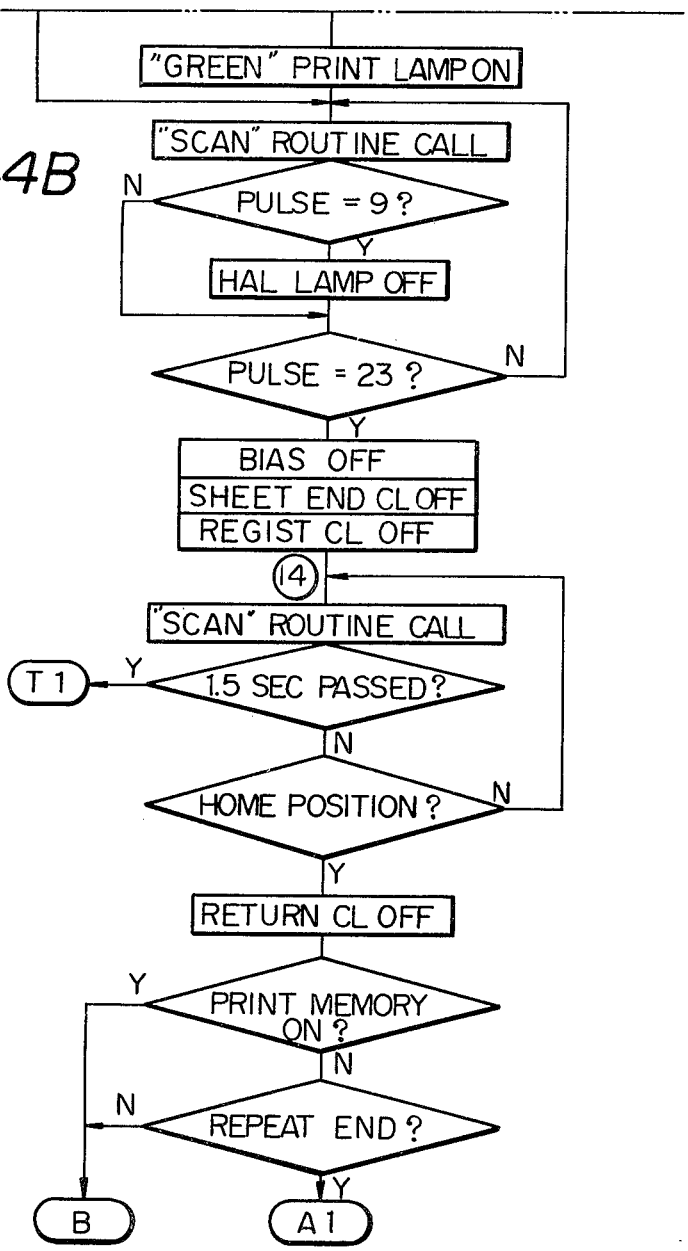
Figure 45:
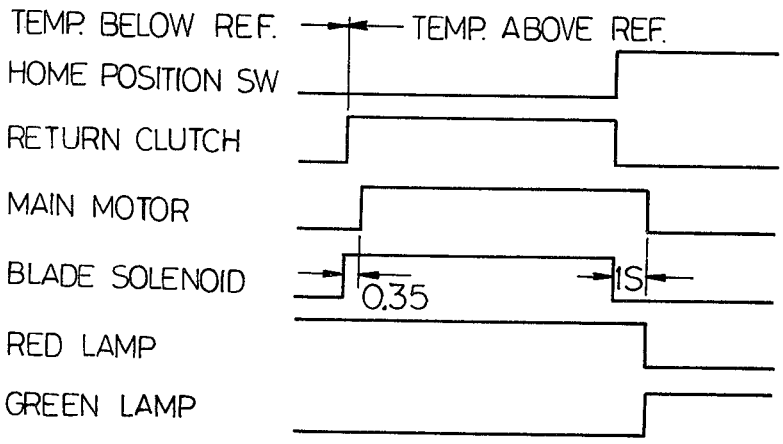
FIGS. 45–49 are timing charts showing the main routines.
Figure 46:
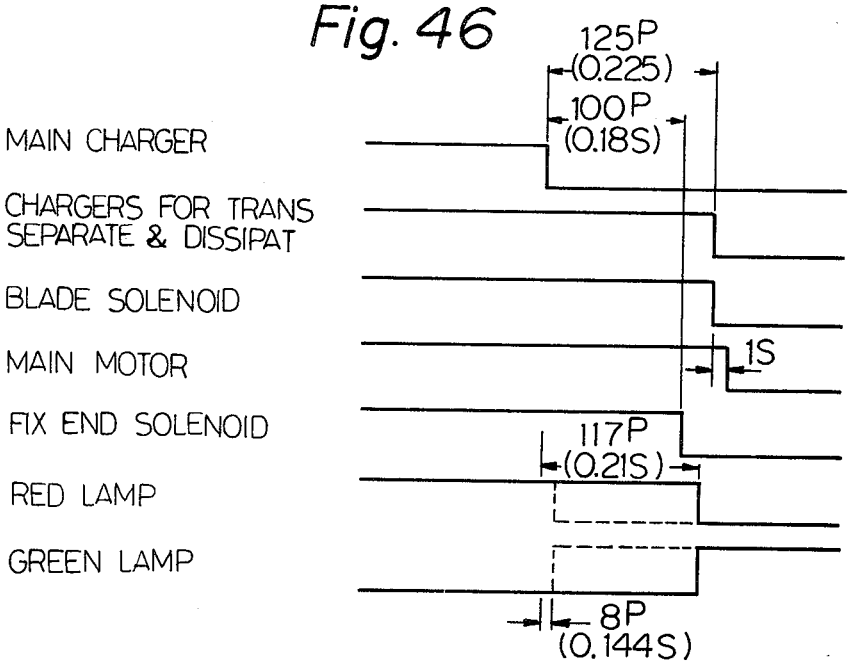
Figure 47:
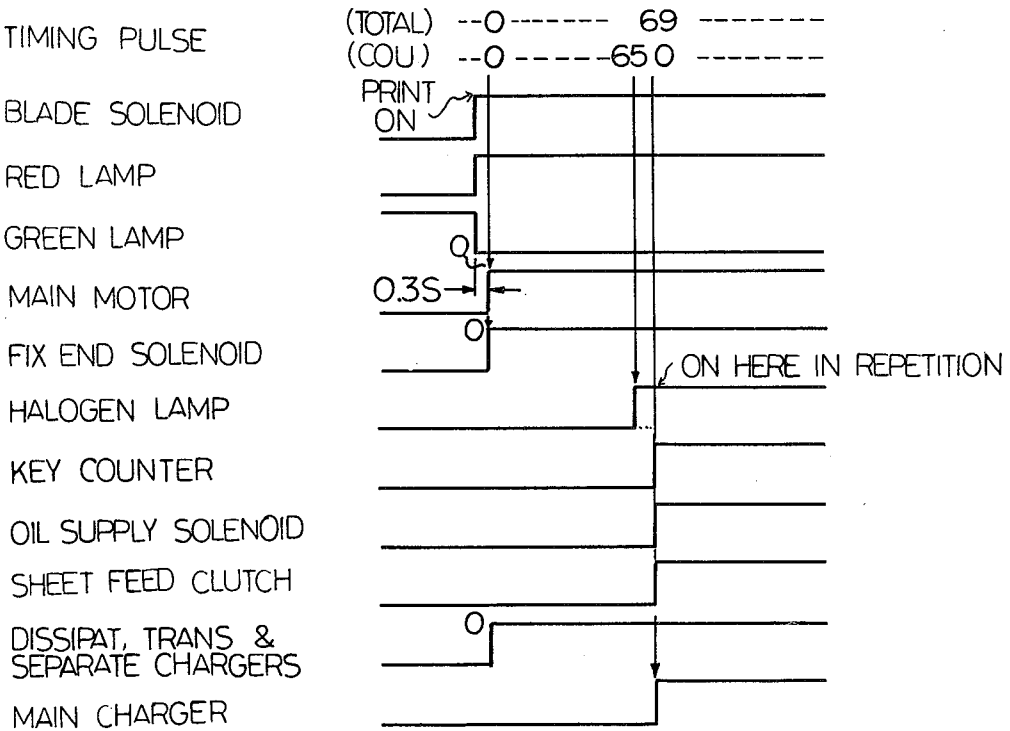
Figure 48:
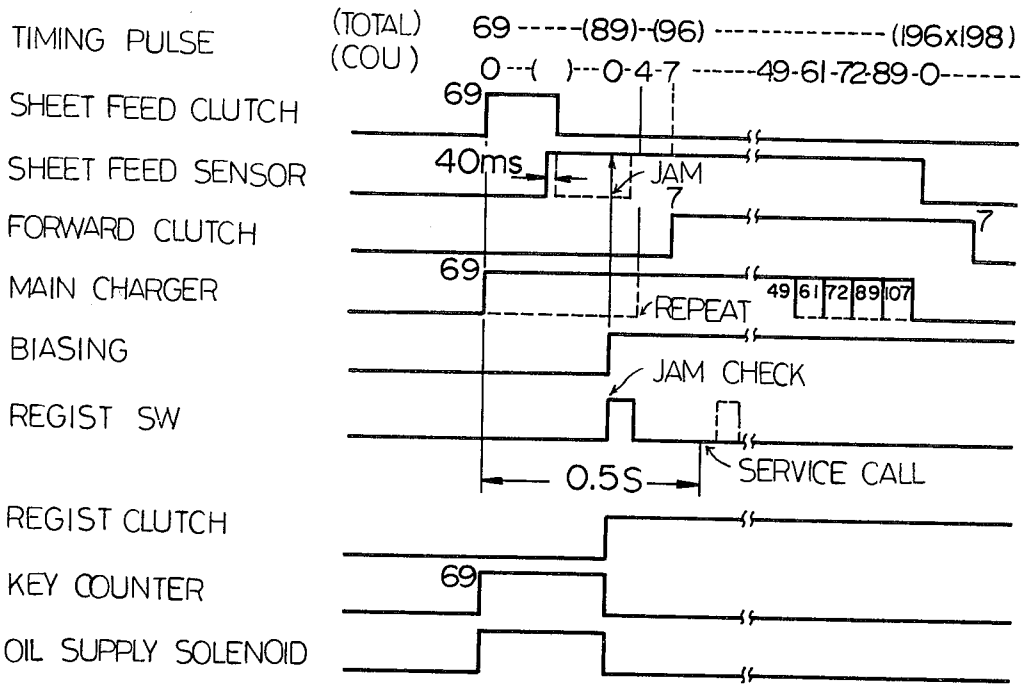
Figure 49:
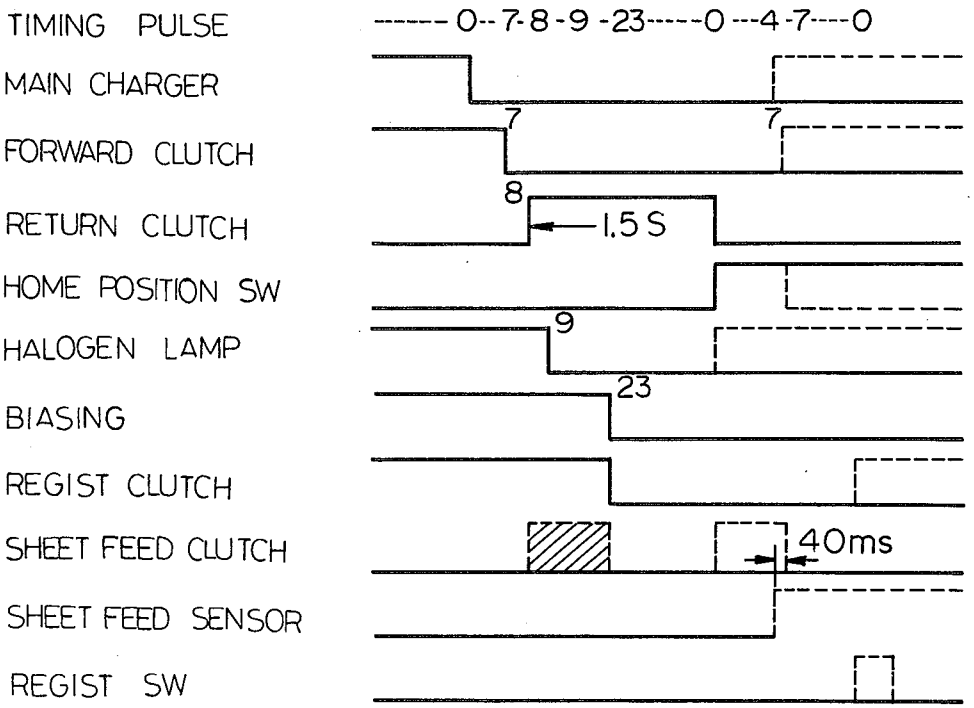

FIG. 39 is a flowchart representing subroutines of the control while FIG. 40 is a timing chart indicating a subroutine for checking a sheet jam at the sheet discharge section.

At a stage ① in FIG. 39, selected keys on the control panel 23 are depressed to enter and store necessary data together with other data while such data are displayed on the control panel 16. At a stage ②, whether to suspend a repeat copy mode is checked. A repeat copy mode will be suspended when sheets have run out as indicated by "paper end", when a sheet feed operation different from one currently in use is selected through a button 84, when a key counter is not set, or when a clear stop key 518 is depressed. A copying cycle will be repeated (in the case of a 1 to 1 copy mode) if the print switch 68 is turned on during an interval from a coupling of the return clutch 250 to a making of the home position switch 210 (see FIG. 11). Then at a stage ③, one timing pulse is added and "1" is added to each timer counter. At a stage ④, the need for a service call is checked. Input of timing pulses and failure in the drive of the optical system are checked by software and the others by hardware. At a stage ⑤, if a copying operation is under way, a sheet jam at the sheet discharge section is checked.

FIGS. 41 to 44 show main routines and FIGS. 46 to 49 are timing charts relevant therewith. When a main switch is made at a stage ①, the random access memory RAM and others of a 1-chip CPU are cleared back to their initial statuses. The "initial statuses" mentioned here refers to indication of a "WAIT" sign on the failure display 72, energization of a red lamp built in the print switch 68, energization of the "UPPER" cassette selection display 362 and indication of "1" on the preset sheet number display 518 (see FIG. 3). Here, the blade solenoid and main motor 50 are energized by a signal which activates a motor of a toner density control device (see FIG. 4). If the carriage 178 is out of the home position, the above-mentioned motor on signal is also used to couple the return clutch 250. At stage ②, whether the sheet feed sensor 376 or the sheet discharge sensor is turned on is checked to determine whether the sheet path is jammed with a sheet. This will not be the case, however, if a free run switch or a jam off switch has been turned off. The free run switch and jam switch will be used for the inspection of operations of the machine. When the free run switch is closed, the machine can be operated with the supply of sheets inhibited and the respective chargers 28, 34 and 36 disabled. When the jam off switch is closed, the machine can be operated with the supply of sheets inhibited. At a stage ③, if the fixing temperature fails to reach a predetermined level even after 6 minutes, a service call will be produced. If it safely builds up to the predetermined level within 6 minutes, the operation proceeds to the next step. A flow at a stage ④ represents a case wherein the fixing unit 62 is pulled out of the machine to remove a jamming sheet for example and the carriage 178 is moved. If the carriage 178 is not at the home position at the stage ④, the return clutch 250 is coupled and the blade solenoid is energized. After 0.3 second, the main motor 50 is activated to return the carriage 178. If the carriage 178 is brought to the home position, the return clutch 250 is uncoupled and the blade solenoid is deenergized. After 1 second, the main motor 50 is deactivated while the "WAIT" lamp on the failure display 72 goes out. If the developer agitating switch 26 has been turned on, the main motor 39 is kept activated until the switch 22 is turned off.

At a stage ⑤, if the machine is not under a "paper end" condition or a "toner end" condition, the preset sheet number counter is loaded with "1" after 60 seconds. If the machine has run out of sheets or toner, if the key counter has not been set yet, if the fixing temperature is lower than a predetermined lower limit, if the carriage 95 is out the home position, if a service call has been produced, if a sheet jam has been detected, or if a printing operation is under way, a red lamp in the print button 68 glows; otherwise, a green lamp glows inside the print button 68. When 60 seconds lapses before the machine is manipulated, the preset sheet number display 518 is reset to "1". However, this will not occur under a "paper end" condition or a "toner end" condition. A stage ⑥ indicates a routine for ending a copying operation. At stage ⑥, after the main charger 28 has been turned off, the fixing end solenoid 498 is deenergized upon appearance of the 100th pulse. In response to the 125th pulse, the blade solenoid and the chargers 34 and 36 are deenergized. Upon the lapse of 1 second, the main motor 50 is deactivated.

At a stage ⑦, when the print switch 68 is closed, the blade solenoid is energized and the red button in the print button 68 is turned on while a copy counter built in the CPU is reset to "0". After 0.3 second, the main motor 50 is energized and the fixing end solenoid 498 is energized while main timing pulses are reset. Also, the chargers 34 and 36 are turned on. The halogen lamp 168 is turned on by the 65th pulse after the activation of the main motor; the main charger 28 is energized by the 68th pulse and main timing pulses are reset. At a stage ⑧, a 60-second timer is set. If the fixing temperature remains below the lower limit for 60 seconds, the machine does not advance to the next step but produces a service call. If the fixing temperature is above a reference level, there are activated the key counter, solenoid for operating the silicone oil drawing pump, and the sheet feed clutch for trasmitting a drive to the sheet feed rollers 324 (326). At the same time, "1" is added to a copy number display 520. If the toner has run out, "1" is added to a toner end counter in the CPU. This is to permit up to 50 copies to be produced sequentially after a turn-on of the toner end display lamp but to inhibit further copying cycles when the toner end counter reaches "50", thereby preventing deposition of the carrier on a transfer sheet attributable to a drop of the developer density. If the machine is in a repeat copy mode, main timing pulses are reset and the halogen lamp 168 is turned on at the instant the carriage 178 regains the home position. (The step will jump directly to Ⓑ when a copying cycle is to be repeated.) It will thus be seen that an on timing of the halogen lamp 168 and charger 28 for the first sheet (discussed at the stage ⑧) after a depression of the print button 68 is distinguished from an on timing for the second copy and onward (discussed at stages ⑨ and ⑩). With this specific design, a time period from a turn-on of the halogen lamp 168 and charger 28 for processing the first sheet after a depression of the print button 68 to a start of a forward stroke of the carriage 178 is made longer than a time period consumed on the second sheet and onward, so that there is prevented misregistry of the carriage 178 with the home position after a turn-on of the main switch or after removal of a failure which would otherwise affect a reproduced image.

At stage ⑩, upon a lapse of 40 miliseconds after the sheet feed sensor 376 has been turned on, the sheet feed clutch is uncoupled. The 7th pulse after the sheet feed clutch has been coupled couples the forward clutch 252. If in a repeat copy mode, the 4th pulse after the coupling of the sheet feed clutch energizes the charger 28. At a stage ⑪, if a registry switch 522 (see FIG. 11) is not turned on even after 0.5 second since a coupling of the sheet feed clutch, a service call is produced. When the registry switch 522 is turned on, a bias for development is turned on, main timing pulses are reset to check a sheet feed jam, and the key counter and registry clutch are turned on. A sheet feed jam is determined to have occurred when no sheets are found in the sheet feed sensor area at the instant the registry switch 522 is turned on. At a stage ⑫, when the main charger 28 is deenergized, main timing pulses are reset; the main charger 28 remains turned on for a time which depends on the sheet size. At a stage ⑬, after the main charger 28 has been turned off and main timing pulses have been reset, the forward clutch 252 is uncoupled by the 7th pulse whereupon the return clutch 250 is coupled by the 8th pulse. If sheets have run out at this moment, the sheet feed clutch is coupled so that the sheet feed rollers 324 and 326 are rubbed against friction pads which are adhered to those portions of the bottom plates 312 of the sheet cassettes which will confront the rollers 324 and 326 when the sheet cassettes are mounted in the machine body. The rollers 324 and 148 are in this way protected from deposition of containments. When the return clutch 250 is coupled, the green lamp inside the print button 68 will glow under conditions: sheets present, toner present, key counter set, desired number of copies fully produced, and 1 to 1 copy mode. Thereafter, the halogen lamp 168 is turned off by the 9th pulse and the developing bias, sheet feed clutch (in the case of "paper end") and registry clutch are all turned off by the 23th pulse. At a stage ⑭, when the carriage 178 fails to regain home position even after 1.5 seconds since a turn-on of the return clutch 250, a service call is produced. If the carriage 178 succeeds in regaining the home position and a repeat copy mode is under way, a printing cycle is repeated with the key counter, oil supply solenoid and sheet feed clutch turned on. If a repeat copy mode has been completed, the fixing end solenoid 498 is turned off by the 100th pulse after a turn-off of the charger 28, the blade solenoid and chargers 34 and 36 are deenergized by the 125th pulse, and the main motor 50 is deactivated after 1 second. The respective units are thus caused into a stand-by condition.

Figure 50:
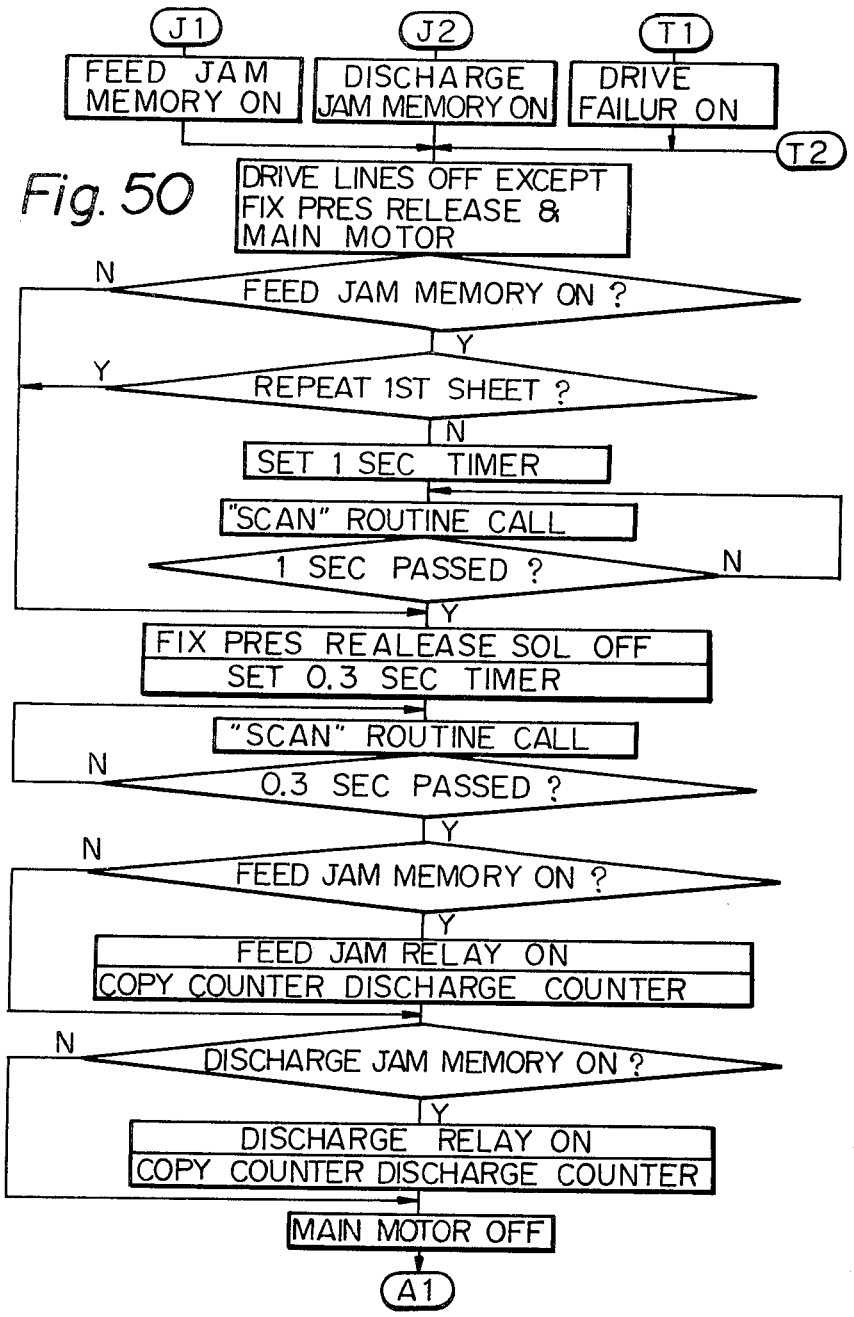
FIG. 50 is a flowchart indicating an operation in the event of a failure.
Figure 51:
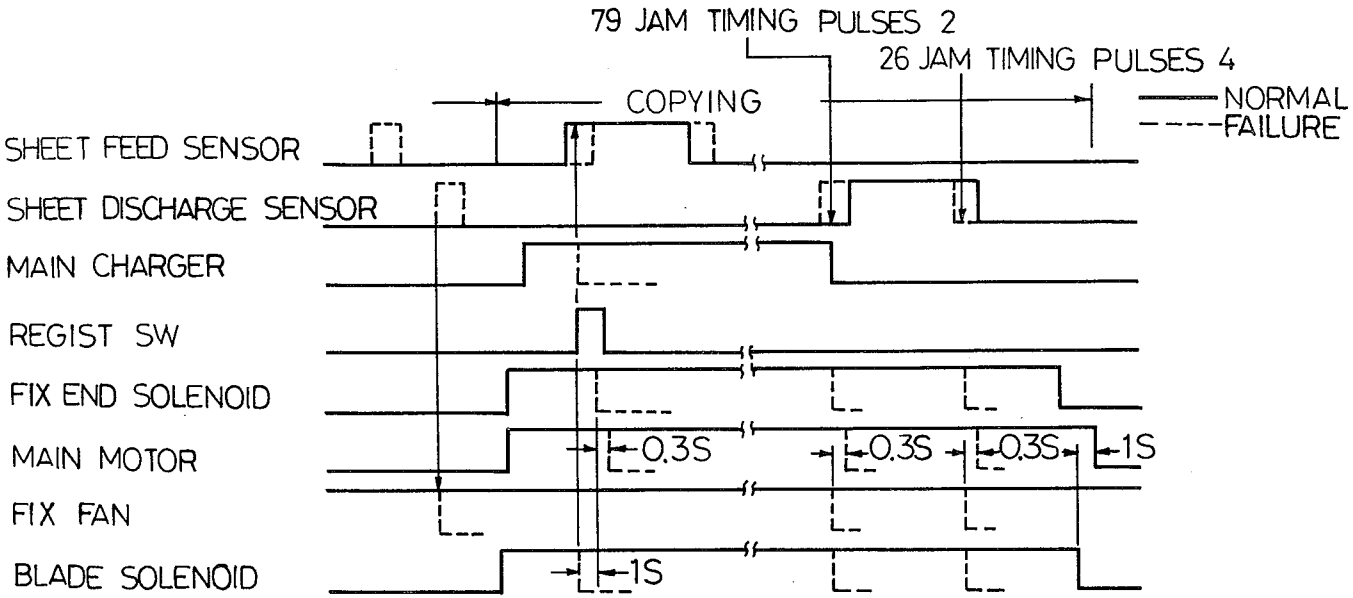
FIG. 51 is a timing chart indicating the operation of FIG. 50.

FIG. 50 is a flowchart for coping with various failures in the machine. FIG. 51 is a timing chart according to which various components are controlled in the event of a sheet jam.

First, a procedure for settling a sheet jam in the sheet feed section will be discussed. Suppose that the sheet feed sensor 376 is turned on under a stand-by condition or that the sheet feed sensor 376 is off when the registry switch 522 is turned on; in each case the fan 66 at the fixing station remains turned on. Under any of these conditions, all the component elements except the fixing end solenoid 498, main motor 50 and fan 66 are deactivated. The turn-off of the fixing end solenoid 498 occurs after 1 second in order to ensure normal discharge of a sheet fed before the sheet is fed out of the machine. The turn-off of the main motor 50 occurs after 0.3 second for releasing the pressure on the fixing roller 404. If it is the first sheet after a depression of the print button 68 that jammed the path, all the component units except the main motor 50 are turned off as soon as the jam is detected and, after 0.3 second, the main motor 50 is turned off.

When a sheet jam occurs in the sheet discharge section, all the drive lines except the main motor 50 are deactivated while the main motor is turned off after 0.3 second. The fan 66 at the fixing station is turned off in this case. When a sheet jam occurs in a stand-by state of the machine, it is reflected by a turn-on of the sheet discharge sensor. When a sheet jam occurs during a copying operation of the machine, all the drive lines are turned off except the main motor 39 and this main motor 50 is deactivated after 0.3 second. Conditions which cause this are: when a sheet is absent at the sheet discharge sensor when 79 jam timing pulses ② are counted since a start of the count which occurs when 40 jam timing pulses ① are counted up from the instant the forward clutch 111A is coupled, or when a sheet fails to move past the sheet sensor when 26 jam timing pulses ④ are counted up since a start of the count which occurs 81 jam timing pulses ③ are counted up from the instant the return clutch 250 is uncoupled. It will be noted that the above-mentioned specific counts of the jam timing pulses ① and ② are reached after a period of time which is somewhat longer than a period of time which a sheet fed properly takes to arrive at the sheet discharge sensor. Also, the counts of the jam timing pulses ③ and ④ are reached after a period of time which is somewhat longer than a time period which a sheet fed properly moves past the discharge sensor.

Now, various conditions which result in a service call will be described. Procedures based on software are employed for a failure in timing pulses, a failure in the optical system drive, a case wherein the fixing temperature remains below a predetermined level for 6 minutes or more under a stand-by condition, and a case wherein the fixing temperature remains lower than a lower limit for 6 minutes or more. For other conditions, procedures are based on hardware. The kind of each service call is displayed by light emitting diodes on the LED display 20.

Figure 52:
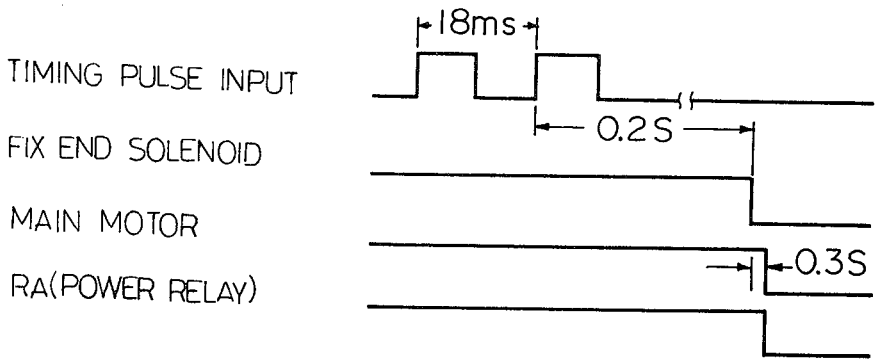
FIG. 52 is a timing chart showing a timing pulse check for a service call.
Figure 54:
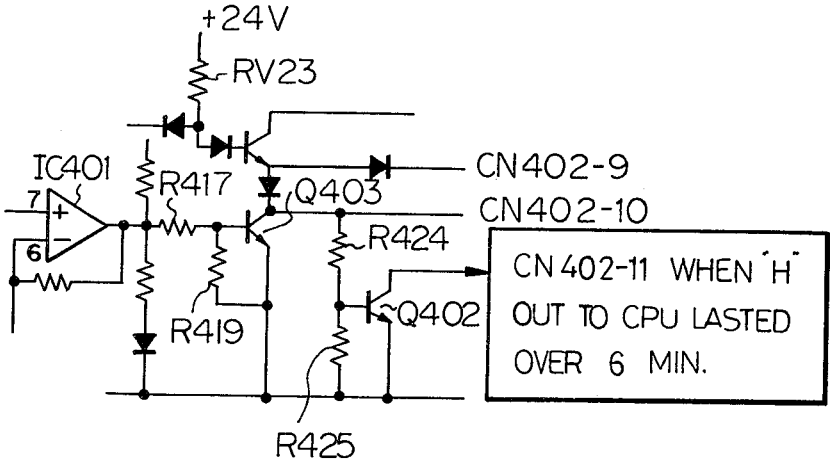
FIG. 54 is a circuit diagram showing an unusual fixing temperature detector.
Figure 53:
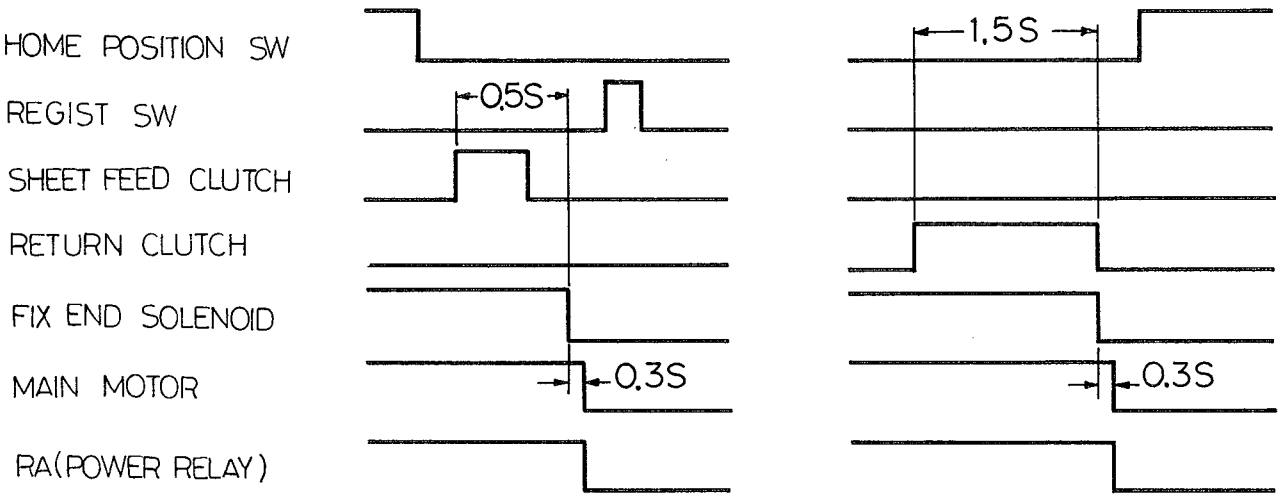
FIG. 53 is a timing chart indicating a failure in the movement of the optical system.
Figure 55:
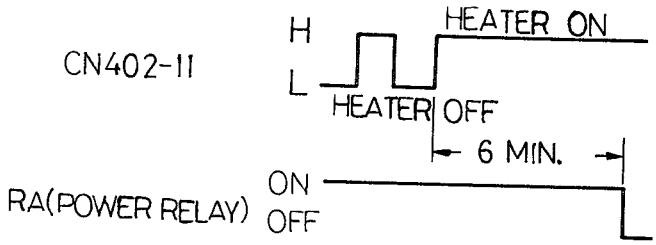
FIG. 55 is a timing chart showing an operation of the unusual fixing temperature detector.
Figure 56:
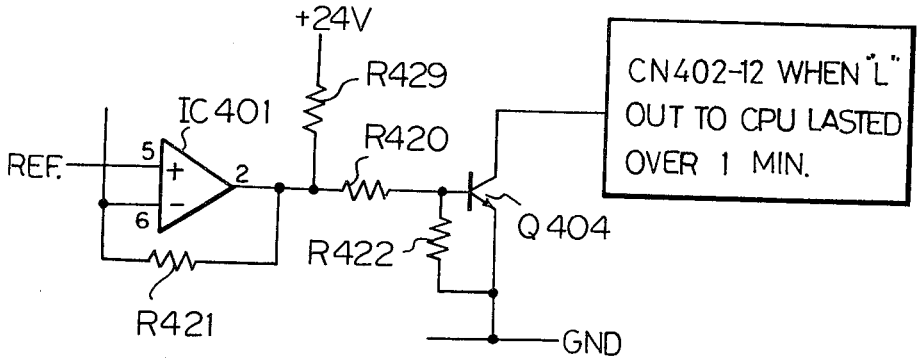
FIG. 56 is a circuit diagram showing a lower fixing temperature limit detector.
Figure 57:
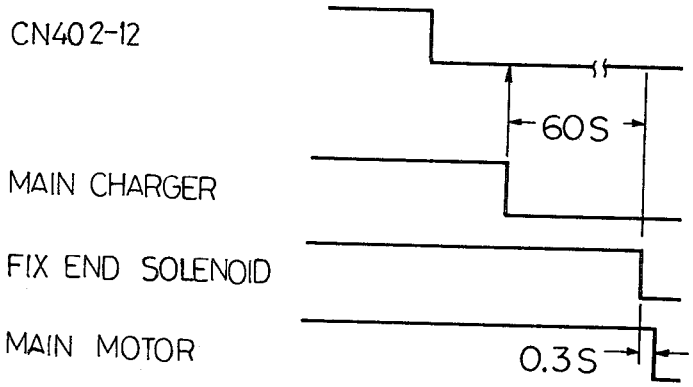
FIG. 57 is a timing chart showing an operation of the lower fixing temperature limit detector.

When a timing pulse does not arrive within 0.2 second after the arrival of an immediately preceding timing pulse, the drive is determined failed and the procedure shown in FIG. 52 occurs. When the registry switch 522 does not turn on within 0.5 second after coupling of the sheet feed clutch, or when the home position switch 210 does not turn on within 1.5 seconds after coupling of the return clutch 250, the drive of the optical system is determined as failed and the procedure shown in FIG. 53 takes place. When the fixing temperature remains below a predetermined level for 6 minutes or more under a stand-by condition, the fixing temperature is judged abnormal and the procedure shown in FIG. 55 is performed through a circuitry of FIG. 54. When the fixing temperature remains below a lower limit for 1 minute or more, the fixing temperature is determined abnormal and the procedure shown in FIG. 57 is performed through a circuitry of FIG. 56.

Figure 58:
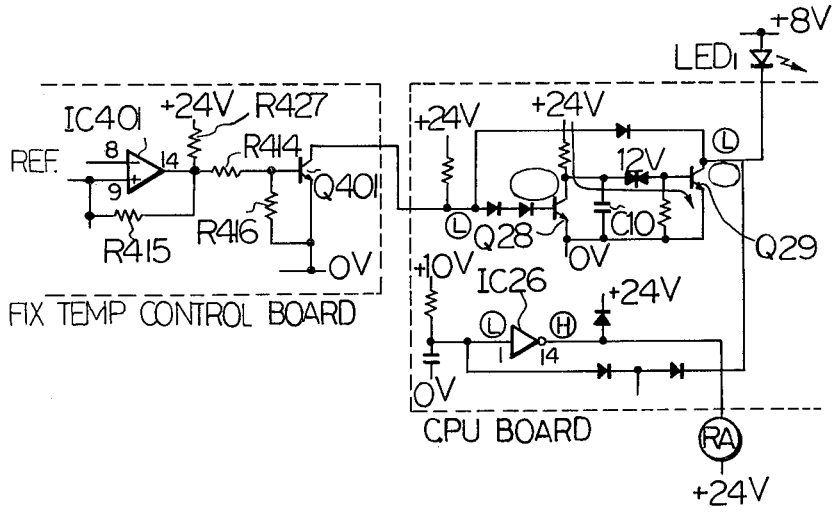
FIG. 58 is a circuit diagram showing an upper fixing temperature detector.

The following actions for producing a service call relay on hardware. When the fixing temperature rises beyond 240° C., a transistor Q 401 in a circuitry of FIG. 58 is turned on to make the base voltage of a transistor Q 28 "L" so that the transistor Q 28 is turned off. Then a capacitor C 10 is charged. Upon an increase in the voltage in the capacitor C 10 above 12.6 V, a transistor Q 29 is rendered conductive energizing a light emitting diode LED 1 on the LED display 20. Since the transistor Q 29 is turned on, a 1-pin of a transistor array IC 26 is at a "L" level and a 14-pin is at a "H" level whereby a power relay RA is turned off. Seeing that the transistor Q 29 is turned off, the CPU turns on a service call lamp.

Figure 59:
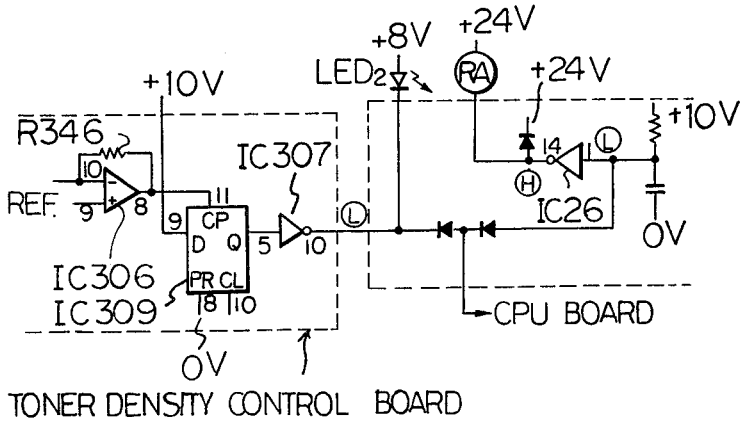
FIG. 59 is a circuit diagram showing a toner sensor stop-up detector.

When the toner density sensor in the developing system remains clogged with the toner for more than 4.9 seconds, a comparator IC 306 in a circuitry of FIG. 59 produces a "H" output which is coupled to a CP terminal 11 of a flip-flop IC 309. Accordingly, the flip-flop IC 309 produces a "H" output at its output terminal 13 whereby a transistor array IC 307 is caused to produce a "L" output at an output terminal 10 thereof. As a result, a light emitting diode LED 2 on the LED display 20 is energized. The 1-pin of the transistor array IC 26 becomes "L" and the 14-pin "H" deenergizing the power relay RA. The CPU receiving the output of the transistor array IC 307 turns on the service call lamp.

Figure 60:
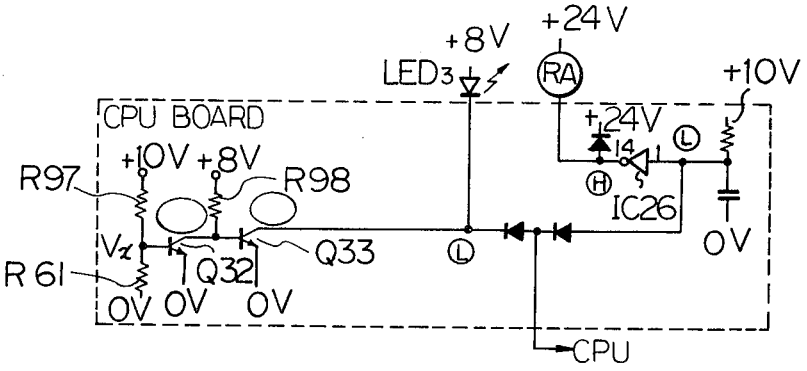
FIGS. 60 and 61 are circuit diagrams showing two different detectors responsive to failures in control power sources.

Referring to FIG. 60,. when a 10 V power source for control is lowered beyond 7 V, a transistor Q 32 is turned off because its base voltage drops below 0.7 V. This turns on a transistor Q 33 and thereby energizes a light emitting diode LED 3 on the LED display 20. The 14-pin of the transistor array IC 26 becomes "H" to deenergize the power relay RA. The CPU turns on the service call lamp in response to the output of the transistor Q 33.

Figure 61:
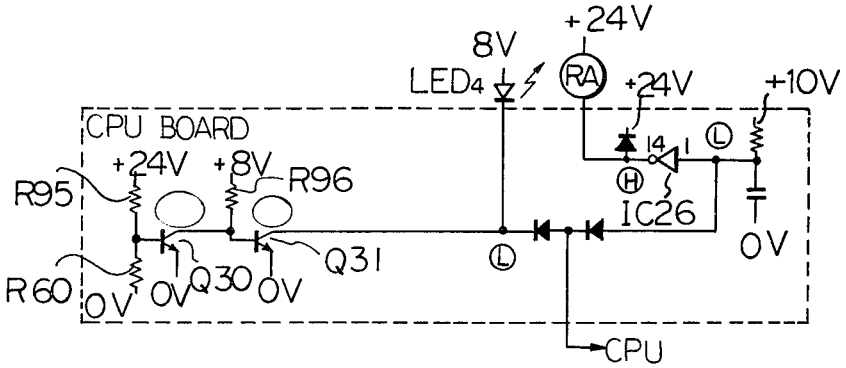

Referring to FIG. 61, when a 24 V power source for DC load drive is lowered beyond a predetermined level, the base voltage of a transistor Q 30 becomes lower than 0.7 V rendering the transistor Q 30 nonconductive. This turns on a transistor Q 31 which in turn energizes a light emitting diode LED 4 on the LED display 20. The 14-pin of the transistor array IC 26 becomes "H" deenergizing the power relay RA. The CPU turns on the service call lamp supplied with the output of the transistor Q 31.

Figure 62:
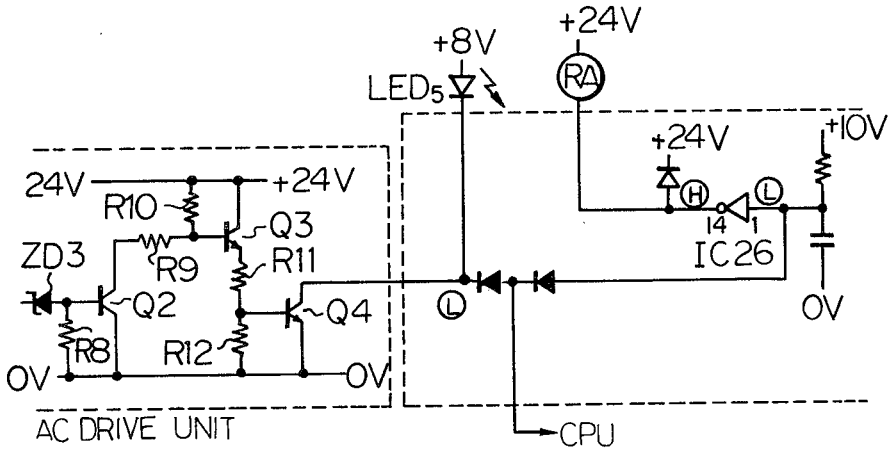
FIG. 62 is a circuit diagram showing a detector responsive to an unusual energization of an illuminating lamp.

Referring to FIG. 62, when the halogen lamp 168 is kept energized for more than 4.3 seconds or a wire breakdown continues for more than the same period, a transistor Q 4 is made conductive to turn on a light emitting diode LED 5 on the LED display 20. The 1-pin of the transistor array IC 26 becomes "L" and the 14-pin "H" turning off the power relay RA. The CPU turns on the service call lamp supplied with the output of the transistor Q 4.

Figure 63:
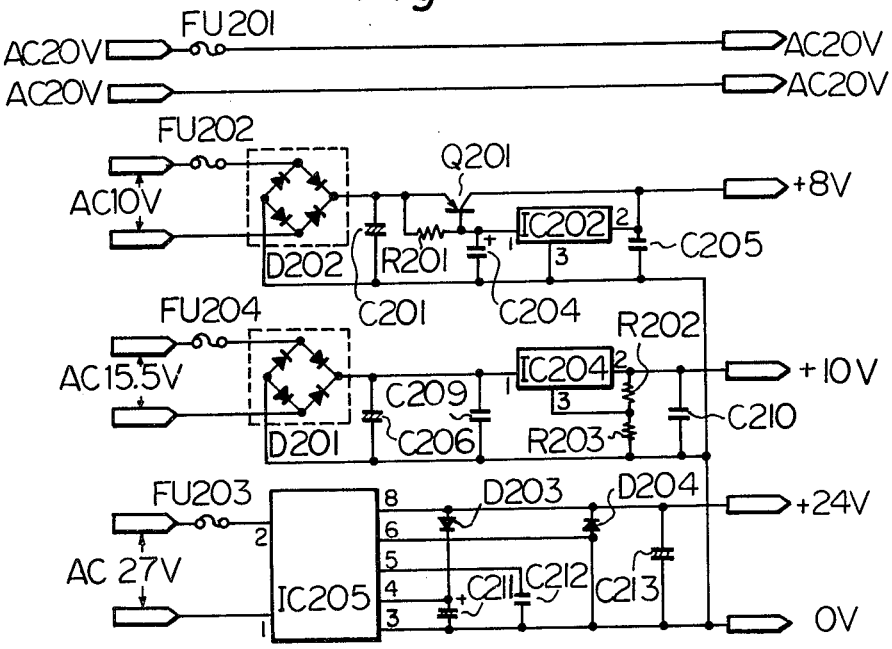
FIG. 63 is a circuit diagram of control power sources.

FIG. 63 illustrates a control power source circuit which includes a power source of AC 20 V for the power pack. A 3-terminal regulator IC 202 prepares a voltage DC 8 V from a voltage AC 10 V. A 3-terminal regulator IC 204 prepares a voltage DC 10 V from a voltage AC 15.5 V. A constant voltage power source IC 205 prepares a voltage DC 24 V from a voltage AC 27 V.

Figure 64:
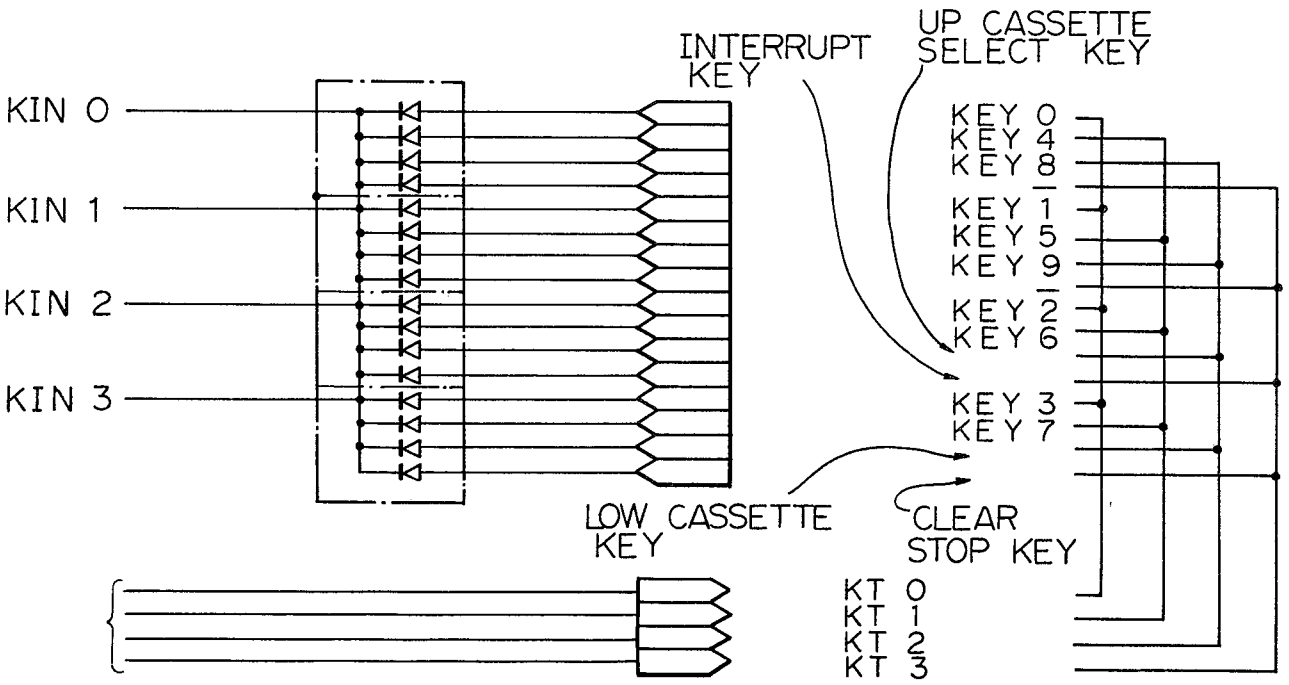
FIG. 64 is a circuit diagram of a key switch input circuit.
Figures 65, 66:
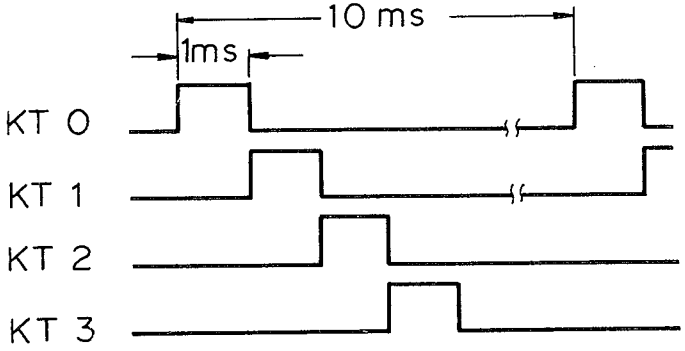
FIG. 65 shows a matrix of the circuit shown in FIG. 64.
FIG. 66 is a timing chart relevant with the matrix.
Figure 67:
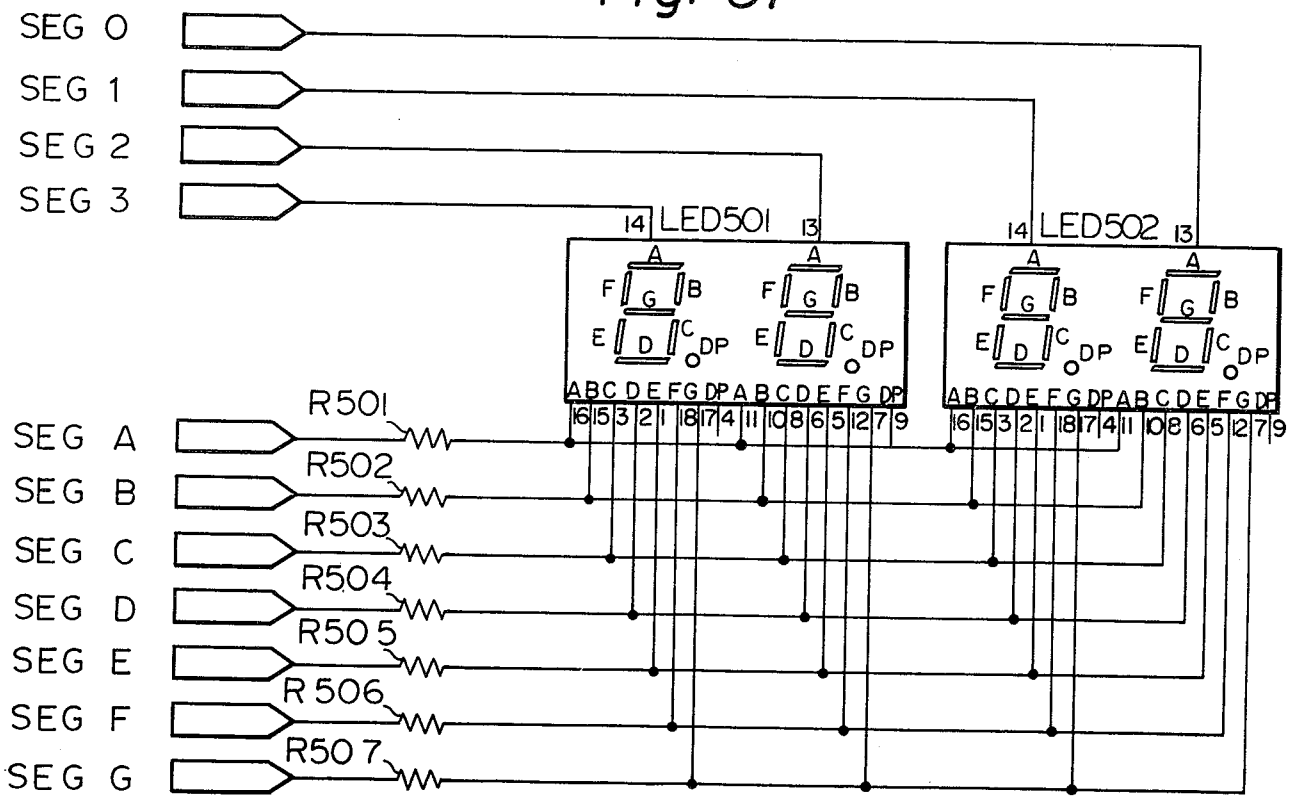
FIG. 67 is a circuit diagram of a segment energization circuit.

The control section is furnished with a key switch input circuit shown in FIGS. 64, 65 and 66 and a segment energization circuit shown in FIG. 67. Inputs through a key switch are entered and identified by the CPU through a KT-KIN matrix. The segment energization circuit turns on the various segments dynamically. For example, to energize "A" segments of the leftmost "8" in FIG. 67, a SEG 38 V is set up and the data are "L" at SEG A and "H" at the others SEG B to SEG G.

A toner density control will be described hereinafter.

Concerning a power source, use is made of 3-terminal regulators to prepare constant voltage sources of DC +10 V and DC +6 V from a voltage of DC 24 V.

Figure 68:
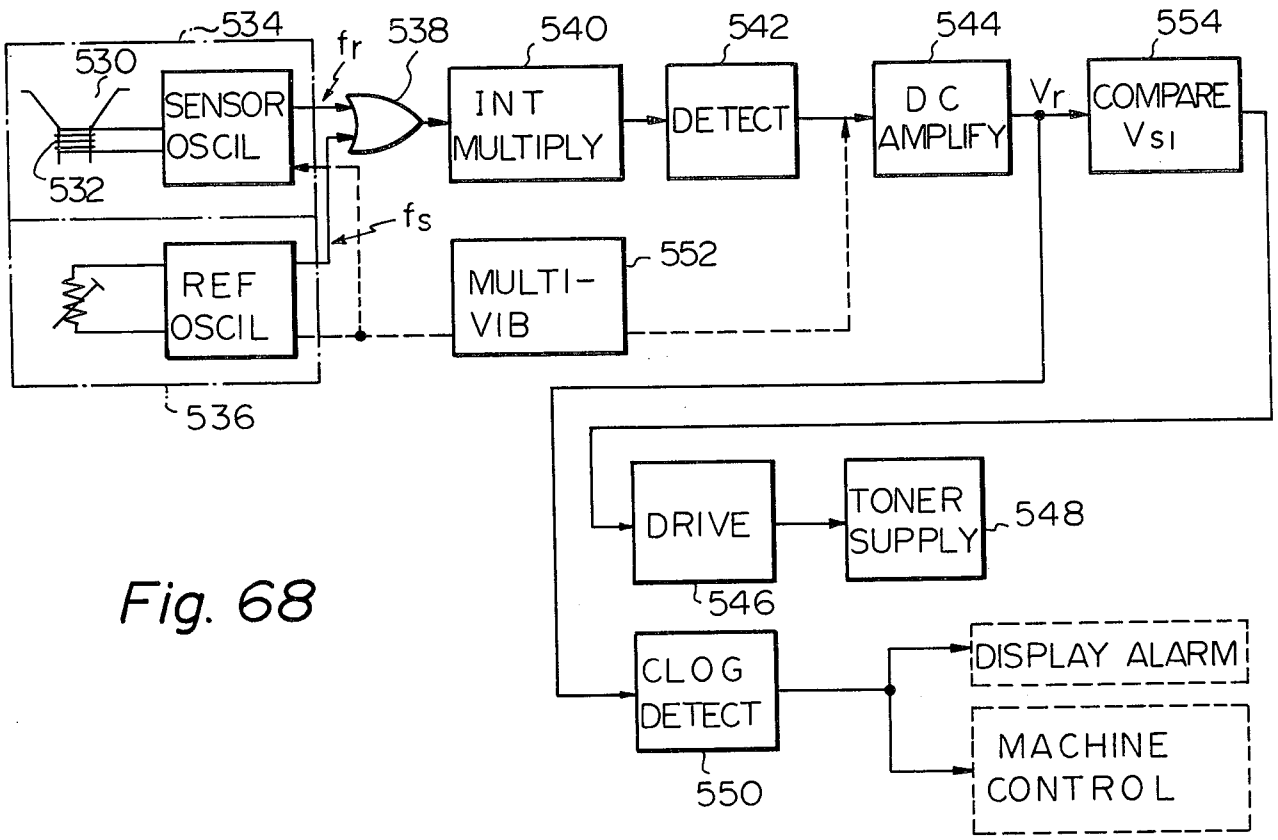
FIGS. 68–70 are block diagrams demonstrating a principle of toner density detection.
Figure 69:
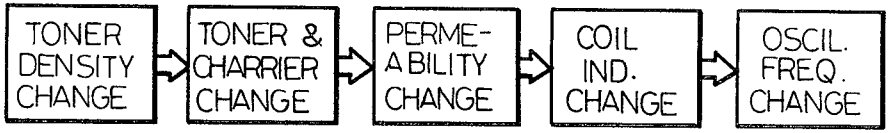
Figure 70:
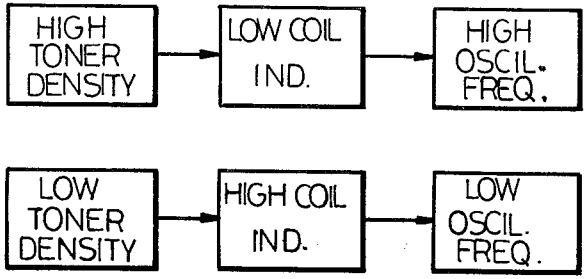
Figure 71:
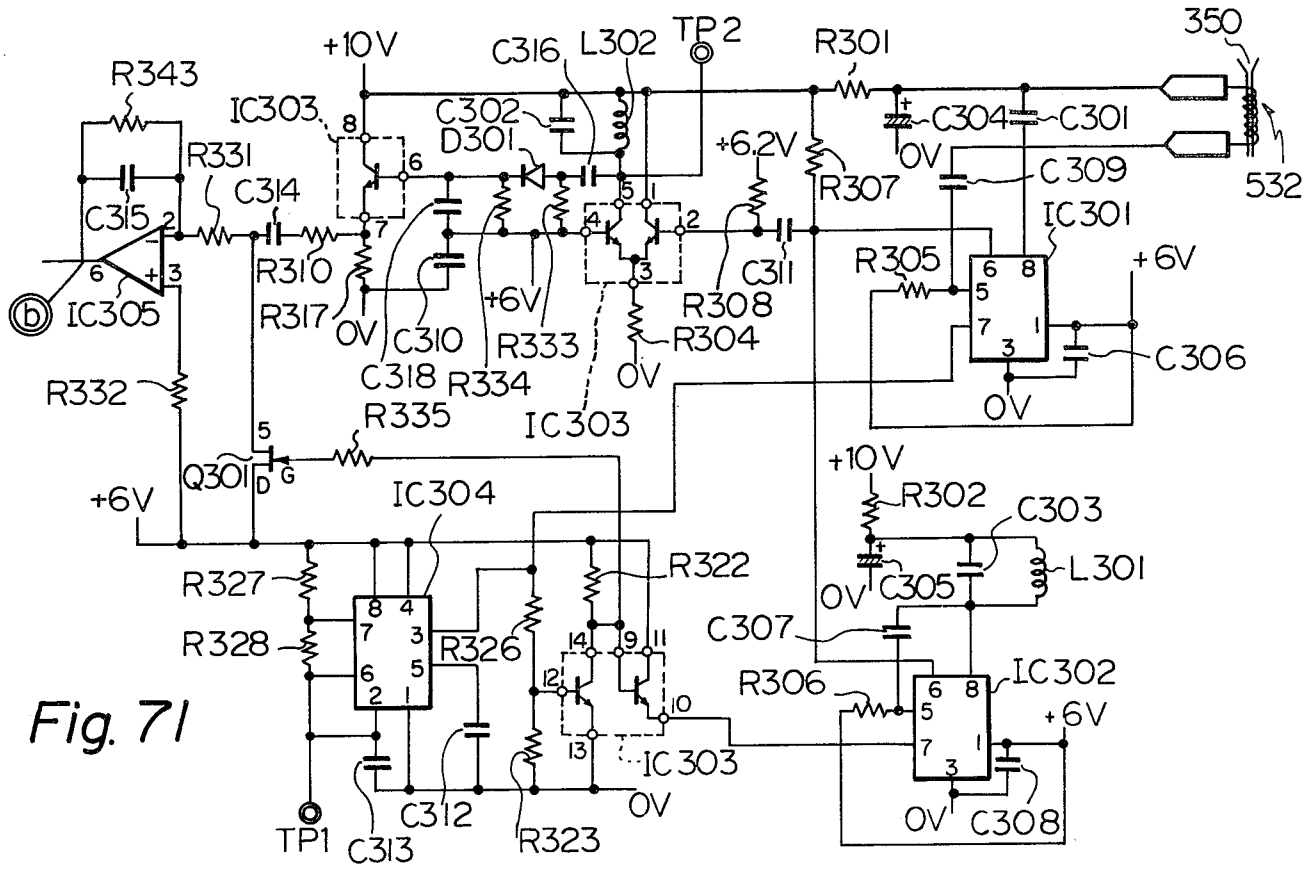
FIGS. 71–73 are circuit diagrams showing a toner density detection circuit.
Figure 72:
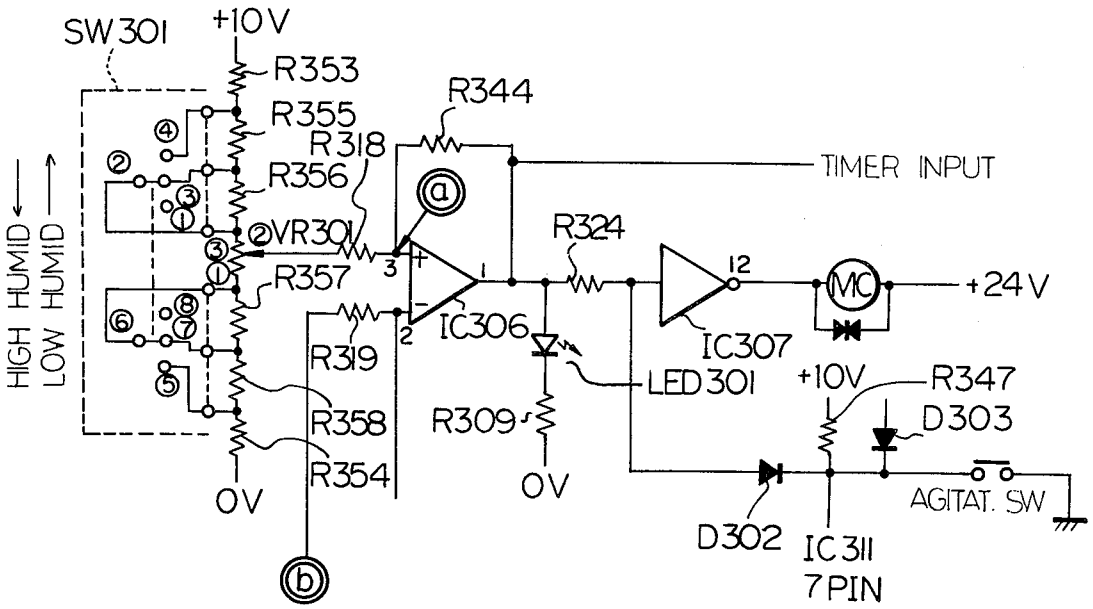
Figure 73:
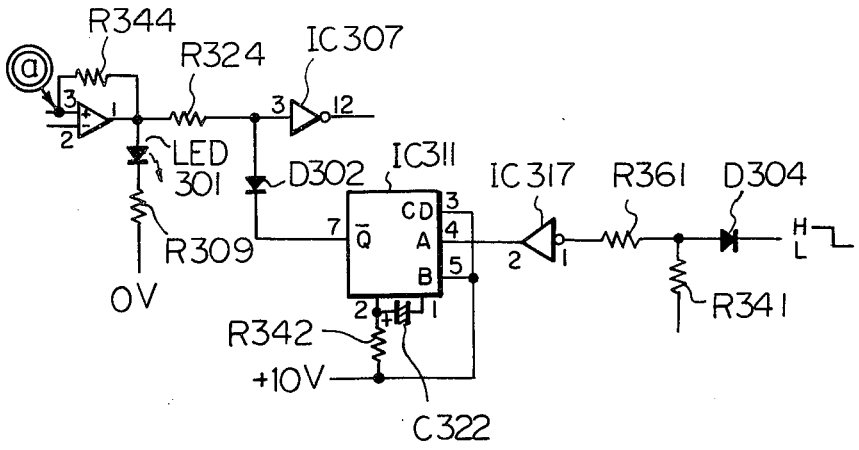

Principles of toner density detection will be outlined first with reference to FIGS. 68 to 70. FIGS. 71 to 73 are circuit diagrams representing details of the toner density detection.

A block diagram shown in FIG. 68 will be described first.

While a constant volume of developer will flow down through the bobbin 530 of the toner density sensor, the inductance of the coil 532 wound on the bobbin 530 is varied depending on the toner density, that is, the ratio of the carrier and the toner to each other which dictates the permeability of the coil 532. A change of the inductance of the coil 532 is reflected by a change of the output frequency $f_r$ of an oscillator 534 which is coactive with the coil 532 on the bobbin 530. A second oscillator 536 produces a reference oscillation frequency $f_s$. Outputs $f_r$ and $f_s$ of these oscillators 534 and 536 are coupled to an adder 538 an output of which is in turn coupled to an integral amplifier 540. An integrated and amplified output of the amplifier 540 is applied through a detector 542 to a DC amplifier 544. A comparator 554 compares an output voltage $V_r$ of the DC amplifier 544 with a reference voltage $V_{s1}$. If an actual toner density is lower than a reference density, the comparator 554 actuates the toner supply mechanism 63 through a driver 546 to cause a supply of toner particles into the casing of the developing unit. The output voltage $V_r$ of the Dc amplifier 544 is also applied to a bobbin stop-up detector 550 so that, if the bobbin 530 is clogged, the detector 550 activates the display while interrupting the drive of the machine body.

More specifically, in FIG. 71, when an actual toner density is lower than a reference level an output terminal 6-pin of a DC amplifier IC 305 produces a voltage which is lower than the reference voltage $V_{s1}$. If an actual toner density is higher than the reference level, a voltage higher than the reference voltage $V_{s1}$ appears at the output terminal 6-pin of the DC amplifier IC 305. A voltage appearing at the output terminal 6-pin of the DC amplifier IC 305 indicated by ⓑ in FIG. 72 is coupled to an inverting input terminal of a comparator IC 306. A voltage at a point ⓐ in FIG. 72 which is the reference voltage $V_{s1}$ is coupled to a non-inverting input terminal of the comparator IC 306. When an actual toner density is lower than the reference level, the voltage coupled to the comparator IC 306 from the point ⓑ is lower than the reference voltage $V_{s1}$ coupled from the point ⓐ. Then the comparator IC 306 produces a "H" output at its output terminal 1-pin whereby a light emitting diode LED 301 is turned on for monitoring a toner supply operation and, at the same time, a transistor array IC 307 is turned on to in turn energize an electromagnet clutch MC. This clutch MC drives the toner supply roller 106 for supplying a supplementary amount of toner into the 56. In case where an actual toner density is higher than the reference level, a voltage appearing at the output terminal 6-pin of the DC amplifier IC 305 is higher than the reference voltage $V_{s1}$. Comparing the voltages at the points ⓐ and ⓑ, the comparator IC 306 produces a "L" output at the output terminal 1-pin which turns off the light emitting diode LED 301 and deenergizes the clutch MC adapted to drive the clutch MC. Where the developer agitating switch 22 has been turned on, the input level of the 3-pin of the transistor array IC 307 is "L" turning the transistor array off and maintaining the clutch MC deenergized.

A switch SW 301 is employed to compensate for a change of the image density attributable to a change in a surrounding condition by altering the reference voltage at the point ⓐ. That is, when air surrounding the machine is relatively humid, the switch SW 301 operates to lower the reference voltage beyond a predetermined level and thereby promote a control of the toner density at a relatively low level because a high humidity would increase the image density. When the air is relatively dry, the reference voltage at the point ⓐ will be raised beyond the predetermined level so as to control the toner density at a relatively high level because a low humidity would lower the image density.

Referring to FIG. 73, when the main motor 50 is activated, the signal level at an input terminal 1-pin of an IC 317 turns from "H" to "L" and, therefore, the signal at an output terminal 2-pin from "L" to "H". At the buildup of the output at the 2-pin of the IC 317, a timer in an IC 311 is activated to hold a "L" output at an output terminal 7-pin of the IC 311 for a time period which is determined by a resistor R 342 and a capacitor C 322. Where the signal level at the output terminal 7-pin of the IC 311 is "L", the input level at the 3-pin of the transistor array IC 307 is kept at "L" regardless of the toner density so as to disable the toner supply mechanism. More specifically, since the amount of flow of the developer through the bobbin is unstable in an initial stage of operation of the developing unit 30, actions of the toner supply mechanism 106 are inhibited to avoid a supply of a needless volume of toner for a given time period from an instant the unit 30 is activated to an instant the flow of the developer grows stable.

Figure 76:
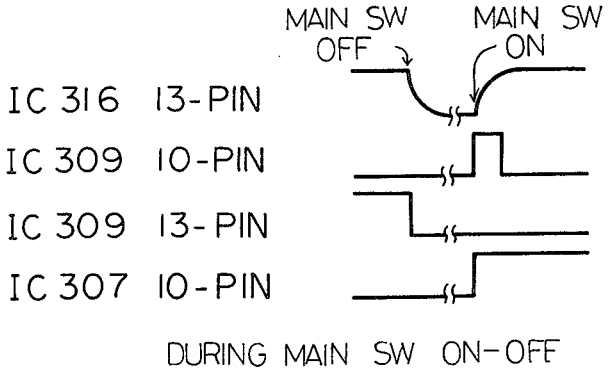
FIGS. 75 and 76 are timing charts explanatory of an operation of the toner sensor stop-up detector.
Figure 74:
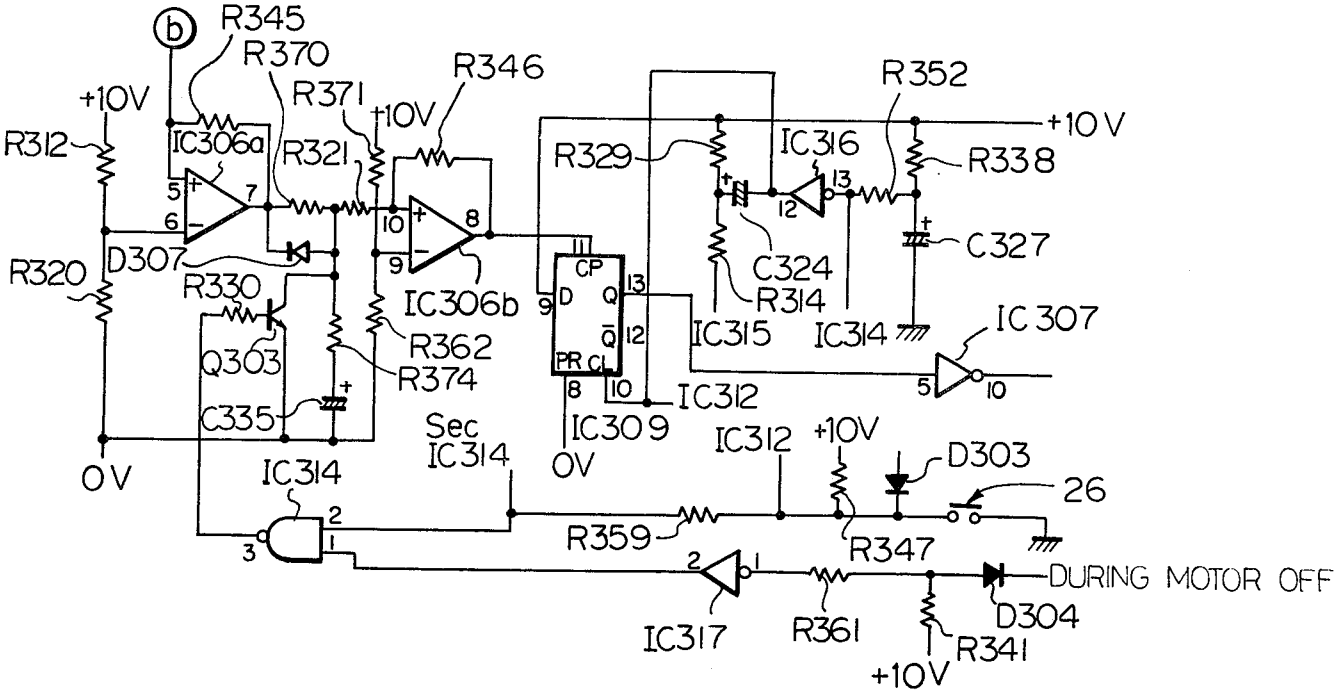
FIG. 74 is a circuit diagram showing a toner sensor stop-up detector.
Figure 75:
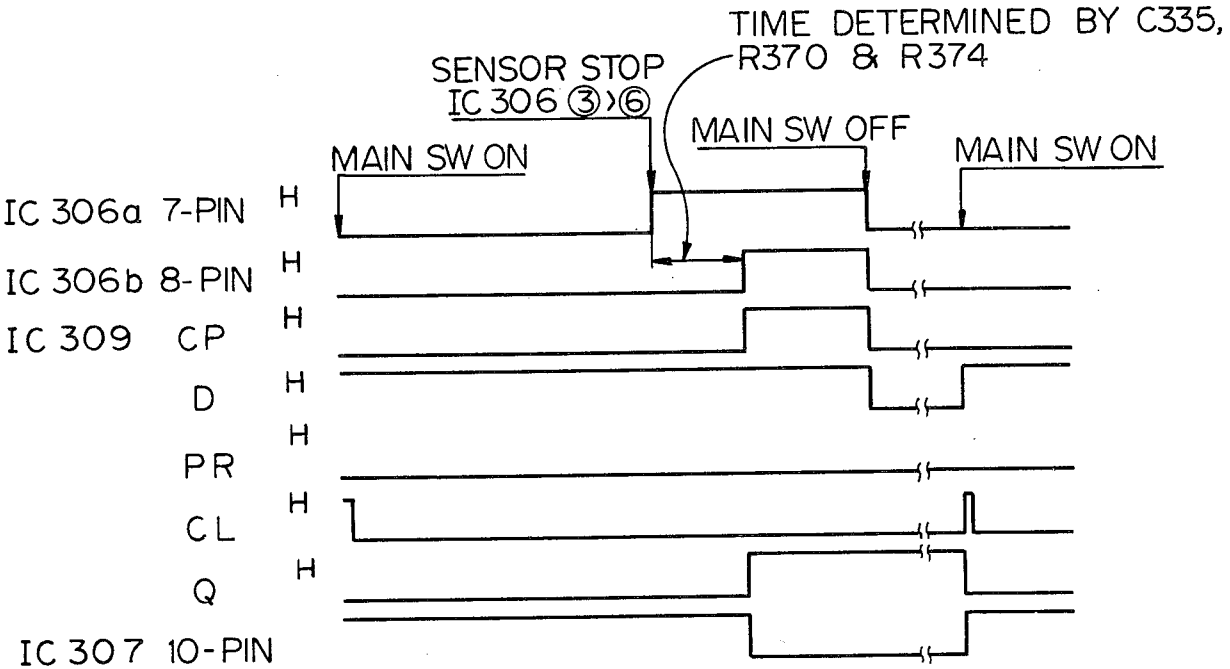

Reference will be made to FIG. 74 showing a sensor stop-up detection circuit and FIGS. 75 and 76 which are timing charts concerned with the circuit of FIG. 74, for explaining a procedure for detecting a stop-up of the toner density sensor.

When the power source is turned on, a capacitor C 327 is charged through a resistor R 338. Before the voltage charged in the capacitor C 327 exceeds a threshold level of an inverter IC 316, an output terminal 12-pin of the inverter IC 316 remains at a "H" level which is coupled to a CL input 309 10-pin of a flip-flop IC 309 to reset it. The flip-flop IC 309 serves as a circuit for memorizing a stop-up of the toner density sensor and memorizes a stop-up condition even after a developing operation has been interrupted and drawing of the developer stopped.

As the flow of the developer is fully stopped or almost stopped, an output voltage of the DC amplifier IC 305 coupled to an input 5-pin of a comparator IC **306*a* rises beyond a voltage at an input 6-pin of the comparator IC 306*a* which is a voltage divided by resistors R 312 and R 320. This makes the signal level at an output 7-pin of the comparator IC 306*a* "H". If in this instance the main motor is turned on, that is, the input level at the inverter IC 317 is "L" and the output level is "H" and if the developer agitating switch 26 is turned off, an output 3-pin of a NAND gate IC 314 is at a "L" level which renders a transistor Q 303 nonconductive so that a capacitor C 335 is charged through resistors R 370 and R 374. As the voltage charged in the capacitor C 335 increases beyond a voltage divided by resistors R 371 and R 362, the signal level at an output 8-pin of a comparator IC 306*b* changes from "L" to "H". This output of the comparator IC 306*b* is supplied to a CP input of the flip-flop IC 309** to set it (Q output becomes "H"), informing the display and machine control with the failure.

When an actual toner density is proper, the voltage at the 5-pin of the comparator IC **306*a* remains lower than the voltage at the 6-pin maintaining the output level at the 7-pin "L". Therefore, the output 8-pin of the comparator IC 306*b* is kept at the "L" level and the flip-flop IC 309 is not set. However, if the developing agitating switch 22 is turned on or the main motor 39 is turned off, either a 1-pin or a 2-pin of the NAND gate IC 314 is "L" and thus the 3-pin is "H" whereby the transistor Q 303 is turned on to release the charge from the capacitor C 335. As a result, a stop-up check on the toner density sensor is not carried out even though the signal level at the 7-pin output of the comparator IC 306*a* may be "H". The flip-flop IC 309** will be reset when the main switch changes its state from off to on.

A toner density control has been described in connection with a case wherein the flow of the developer through the bobbin 8 is fully or almost stopped. It will be seen that clogging of the bobbin can be detected in the same way when the developer is caused to stay within the bobbin. In such a case, the output voltage of the DC amplifier IC 305 will be lowered sufficiently beyond an output voltage under normal conditions. Thus, it suffices to compare an output voltage of the DC amplifier IC 305 with a predetermined reference voltage by a comparator. Details will be described later.

Figure 77:
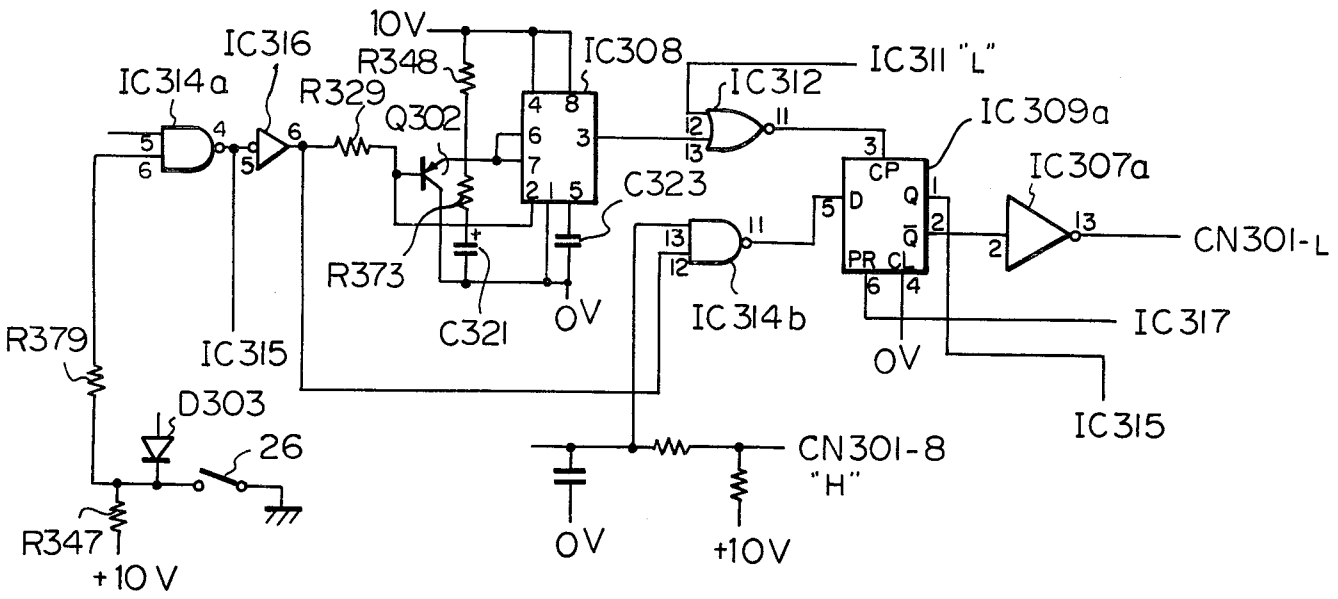
FIG. 77 is a circuit diagram of a toner end detector.
Figure 78:
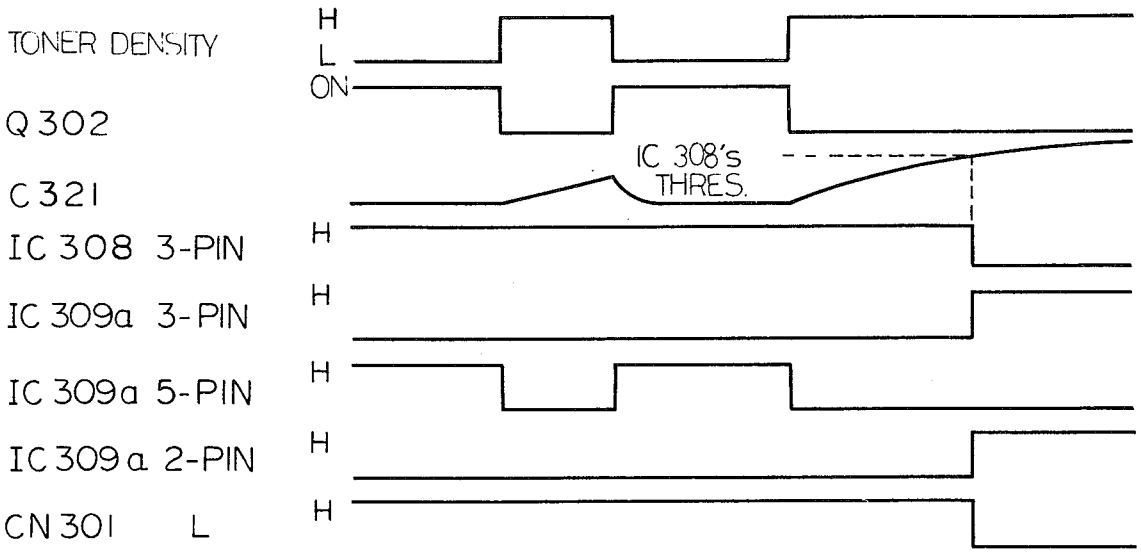
FIG. 78 is a timing chart showing an operation of the toner end detector.

FIG. 77 shows a toner end detection circuit and FIG. 78 is a timing chart demonstrating its operation.

When the toner density in the casing drops beyond a predetermined reference density, the voltage coupled from the DC amplifier IC 305 to the input 2-pin of the comparator IC 306 is lowered beyond the voltage at the input 3-pin (point ⓐ). This renders the output level of the comparator IC 306 "H" and this output is applied to an input 5-pin of a NAND gate IC **314*a*. Since the developer agitating switch 26 is turned off, an output 4-pin of the NAND gate IC 314*a* is "L" and a transistor Q 302 is nonconductive. Then a timer IC 308 is activated and, when the "H" output level of the comparator IC 306 lasts a given period of time determined by a capacitor C 321 and resistors R 348 and R 373, said "H" output changes into "H" output. At this instant, the signal level at an input 12-pin of a NOR gate IC 312 is "L" so that an output 12-pin of the NOR gate IC 312 turns from "L" to "H". A flip-flop IC 309*a* therefore has its $\overline{Q}$ terminal set to "H" level whereby a toner end signal is delivered through a transistor array IC 307*a*** to the display and machine body control.

An input 12-pin of a NAND gate IC **314*b* is connected with an output 6-pin of the inverter IC 316 and, therefore, at a "H" level. If the front cover 24 of the machine is closed, an input 13-pin of the NAND gate IC 314*b* is at a "H" level. Therefore, an output level of the NAND gate IC 314*b*** is "L" under these conditions.

Figure 79:
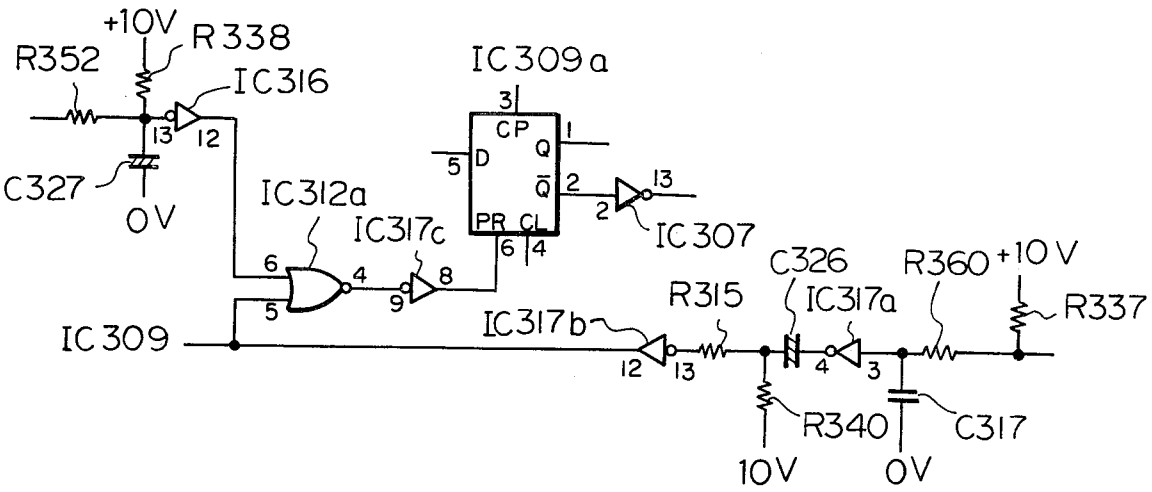
FIG. 79 is a circuit diagram of a toner end reset circuit.
Figure 80:
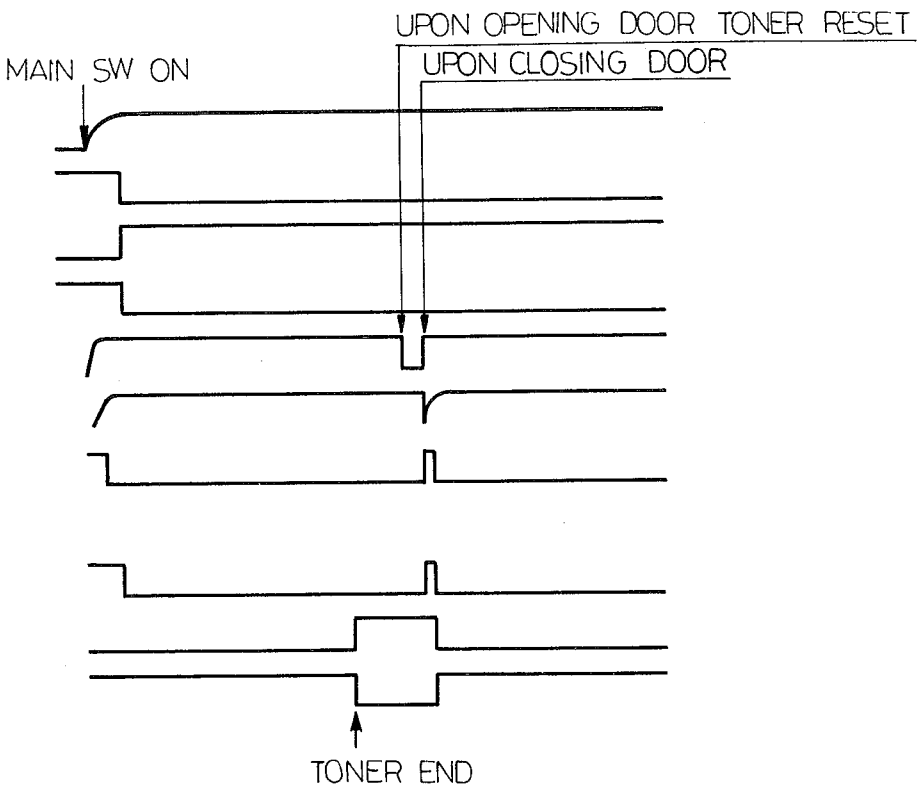
FIG. 80 is a timing chart showing an operation of the toner end reset circuit.

FIG. 79 indicates a toner end reset circuit and its operation is represented by a timing chart in FIG. 80. As shown, when the main switch is turned on or the front cover 18 of the machine is closed, a toner end reset signal is supplied to the toner end reset circuit for thereby resetting a toner end condition.

Figure 81:
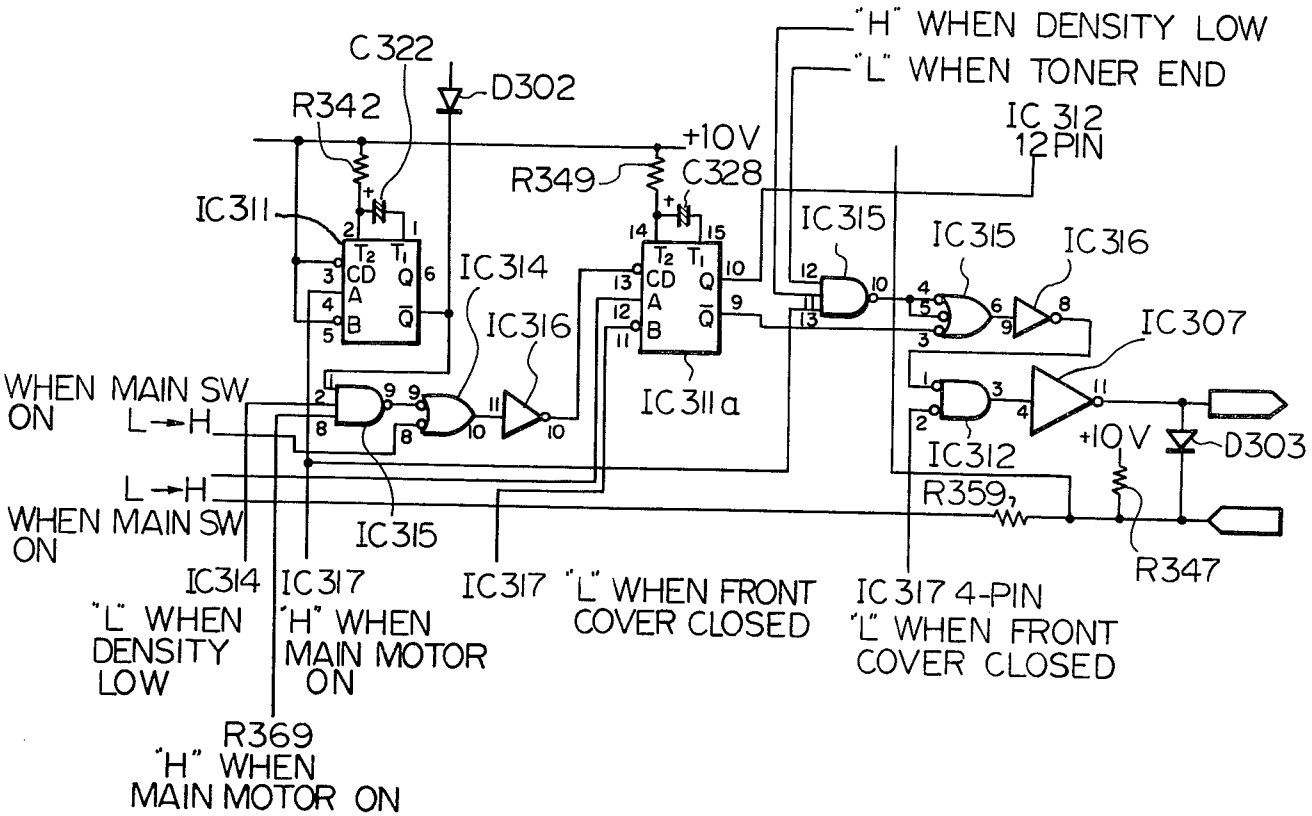
FIG. 81 is a circuit diagram of an initial main motor control.
Figure 82:
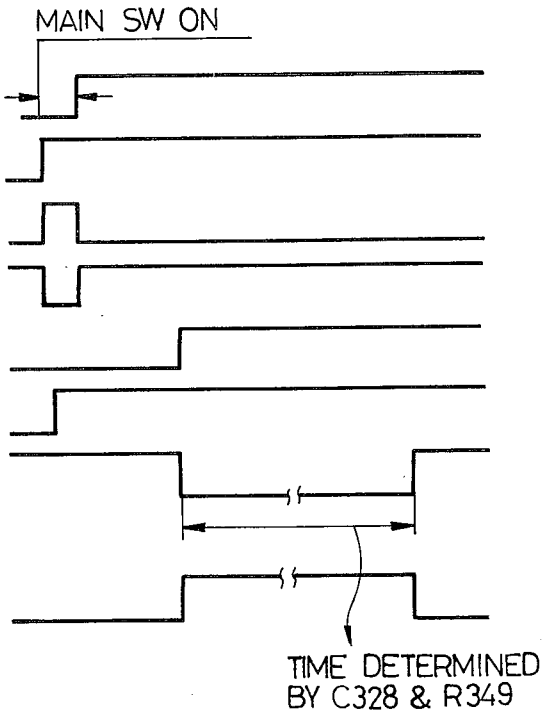
FIG. 82 is a timing chart showing an operation of the initial main motor control.

FIG. 81 is a circuit diagram showing an initial main motor control circuit while FIG. 82 is a timing chart corresponding to this circuit. This circuit functions to control the operation of the main motor 50 so that a toner density is detected for a toner density control when the main switch is turned on and that, when the front cover 18 is closed after a supply of a supplementary volume of toner which naturally requires opening of the front cover 18, the toner is safely supplied to increase an actual toner density to a normal level.

A monostable multivibrator IC **311*a* in FIG. 81 serves to determine an operating time of the main motor 50**.

When the power source is turned on, an integrator made up of the resistor R 338 and capacitor C 327 produces a pulse signal based on which the monostable multivibrator IC **311*a* is triggered. When the front cover 18 is closed, the monostable multivibrator IC 311*a* is triggered by a signal prepared by a differentiator which consists of the resistor 340 and capacitor C 326. While the monostable multivibrator IC 311*a* produces a pulse whose duration is determined by a maximum time period determined by a resistor R 349 and a capacitor C 328, it is reset by a reset circuit made up of the NAND gate IC 315, NOR gate IC 314 and inverter IC 316 when an actual toner density is determined high. Then the command to the main motor drive is stopped to thereby deactivate the motor 39**.

Furthermore, the toner density control method in the present invention will be described in detail hereinafter.

Figures 83, 83A:
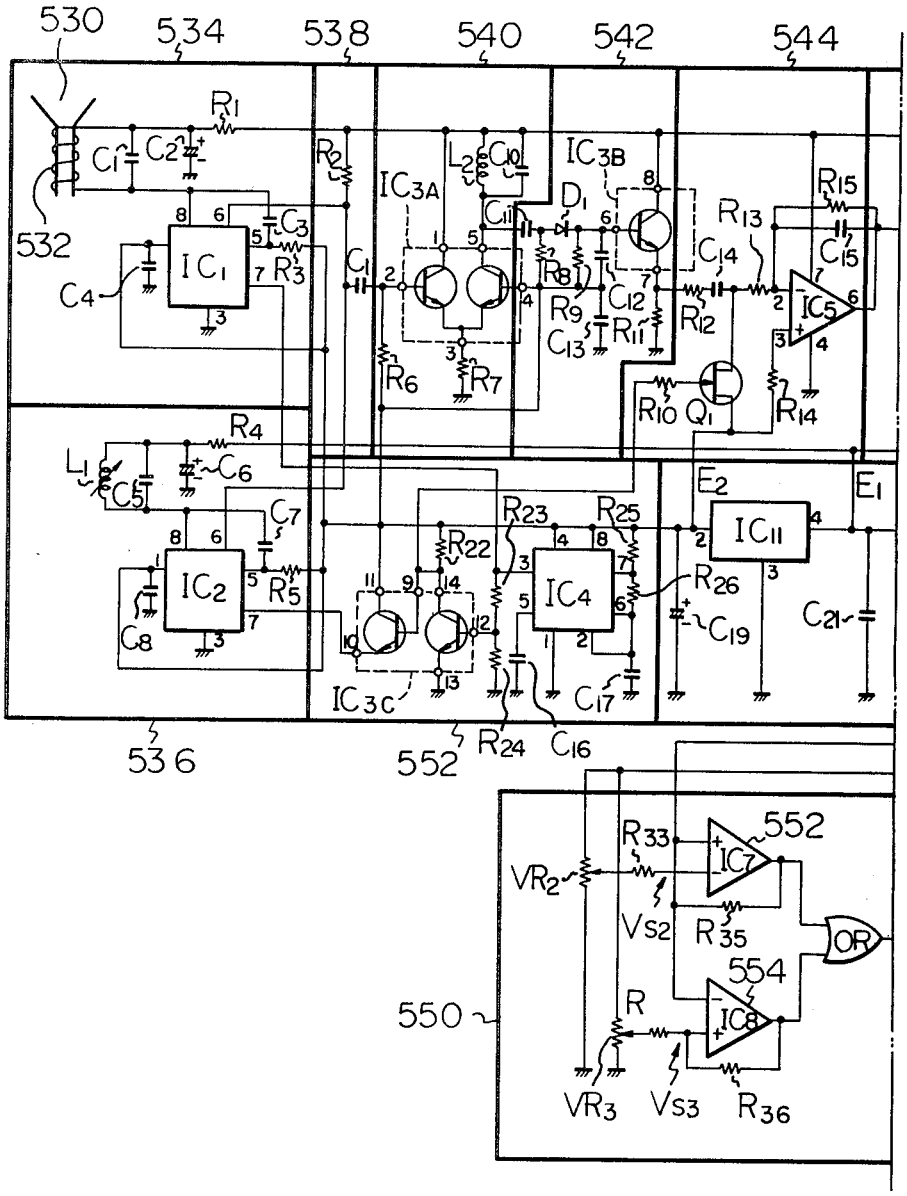
FIG. 83 is a circuit diagram of a toner density control.
Figure 83B:
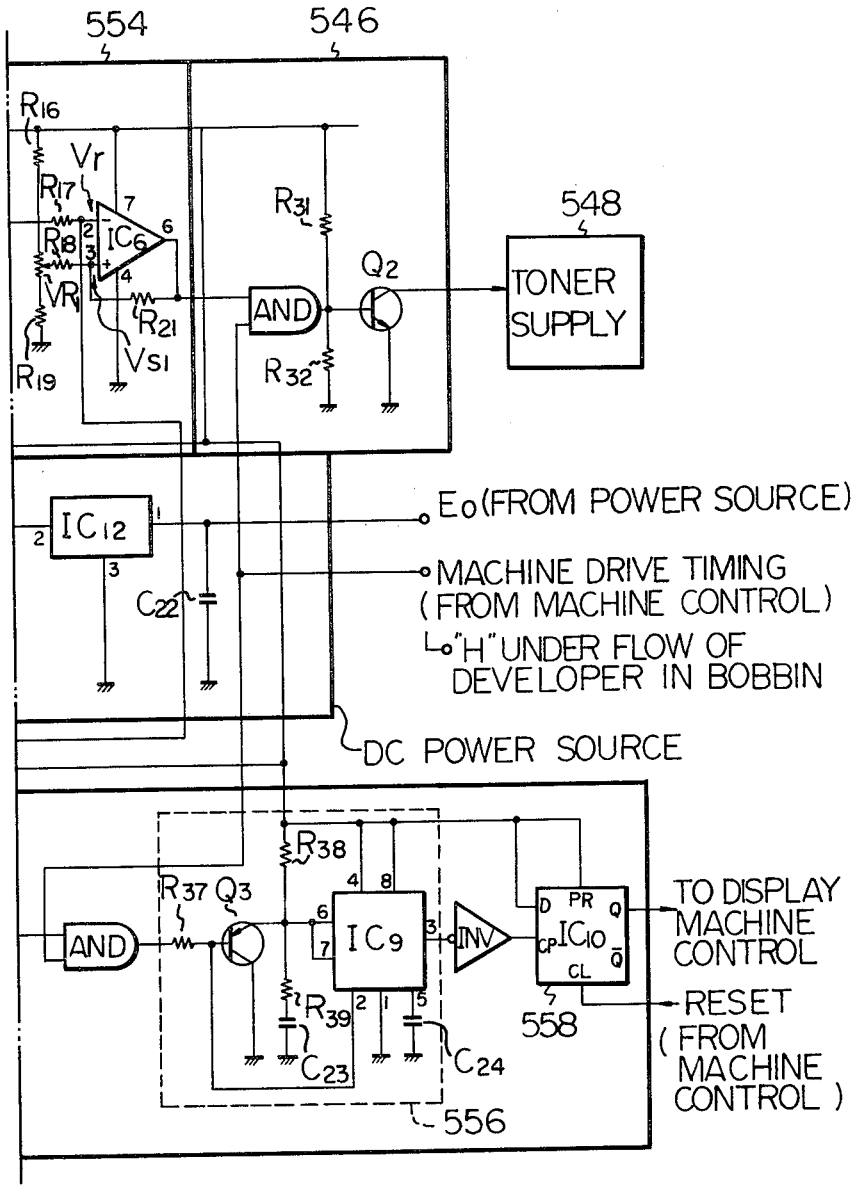

Referring to FIGS. 68 and 83, the sensor oscillator 534 comprises the funnel-shaped bobbin 530 and an oscillation circuit. A change of the inductance $L_r$ of the coil is reflected by a change of the output oscillation frequency $f_r$. A toner density attained through this change of the output oscillation frequency $f_r$ will be used as a first level of toner density. The oscillation frequency $f_r$ may be expressed as:

$$f_r = \frac{1}{2\pi\sqrt{L_r C_1}}$$

The reference oscillator 536 is essentially similar to the sensor oscillator 534 except that it does not involve a flow of the developer through a coil. An output frequency of the sensor oscillator $f_r$ is compared with an output frequency $f_s$ of the reference oscillator. An output frequency $f_s$ of the reference oscillator is also utilized to compensate for an initial drift and a drift attributable to temperature of an output frequency $f_r$ of the sensor oscillation circuit.

A multivibrator 552 is connected with the sensor oscillator 534 and reference oscillator 536 to change over their oscillation intervals. Another function of the multivibrator 552 is to clamp a portion of an input of the DC amplifier 544 based on the reference oscillation to a predetermined voltage. The adder 538 combines oscillation frequencies $f_r$ and $f_s$ and produces an AC component only through a coupling capacitor $C_9$. The integral amplifier 540 modulates its input frequency with respect to a voltage (amplitude) by reducing an amplitude amplification ratio as the input frequency differs more from a resonance frequency which is expressed as:

$$f_0 (= \frac{1}{2\pi\sqrt{L_2C_{10}}}$$

The detector 542 is adapted to process an output of the integral amplifier 540 on amplitude modulation basis. An amplified output of the detector 542 is passed through a coupling capacitor $C_{14}$ of the DC amplifier 544 so that a DC component of the input is picked up. At the same time, controlled by the multivibrator 552, the DC amplifier 544 forcibly clamps a signal component produced by the reference oscillator 536 to a predetermined voltage. Thus, the DC amplifier 552 produces a DC signal which is an inverted, integrated and amplified version of a difference between the two oscillators 534 and 536. The comparator 554 compares an output voltage $V_r$ of the DC amplifier 544 with the reference voltage $V_{s1}$ to control a supply of toner particles. A "H" level output of the comparator 287 indicates a drop of the toner density and urges the toner supply mechanism 548 to supplement the toner. The drive 546 amplifies an output of the comparator 554 for thereby driving the toner supply mechanism 548. The mechanism 548 includes an electromagnetic clutch, a motor and the like as well as a supply mechanism. The stop-up detector 550 includes a comparator 552 supplied with a reference voltage $V_{s2}$, a second comparator 554 supplied with a reference voltage $V_{s3}$, a timer 556, flip-flop 558 etc. The comparator 552 compares an output voltage $V_r$ of the DC amplifier 544 with the reference voltage $V_{s2}$ for checking a stop-up at the bobbin 530. As the bobbin 530 becomes clogged, the input voltage $V_r$ increases beyond a level $V_{r1}$ which will be supplied during normal operations of the toner density sensor. The voltage $V_r$ higher than the voltage $V_{r1}$ will be referred to as a voltage $V_{r2}$. The reference voltage $V_{s2}$ coupled to the comparator 552 is predetermined to be higher than the voltage $V_{r1}$ but lower than the voltage $V_{r2}$. In the event of a stop-up, the voltage $V_{r2}$ becomes higher than the reference voltage $V_{s2}$ making the output level of the comparator 552 "H". The other comparator 554 serves to compare an output voltage $V_r$ of the DC amplifier 544 with the reference voltage $V_{s3}$ for checking a stop-up at the bobbin 530. When the bobbin 530 is choked up, the voltage $V_r$ grows lower than the voltage $V_{r1}$ under normal conditions of the toner density sensor. The voltage $V_r$ higher than the voltage $V_{r1}$ will be referred to as a voltage $V_{r3}$. The reference voltage $V_{s3}$ coupled to the comparator 554 is predetermined to be higher than the voltage $V_{r3}$ but lower than the voltage $V_{r1}$. As the bobbin 530 becomes choked up, the voltage $V_{r3}$ is lowered beyond the reference level $V_{s3}$ turning the output level of the comparator 554 from "L" to "H". The toner densities thus measured by the comparators 552 and 554 will be used as second and third levels of toner density, respectively. An output of each comparator 552 or 554 is applied to the timer 556. The timer 556 normally produces a "H" output, but this output level turns into "L" when the input signal holds the "H" level over a given period of time dependent on the time constant of its C-R network. A "L" level output of the timer 556 sets the flip-flop 558 which then supplies an output to the display and machine body control. The timer 556 is effective to prevent a malfunction of the machine which will result from a relation $V_{s2} < V_{r2}$ or $V_{r3} < V_{s3}$ which may temporarily hold due to fluctuation of the flow of the developer. When the developing unit is in a stand-by state, the developer will not flow through the bobbin 530. An arrangement is made such that the timer 566 remains inoperative during a stand-by of the developing unit.

In summary, a toner density control method in this case eliminates a short or excessive supply of a toner which would adversely affect an image quality by measuring, apart from a usual first level of toner density, a second level of toner density and a third level of toner density each for checking a stop-up of a bobbin.

Figure 84:
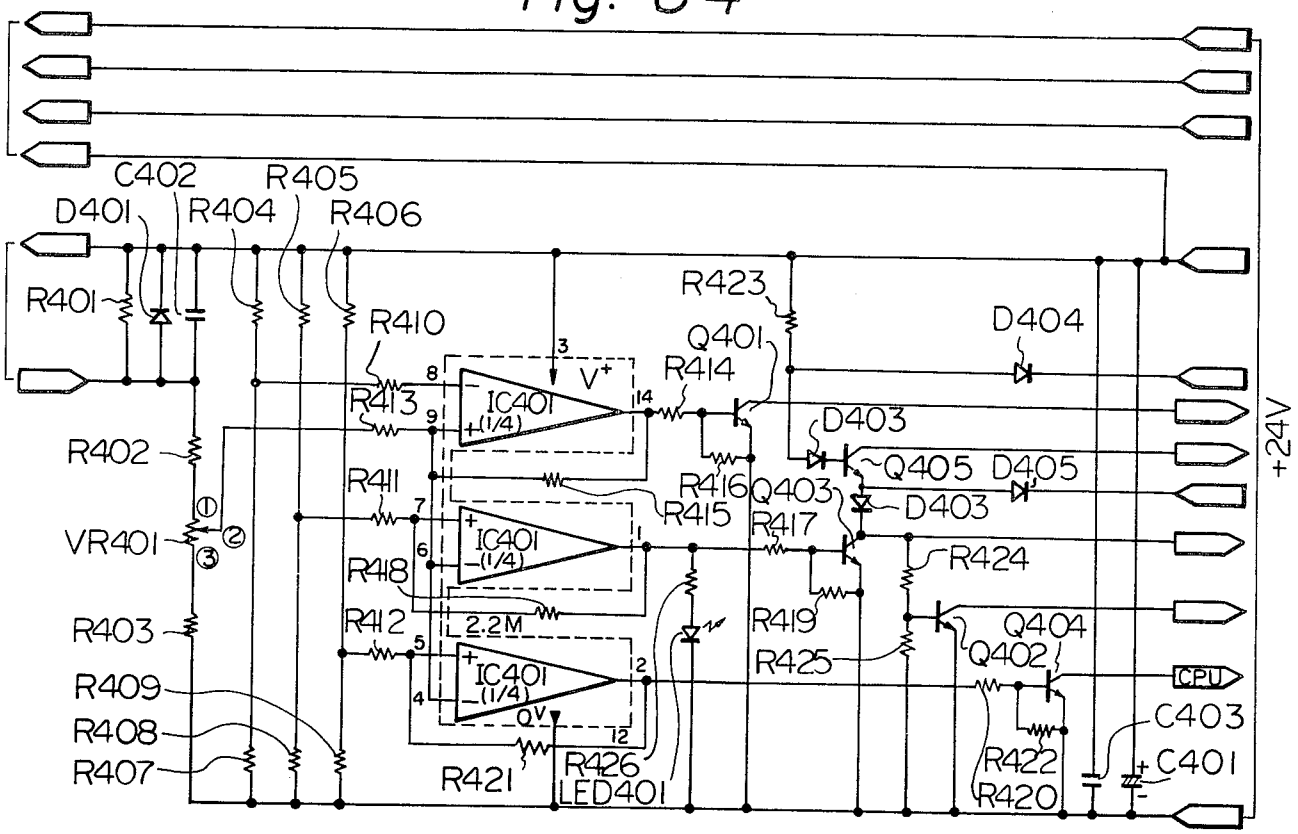
FIG. 84 is a circuit diagram of a fixing temperature control.
Figure 85:
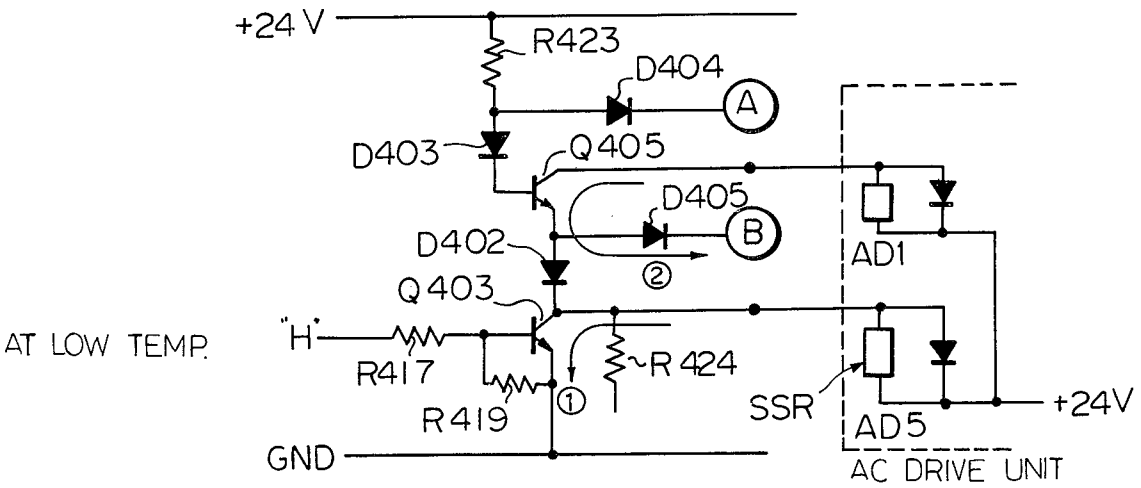
FIG. 85 is a circuit diagram of a lower heater temperature control.
Figure 86:
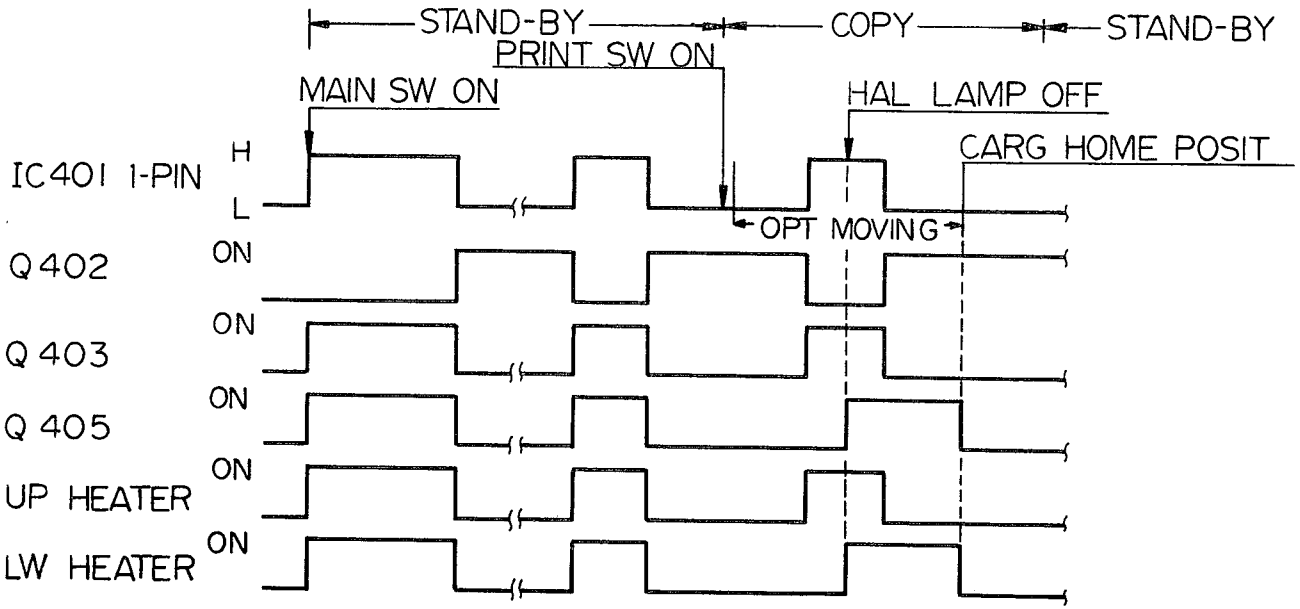
FIG. 86 is a timing chart for the control of a fixing temperature.

FIG. 84 shows a fixing temperature control circuit and FIG. 85 shows a lower heater control circuit. FIG. 86 is a timing chart indicating an operation of the fixing temperature control circuit.

The circuit depicted in FIG. 84 generally comprises a lower temperature sensing section, a temperature control section (upper heater 402), an upper temperature limit sensing section and a circuit for forcibly energizing the lower heater 406.

When an actual fixing temperature is lower than a predetermined lower limit 180° C. allowable for fixing operations, the thermistor 410 connected in parallel with a resistor R 401 for sensing a temperature at the fixing roller increases its resistance. Then a voltage at a terminal ② of a volume VR 401 is lowered beyond a lower limit reference voltage determined by resistors R 406 and R 409. More specifically, a comparator IC 401 determines a voltage at an input 4-pin lower than a voltage at an input 5-pin, producing a "H" output at its input 2-pin. This turns on a transistor Q 404 an output of which is coupled to the central processing unit CPU. Thus, if an actual fixing temperature is lower than the lower limit, a signal is applied from the transistor Q 404 to the central processing unit CPU to disenable printing actions. As the fixing temperature is elevated beyond 180° C., the voltage relation between the 5-pin and 4-pin of the comparator IC 401 is inverted so that a "L" output appears from the output 2-pin. This turns off the transistor Q 404 informing the central processing unit CPU of an increase in the actual fixing temperature above the lower limit.

The temperature control section will operate as follows. When an actual fixing temperature is below 195° C. which suffices for fixing operations, a resistance of the thermistor 186 is higher than a resistance at the fixing temperature of 195° C. Under this condition, a voltage at a ② terminal of the volume VR 401 is lower than a reference voltage determined by resistors R 405 and R 408. The comparator IC 401 judges a voltage at an input 6-pin lower than the voltage at an input 7-pin producing a "H" output at its output 1-pin. Then a transistor Q 403 is made conductive to turn on a light emitting diode LED 401 adapted to monitor operations of the heaters 402 and 406. The transistor Q 403 also turns on a transistor Q 405 and turns off a transistor Q 402. Then the transistor Q 403 energizes the upper heater 402 and the transistor Q 405 the lower heater 406. The transistor Q 402 turned off shows the central processing unit CPU that an actual fixing temperature is short of the reference level 195° C. Upon an increase in the temperature beyond 195° C., a voltage at the input 6-pin of the comparator IC 401 grows higher than the reference voltage at the input 7-pin, an output "L" appearing from the output 1-pin. Then the transistors Q 403 and Q 405 are turned off while the transistor Q 402 is turned on. The transistor Q 403 turned off deenergizes the upper heater 402, the transistor Q 405 turned off deenergizes the lower heater 406, and the transistor Q 402 turned on informs the central processing unit CPU of the rise of the temperature above 195° C. (a reload condition). Once a reload condition is set up, it is maintained until the actual temperature drops down to a level lower than the lower limit 180° C. It should be noted, however, the lower heater 406 is controlled in a different manner as will be described.

The upper temperature limit detecting section will operate as follows. When an actual temperature rises above a predetermined level 230° C. which is the thermal breakdown level of the rollers 404 and 408, the resistance of the thermistor 410 is reduced to increase a voltage at the ② terminal of the volume VR 401 beyond an upper limit reference voltage which is determined by resistors R 404 and R 407. The comparator IC 401 produces a "H" output at its output 14-pin because a voltage at an input 9-pin is higher than that at an input 8-pin. This turns on a transistor Q 401 an output of which is passed to the central processing unit CPU so as to produce a service call. Simultaneously, a power relay is turned off to kill the power source. If an actual fixing temperature is lower than 230° C., a voltage at the input 9-pin of the comparator IC 401 becomes lower than that at the input 8-pin. Then a "L" output appears from the output 14-pin which turns off the transistor Q 401.

The lower heater control section will operate as follows in the course of copying cycles. To save power consumption, the lower heater 406 is controlled independently of the upper heater 402. In FIG. 85, a point Ⓐ is connected to a turn-on timing signal for the halogen lamp 168 such that a voltage at the circled point Ⓐ is "L" when the lamp 168 is turned on. Therefore, while the lamp 168 is turning on, the transistor Q 405 is turned off to deenergize a lower heater drive relay $AD_1$ and thereby the lower heater 406. A point Ⓑ is connected to an operation timing signal for the return clutch 250 and, thus, becomes "L" in voltage level during an operation of the return clutch 250. Accordingly, when the halogen lamp 168 is turned off and the return clutch 250 is coupled to return the carriage 178 to the home position, the transistor Q 405 is rendered conductive to energize the lower heater drive relay $AD_1$ and thereby the lower heater 406.

In this way, the lower heater 406 is controlled regardless of a temperature detected by the thermistor 410 throughout copying cycles by timing signals supplied to the halogen lamp 168 and return clutch 250.

The circuitry of FIG. 85 additionally includes a relay $AD_5$ for driving the upper heater 402.

Figure 87:
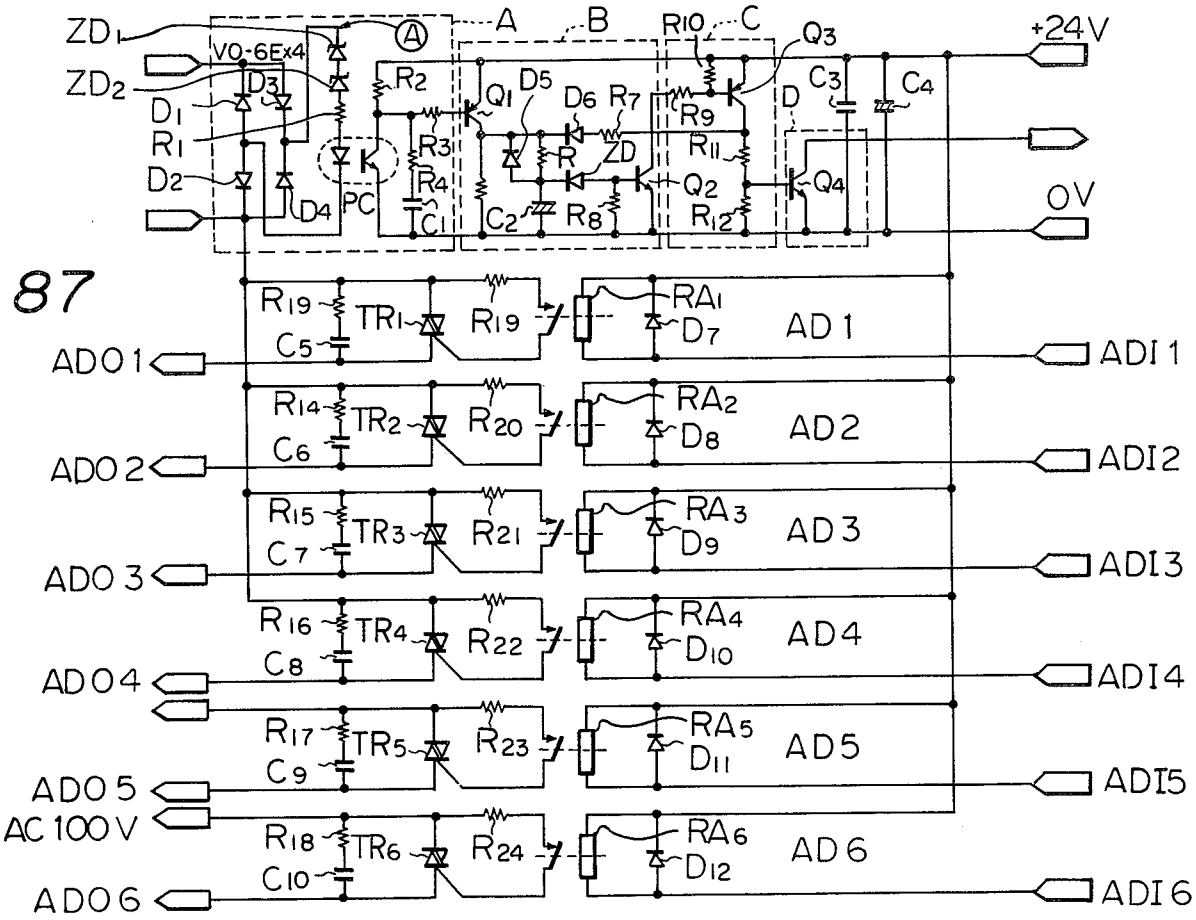
FIG. 87 is a circuit diagram of an AC drive and lamp turn-on detector.
Figure 88:
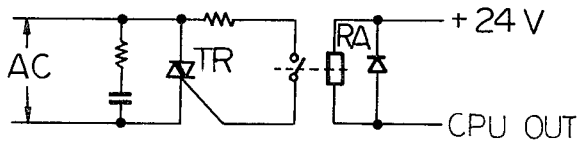
FIG. 88 is a circuit diagram showing a part of the AC drive and lamp turn-on detector.
Figure 89:
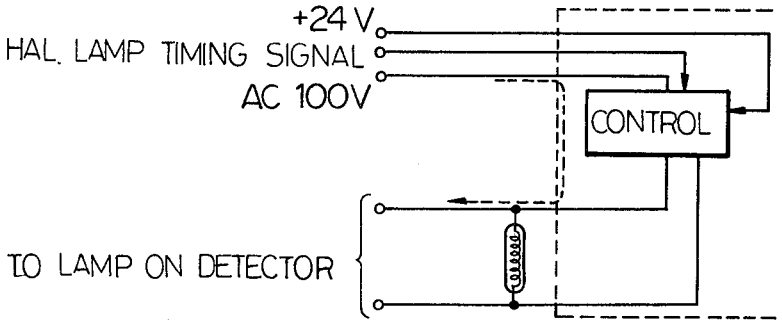
FIG. 89 is a circuit diagram of a lamp turn-on circuit.
Figure 90:
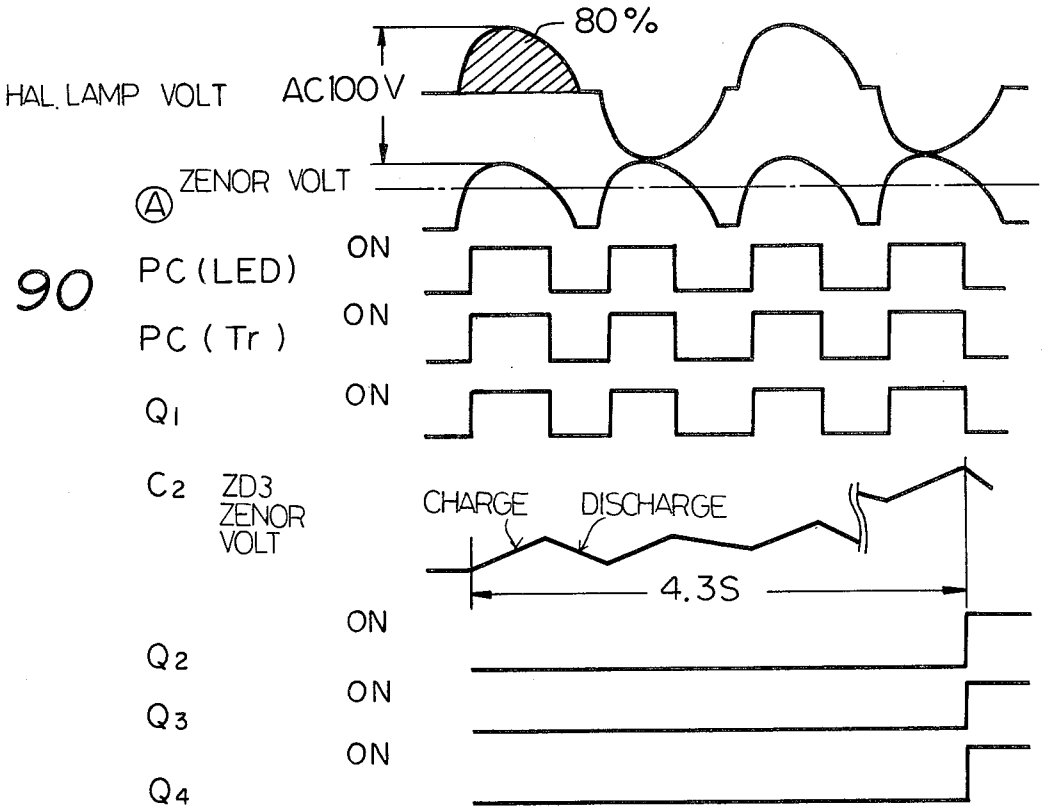
FIG. 90 is a timing chart showing an operation the lamp turn-on detector.

FIG. 87 shows a circuit for AC drive and lamp turn-on detection and FIG. 88 indicates an essential part of the circuit in detail. FIG. 89 shows a lamp turn-on circuit. A timing chart indicated in FIG. 90 demonstrates an operation of the lamp turn-on detection circuit.

In FIG. 87, input terminals $ADI_1$–$ADI_6$ are connected with the central processing unit CPU so as to be supplied with signals therefrom at predetermined timings. These input terminals $ADI_1$–$ADI_6$ are individually connected to relays $RA_1$–$RA_6$ which function to trigger load driving Triacs $TR_1$–$TR_6$, respectively. The lamp turn-on detection circuit is designed to turn off the power relay while producing a service call when detected an endless turn-on of the halogen lamp 168 or a cut-off of its associated wiring. As shown in FIG. 87, this circuit consists of a lamp turn-on and wire cut-off detector section A, a timer section B, a holding section C and an output section D.

Figures 91, 91A, 91B:
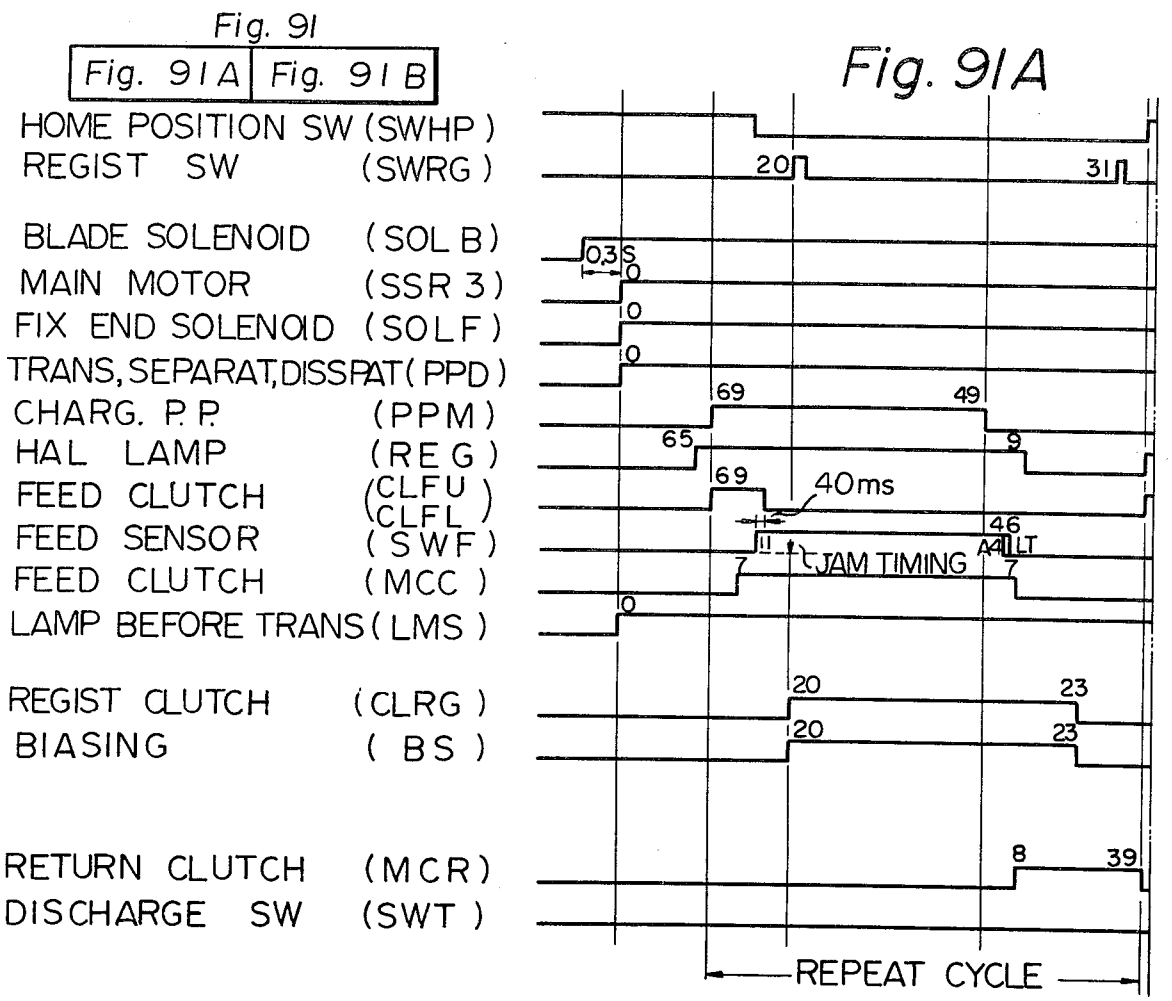
FIG. 91 is a timing chart showing an operation of the copying machine.
Figure 91B:
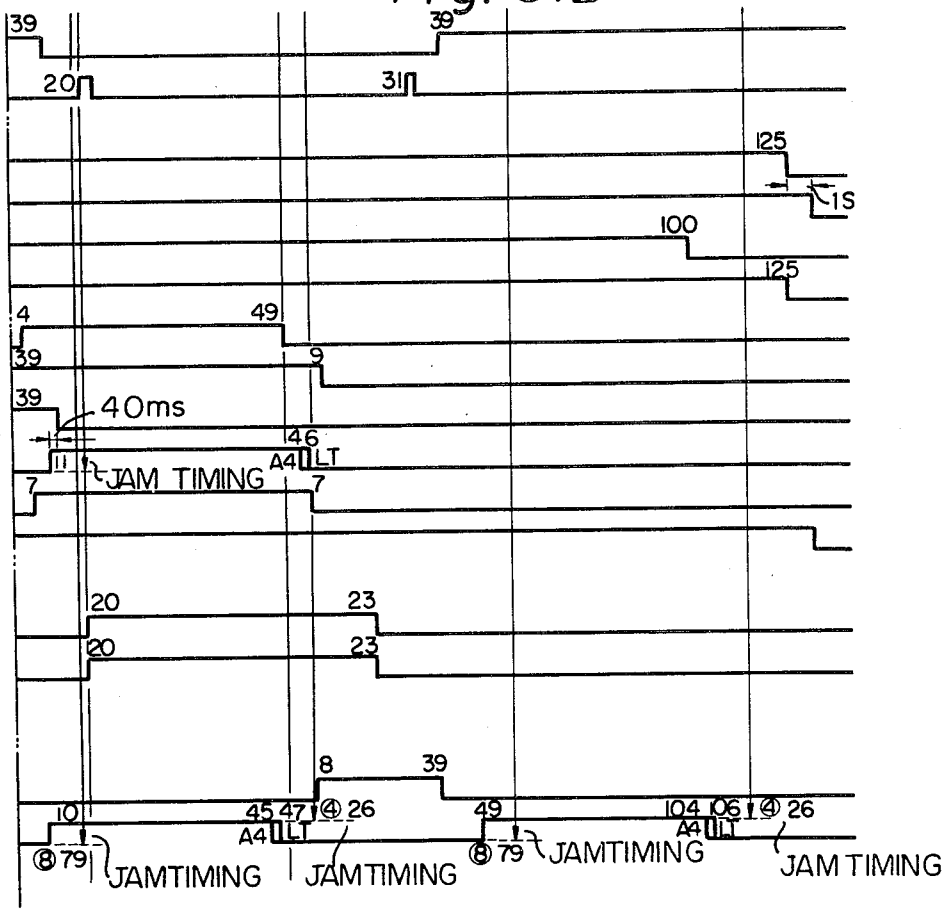

A timing chart indicated in FIG. 91 represents a general operation of the copying machine described hereinabove.

The above description will suffice to clarify the construction and arrangement of an electrophotographic copying machine to which the present invention is applicable.

The following pages will indicate Table 1 which is a program list of the 1-chip $IC_1$ shown in FIG. 38 and Table 2 which is a program list for the other 1-chip $IC_2$.

Table 1

```
STNO E ADRS OBJ.     SOURCE STATEMENTS

0001                 ;
0002                 ;
0003                 ;   EMO90-M    (MF2)
0004                 ;
0005                 ; < MAIN SEQUENCE CONTROL >
0006                 ;
0007                 ;      1979.11.1
0008                 ;
0009                 ;                BY A. KATSUMATA
0010                 ;
0011                 ;******
0012                 ;
0013                 ;  DATA MEMORY ADRS IDENTIFIERS
0014                 ;
0015                 ;
0016                 ; * INPUT & OUTPUT *
0017                 ;
0018   0000          SINB1    EQU    00H
0019                 ;
0020   0001          INB0     EQU    01H
```

```
STNO E ADRS OBJ.    SOURCE STATEMENTS

0021   0011         INB1    EQU   11H
0022   0021         INB2    EQU   21H
0023                ;
0024   0002         OUTC0   EQU   02H
0025   0012         OUTC1   EQU   12H
0026   0022         OUTC2   EQU   22H
0027   0032         OUTC3   EQU   32H
0028                ;
0029   0013         OUTD    EQU   13H
0030                ;
0031   0005         OUTF0   EQU   05H
0032   0015         OUTF1   EQU   15H
0033   0025         OUTF2   EQU   25H
0034   0035         OUTF3   EQU   35H
0035                ;
0036   0006         OUTG    EQU   06H
0037                ;
0038   0007         OUTH    EQU   07H
0039                ;
0040   0008         OUTI    EQU   08H
0041                ;
0042   0009         INA0    EQU   09H
0043   0019         INA1    EQU   19H
0044   0029         INA2    EQU   29H
0045   0039         INA3    EQU   39H
0046   0028         INA6    EQU   28H
0047   0038         INA7    EQU   38H
0048                ;
0049                ; * FLAG *
0050                ;
0051   001A         CNDT    EQU   1AH
0052                ;
0053   0003         F1      EQU   03H
0054   0004         F2      EQU   04H
0055   000A         F3      EQU   0AH
0056   0017         F4      EQU   17H
0057   0027         F5      EQU   27H
0058   002A         F6      EQU   2AH
0059   0034         F7      EQU   34H
0060                ;
0061   0079         FLAG    EQU   79H
0062                ;
0063                ; * PULSE COUNTER *
0064                ;
0065   000C         PLSCN   EQU   0CH
0066   001C         PLSC1   EQU   1CH
0067   002C         PLSC2   EQU   2CH
0068   003C         PLSC3   EQU   3CH
0069   004A         PLSC4   EQU   4AH
0070                ;
0071                ; * T COUNTER *
0072                ;
0073   0037         TCNT    EQU   37H
0074                ;
0075                ; * TIMER COUNTER *
0076                ;
0077   000F         TM1     EQU   0FH ; SSR3-Q.3S,2S,J-500MS,
                                         J1-1
```

```
STNO E ADRS OBJ.    SOURCE STATEMENTS

0078   001F         TM2      EQU   1FH ; HP-1.5S,RG-500MS
0079   002F         TM3      EQU   2FH ; CL-40MS, F-150MS
0080   003F         TM4      EQU   3FH ; PLS 200MS
0081   004F         TM5      EQU   4FH ; 60S, 6MIN
0082                ;
0083   000D         TM1B     EQU   TM1-2 ; BOTTOM OF TIMER
0084   001D         TM2B     EQU   TM2-2
0085   002E         TM3B     EQU   TM3-1
0086   003E         TM4B     EQU   TM4-1
0087   004B         TM5B     EQU   TM5-4
0088                ;
0089   003D         RGCNT    EQU   3DH
0090                ;
0091                ; * REGISTER *
0092                ;
0093   003A         W1       EQU   3AH
0094                ;
0095   007A         RGZ      EQU   7AH
0096   007B         RGW      EQU   7BH
0097   007C         RGS      EQU   7CH
0098   007D         RGR      EQU   7DH
0099   007E         RGY      EQU   7EH
0100   007F         RGX      EQU   7EH
0101                ;******
0102                ;
0103                ;  DATA MEMORY BIT IDENTIFIERS
0104                ;
0105                ;
0106                ; *INPUT & OUTPUT *
0107                ;  @-MINUS LOGIC MARK
0108                ;
0109   0000         SI       EQU   0      ; INBO
0110   0001         KS       EQU   1
0111   0003         SWF@     EQU   3
0112                ;
0113   0000         KT       EQU   0      ; INBA,SINB1
0114   0001         RD       EQU   1
0115                ;
0116   0003         ?FIX     EQU   3      ; SINB1
0117                ;
0118   0000         CP       EQU   0      ; INB2
0119   0001         ST       EQU   1
0120                ;
0121   0000         LMPU     EQU   0      ; OUTC0
0122   0001         LMW      EQU   1
0123   0002         CNX      EQU   2
0124   0003         CN       EQU   3
0125                ;
0126   0000         LMPL     EQU   0      ; OUTC1
0127   0002         OCLM     EQU   2
0128   0003         OK       EQU   3
0129                ;
0130   0000         LM1      EQU   0        ; OUTC2
0131   0001         LM2      EQU   1
0132   0002         LM3      EQU   2
0133   0003         LM4      EQU   3
0134                ;
```

```
STNO E ADRS OBJ.    SOURCE STATEMENTS

0135   0000         LM5     EQU   0        ; OUTC3
0136   0001         LM6     EQU   1
0137   0002         LM7     EQU   2
0138   0003         LM8     EQU   3
0139                ;
0140   0000         MTR     EQU   0        ; OUTD
0141   0001         CPX     EQU   1
0142   0002         CNT     EQU   2
0143   0003         SSR1    EQU   3
0144                ;
0145   0000         MCC     EQU   0        ; OUTF0
0146   0001         MCD     EQU   1
0147   0002         MCR     EQU   2
0148   0003         LMS     EQU   3
0149                ;
0150   0000         PPM     EQU   0        ; OUTF1
0151   0001         PPD     EQU   1
0152   0002         LMKS    EQU   2
0153   0003         REG     EQU   3
0154                ;
0155   0000         CLRG    EQU   0        ; OUTF2
0156   0001         CLFL    EQU   1
0157   0002         CLFU    EQU   2
0158   0003         PR      EQU   3
0159                ;
0160   0000         PT      EQU   0        ; OUTF3
0161   0001         SOLJ1   EQU   1
0162   0002         SOLJ2   EQU   2
0163   0003         SOLB    EQU   3
0164                ;
0165   0000         KC      EQU   0        ; OUTG
0166   0001         SOLBS   EQU   1
0167   0002         USC     EQU   2
0168   0003         SOLF    EQU   3
0169                ;
0170   0000         LMK     EQU   0        ; OUTH
0171   0001         TR      EQU   1
0172   0002         SSR3    EQU   2
0173   0003         BS      EQU   3
0174                ;
0175   0000         SWEX    EQU   0        ; INA0
0176   0001         SWU     EQU   1
0177   0002         SWX     EQU   2
0178   0003         SWZ     EQU   3
0179                ;
0180   0000         SWJM    EQU   0
0181   0001         SWLM    EQU   1        ; INA1
0182   0002         SWT     EQU   2
0183   0003         SWHP@   EQU   3
0184                ;
0185   0000         SU0     EQU   0        ; INA2
0186   0001         SU1     EQU   1
0187   0002         SU2     EQU   2
0188   0003         PU      EQU   3
0189                ;
0190   0000         SL0     EQU   0        ; INA3
0191   0001         SL1     EQU   1
```

```
STNO E ADRS OBJ.    SOURCE STATEMENTS

0192   0002         SL2     EQU   2
0193   0003         PL      EQU   3
0194                ;
0195   0000         AF@     EQU   0        ; INA6
0196   0001         T@      EQU   1
0197   0002         TN@     EQU   2
0198   0003         SWRG    EQU   3
0199                ;
0200   0000         M@      EQU   0        ; INA7
0201   0001         LD@     EQU   1
0202   0002         TH1@    EQU   2
0203   0003         TH2@    EQU   3
0204                ;
0205                ; * FLAG *
0206                ;
0207   0000         ?N      EQU   0        ; F1
0208   0001         ?Q      EQU   1
0209   0002         ?T      EQU   2
0210   0003         ?H      EQU   3
0211                ;
0212   0000         ?Z      EQU   0        ; F2
0213   0001         ?PS     EQU   1
0214   0002         ?CPS    EQU   2
0215   0003         ?J1     EQU   3
0216                ;
0217   0000         ?THP    EQU   0        ; F3
0218   0001         ?T2S    EQU   1
0219   0002         ?S      EQU   2
0220   0003         ?T1S    EQU   3
0221                ;
0222   0000         ?CPY    EQU   0        ; F4
0223   0001         ?CPZ    EQU   1
0224   0002         ?CPW    EQU   2
0225                ;
0226   0000         ?ST     EQU   0        ; F5
0227   0001         ?TN1    EQU   1
0228   0002         ?TN2    EQU   2
0229   0003         ?CN     EQU   3
0230                ;
0231   0000         ?JM     EQU   0        ; F6
0232   0001         ?JZ     EQU   1
0233   0002         FGM     EQU   2
0234   0003         FGMA    EQU   3
0235                ;
0236   0000         FGFJ    EQU   0        ; F7
0237   0001         FGTJ    EQU   1
0238                ;
0239   0000         FGXX    EQU   0        ; FLAG
0240   0001         FGXY    EQU   1
0241   0002         RGXX    EQU   2
0242   0003         RGXY    EQU   3
0243                ;
0244                ; * PULSE COUNTER *
0245                ;
0246   0003         PSET    EQU   3
0247                ;
0248                ; * T COUNTER *
```

```
STNO E ADRS OBJ.    SOURCE STATEMENTS

0249                ;
0250   0003         TSET    EQU   PSET
0251                ;
0252                ; * TIMER *
0253                ;
0254   0002         TMON    EQU   2        ; TIMER ON
0255   0003         TMOUT   EQU   3        ; TIME OUT
0256                ;******
0257                ;
0258                ;  CONDITION IDENTIFIERS
0259                ;
0260   0003         CDB1    EQU   3
0261   0007         CDB2    EQU   7
0262   0005         CDC     EQU   5
0263   0006         CDE     EQU   6
0264   0001         CDF     EQU   1
0265   0004         CDG1    EQU   4
0266   0002         CDG2    EQU   2
0267                ;******
0268                ;
0269                ;  FIRST VALUES OF TIMER - IDENTIFIERS
0270                ;
0271                ;
0272                ; * LOOP TIME - MS *
0273                ;
0274                ;  TSCN=SCAN LOOP TIME
0275                ;  TRGC=RGCHK LOOP TIME
0276                ;  (TSCN=8.8MS, TRGC=1.7MS)
0277                ;
0278                ; * TM1 *
0279                ;
0280                ;  TP3SC=800H-300/TSCN
0281                ;
0282   07DE         TP3SC   EQU   2014
0283   0007         TP31    EQU   TP3SC SHR 8
0284   000D         TP32    EQU   TP3SC SHR 4 AND 0FH
0285   000E         TP3B    EQU   TP3SC AND 0FH
0286                ;
0287                ;  T2SC=800H-2000/TSCN
0288                ;
0289   071D         T2SC    EQU   1821
0290   0007         T2S1    EQU   T2SC SHR 8
0291   0001         T2S2    EQU   T2SC SHR 4 AND 0FH
0292   000D         T2SB    EQU   T2SC AND 0FH
0293                ;
0294                ;  TJ=800H-500/TSCN
0295                ;
0296   07C7         TJ      EQU   1991
0297   0007         TJ1     EQU   TJ SHR 8
0298   000C         TJ2     EQU   TJ SHR 4 AND 0FH
0299   0007         TJB     EQU   TJ AND 0FH
0300                ;
0301                ;  T1SC=800H-1000/TSCN
0302                ;
0303   078E         T1SC    EQU   1934
0304   0007         T1S1    EQU   T1SC SHR 8
0305   0008         T1S2    EQU   T1SC SHR 4 AND 0FH
```

```
STNO E ADRS OBJ.    SOURCE STATEMENTS

0306   000E         T1SB     EQU   T1SC AND 0FH
0307                ;
0308                ; * TM2 *
0309                ;
0310                ;  THP=800H-1500/TSCN
0311                ;
0312   0756         THP      EQU   1878
0313   0007         THP1     EQU   THP SHR 8
0314   0005         THP2     EQU   THP SHR 4 AND 0FH
0315   0006         THPB     EQU   THP AND 0FH
0316                ;
0317                ;  TRG=800H-500/TRGC
0318                ;
0319   06DA         TRG      EQU   1754
0320   0006         TRG1     EQU   TRG SHR 8
0321   000D         TRG2     EQU   TRG SHR 4 AND 0FH
0322   000A         TRGB     EQU   TRG AND 0FH
0323                ;
0324                ; * TM3 *
0325                ;
0326                ;  TCL=80H-40/TRGC
0327                ;
0328   0068         TCL      EQU   104
0329   0006         TCL1     EQU   TCL SHR 4
0330   0008         TCLB     EQU   TCL AND 0FH
0331                ;
0332                ;  TF=80H-150/TSCN
0333                ;
0334   006F         TF       EQU   111
0335   0006         TF1      EQU   TF SHR 4
0336   000F         TFB      EQU   TF AND 0FH
0337                ;
0338                ; * TM4 *
0339                ;
0340                ;  TPLS=80H-200/TSCN+1
0341                ;
0342   006A         TPLS     EQU   106
0343   0006         TPL1     EQU   TPLS SHR 4
0344   000A         TPLB     EQU   TPLS AND 0FH
0345                ;
0346                ; * TM5 *
0347                ;
0348                ;  T60SC=80000H-60000/TSCN
0349                ;
0350   E55E         T60SC    EQU   517470
0351   0007         T601     EQU   07H      ; T60SC SHR 16
0352   000E         T602     EQU   0EH      ; T60SC SHR 12
                                               AND 0FH
0353   0005         T603     EQU   05H      ; T60SC SHR 8
                                               AND 0FH
0354   0005         T604     EQU   05H      ; T60SC SHR 4
                                               AND 0FH
0355   000E         T60B     EQU   0EH      ; T60SC AND 0FH
0356                ;
0357                ;
0358                ;  *** T6M=80000H-360000/TSCN
0359                ;
```

```
STNO E ADRS OBJ.     SOURCE STATEMENTS

0360   7081          T6MSC   EQU   487553
0361   0007          T6M1    EQU   07H      ; T6MSC SHR 16
0362   0007          T6M2    EQU   07H      ; T6MSC SHR 12
                                              AND 0FH
0363   0000          T6M3    EQU   00H      ; T6MSC SHR 8
                                              AND 0FH
0364   0008          T6M4    EQU   08H      ; T6MSC SHR 4
                                              AND 0FH
0365   0001          T6MB    EQU   01H      ; T6MSC AND 0FH
0366                 ; * RGCNT *
0367                 ;
0368                 ;  TSCR=16-TSCN/TRGC
0369                 ;
0370   000B          TSCR    EQU   0BH
0371                 ;******
0372                 ;
0373                 ;  *** START
0374                 ;
0375   0000                  ORG   0
0376                 ;
0377                 ;
0378                 ;  PORT & LATCH ALL CLEAR
0379                 ;
0380   0000 AFB3            CAL   PNLAL
0381                 ;
0382                 ;  DATA MEMORY CLEAR
0383                 ;
0384   0002 80              LDZ   0
0385   0003 AFC0            CAL   RCLR     : DPH=0,1,2,3 CLEAR
0386   0005 1540            LDI   40H
0387   0007 AFC0            CAL   RCLR     ; DPH=4,7 CLEAR
0388                 ;
0389   0009 AD67            CAL   STOP3
0390                 ;
0391                 ;
0392                 ;  *** LOOP ENTRY - A1
0393                 ;
0394   000B                ORG   0CH
0395                 ;
0396                 A1:
0397   000C 1512            LDI   OUTC1
0398   000E 6B              RMB   OK       ; RESET OK
0399                 ;
0400   000F 82              LDZ   OUTC0
0401   0010 79              SMB   LMW      ; SET LAMP-M
0402                 ;
0403                 ; *** LOOP ENTRY - A
0404                 ;
0405   0011                ORG   14H
0406                 ;
0407                 A:
0408   0014 80              LDZ   SINB1
0409   0015 6B              RMB   ?FIX     ; RESET MR-FIX(NO FIX
                                              KT, RD)
0410                 ;
0411   0016 A100            JMP   A00
0412                 ;******
0413                 ;
```

```
STNO E ADRS OBJ.    SOURCE STATEMENTS

0414                ;  ERR ENTRY - T1, T2, T
0415                ;
0416   0018                 ORG   18H
0417                ;
0418                T1:
0419   0018 1525           LDI   OUTF2
0420   001A 7B             SMB   PR        ; SET PR
0421   001B DE             JCP   T
0422                ;
0423                T2:
0424   001C 86             LDZ   OUTG
0425   001D 7A             SMB   USC       ; SET USC
0426                ;
0427   001E A430     T:    JMP   E
0428                ;******
0429                ;
0430                ;  SUBROUTINE AREA
0431                ;
0432                ;
0433                ; *** JUDGE PULSE NUMBER
0434                ;
0435   0020                 ORG   24H
0436                ;
0437                JPLSCN:
0438   0024 46             TLY             ; RESTORE DPL=LOW
                                             DIGIT
0439                ;
0440   0025 8C             LDZ   PLSCN
0441   0026 A500           JMP   JP00
0442                ;
0443                ; *** PULSE COUNTER CLEAR
0444                ;
0445   0028                 ORG   28H
0446                ;
0447                PLCRA:
0448   0028 8C             LDZ   PLSCN
0449                ;
0450                PLC1:
0451   0029 98             LI    8         ; SET PSET (BIT3)
0452   002A 2C             XD
0453   002B 90             CLA
0454   002C 02             S
0455   002D 48             RT
0456                ;
0457                ; *** COUNT TIMER
0458                ;
0459   002E                 ORG   30H
0460                ;
0461                CNTT:
0462   0030 157F           LDI   RGX
0463   0032 02             S               ; (X)=DPH OF TIMER
0464                ;
0465   0033 9E             LI    TM3B AND 0FH
0466                ;
0467   0034 5A             TMB   2         ; DPH=4 ?
0468   0035 F8             JCP   CNT0      ; N
0469                ;
```

```
STNO E ADRS OBJ.    SOURCE STATEMENTS

0470   0036 9B              LI     TM5B AND 0FH     ; Y
0471   0037 FA              JCP    CNT1
0472                 ;
0473                 CNT0:
0474   0038 59              TMB    1          ; DPH=2 OR 3 ?
0475   0039 9D              LI     TM1B AND 0FH     ; N
0476                 ;
0477                 CNT1:
0478   003A A519            JMP    CNT2
0479                 ;
0480                 ; *** SCAN
0481                 ;
0482   003C                ORG    3CH
0483                 ;
0484                 SCAN:
0485                 ;
0486                 ;  ALL INPUT & OUTPUT
0487                 ;  CONDITION SET
0488                 ;
0489   003C AF00            CAL    INOUT
0490                 ;
0491                 ;  MR-ST CONTROL
0492                 ;
0493   003E 90              LI     0
0494   003F 84              LDZ    F2
0495   0040 34              CMB    ?Z         : MR-Z ON ?
0496   0041 DA              JCP    SCA4
0497   0042 152A            LDI    F6
0498   0044 34              CMB    ?JM          MR-JM ON ?
0499   0045 DA              JCP    SCA4
0500   0046 3B              LM     3          ; DP=CNDT
0501   0047 38              L
0502   0048 0F              DEC               ; (CNDT)=0 ?
0503   0049 CB              JCP    SCA0
0504   004A D6              JCP    SCA5
0505   004B 81       SCA0:  LDZ    INB0
0506   004C 59              TMB    KS         ; KS ON ?
0507   004D D6              JCP    SCA5
0508   004E 80              LDZ    SINB1
0509   004F 38              L
0510   0050 1529            LDI    INA2
0511   0052 24              TAB    KT         ; KT ON ?
0512   0053 39              LM     1
0513   0054 5B              TMB    PU         ; PU OR PL ON ?
0514   0055 DA              JCP    SCA4
0515   0056 1512     SCA5:  LDI    OUTC1
0516   0058 6B              RMB    OK
0517   0059 DE              JCP    SCA1
0518   005A 1521     SCA4:  LDI    INB2
0519   005C 59              TMB    ST         ; ST ON ?
0520   005D E2              JCP    SCA2
0521   005E 1527     SCA1:  LDI    F5
0522   0060 78              SMB    ?ST        ; SET MR-ST
0523   0061 E5              JCP    SCA3
0524   0062 1527     SCA2:  LDI    F5
0525   0064 68              RMB    ?ST        ; RESET MR-ST
0526                 ;
```

```
STNO E ADRS OBJ.    SOURCE STATEMENTS

0527                ;  PULSE TASK
0528                ;
0529                SCA3:
0530   0065 AD24            CAL   PLTSK
0531                ;
0532                ;  TIMER TASK
0533                ;
0534   0067 81              LDZ   INB0
0535   0068 58              TMB   SI        ; SIMULATION-SW
                                                ON ?
0536   0069 EB              JCP   SCA00     ; N, ALL COUNT
0537                ;
0538   006A EF              JCP   SCA02     ; Y, COUNT EXCEPT
                                                TM2 & TM4
0539                ;
0540                SCA00:
0541   006B 93              LI    TM4 SHR 4
0542   006C BC              CZP   CNTT      ; PLS-200MS
0543                ;
0544                SCA01:
0545   006D 91              LI    TM2 SHR 4
0546   006E BC              CZP   CNTT      ; HP-1.5S, RG-500MS
0547                ;
0548                SCA02:
0549   006F 94              LI    TM5 SHR 4
0550   0070 BC              CZP   CNTT      ; 60S
0551                ;
0552   0071 90              LI    TM1 SHR 4
0553   0072 BC              CZP   CNTT      ; SSR3-0.3S, 2S,
                                                J-500MS, J1-1
0554                ;
0555   0073 92              LI    TM3 SHR 4
0556   0074 BC              CZP   CNTT      ; CL-40MS, F-150MS
0557                ;
0558                ;  ALL INPUT & OUTPUT
0559                ;  CONDITION SET
0560                ;
0561   0075 AF00            CAL   INOUT
0562                ;
0563                ;  LAMP SU, SL, PU, PL, KS CONTROL
0564                ;  PULSE CK
0565                ;
0566   0077 1529            LDI   INA2
0567   0079 AF50            CAL   PUPL
0568   007B 1539            LDI   INA3
0569   007D AF50            CAL   PUPL
0570   007F 1517            LDI   F4
0571   0081 58              TMB   ?CPY      ; MR-CPY ON ?
0572   0082 C4              JCP   SCA10
0573                ;
0574   0083 C7              JCP   SCA11
0575                ;
0576                ;
0577   0084 83      SCA10:        LDZ     F1
0578   0085 58              TMB   ?N        ; MR-N ON ?
0579   0086 C9              JCP   SCAN12
0580                ;
0581                SCA11:
```

```
STNO E ADRS OBJ.    SOURCE STATEMENTS

0582   0087 AE8C            CAL   FBTCK
0583                ;
0584                SCA12:
0585   0089 82              LDZ   OUTC0
0586   008A AFA0            CAL   SUSL     ; LAMP-SU CONTROL
0587   008C 1512            LDI   OUTC1
0588   008E AFA0            CAL   SUSL     ; LAMP-SL CONTROL
0589                ;
0590   0090 81              LDZ   INB0     ; RESET LAMP-KS
                                              IF KS ON
0591   0091 38              L              ; SET LAMP KS
                                              IF KS OFF
0592   0092 1515            LDI   OUTF1
0593   0094 6A              RMB   LMKS
0594   0095 25              TAB   KS
0595   0096 7A              SMB   LMKS
0596                ;
0597   0097 151A            LDI   CNDT
0598   0099 38              L              ; (A)=CONDITION
0599                ;
0600   009A 80              LDZ   SINB1
0601   009B 59              TMB   RD       ; RD ON ?
0602   009C E6              JCP   SCA20
0603                ;
0604   009D DE              JCP   SCA25
0605                ;
0606                SCA25:
0607   009E 17C5            CI    CDC      ; CNDT C ?
0608   00A0 E2              JCP   SCA21    ; N
0609                ;
0610   00A1 F5              JCP   SCA30    ; Y
0611                ;
0612                SCA21:
0613   00A2 17C6            CI    CDE      ; CNDT E ?
0614   00A4 F8              JCP   SCA31    ; N
0615                ;
0616   00A5 F5              JCP   SCA30    ; Y
0617                ;
0618                SCA20:
0619   00A6 17C3            CI    CDB1     ; CNDT B1 ?
0620   00A8 EA              JCP   SCA22    ; N
0621                ;
0622   00A9 F5              JCP   SCA30    ; Y
0623                ;
0624                SCA22:
0625   00AA 17C7            CI    CDB2     ; CNDT B2 ?
0626   00AC EE              JCP   SCA24
0627                ;
0628   00AD F5              JCP   SCA30    ; Y
0629                ;
0630                ;
0631   00AE 17C4    SCA24:  CI    CDG1
0632   00B0 F2              JCP   SCA26
0633   00B1 F5              JCP   SCA30
0634                ;
0635   00B2 17C2    SCA26:  CI    CDG2
0636   00B4 F8              JCP   SCA31
```

```
STNO E ADRS OBJ.    SOURCE STATEMENTS

0637                ;
0638                SCA30:                      ; Y
0639   00B5 87              LDZ   OUTH
0640   00B6 78              SMB   LMK           ; SET LAMP-K
0641   00B7 FA              JCP   SCA40
0642                ;
0643                SCA31:
0644   00B8 87              LDZ   OUTH
0645   00B9 68              RMB   LMK           ; RESET LAMP-K
0646                ;
0647                SCA40:
0648   00BA 1528            LDI   INA6
0649   00BC 59              TMB   T@            ; T ON ?
0650   00BD A0C8            JMP   SCA41
0651                ;
0652                ;
0653                ;
0654                ;
0655                SCA51:
0656   00BF 1517            LDI   F4
0657   00C1 59              TMB   ?CPZ          ; MR-CPZ ON ?
0658   00C2 48              RT                  ; N
0659                ;
0660   00C3 3B              LM    3             ; Y, DP=F5
0661   00C4 58              TMB   ?ST           ; MR-ST ON ?
0662   00C5 48              RT                  ; N
0663                ;
0664   00C6 A412            JMP   Z
0665                ;
0666                SCA41:
0667   00C8 8A              LDZ   F3
0668   00C9 5A              TMB   ?S            ; MR-S ON ?
0669   00CA A430            JMP   E
0670                ;
0671   00CC 48              RT                  ; Y
0672   00CD 1513    CPXOF:  LDI   OUTD
0673   00CF 6B              RMB   SSR1          ; RESET SSR1
0674   00D0 69              RMB   CPX           ; RESET CPX
0675   00D1 48              RT
0676                ;
0677   00D2 97      ST6M:   LI    T6M1
0678   00D3 2C              XD
0679   00D4 97              LI    T6M2
0680   00D5 2C              XD
0681   00D6 90              LI    T6M3
0682   00D7 2C              XD
0683   00D8 98              LI    T6M4
0684   00D9 2C              XD
0685   00DA 91              LI    T6MB
0686   00DB 02              S
0687   00DC 48              RT
0688                ;*****
0689                ;
0690                ; *** A00
0691                ;
0692   00DD                ORG   100H
0693                ;
```

```
STNO E ADRS OBJ.    SOURCE STATEMENTS

0694                A00:
0695   0100 1517            LDI   F4
0696   0102 68              RMB   ?CPY     ; RESET MR-CPY
0697                ;
0698   0103 BF              CZP   SCAN
0699                ;
0700   0104 83              LDZ   F1
0701   0105 5A              TMB   ?T       ; MR-T ON ?
0702   0106 CE              JCP   A01      ; NO
0703                ;
0704   0107 6A              RMB   ?T       ; YES, RESET MR-T
0705   0108 87              LDZ   OUTH
0706   0109 69              RMB   TR       ; RESET TR
0707                ;
0708   010A 82              LDZ   OUTC0
0709   010B 79              SMB   LMW      ; SET LAMP W
0710   010C AD67            CAL   STOP3
0711                ;
0712   010E 83      A01:    LDZ   F1
0713   010F 58              TMB   ?N       ; MR N ON ?
0714   0110 D4              JCP   A011
0715   0111 AE4E            CAL   CPEND    ; CALL COPY EVD
                                              TASK
0716   0113 FD              JCP   A03
0717                ;
0718   0114 89      A011:   LDZ   INA0
0719   0115 5B              TMB   SWZ      ; SWZ ON ?
0720   0116 D8              JCP   A012
0721   0117 EA              JCP   A021
0722                ;
0723   0118 39      A012:   LM    1
0724   0119 58              TMB   SWJM     ; SWJM ON ?
0725   011A DC              JCP   A013
0726   011B EA              JCP   A021
0727                ;
0728   011C 8F      A013:   LDZ   TM1
0729   011D 5A              TMB   TMON     ; 0.3S TIMER SET ?
0730   011E E0              JCP   A02
0731   011F B3              CZP   A1
0732                ;
0733                A02:
0734   0120 81              LDZ   INB0
0735   0121 5B              TMB   SWF@     ; SW-F ON ?
0736   0122 A425            JMP   I1       ; Y
0737                ;
0738   0124 1519            LDI   INA1     ; N
0739   0126 5A              TMB   SWT      ; SW-T ON ?
0740   0127 EA              JCP   A021
0741                ;
0742   0128 A429            JMP   J2
0743                ;
0744   012A 90      A021:   LI    0
0745   012B 152A            LDI   F6
0746   012D 36              CMB   FGM      ; FGM ON ?
0747   012E FB              JCP   A022
0748   012F 1538            LDI   INA7
0749   0131 34              CMB   M@       ; M ON ?
```

```
STNO E ADRS OBJ.    SOURCE STATEMENTS

0750   0132 FD              JCP   A03
0751   0133 152A            LDI   F6
0752   0135 7A              SMB   FGM      ; SET FGM
0753   0136 83              LDZ   F1
0754   0137 69              RMB   ?Q
0755   0138 154F            LDI   TM5
0756   013A 6A              RMB   TMON
0757   013B A171     A022:  JMP   A10
0758                ;
0759                A03:
0760   013D 89              LDZ   INA0
0761   013E 5B              TMB   SWZ      ; SW-Z ON ?
0762   013F A144            JMP   A04
0763                ;
0764   0141 84              LDZ   F2       ; Y
0765   0142 78              SMB   ?Z       ; SET MR-Z
0766   0143 F1              JCP   A10
0767                ;
0768   0144 84      A04:    LDZ   F2
0769   0145 58              TMB   ?Z       ; MR-Z ON ?
0770   0146 CB              JCP   A043
0771   0147 68              RMB   ?Z       ; RESET MR-Z
0772   0148 83      A045:   LDZ   F1
0773   0149 69              RMB   ?Q       : RESET MR-Q
0774   014A B3              CZP   A1
0775   014B 1519    A043:   LDI   INA1
0776   014D 58              TMB   SWJM     ; SWJM ON ?
0777   014E D3              JCP   A041
0778   014F 152A            LDI   F6
0779   0151 78              SMB   ?JM      ; SET MR-JM
0780   0152 F1              JCP   A10
0781                ;
0782   0153 152A    A041:   LDI   F6
0783   0155 58              TMB   ?JM      ; MR-JM ON ?
0784   0156 D9              JCP   A044
0785   0157 68              RMB   ?JM      ; RESET MR-JM
0786   0158 C8              JCP   A045
0787                ;
0788   0159 83      A044:   LDZ   F1
0789   015A 5B              TMB   ?H       ; MR-H ON ?
0790   015B DD              JCP   A05      ; N
0791                ;
0792   015C F1              JCP   A10
0793                ;
0794   015D 154F    A05:    LDI   TM5
0795   015F 5B              TMB   TMOUT    ; 6MIN TIME OUT ?
0796   0160 F3              JCP   A051
0797   0161 A01C            JMP   T2
0798                ;
0799   0163 5A      A051:   TMB   TMON     ; 6MIN TIMER SET ?
0800   0164 A8D2            CAL   ST6M
0801                ;
0802   0166 1538    A054:   LDI   INA7
0803   0168 5A              TMB   TH1@     ; TH1 ON ?
0804   0169 EB              JCP   A052
0805   016A B3              CZP   A1
0806                ;
```

```
STNO E ADRS OBJ.    SOURCE STATEMENTS

0807   016B 154F    A052:   LDI   TM5
0808   016D 6A               RMB   TMON     ; 6MIN TIMER OFF
0809   016E 83               LDZ   F1
0810   016F 7B               SMB   ?H       ; SET MR-H
0811   0170 B3               CZP   A1
0812                ;
0813                ;
0814                ;  MEMORY-Q ON ?
0815                ;
0816                A10:
0817   0171 83               LDZ   F1
0818   0172 59               TMB   ?Q       ; MR-Q ON ?
0819   0173 F6               JCP   A11      ; N
0820                ;
0821   0174 A1DA             JMP   A30      ; Y
0822                ;
0823                ;
0824                A11:
0825   0176 1519             LDI   INA1
0826   0178 5B               TMB   SWHP@    ; SW-HP ON ?
0827   0179 A1A0             JMP   A20      ; Y
0828                ;
0829   17B 8A                LDZ   F2       ; N
0830   017C 58               TMB   ?THP     ; MR-THP(TIMER-HP)
                                               ON ?
0831   017D A184             JMP   A12
0832                ;
0833   017F 151F             LDI   TM2      ; Y
0834   0181 5B               TMB   TMOUT    ; HP-1.5S TIME OUT ?
0835   0182 CA               JCP   A13
0836                ;
0837   0183 B6               CZP   T1       ; Y, JUMP T1
0838                ;
0839                A12:
0840   0184 85               LDZ   OUTF0
0841   0185 7A               SMB   MCR      ; SET MCR
0842                ;
0843   0186 8A               LDZ   F3
0844   0187 78               SMB   ?THP     ; SET MR-THP(TIMER-
                                               HP)
0845                ;
0846   0188 AD5E             CAL   ST1P5    ; SET 1.5S TIMER
0847                ;
0848                A13:
0849   018A 1535             LDI   OUTF3
0850   018C 5B               TMB   SOLB     ; SOLB ON ?
0851   018D DA               JCP   A14
0852                ;
0853   018E 87               LDZ   OUTH     ; Y
0854   018F 5A               TMB   SSR3     ; SSR3 ON ?
0855   0190 D2               JCP   A15
0856                ;
0857   0191 B3               CZP   A1       ; Y, JUMP A1
0858                ;
0859                A15:
0860   0192 8F               LDZ   TM1
```

```
STNO E ADRS OBJ.     SOURCE STATEMENTS

0861   0193 5B                TMB    TMOUT    ; SSR3-0.3S TIME
                                               OUT ?
0862   0194 B3                CZP    A1       ; N, JUMP A1
0863                 ;
0864   0195 87                LDZ    OUTH     ; Y
0865   0196 7A                SMB    SSR3     ; SET SSR3
0866                 ;
0867   0197 84                LDZ    F2
0868   0198                   RMB    ?PS      ; RESET MR-PS
0869   0199 B3                CZP    A1       ; JUMP A1
0870                 ;
0871                 A14:
0872   019A 7B                SMB    SOLB     ; SET SOLB
0873   019B 86                LDZ    OUTG
0874   019C 79                SMB    SOLBS
0875   019D AD67              CAL    ST0P3    ; SET 0.3S TIMER
0876   019F B3                CZP    A1       ; JUMP A1
0877                 ;
0878                 ;
0879                 A20:
0880   01A0 85                LDZ    OUTF0
0881   01A1 6A                RMB    MCR      ; RESET MCR
0882                 ;
0883   01A2 8A                LDZ    F3
0884   01A3 68                RMB    ?THP     ; RESET MR-THP
0885   01A4 1538              LDI    INA7
0886   01A6 58                TMB    M@       ; M ON ?
0887   01A7 CA                JCP    A13
0888                 ;
0889   01A8 86                LDZ    OUTG
0890   01A9 69                RMB    SOLBS
0891   01AA 87                LDZ    OUTH
0892   01AB 5A                TMB    SSR3
0893   01AC FB                JCP    A202
0894   01AD 8A                LDZ    F3
0895   01AE 5B                TMB    ?T1S
0896   01AF F1                JCP    A200
0897   01B0 F4                JCP    A201
0898                 ;
0899   01B1 7B       A200:    SMB    ?T1S
0900   01B2 ACC4              CAL    ST1P0
0901                 ;
0902   01B4 8F       A201:    LDZ    TM1
0903   01B5 5B                TMB    TMOUT
0904   01B6 B3                CZP    A1
0905   01B7 8A                LDZ    F3
0906   01B8 6B                RMB    ?T1S
0907   01B9 87                LDZ    OUTH
0908   01BA 6A                RMB    SSR3
0909                 ;
0910   01BB 1535     A202:    LDI    OUTF3
0911   01BD 5B                TMB    SOLB     ; SOLB ON ?
0912   01BE A1D6              JMP    A21
0913                 ;
0914   01C0 8A                LDZ    F3       ; Y
0915   01C1 59                TMB    ?T2S     ; MR-T2S (TIMER-2S)
                                                ON ?
```

```
STNO E ADRS OBJ.    SOURCE STATEMENTS

0916   01C2 A1C5            JMP   A22
0917                ;
0918   01C4 C8              JCP   A23      ; Y
0919                ;
0920                A22:
0921   01C5 79              SMB   ?T2S     ; SET MR-T2S
0922                ;
0923   01C6 AD6F            CAL   ST2P0    ; SET 2S TIMER
0924                ;
0925                A23:
0926   01C8 8F              LDZ   TM1
0927   01C9 5B              TMB   TMOUT    ; SSR3-2S TIME
                                             OUT ?
0928   01CA B3              CZP   A1       ; N, JUMP A1
0929                ;
0930   01CB 8A              LDZ   F3       ; Y
0931   01CC 69              RMB   ?T2S     ; RESET MR-T2S
0932                ;
0933   01CD 1535            LDI   OUTF3
0934   01CF 6B              RMB   SOLB     ; RESET SOLB
0935   01D0 152A            LDI   F6
0936   01D2 5A              TMB   FGM      ; FGM=1 ?
0937   01D3 D6              JCP   A21
0938   01D4 6A              RMB   FGM      ; RESET FGM
0939   01D5 B3              CZP   A1
0940                ;
0941                A21:
0942   01D6 82              LDZ   OUTC0
0943   01D7 69              RMB   LMW      ; RESET LAMP W
0944                ;
0945   01D8 83              LDZ   F1
0946   01D9 79              SMB   ?Q       ; SET MR-Q
0947                ;
0948                ; OK ON ?
0949                ;
0950   01DA 89      A30:    LDZ   INA0
0951   01DB 5B              TMB   SWZ      ; SWZ ON ?
0952   01DC DE              JCP   A300
0953   01DD E1              JCP   A301
0954   01DE 39      A300:   LM    1
0955   01DF 58              TMB   SWJM     ; SWJM ON ?
0956   01E0 F2              JCP   A31
0957   01E1 A213    A301:   JMP   A360
0958                ;
0959                A32:
0960   01E3 1512            LDI   OUTC1    ; Y
0961   01E5 7B              SMB   OK       ; SET OK
0962                ;
0963   01E6 1521            LDI   INB2
0964   01E8 58              TMB   CP       ; CP ON ?
0965   01E9 EC              JCP   A320
0966                ;
0967   01EA A21A            JMP   A40      ; Y
0968                ;
0969                A320:
0970   01EC 1528            LDI   INA6
0971   01EE 58              TMB   AF@      ; AF ON ?
```

```
STNO E ADRS OBJ.    SOURCE STATEMENTS

0972   01EF A21A            JMP   A40      ; Y
0973                ;
0974   01F1 B5              CZP   A        ; N, JUMP A
0975                ;
0976                ;
0977                A31:
0978   01F2 80              LDZ   SINB1
0979   01F3 38              L              ; (A) = (SINB1)
0980                ;
0981   01F4 82              LDZ   OUTC0
0982   01F5 24              TAB   KT       ; KT ON ?
0983   01F6 39              LM    1        ; N, DP=OUTC1
0984                ;
0985   01F7 58              TMB   LMPU     ; Y, LAMP-PU OR
                                             LAMP-PL ON ?
0986   01F8 A200            JMP   A38
0987                ;
0988                ;
0989                A35:
0990   01FA 1512            LDI   OUTC1
0991   01FC 6B              RMB   OK       ; RESET OK
0992   01FD B5              CZP   A        ; JUMP A
0993                ;
0994                ;
0995                ;
0996   01FE                ORG   200H
0997                ;
0998                ;
0999                ;
1000   0200 151A    A38:    LDI   CONDT    ; (CNDT)=CONDITION
1001   0202 38              L
1002   0203 0F              DEC            ; (A)=0 ?
1003   0204 C6              JCP   A36      ; N(=K-FLAG ON)
1004                ;
1005   0205 D8              JCP   A361
1006                ;
1007                A36:
1008   0206 81              LDZ   INB0
1009   0207 59              TMB   KS       ; KS ON ?
1010   0208 D8              JCP   A361
1011                ;
1012   0209 1538            LDI   INA7     ; Y
1013   020B 5B              TMB   TH2@     ; TH2 ON ?
1014   020C CE              JCP   A362
1015   020D D1              JCP   A363
1016                ;
1017   020E 83      A362:   LDZ   F1
1018   020F 6B              RMB   ?H       ; RESET MR-H
1019   0210 D8              JCP   A361
1020                ;
1021   0211 59      A363:   TMB   LD@      ; LD ON ?
1022   0212 D8              JCP   A361
1023                ;
1024   0213 1519    A360:   LDI   INA1
1025   0215 5B              TMB   SWHP@    ; SW-HP ON ?
1026   0216 A1E3            JMP   A32      ; Y
1027                ;
```

```
STNO E ADRS OBJ.    SOURCE STATEMENTS

1028   0218 A1FA    A361:   JMP   A35
1029                ;
1030                ;
1031                ; *** COPY START
1032                ;
1033                ;
1034                A40:
1035   021A 1517            LDI   F4
1036   021C 78              SMB   ?CPY     ; SET MR-CPY
1037                ;
1038   021D 152A            LDI   F6
1039   021F 69              RMB   ?JZ      ; RESET MR-JZ
1040   0220 6B              RMB   FGMA
1041   0221 1512            LDI   OUTC1
1042   0223 6B              RMB   OK       ; RESET OK
1043                ;
1044   0224 33              IND            ; DP=OUTD
1045   0225 79              SMB   CPX      ; SET CPX
1046                ;
1047   0226 80              LDZ   SINB1
1048   0227 7B              SMB   ?FIX     ; SET MR-FIX
                                              (TO FIX KT, RD)
1049                ;
1050   0228 1535            LDI   OUTF3
1051   022A 7B              SMB   SOLB     ; SET SOLB
1052   022B 86              LDZ   OUTG
1053   022C 79              SMB   SOLBS    ; SET SOLBS
1054                ;
1055   022D AD67            CAL   STOP3    ; SET 0.3S TIMER
1056                ;
1057   022F 84              LDZ   F2
1058   0230 7A              SMB   ?CPS     ; SET MR-CPS
1059                ;
1060                A41:
1061   0231 BF              CZP   SCAN
1062   0232 8F              LDZ   TM1
1063   0233 5B              TMB   TMOUT    ; SSR3-0.3S TIME
                                              OUT ?
1064   0234 F1              JCP   A41      ; N
1065                ;
1066   0235 1513            LDI   OUTD
1067   0237 78              SMB   MTR      ; SET MTR
1068   0238 87              LDZ   OUTH
1069   0239 7A              SMB   SSR3     ; SET SSR3
1070                ;
1071   023A 39              LM    1        ; DP=F4
1072   023B 79              SMB   ?CPZ     ; SET MR-CPZ
1073                ;
1074   023C 84              LDZ   F2
1075   023D 69              RMB   ?PS      ; RESET MR-PS
1076                ;
1077   023E BA              CZP   PLCRA    ; SET PLSCA CLEAR
1078                ;
1079   023F 86              LDZ   OUTG
1080   0240 7B              SMB   SOLF     ; SET SOLF
1081                ;
1082   0241 84              LDZ   F2
```

```
STNO E ADRS OBJ.     SOURCE STATEMENTS

1083   0242 58                TMB   ?Z        ; MR-Z ON ?
1084   0243 C5                JCP   A42       ; N
1085                 ;
1086   0244 FC                JCP   G011
1087                 ;
1088                 A42:
1089   0245 1515              LDI   OUTF1
1090   0247 79                SMB   PPD       ; SET PPD
1091                 ;
1092                 A43:
1093   0248 BF                CZP   SCAN
1094                 ;
1095   0249 9C                LI    69 SHR
                                     4 OR 8
1096   024A 85                LDZ   69 AND
                                     0FH
1097   024B B9                CZP   JPLSCN    ; (PLSCN)=69 ?
1098   024C D4                JCP   A44
1099   024D 1515              LDI   OUTF1
1100   024F 78                SMB   PPM       ; SET PPM
1101   0250 83                LDZ   F1
1102   0251 68                RMB   ?N        ; RESET MR-N
1103                 ;
1104   0252 BA                CZP   PLCRA
1105                 ;
1106   0253 DC                JCP   H
1107                 ;
1108   0254 9C       A44:     LI    65 SHR
                                     4 OR 8
1109   0255 81                LDZ   65 AND
                                     0FH
1110   0256 B9                CZP   JPLSCN    ; (PLSCN)=65 ?
1111   0257 C8                JCP   A43
1112   0258 1515              LDI   OUTF1
1113   025A 7B                SMB   REG
1114   025B C8                JCP   A43
1115                 ;
1116                 ; *** H
1117                 ;
1118   025C 152A     H:       LDI   F6
1119   025E 58                TMB   ?JM       ; MR-JM ON ?
1120   025F E1                JCP   H1
1121   0260 FC                JCP   G011
1122   0261 154F     H1:      LDI   TM5       ; SET 60S TIMER
1123   0263 97                LI    T601
1124   0264 2C                XD
1125   0265 9E                LI    T602
1126   0266 2C                XD
1127   0267 95                LI    T603
1128   0268 2C                XD
1129   0269 95                LI    T604
1130   026A 2C                XD
1131   026B 9E                LI    T60B
1132   026C 02                S
1133   026D EE                JCP   G00
1134                 ;
1135                 ;
```

```
STNO E ADRS OBJ.    SOURCE STATEMENTS

1136                G00:
1137   026E BF              CZP   SCAN
1138                ;
1139   026F 154F            LDI   TM5
1140   0271 5B              TMB   TMOUT    ; 60S TIME OUT ?
1141   0272 F5              JCP   G01      ; N
1142                ;
1143   0273 A01C            JMP   T2       ; Y
1144                ;
1145                G01:
1146   0275 1538            LDI   INA7
1147   0277 5B              TMB   TH2@     ; TH2 ON ?
1148   0278 EE              JCP   G00      ; Y
1149   0279 154F            LDI   TM5
1150   027B 6A              RMB   TMON     ; 60S TIMER OFF
1151                ;
1152   027C 1517    G011:   LDI   F4
1153   027E 69              RMB   ?CPZ     ; RESET MR-CPZ
1154                ;
1155                ;
1156                ; *** G
1157                ;
1158   027F 80      G:      LDZ   SINB1
1159   0280 7B              SMB   ?FIX     ; SET MR-FIX
1160   0281 84              LDZ   F2
1161   0282 58              TMB   ?Z       ; MR-Z ON ?
1162   0283 C5              JCP   G001
1163   0284 D7              JCP   F
1164   0285 152A    G001:   LDI   F6
1165   0287 58              TMB   ?JM      ; MR-JM ON ?
1166   0288 CA              JCP   G002
1167   0289 D5              JCP   G04
1168                ;
1169   028A 86      G002:   LDZ   OUTG
1170   028B 78              SMB   KC       ; SET KC
1171                ;
1172                ;
1173   028C 80              LDZ   SINB1
1174   028D 38              L              ; (A)=(SINB1)
1175   028E 1525            LDI   OUTF2
1176   0290 24              TAB   KT       ; KT ON ?
1177   0291 D4              JCP   G03      ; N
1178                ;
1179   0292 7A              SMB   CLFU     ; SET CLFU
1180   0293 D5              JCP   G04
1181                ;
1182                G03:
1183   0294 79              SMB   CLFL     ; SET CLFL
1184                ;
1185   0295 82      G04:    LDZ   OUTC0
1186   0296 7B              SMB   CN       ; SET CN
1187                ;
1188                ; *** F
1189                ;
1190                F:
1191   0297 BA              CZP   PLCRA    ; CLEAR & SET PLSCN
1192   0298 1515            LDI   OUTF1
```

```
STNO E ADRS OBJ.    SOURCE STATEMENTS

1193   029A 7B              SMB   REG      ; SET REG
1194   029B 1525            LDI   OUTF2
1195   029D 68              RMB   CLRG     ; RESET CLRG
1196                ;
1197   029E 1512            LDI   OUTC1
1198   02A0 6A              TMB   OCLM     ; RESET LM
1199   02A1 AF00            CAL   INOUT
1200                ;
1201   02A3 7C              SFB   FGXX     ; SET MR-FGXX,
                                              MR-RGXX
1202   02A4 7E              SFB   RGXX
1203                ;
1204   02A5 151F            LDI   TM2      ; SET RG-500MS TIMER
1205   02A7 96              LI    TRG1
1206   02A8 2C              XD
1207   02A9 9D              LI    TRG2
1208   02AA 2C              XD
1209   02AB 9A              LI    TRGB
1210   02AC 2A              XM    2        ; DP=RGCNT
1211   02AD 9B              LI    TSCR     ; TSCR=16-(SCAN)/
                                              (RGCHK)
1212   02AF 02              S
1213                ;
1214                F01:
1215   02AF AD84            CAL   RGCHK
1216   02B1 AE8C            CAL   FBTCK
1217                ;
1218   02B3 151F            LDI   TM2
1219   02B5 5B              TMB   TMOUT    ; RG-500MS TIME OUT ?
1220   02B6 F8              JCP   F02      ; N
1221                ;
1222   02B7 B6              CZP   T1       ; Y, JUMP T1
1223                ;
1224                F02:
1225   02B8 22              FBF   RGXX     ; MR-RGXX ON ?
1226   02B9 EF              JCP   F01
1227   02BA 1525            LDI   OUTF2
1228   02BC 6A              RMB   CLFU     ; RESET CLFU, CLFL
1229   02BD 69              RMB   CLFL
1230                ;
1231                ;
1232                F03:
1233   02BE BF              CZP   SCAN
1234                ;
1235   02BF 98              LI    7 SHR 4
                                   OR 8
1236   02C0 87              LDZ   7 AND
                                   0FH
1237   02C1 B9              CZP   JPLSCN   ; (PLSCN)=7 ?
1238   02C2 A2BE            JMP   F03
1239                ;
1240                ;
1241                ;
1242                F05:
1243   02C4 82              LDZ   OUTC0
1244   02C5 6B              RMB   CN       ; RESET CN
1245                ;
```

```
STNO E ADRS OBJ.    SOURCE STATEMENTS

1246                ;
1247                ;
1248                ;
1249                ; WAIT
1250                ;
1251                F20:
1252   02C6 BF              CZP   SCAN
1253                ;
1254   02C7 151A            LDI   CNDT      ; (CNDT)=CONDITION
1255   02C9 38              L
1256                ;
1257   02CA 17C3            CI    CDB1      ; CNDT B1 ?
1258   02CC D3              JCP   F210      ; N
1259                ;
1260                F21:                    ; Y
1261   02CD 9B              LI    49 SHR 4
                                  OR 8
1262   02CF 81              LDZ   49 AND
                                  0FH
1263   02CF B9              CZP   JPLSCN    ; (PLSCN)=49 ?
1264   02D0 C6              JCP   F20       ; N
1265                ;
1266   02D1 A32A    F201:   JMP   F30       ; Y
1267                ;
1268                F210:
1269   02D3 17C7            CI    CDB2      ; CNDT B2 ?
1270   02D5 D7              JCP   F22
1271                ;
1272   02D6 CD              JCP   F21       ; Y
1273                ;
1274                ;
1275                F22:
1276   02D7 17C5            CI    CDC       ; CNDT C ?
1277   02D9 DF              JCP   F23
1278                ;
1279   02DA 9B              LI    61 SHR 4; Y
                                  OR 8
1280   02DB 8D              LDZ   61 AND
                                  0FH
1281   02DC B9              CZP   JPLSCN    ; (PLSCN)=61 ?
1282                ;
1283                F200:
1284   02DD C6              JCP   F20       ; N
1285                ;
1286   02DE D1              JCP   F201
1287                ;
1288                F23:
1289   02DF 89              LDZ   INA0
1290   02E0 59              TMB   SWU       ; SW-U ON ?
1291   02E1 F5              JCP   F231
1292                ;
1293   02E2 80              LDZ   SINB1     ; Y
1294   02E3 59              TMB   RD        ; RD ON ?
1295   02E4 E7              JCP   F230      ; N
1296                ;
1297   02E5 A300    F231:   JMP   F24
1298                ;
```

```
STNO E ADRS OBJ.    SOURCE STATEMENTS

1299                F230:
1300   02E7 9C              LI     69 SHR 4
                                   OR 8
1301   02E8 85              LDZ    69 AND
                                   0FH
1302   02E9 B9              CZP    JPLSCN   ; (PLSCN)=69 ?
1303   02EA C6              JCP    F20
1304                ;
1305   02EB D1              JCP    F201
1306                ;
1307                ;
1308   02EC                 ORG    300H
1309                ;
1310                ;
1311                F24:
1312   0300 89              LDZ    INA0
1313   0301 58              TMB    SWEX     ; SW-EX ON ?
1314   0302 CD              JCP    F26      ; N
1315                ;
1316   0303 80              LDZ    SINB1    ; Y
1317   0304 59              TMB    RD       ; RD ON ?
1318   0305 C7              JCP    F240     ; N
1319                ;
1320   0306 CD              JCP    F26      ; Y
1321                ;
1322                F240:
1323   0307 9C              LI     70 SHR 4
                                   OR 8
1324   0308 86              LDZ    70 AND
                                   0FH
1325   0309 B9              CZP    JPLSCN   ; (PLSCN)=70 ?
1326   030A A2C6   F241:    JMP    F20
1327                ;
1328   030C EA              JCP    F30
1329                ;
1330                F26:
1331   030D 17C6            CI     CDE      ; CNDT E ?
1332   030F D5              JCP    F27      ; N
1333                ;
1334   0310 9C              LI     72 SHR 4; Y
                                   OR 8
1335   0311 88              LDZ    72 AND
                                   0FH
1336   0312 B9              CZP    JPLSCN   ; (PLSCN)=72 ?
1337   0313 CA              JCP    F241
1338                ;
1339   0314 EA              JCP    F30
1340                ;
1341                F27:
1342   0315 80              LDZ    SINB1
1343   0316 59              TMB    RD       ; RD ON ?
1344   0317 D9              JCP    F270     ; N
1345                ;
1346   0318 DE              JCP    F28
1347                ;
1348                F270:
```

```
STNO E ADRS OBJ.    SOURCE STATEMENTS

1349   0319 9D              LI     84 SHR
                                   4 OR 8
1350   031A 84              LDZ    84 AND
                                   0FH
1351   031B B9              CZP    JPLSCN   ; (PLSCN)=84 ?
1352   031C CA              JCP    F241
1353                ;
1354   031D EA              JCP    F30
1355                ;
1356                F28:
1357   031E 17C1            CI     CDF      ; CNDT F ?
1358   0320 E6              JCP    F29      ; N
1359                ;
1360   0321 9D              LI     89 SHR   ; Y
                                   4 OR 8
1361   0322 89              LDZ    89 AND
                                   0FH
1362   0323 B9              CZP    JPLSCN   ; (PLSCN)=89 ?
1363   0324 CA              JCP    F241
1364                ;
1365   0325 EA              JCP    F30
1366                ;
1367                F29:
1368   0326 9E              LI     107 SHR
                                   4 OR 8
1369   0327 8B              LDZ    107 AND
                                   0FH
1370   0328 B9              CZP    JPLSCN   ; (PLSCN)=107 ?
1371   0329 CA              JCP    F241
1372                ;
1373                ; RESET PPM
1374                ;
1375                F30:                    ; Y
1376   032A 1515            LDI    OUTF1
1377   032C 68              RMB    PPM      ; RESET PPM
1378   032D 80              LDZ    SINB1
1379   032E 6B              RMB    ?FIX
1380                ;
1381   032F BA              CZP    PLCRA    ; CLEAR & SET PLSCN
1382                ;
1383                F31:
1384   0330 BF              CZP    SCAN
1385                ;
1386   0331 98              LI     8 SHR
                                   4 OR 8
1387   0332 88              LDZ    8 AND
                                   0FH
1388   0333 B9              CZP    JPLSCN   ; (PLSCN)=8 ?
1389   0334 FD              JCP    F34      ; N
1390                ;
1391   0335 85              LDZ    OUTF0    ; Y
1392   0336 7A              SMB    MCR      ; SET MCR
1393                ;
1394   0337 153C            LDI    PLSC3
1395   0339 A829            CAL    PLC1     ; CLEAR & SET PLSC3
1396   033B A347            JMP    F40
1397                ;
```

```
STNO E ADRS OBJ.    SOURCE STATEMENTS

1398                F34:
1399   033D 98              LI     7 SHR
                                   4 OR 8
1400   033E 87              LDZ    7 AND
                                   0FH
1401   033F B9              CZP    JPLSCN   ; (PLSCN)=7 ?
1402   0340 A330            JMP    F31
1403                ;
1404   0342 85              LDZ    OUTF0    ; Y
1405   0343 68              RMB    MCC      ; RESET MCC, MCD
1406   0344 69              RMB    MCD
1407   0345 A330            JMP    F31
1408                ;
1409                F40:
1410   0347 AD5E            CAL    ST1P5    ; SET 1.5S TIMER
1411                ;
1412                ;
1413   0349 84      F44:    LDZ    F2
1414   034A 90              LI     0
1415   034B 34              CMB    ?Z       ; MR Z ON ?
1416   034C D0              JCP    F441
1417   034D 152A            LDI    F6
1418   034F 34              CMB    ?JM      ; MR-JM ON ?
1419   0350 A391    F441:   JMP    F52
1420   0352 80              LDZ    SINB1
1421   0353 38              L
1422                ;
1423   0354 1529            LDI    INA2
1424   0356 24              TAB    KT       ; KT ON ?
1425   0357 39              LM     1        ; N, DP=INA3
1426                ;
1427   0358 5B              TMB    PU       ; Y,PU OR PL ON ?
1428   0359 F8              JCP    F480
1429                ;
1430   035A 1519            LDI    INA1     ; Y
1431   035C 59              TMB    SWLM     ; SW-LM ON ?
1432   035D FA              JCP    F45
1433                ;
1434   035E 3B              LM     3        ; Y,DP=INA2
1435   035F 39              LM     1        ;(A)=(INA2),DP=INA
1436   0360 18              EXL
1437                ;
1438   0361 33              IND             ; DP=W1
1439   0362 02              S
1440   0363 6B              RMB    PU
1441                ;
1442   0364 1F              DEM             ; SU=SL ?
1443   0365 FA              JCP    F45      ; N
1444                ;
1445   0366 80              LDZ    SINB1    ; Y
1446   0367 58              TMB    KT       ; KT ON ?
1447   0368 EA              JCP    F440     ; N
1448                ;
1449   0369 FF              JCP    F46
```

```
STNO E ADRS OBJ.    SOURCE STATEMENTS

1450                ;
1451                F440:
1452   036A 1529            LDI    INA2
1453   036C 5B              TMB    PU       ; PU ON ?
1454   036D F3              JCP    F48      ; N
1455                ;
1456                F47:                    ; Y
1457   036E 1525            LDI    OUTF2
1458   0370 79              SMB    CLFL     ; SET CLF1
1459   0371 A398            JMP    F70
1460                ;
1461                F48:
1462   0373 1512            LDI    OUTC1
1463   0375 7A              SMB    OCLM     ; SET LM
1464   0376 80             LDZ    SINB1
1465   0377 6B             RMB    ?FIX     ; RESET MR-FIX
1466   0378 A388   F480:   JMP    F50
1467                ;
1468                F45:
1469   037A 80             LDZ    SINB1
1470   037B 58             TMB    KT       ; KT ON ?
1471   037C EE             JCP    F47
1472                ;
1473   037D A384           JMP    F49
1474                ;
1475                F46:
1476   037F 1539           LDI    INA3
1477   0381 5B             TMB    PL       ; PL ON ?
1478   0382 A373           JMP    F48
1479                ;
1480                F49:                    ; Y
1481   0384 1525           LDI    OUTF2
1482   0386 7A             SMB    CLFU     ; SET CLFU
1483   0387 D8             JCP    F70
1484                ;
1485                F50:
1486   0388 151A           LDI    CNDT     ; (CNDT)=CONDITION
1487   038A 38             L
1488   038B 0F             DEC             ; (A)=0 ?
1489   038C CE             JCP    F51      ; N(=K-FLAG ON)
1490                ;
1491   038D D8             JCP    F70
1492                ;
1493                ;
1494                F51:
1495   038E 81             LDZ    INB0     ;
1496   038F 59             TMB    KS       ; KS ON ?
1497   0390 D8             JCP    F70
1498                ;
1499                ;
1500                ;
1501   0391 1521   F52:    LDI    INB2
1502   0393 59             TMB    ST       ; ST ON ?
1503   0394 DD             JCP    F71
1504                ;
```

```
STNO E ADRS OBJ.    SOURCE STATEMENTS

1505   0395 1512            LDI   OUTC1     ; Y
1506   0397 7B              SMB   OK        ; SET OK
1507                ;
1508                ;
1509                F70:
1510   0398 1513            LDI   OUTD
1511   039A 69              RMB   CPX       ; RESET CPX
1512                ;
1513   039B 80              LDZ   SINB1
1514   039C 6B              RMB   ?FIX      ; RESET MR-FIX (NO
                                               FIX KT, RD)
1515                ;
1516                F71:
1517   039D BF              CZP   SCAN
1518                ;
1519   039E 99              LI    24 SHR
                                   4 OR 8
1520   039F 88              LDZ   24 AND
                                   0FH
1521   03A0 B9              CZP   JPLSCN    ; (PLSCN)=24 ?
1522   03A1 EA              JCP   F72       ; N
1523                ;
1524   03A2 1527            LDI   F5        ; Y
1525   03A4 58              TMB   ?ST       ; MR-ST ON ?
1526   03A5 EE              JCP   F80       ; N
1527                ;
1528   03A6 1513            LDI   OUTD      ; Y
1529   03A8 6B              RMB   SSR1      ; RESET SSR1
1530   03A9 FE              JCP   F80
1531                ;
1532                F72:
1533   03AA 99              LI    23 SHR
                                   4 OR 8
1534   03AB 87              LDZ   23 AND
                                   0FH
1535   03AC B9              CZP   JPLSCN    ; (PLSCN)=23 ?
1536   03AD F6              JCP   F73       ; N
1537                ;
1538   03AE 87              LDZ   OUTH      ; Y
1539   03AF 6B              RMB   BS        ; RESET BS
1540   03B0 1525            LDI   OUTF2
1541   03B2 6A              RMB   CLFU      ; RESET CLFU, CLFL
1542   03B3 69              RMB   CLFL
1543   03B4 68              RMB   CLRG
1544   03B5 DD              JCP   F71
1545                ;
1546   03B6 98      F73:    LI    9 SHR
                                   4 OR 8
1547   03B7 89              LDZ   9 AHD
                                   0FH
1548   03B8 B9              CZP   JPLSN     ; (PLSCN)=9 ?
1549   03B9 DD              JCP   F71       ; N
1550                ;
1551   03BA 1515            LDI   OUTF1     ; Y
1552   03BC 6B              RMB   REG       ; RESET REG
1553   03BD DD              JCP   F71
1554                ;
```

```
STNO E ADRS OBJ.    SOURCE STATEMENTS

1555                ;
1556                F80:
1557   03BE BF              CZP   SCAN
1558                ;
1559   03BF 151F            LDI   TM2
1560   03C1 5B              TMB   TMOUT    ; HP-1.5S TIME OUT ?
1561   03C2 C4              JCP   F81
1562                ;
1563   03C3 B6              CZP   T1       ; Y, JUMP T1
1564                ;
1565   03C4 1519    F81:    LDI   INA1
1566   03C6 5B              TMB   SWHP@    ; SWHP ON ?
1567   03C7 CA              JCP   F82
1568   03C8 A3BE            JMP   F80
1569                ;
1570                F82:
1571   03CA 85              LDZ   OUTF0
1572   03CB 6A              RMB   MCR      ; RESET MCR
1573                ;
1574                F90:
1575   03CC 89              LDZ   INA0
1576   03CD 5B              TMB   SWZ      ; SW-Z ON ?
1577   03CE D7              JCP   F91
1578                ;
1579   03CF 1527            LDI   F5       ; Y
1580   03D1 58              TMB   ?ST      ; MR-ST ON ?
1581   03D2 A297            JMP   F        ; N
1582                ;
1583   03D4 A8CD    F900:   CAL   CPXOF
1584   03D6 E9              JCP   F921
1585                ;
1586                F91:
1587   03D7 84              LDZ   F2
1588   03D8 58              TMB   ?Z       ; MR-Z ON ?
1589   03D9 DE              JCP   F92      ; N
1590                ;
1591   03DA 152A            LDI   F6
1592   03DC 79              SMB   ?JZ      ; SET MR-JZ
1593   03DD D4              JCP   F900
1594                ;
1595                F92:
1596   03DE 1521            LDI   INB2
1597   03E0 58              TMB   CP       ; CP ON ?
1598   03E1 E3              JCP   F920     ; N
1599                ;
1600   03E2 EB              JCP   F93      ; Y
1601                ;
1602                F920:
1603   03E3 1527            LDI   F5
1604   03E5 58              TMB   ?ST      ; MR-ST ON ?
1605   03E6 F3              JCP   F94      ; N
1606   03E7 A8CD            CAL   CPXOF
1607   03E9 A420    F921:   JMP   Y
1608                ;
1609   03EB 1513    F93:    LDI   OUTD
1610   03ED 6B              RMB   SSR1     ; RESET SSR1
1611   03EE 79              SMB   CPX      ; SET CPX
```

```
STNO E ADRS OBJ.    SOURCE STATEMENTS

1612   03EF 13              DED          ; DP=OUTC1
1613   03F0 6B              RMB   OK     ; RESET OK
1614                ;
1615                F930:
1616   03F1 A25C            JMP   H
1617                ;
1618   03F3 1519    F94:    LDI   INA1
1619   03F5 58              TMB   SWJM   ; SWJM ON ?
1620   03F6 A400            JMP   F940
1621   03F8 A27F    F941:   JMP   G
1622                ;
1623                ;
1624                ;
1625   03FA                 ORG   400H
1626                ;
1627                ;
1628                ;
1629   0400 152A    F940:   LDI   F6
1630   0402 58              TMB   ?JM    ; MR-JM ON ?
1631   0403 C7              JCP   F943
1632   0404 79              SMB   ?JZ    ; SET MR-JZ
1633   0405 A3D4            JMP   F900
1634                ;
1635   0407 1538    F943:   LDI   INA7
1636   0409 5B              TMB   TH2@   ; TH2 ON ?
1637   040A CD              JCP   F942
1638   040B A27F            JMP   G
1639                ;
1640   040D 1513    F942:   LDI   OUTD
1641   040F 6B              RMB   SSR1   ; RESET SSR1
1642   0410 A25C            JMP   H
1643                ;
1644                ; *** Z
1645                ;
1646                Z:
1647   0412 1517            LDI   F4
1648   0414 69              RMB   ?CPZ   ; RESET MR-CPZ
1649                ;
1650   0415 1513            LDI   OUTD
1651   0417 69              RMB   CPX    ; RESET CPX
1652                ;
1653   0418 80              LDZ   SINB1
1654   0419 6B              RMB   ?FIX   ; RESET MR-FIX (NO
                                            FIX KT, RD)
1655                ;
1656   041A 84              LDZ   F2
1657   041B 6A              RMB   ?CPS   ; RESET MR-CPS
1658                ;
1659   041C 1515            LDI   OUTF1
1660   041E 6B              RMB   REG
1661   041F 68              RMB   PPM
1662                ;
1663                ;
1664                ; *** Y
1665                ;
1666                Y:
1667   0420 83              LDZ   F1
```

```
STNO E ADRS OBJ.    SOURCE STATEMENTS

1668   0421 78              SMB   ?N       ; SET MR-N
1669   0422 B5              CZP   A        ; JUMP A
1670                ;******
1671                ;
1672                ; ERR ENTRY - J1, J2, I1, I2
1673                ;
1674                ;
1675   0423 84      J1:     LDZ   F2
1676   0424 7B              SMB   ?J1      ; SET MR-J1
1677                ;
1678   0425 1534    I1      LDI   F7
1679   0427 78              SMB   FGFJ
1680   0428 F0              JCP   E
1681                ;
1682                ;
1683                ;
1684   0429 1534    J2:     LDI   F7
1685   042B 79              SMB   FGTJ
1686   042C 84              LDZ   F2
1687   042D 6B              RMB   ?J1      ; RESET MR-J1
1688   042F 8A              LDZ   F3
1689   042F 6A              RMB   ?S       ; RESET MR-S
1690                ;
1691                ;
1692                ;
1693                ; *** F - ERR RESET
1694                ;
1695                E:
1696   0430 80              LDZ   SINB1
1697   0431 6B              RMB   ?FIX     ; RESET MR-FIX (NO
                                              FIX KT, RD)
1698                ;
1699   0432 83              LDZ   F1
1700   0433 94              LI    0100B    ; MR-H=0, MR-T=1,
                                              MR-Q=0
1701   0434 3C              XI             ; MR-N=0, DP=F2
1702                ;
1703   0435 69              RMB   ?PS      ; MR-PS=0
1704                ;
1705   0436 8A              LDZ   F3
1706   0437 68              RMB   ?THP     ; MR=THP=MR-T2S=0
1707   0438 69              RMB   ?T2S
1708   0439 6B              RMB   ?T1S
1709   043A 3A              LM    2        ; DP=F6
1710   043B 6A              RMB   FGM
1711                ;
1712   043C 1517            LDI   F4
1713   043E 69              RMB   ?CPZ     ; MR-CPZ=MR-CPW=0
1714                ;
1715   043F 90              CLA
1716                ;
1717   0440 1579            LDI   FLAG
1718   0442 02              S              ; FGXX=FGXY=RGXX=
                                              RGXY=0
1719                ;
1720   0443 8C              LDZ   PLSCN
1721   0444 02              S              ; RESET PLSCN
```

```
STNO E ADRS OBJ.    SOURCE STATEMENTS

1722   0445 39              LM    1
1723   0446 02              S                 ; PLSC1
1724   0447 3B              LM    3
1725   0448 02              S                 ; PLSC2
1726                ;
1727   0449 154F            LDI   TM5         ; RESET TM 5 (6 MIN
                                                TIMER)
1728   044B 6A              RMB   TMON
1729   044C 6B              RMB   TMOUT
1730                ;
1731                ;
1732                ; RESET OR SET OUTPUT PORT BUF
1733                ;
1734   044D 82              LDZ   OUTC0       ; DP=OUTC0
1735   044E 6B              RMB   CN
1736   044F 6A              RMB   CNX
1737   0450 69              RMB   LMW
1738                ;
1739   0451 39              LM    1           ; DP=OUTC1
1740   0452 6B              RMB   OK
1741   0453 6A              RMB   OCLM
1742                ;
1743   0454 33              IND               ; DP=OUTD
1744   0455 69              RMB   CPX         ; RESET CPX
1745   0456 6B              RMB   SSR1        ; RESET SSR1
1746                ;
1747   0457 85              LDZ   OUTF0       ; DP=OUTF0
1748   0458 90              LI    0
1749   0459 29              XM    1
1750                ;
1751   045A 6B              RMB   REG       DP=OUTF1
1752   045B 69              RMB   PPD
1753   045C 68              RMB   PPM
1754                ;
1755   045D 3B              LM    3           ; DP=OUTF2
1756   045E 6A              RMB   CLFU
1757   045F 69              RMB   CLFL
1758   0460 68              RMB   CLRG
1759                ;
1760                ;
1761   0461 86              LDZ   OUTG        ; DP=OUTG
1762   0462 69              RMB   SOLBS
1763   0463 68              RMB   KC
1764                ;
1765   0464 87              LDZ   OUTH        ; DP=OUTH
1766   0465 6B              RMB   BS
1767   0466 79              SMB   TR
1768                ;
1769                ; WAIT IS IF MR-J1 & MR-CPS OFF
1770                ;
1771                E00:
1772   0467 84              LDZ   F2
1773   0468 5B              TMB   ?J1         ; MR-J1 ON ?
1774   0469 F5              JCP   E10
1775                ;
1776   046A 5A              TMB   ?CPS        ; Y, MR-CPS ON ?
1777   046B ED              JCP   E01         ; N
```

```
STNO E ADRS OBJ.    SOURCE STATEMENTS

1778                ;
1779   046C F5              JCP   E10
1780                ;
1781                E01:
1782   046D ACC4            CAL   ST1P0
1783                ;
1784   046F 8A              LDZ   F3
1785   0470 7A              SMB   ?S        ; SET MR-S
1786                ;
1787                E02:
1788   0471 BF              CZP   SCAN
1789                ;
1790   0472 8F              LDZ   TM1
1791   0473 5B              TMB   TMOUT     ; 1S TIME OUT ?
1792   0474 F1              JCP   E02       ; N
1793   0475 86      E10:    LDZ   OUTG
1794   0476 6B              RMB   SOLF      ; RESET SOLF
1795   0477 84              LDZ   F2
1796   0478 6B              RMB   ?J1       ; RESET MR-J1
1797   0479 6A              RMB   ?CPS      ; RESET MR-CPS
1798   047A AD67            CAL   ST0P3
1799   047C 8A              LDZ   F3
1800   047D 7A              SMB   ?S        ; SET MR-S
1801                ;
1802   047E BF      E100:   CZP   SCAN
1803   047F 8F              LDZ   TM1
1804   0480 5B              TMB   TMOUT     ; 0.3 SEC TIMEOUT ?
1805   0481 A47E            JMP   E100
1806   0483 1534            LDI   F7
1807   0485 58              TMB   FGFJ      ; FGFJ ON ?
1808   0486 CA              JCP   E101
1809   0487 68              RMB   FGFJ      ; RESET FGFJ
1810   0488 33              IND             ; DP-OUTF3
1811   0489 79              SMB   SOLJ1     ; SET SOLJ1
1812                ;
1813   048A 1534    E101:   LDI   F7
1814   048C 59              TMB   FGTJ      ; FGTJ ON ?
1815   048D D1              JCP   E102
1816   048E 69              RMB   FGTJ      ; RESET FGTJ
1817   048F 33              IND             ; DP-OUTF3
1818   0490 7A              SMB   SOLJ2     ; SET SOLJ2
1819                ;
1820   0491 8F      E102:   LDZ   TM1
1821   0492 97              LI    7
1822   0493 2C              XD
1823   0494 9F              LI    0FH
1824   0495 2C              XD
1825   0496 95              LI    5
1826   0497 02              S
1827                ;
1828   0498 BF      E103:   CZP   SCAN
1829   0499 8F              LDZ   TM1
1830   049A 5B              TMB   TMOUT     ; 0.1 SEC TIMEOUT ?
1831   049B D8              JCP   E103
1832   049C 1535            LDI   OUTF3
1833   049E 69              RMB   SOLJ1     ; RESET SOLJ1
1834   049F 6A              RMB   SOLJ2     ; RESET SOLJ2
```

```
STNO E ADRS OBJ.     SOURCE STATEMENTS

1835   04A0 8A                LDZ   F3
1836   04A1 6A                RMB   ?S        ; RESET MR-S
1837   04A2 87                LDZ   OUTH
1838   04A3 6A                RMB   SSR3      ; RESET SSR3
1839   04A4 1513              LDI   OUTD
1840   04A6 68                RMB   MTR
1841   04A7 90                CLA
1842   04A8 153C              LDI   PLSC3
1843   04AA 02                S
1844   04AB 154A              LDI   PLSC4
1845   04AD 02                S
1846   04AE 1535              LDI   OUTF3
1847   04B0 5B                TMB   SOLB
1848   04B1 B5                CZP   A
1849   04B2 AD6F              CAL   ST2P0
1850   04B4 8A                LDZ   F3
1851   04B5 7A                SMB   ?S
1852   04B6 82                LDZ   OUTC0
1853   04B7 7A                SMB   CNX
1854                  ;
1855   04B8 BF        E11:    CZP   SCAN
1856   04B9 8F                LDZ   TM1
1857   04BA 5B                TMB   TMOUT
1858   04BB F8                JCP   E11
1859   04BC 1535              LDI   OUTF3
1860   04BE 6B                RMB   SOLB
1861   04BF 8A                LDZ   F3
1862   04C0 6A                RMB   ?S
1863   04C1 82                LDZ   OUTC0
1864   04C2 6A                RMB   CNX
1865   04C3 B5                CZP   A
1866                  ;
1867                  ;
1868   04C4 8F        ST1P0:  LDZ   TM1
1869   04C5 97                LI    T1S1
1870   04C6 2C                XD
1871   04C7 98                LI    T1S2
1872   04C8 2C                XD
1873   04C9 9E                LI    T1SB
1874   04CA 02                S
1875   04CB 48                RT
1876                  ;
1877                  ;
1878                  ;******
1879   04CC                   ORG   500H
1880                  ;
1881                  ;  SUBROUTINE AREA
1882                  ;
1883                  ;
1884                  ; *** JUDGE PLS NUMBER - PART 2
1885                  ;
1886                  JP00:
1887   0500 0C                CM            ; HIGH DIGIT EQUAL ?
1888   0501 48                RT            ; N
1889                  ;
1890   0502 13                DED           ; Y, DP=PLSCX-1
                                               (X=N, 1, 2, 3)
```

```
STNO E ADRS OBJ.    SOURCE STATEMENTS

1891   0503 4E              XLY            ; DPL=LOW DIGIT
1892   0504 12              TLA            ; (A)=LOW DIGIT
1893   0505 4E              XLY            ; DP=PLSCX-1
1894   0506 0C              CM             ; LOW DIGIT EQUAL ?
1895   0507 48              RT             ; N
1896   0508 49              RTS            ; Y
1897                ;
1898                ; *** JUDGE PLS-1 NUMBER
1899                ;
1900                JPLS1:
1901   0509 46              TLY            ; RESORE DPL=LOW
                                              DIGIT
1902                ;
1903   050A 151C            LDI    PLSC1
1904   050C C0              JCP    JP00
1905                ;
1906                ; *** JUDGE PLS-2 NUMBER
1907                ;
1908                JPLS2:
1909   050D 46              TLY
1910                ;
1911   050E 152C            LDI    PLSC2
1912   0510 C0              JCP    JP00
1913                ;
1914                ; *** JUDGE PLS-3 NUMBER
1915                ;
1916                JPLS3:
1917   0511 46              TLY
1918                ;
1919   0512 153C            LDI    PLSC3
1920   0514 C0              JCP    JP00
1921                ;
1922                ; *** JUDGE PLS-4 NUMBER
1923                ;
1924   0515 46      JPLS4:  TLY
1925   0516 154A            LDI    PLSC4
1926   0518 C0              JCP    JP00
1927                ;
1928                ; *** COUNT TIMER - PART 2
1929                ;
1930                CNT2:
1931   0519 8F              LDZ    TM1     ; (A)=TMXB AND 0FH
1932   051A 4F              XHX            ; DP=TMX(X=1, 2, 3,
                                              4 OR 5)
1933   051B 1B              STC
1934   051C 5A              TMB    TMON    ; TIMER ON ?
1935   051D 0B              CLC            ; N, C=0
1936                ;
1937   051E 07              TAL            ; Y, DP=TMXB(X=1, 2.
                                              3, 4 OR 5)
1938                ;
1939                CNT3:
1940   051F 90              CLA            ; COUNT IF TIMER ON
1941   0520 19              ADC
1942   0521 3C              XI
1943   0522 DF              JCP    CNT3
1944   0523 48              RT
```

```
STNO E ADRS OBJ.     SOURCE STATEMENTS

1945                 ;
1946                 ; *** PULSE TASK
1947                 ;
1948                 PLTSK:
1949   0524 87               LDZ   OUTH
1950   0525 5A               TMB   SSR3      ; SSR3 ON ?
1951   0526 48               RT              ; N
1952                 ;
1953   0527 84               LDZ   F2        ; Y
1954   0528 59               TMB   ?PS       ; MR-PS ON ?
1955   0529 F7               JCP   PLT0      ; N
1956                 ;
1957   052A 153F             LDI   TM4       ; Y
1958   052C 5B               TMB   TMOUT     ; PLS-200MS TIME
                                               OUT ?
1959   052D FD               JCP   PLT1      ; N
1960                 ;
1961                 ;
1962   052E 87               LDZ   OUTH
1963   052F 59               TMB   TR        ; TR ON ?
1964   0530 F2               JCP   PLT2
1965   0531 FD               JCP   PLT1
1966                 ;
1967   0532 1535     PLT2:   LDI   OUTF3
1968   0534 78               SMB   PT        ; SET PT
1969   0535 A430             JMP   E
1970                 ;
1971                 PLT0:
1972   0537 153F             LDI   TM4
1973   0539 96               LI    TPL1
1974   053A 2C               XD
1975   053B 9A               LI    TPLB
1976   053C 02               S
1977                 ;
1978                 PLT1:
1979   053D 84               LDZ   F2
1980   053E 79               SMB   ?PS       ; SET MR-PS
1981   053F 03               TIT             ; PULSE IN ?
1982   0540 48               RT              ; N
1983                 ;
1984   0541 69               RMB   ?PS       ; Y, RESET MR-PS
1985                 ;
1986   0542 8C               LDZ   PLSCN
1987   0543 AD53             CAL   CNTP      ; COUNT PLSCN IF
                                               PSET=1
1988   0545 39               LM    1
1989   0546 AD53             CAL   CNTP      ; PLSC1
1990   0548 3B               LM    3
1991   0549 AD53             CAL   CNTP      ; PLSC2
1992   054B 39               LM    1
1993   054C AD53             CAL   CNTP      ; PLSC3
1994   054E 154A             LDI   PLSC4
1995   0550 AD53             CAL   CNTP      ; PLSC4
1996   0552 48               RT
1997                 ;
1998                 ; *** COUNT PULSE
1999                 ;
```

```
STNO E ADRS OBJ.    SOURCE STATEMENTS

2000                CNTP:
2001   0553 5B              TMB   PSET     ; PSET ON ?
2002   0554 48              RT             ; N TO RET
2003   0555 1B              STC            ; Y
2004                ;
2005   0556 13              DED            ; DP=PLSCX-1(X=N, 1,
                                               2 OR 3)
2006                ;
2007   0557 90      CNTP0:  CLA
2008   0558 19              ADC
2009   0559 3C              XI
2010   055A 90              CLA
2011   055B 19              ADC
2012   055C 02              S
2013   055D 48              RT
2014                ;
2015                ; *** SET 1.5S TIMER
2016                ;
2017                ;
2018                ST1P5:
2019   055E 151F            LDI   TM2
2020   0560 97              LI    THP1
2021   0561 2C              XD
2022   0562 95              LI    THP2
2023   0563 2C              XD
2024   0564 96              LI    THPB
2025   0565 02              S
2026   0566 48              RT
2027                ;
2028                ; *** SET 0.3S TIMER
2029                ;
2030                ST0P3:
2031   0567 8F              LDZ   TM1
2032   0568 97              LI    TP31
2033   0569 2C              XD
2034   056A 9D              LI    TP32
2035   056B 2C              XD
2036   056C 9E              LI    TP3B
2037   056D 02              S
2038   056E 48              RT
2039                ;
2040                ; *** SET 2S TIMER
2041                ;
2042                ST2P0:
2043   056F 8F              LDZ   TM1
2044   0570 97              LI    T2S1
2045   0571 2C              XD
2046   0572 91              LI    T2S2
2047   0573 2C              XD
2048   0574 9D              LI    T2SB
2049   0575 02              S
2050   0576 48              RT
2051                ;
2052                ; *** OUTPUT OUTF2
2053                ;
2054                OPF2:
2055   0577 1522            LDI   OUTC2
```

```
STNO E ADRS OBJ.    SOURCE STATEMENTS

2056   0579 38              L
2057   057A 0E              OP              ; OUTPUT OUTC2
2058                ;
2059   057B 1525             LDI   OUTF2
2060   057D 38              L
2061   057E 0E              OP              ; OUTPUT OUTF2
                                               (CLFU, CLFL, CL)
2062                ;
2063   057F 94               LI    4
2064   0580 44               OE              ; OUTPUT TIMING-T2
2066   0581 90              LI    0
2067   0582 44              OE              ; CLEAR PORT E
2068   0583 48              RT
2069                ;
2070                ; *** RG CHECK
2071                ;
2072                RGCHK:
2073                ;
2074                ; PARTIAL INPUT & OUTPUT
2075                ;
2076   0584 1528            LDI   INA6
2077   0586 92              LI    2
2078   0587 0E              OP              ; OUTPUT PORT 1
2079                ;
2080   0588 40              IA              ; INPUT INA6(SW-RG,T)
2081   0589 02              S
2082                ;
2083   058A 90              LI    0
2084   058B 0E              OP              ; CLEAR PORT 1
2085                ;
2086   058C 81              LDZ   INB0
2087   058D 32              IP              ; INPUT INB0(SW-F,SI)
2088   058E 02              S
2089                ;
2090   058F 1512            LDI   OUTC1
2091   0591 38              L
2092   0592 0E              OP
2093                ;
2094   0593 1515            LDI   OUTF1
2095   0595 38              L
2096   0596 0E              OP              ; OUTPUT OUTF1
2097                ;
2098   0597 92              LI    2
2099   0598 44              OE              ; OUTPUT TIMING-T1
2100                ;
2101   0599 1519            LDI   INA1      ; INPUT INA1(SW-T)
2102   059B 40              IA
2103   059C 02              S
2104                ;
2105   059D 82              LDZ   OUTC0
2106                ;
2107   059E 38              L
2108   059F 0E              OP              ; OUTPUT OUTC0
2109                ;
2110   05A0 85              LDZ   OUTF0
2111   05A1 38              L
2112   05A2 0E              OP              ; OUTPUT OUTF0(MCC,MCD)
```

```
STNO E ADRS OBJ.    SOURCE STATEMENTS

2113                ;
2114   05A3 91              LI     1
2115   05A4 44              OE                 ; OUTPUT TIMING-T0
2116                ;
2117   05A5 89              LDZ    INA0
2118   05A6 40              IA                 ; INPUT INA0(SW-U,
                                                           SW-EX)
2119   05A7 02              S
2120                ;
2121   05A8 90              LI     0
2122   05A9 44              OE                 ; CLEAR PORT E
2123                ;
2124                ;
2125                ; SINCE SW-F ON, 40MS TIME OUT ?
2126                ;
2127   05AA 5C              FBT    FGXX       ; MR-FGXX ON ?
2128   05AB FD              JCP    RGC09
2129                ;
2130   05AC 21              FBF    FGXY       ; Y,MR-FGXY ON ?
2131   05AD FA              JCP    RGC00      ; Y
2132                ;
2133   05AE 81              LDZ    INB0       ; N
2134   05AF 5B              TMB    SWF@       ; SW-F ON ?
2135   05B0 F2              JCP    FGC01      ; Y
2136                ;
2137   05B1 FD              JCP    FGC09
2138                ;
2139                RGC01:
2140   05B2 152F            LDI    TM3        ; SET CL-40MS TIMER
2141   05B4 96              LI     TCL1
2142   05B5 2C              XD
2143   05B6 98              LI     TCLB
2144   05B7 02              S
2145                ;
2146   05B8 7D              SFB    FGXY       ; SET MR-FGXY
2147   05B9 FD              JCP    RGC09
2148                ;
2149                RGC00:
2150   05BA 152F            LDI    TM3
2151   05BC 5B              TMB    TMOUT      ; CL-40MS TIME OUT ?
2152   05BD A5C7    RGC09:  JMP    RGC10
2153                ;
2154   05BF 6C              RFB    FGXX       ; Y, RESET MR-FGXX,
                                                           MR-FGXY
2155   05C0 6D              RFB    FGXY
2156                ;
2157   05C1 1525            LDI    OUTF2
2158   05C3 6A              RMB    CLFU
2159   05C4 69              RMB    CLFL
2160                ;
2161   05C5 AD77            CAL    OPF2       ; OUTPUT OUTF2
2162                ;
2163                RGC10:
2164   05C7 8C              LDZ    PLSCN
2165   05C8 98              LI     7 SHR 4 OR 8
2166   05C9 0C              CM                ; (PLSCN)=7 ?
2167   05CA D0              JCP    RGC13
```

```
STNO E ADRS OBJ.     SOURCE STATEMENTS

2168                 ;
2169   05CB 13               DED
2170   05CC 97               LI     7 AND 0FH
2171   05CD 0C               CM                ; (PLSCN)=7 ?
2172   05CE D0               JCP    RGC13
2173   05CF E0               JCP    RGC14
2174                 ;
2175   05D0 84       RGC13:  LDZ    F2
2176   05D1 58               TMB    ?Z         ; MR-Z ON ?
2177   05D2 D4               JCP    RGC15
2178   05D3 EC               JCP    RGC2
2179                 ;
2180   05D4 8C       RGC15:  LDZ    PLSCN
2181   05D5 98               LI     4 SHR 4 OR 8
2182   05D6 0C               CM
2183   05D7 EC               JCP    RGC2
2184   05D8 13               DED
2185   05D9 94               LI     4 AND 0FH
2186   05DA 0C               CM
2187   05DB EC               JCP    RGC2
2188   05DC 1515             LDI    OUTF1
2189   05DE 78               SMB    PPM        ; SET PPM
2190   05DF EC               JCP    RGC2
2191                 ;
2192                 ;
2193   05F0 85       RGC14:  LDZ    OUTF0
2194   05E1 78               SMB    MCC        ; SET MCC
2195                 ;
2196   05E2 7B       RGC11:  SMB    LMZ        ; SET LMP-S
2197   05E3 1513             LDI    OUTD
2198   05E5 7B               SMB    SSR1       ; SET SSR1
2199   05E6 38               L
2200   05E7 0E               OP
2201   05E8 151C             LDI    PLSC1
2202   05EA A829             CAL    PLC1       ; CLEAR & SET PLSC1
2203   05EC AD24     RGC2:   CAL    PLTSK
2204                 ;
2205                 ; TIMER TASK
2206                 ;
2207   05EE 81               LDZ    INB0
2208   05EF 58               TMB    SI         ; SIMULATION-SW ON ?
2209   05F0 F3               JCP    RGC20      ; N
2210                 ;
2211   05F1 A60E             JMP    RGC21      ; T, COUNT ONLY CL-
                                                                  49MS
2212                 ;
2213                 RGC20:
2214   05F3 151F             LDI    TM2
2215   05F5 1B               STC
2216   05F6 5A               TMB    TMON       ; TIMER ON ?
2217   05F7 0B               CLC               ; N
2218                 ;
2219   05F8 151D             LDI    TM2B       ; Y
2220   05FA AD1F             CAL    CNT3       ; COUNT RG-500MS
2221   05FC A600             JMP    RGC25
2222                 ;
2223   05FE                  ORG    600H
```

```
STNO E ADRS OBJ.    SOURCE STATEMENTS

2224                ;
2225   0600 153F    RGC25: LDI   TM4
2226   0602 1B              STC
2227   0603 5A              TMB   TMON      ; TIMER ON ?
2228   0604 0B              CLC             ; N
2229                ;
2230   0605 153D            LDI   RFGNT     ; Y
2231   0607 1D              INM             ; RECNT TIME OUT ?
2232   0608 D7              JCP   RGC22     ; N
2233                ;
2234   0609 9B              LI    TSCR      ; Y
2235   060A 02              S
2236                ;
2237                RGC23:
2238   060B 33              IND             ; DP=TM4B
2239   060C AD1F            CAL   CNT3      ; COUNT PLS-200MS
2240                ;
2241                RGC21:
2242   060E 152F            LDI   TM3
2243   0610 1B              STC
2244   0611 5A              TMB   TMON      ; TIMER ON ?
2245   0612 0B              CLC             ; N
2246                ;
2247   0613 13              DED             ; Y, DP=TM3B
2248   0614 AD1F            CAL   CNT3      ; COUNT CL-40MS
2249   0616 D9              JCP   RGC30
2250                ;
2251                RGC22:
2252   0617 0B              CLC
2253   0618 CB              JCP   RGC23
2254                ;
2255                ;
2256                RGC30:
2257   0619 5E              FBT   RGXX      ; MR-RGXX ON ?
2258   061A F9              JCP   RGC38
2259                ;
2260   061B 5F              FBT   RGXY      ; Y, MR-RGXY ON ?
2261   061C F6              JCP   RGC31     ; N
2262                ;
2263                ;
2264                RGC32:
2265   061D 81              LDZ   INB0
2266   061E 5B              TMB   SWF@      ; SW-F ON ?
2267   061F E9              JCP   RGC33     ; Y
2268                ;
2269   0620 84              LDZ   F2
2270   0621 58              TMB   ?Z        ; MR-X ON ?
2271   0622 E4              JCP   RGC37
2272   0623 E9              JCP   RGC33
2273   0624 152A    RGC37: LDI   F6
2274   0626 58              TMB   ?JM       ; MR-JM ON ?
2275   0627 A423            JMP   J1
2276                ;
2277                RGC33:                  ; Y
2278   0629 6E              RFB   RGXX      ; RESET MR-RGXX,
                                                     MR-RGXY
2279   062A 6F              RFB   RGXY
```

```
STNO E ADRS OBJ.    SOURCE STATEMENTS

2280                ;
2281   062B 86              LDZ   OUTG
2282   062C 68              RMB   KC        ; RESET KC
2283   062D 60              RPB   KC        ; OUTPUT KC
2284                ;
2285   062E 1525            LDI   OUTF2
2286   0630 78              SMB   CLRG      ; SET CLRG
2287                ;
2288   0631 AD77            CAL   OPF2      ; OUTPUT OUTF2
2289                ;
2290   0633 84              LDZ   F2
2291   0634 6A              RMB   ?CPS      ; RESET MR-CPS
2292   0635 48              RT
2293                ;
2294                RGC31:
2295   0636 1528            LDI   INA6
2296   0638 5B              TMB   SWRG      ; SW-RG ON ?
2297   0639 A648    RGC38:  JMP   RGC40
2298                ;
2299   063B 03              TIT             ; Y, RESET INT F/F
2300   063C 00              NOP
2301                ;
2302   063D 7F              SFB   RGXY      ; SET MR-RGXY
2303                ;
2304   063E BA              CZP   PLCRA     ; CLEAR & SET PLSCN
2305                ;
2306   063F 87              LDZ   OUTH
2307   0640 7B              SMB   BS        ; SET BS
2308   0641 38              L
2309   0642 0E              OP
2310                ;
2311   0643 151F            LDI   TM2
2312   0645 6A              RMB   TMON      ; RESET RG-500MS TIMER
2313   0646 A61D            JMP   RGC32
2314                ;
2315                ;
2316                RGC40:
2317   0648 1528            LDI   INA6
2318   064A 59              TMB   T@        ; T ON ?
2319   064B A430            JMP   E
2320                ;
2321   064D 48              RT              ; N
2322                ;
2323                ; *** COPY END TASK
2324                ;
2325                ;
2326                ;
2327                CPEND:
2328   064E 86              LDZ   OUTG
2329   064F 59              TMB   SOLBS     ; SOLBS ON ?
2330   0650 EF              JCP   CPE0      ; N
2331                ;
2332   0651 152A            LDI   F6
2333   0653 5B              TMB   FGMA
2334   0654 E6              JCP   CPE2
2335   0655 1538            LDI   INA7
2336   0657 58              TMB   M@
```

```
STNO E ADRS OBJ.    SOURCE STATEMENTS

2337   0658 48              RT
2338   0659 152A            LDI   F6
2339   065B 6B              RMB   FGMA
2340                   ;
2341   065C ACC4            CAL   ST1P0
2342                   ;
2343   065E 86              LDZ   OUTG
2344   065F 69              RMB   SOLBS      ; RESET SOLBS
2345   0660 1525            LDI   OUTF2
2346   0662 68              RMB   CLRG
2347   0663 3B              LM    3
2348   0664 69              RMB   PPD
2349   0665 48              RT
2350                   ;
2351   0666 9F         CPE2: LI    125 SHR 4 OR 8
2352   0667 8D              LDZ   125 AND 0FH
2353   0668 B9              CZP   JPLSCN     ; (PLSCN)=120 ?
2354   0669 A685            JMP   CPE1
2355   066B 152A            LDI   F6
2356   066D 7B              SMB   FGMA
2357   066E 48              RT
2358                   ;
2359                   ;
2360   066F 87         CPE0: LDZ   OUTH
2361   0670 5A              TMB   SSR3       ; SSR 3 ON ?
2362   0671 FC              JCP   CPE3
2363   0672 8F              LDZ   TM1
2364   0673 5B              TMB   TMOUT      ; 1S TIME OUT ?
2365   0674 48              RT
2366   0675 87              LDZ   OUTH
2367   0676 6A              RMB   SSR3
2368   0677 1513            LDI   OUTD
2369   0679 68              RMB   MTR
2370   067A AD6F            CAL   ST2P0
2371                   ;
2372   067C 8F         CPE3: LDZ   TM1
2373   067D 5B              TMB   TMOUT      ; SSR3-2S TIME OUT ?
2374   067E 48              RT               ; N
2375                   ;
2376   067F 1535            LDI   OUTF3      ; Y
2377   0681 6B              RMB   SOLB       ; RESET SOLB
2378                   ;
2379   0682 83              LDZ   F1
2380   0683 68              RMB   ?N         ; RESET MR-N
2381   0684 48              RT
2382                   ;
2383                   CPE1:
2384   0685 9E              LI    100 SHR 4 OR 8
2385   0686 84              LDZ   100 AND 0FH
2386   0687 B9              CZP   JPLSCN     ; (PLSCN)=100 ?
2387   0688 48              RT               ; N
2388                   ;
2389   0689 86              LDZ   OUTG       ; Y
2390   068A 6B              RMB   SOLF       ; RESET SOLF
2391   068B 48              RT
2392                   ;
```

```
STNO E ADRS OBJ.     SOURCE STATEMENTS

2393                 ; *** FBTCK
2394                 ;
2395                 ;
2396   068C 151C     FBTCK: LDI   PLSC1
2397   068E 5B              TMB   PSET      ; PLSC1 ON ?
2398   068F DB              JCP   FB03
2399   0690 9A       LI     40 SHR 4 OR 8
2400   0691 88              LDZ   40 AND 0FH
2401   0692 AD09            CAL   JPLS1     ; (PLSC1)=40 ?
2402   0694 DB              JCP   FB03
2403   0695 151C            LDI   PLSC1
2404   0697 6B              RMB   PSET      ; RESET PLSC1
2405   0698 3B              LM    3
2406   0699 A829            CAL   PLC1      ; CLEAR & SET PLSC2
2407   069B 152C     FB03:  LDI   PLSC2
2408   069D 5B              TMB   PSET      ; PLSC2 ON ?
2409   069E FE              JCP   FB06
2410                 ;
2411   069F 9C              LI    79 SHR 4 OR 8
2412   06A0 8F              LDZ   79 AND 0FH
2413   06A1 AD0D            CAL   JPLS2     ; (PLSC2)=82 ?
2414   06A3 FA              JCP   FB00
2415                 ;
2416   06A4 84              LDZ   F2        ; Y
2417   06A5 58              TMB   ?Z        ; MR-Z ON ?
2418   06A6 E8              JCP   FB04
2419   06A7 F0              JCP   FB02
2420                 ;
2421   06A8 152A     FB04:  LDI   F6
2422   06AA 58              TMB   ?JM       ; MR-JM ON ?
2423   06AB ED              JCP   FB05
2424   06AC F0              JCP   FB02
2425                 ;
2426                 ;
2427   06AD 59       FB05   TMB   ?JZ       ; MR-JZ ON ?
2428   06AE F4              JCP   FB01
2429   06AF 69              RMB   ?JZ       ; RESET MR-JZ
2430                 ;
2431   06B0 152C     FB02:  LDI   PLSC2
2432   06B2 6B              RMB   PSET      ; RESET PLSC2
2433   06B3 FE              JCP   FB06
2434                 ;
2435                 FB01:
2436   06B4 1519            LDI   INA1
2437   06B6 5A              TMB   SWT       ; SW-T ON ?
2438   06B7 A429            JMP   J2        ; N
2439                 ;
2440   06B9 F0              JCP   FB02      ; Y
2441                 ;
2442                 FB00:
2443   06BA 99              LI    26 SHR 4 OR 8
2444   06BB 8A              LDZ   26 AND 0FH
2445   06BC AD0D            CAL   JPLS2     ; (PLSC2)=26 ?
2446   06BE A5C2     FB06:  JMP   FB10
2447                 ;
2448   06C0 85              LDZ   OUTF0     ; Y
2449   06C1 6B              RMB   LMS       ; RESET LAMP-S
```

```
STNO E ADRS OBJ.    SOURCE STATEMENTS

2450                ;
2451   06C2 153C    FB10:  LDI   PLSC3
2452   06C4 5B             TMB   PSET      ; PLSC3 ON ?
2453   06C5 A6D3           JMP   FB20
2454                ;
2455   06C7 9D             LI    81 SHR 4 OR 8  ; Y
2456   06C8 81             LDZ   81 AND 0FH
2457   06C9 AD11           CAL   JPLS3     ; (PLSC3)=81 ?
2458   06CB D3             JCP   FB20
2459                ;
2460   06CC 153C           LDI   PLSC3
2461   06CE 6B             RMB   PSET      ; RESET PLSC4
2462                ;
2463   06CF 154A           LDI   PLSC4
2464   06D1 A829           CAL   PLC1      ; CLEAR & SET PLSC4
2465                ;
2466                FB20:
2467   06D3 154A           LDI   PLSC4
2468   06D5 5B             TMB   PSET      ; PLSC3 ON ?
2469   06D6 48             RT              ; N
2470                ;
2471   06D7 99             LI    28 SHR 4 OR 8  ; Y
2472   06D8 8C             LDZ   28 AND 0FH
2473   06D9 AD15           CAL   JPLS4     ; (PLSC4)=8 ?
2474   06DB E3             JCP   FB21
2475                ;
2476   06DC 1513           LDI   OUTD      ; Y
2477   06DE 6A             RMB   CNT       ; RESET CNT
2478                ;
2479   06DF 154A           LDI   PLSC4
2480   06E1 6B             RMB   PSET      ; RESET PLSC4
2481   06E2 48             RT
2482                ;
2483                FB21:
2484   06E3 99             LI    26 SHR 4 OR 8
2485   06E4 8A             LDZ   26 AND 0FH
2486   06E5 AD15           CAL   JPLS4     ; (PLSC4)=26 ?
2487   06E7 48             RT              ; N
2488                ;
2489   06E8 84             LDZ   F2        ; Y
2490   06E9 58             TMB   ?Z        ; MR-Z ON ?
2491   06EA EC             JCP   FB24
2492   06EB 48             RT
2493                ;
2494   06EC 152A    FB24:  LDI   F6
2495   06EE 58             TMB   ?JM       ; MR-JM ON ?
2496   06EF F1             JCP   FB22
2497   06F0 48             RT
2498                ;
2499                FB22:
2500   06F1 1519           LDI   INA1
2501   06F3 5A             TMB   SWT       ; SW-T ON ?
2502   06F4 F7             JCP   FB23      ; N
2503                ;
2504   06F5 A429           JMP   J2        ; Y
2505                ;
2506                FB23:
```

```
STNO E ADRS OBJ.     SOURCE STATEMENTS

2507   06F7 1513            LDI   OUTD
2508   06F9 7A              SMB   CNT        ; SET CNT
2509   06FA 48              RT
2510                 ;
2511                 ; *** ALL INPUT & OUTPUT
2512                 ; *** CONDITION SET
2513                 ;
2514   06FB                 ORG   700 H
2515                 ;
2516                 INOUT:
2517   0700 157F            LDI   RBX
2518   0702 93              LI    3          ; (X)=3
2519                 ;
2520                 INO01:
2521   0703 02              S
2522   0704 88              LDZ   OUT1       ; OUTPUT PORT 1
2523   0705 0E              OP
2524                 ;
2525   0706 40              IA               ; INPUT PORT A
                                                      (INA6.7)
2526   0707 4F              XHX
2527   0708 47              THX
2528   0709 02              S
2529                 ;
2530   070A 81              LDZ   INB0
2531   070B 32              IP               ; INPUT PORT B
                                                      (INB0, 1, 2)
2532   070C 4F              XHX
2533   070D 47              THX
2534   070E 02              S                ; DATA STORE
2535                 ;
2536   070F 157F            LDI   RGX
2537   0711 38              L
2538   0712 0F              DEC              ; (X)=0 ?
2539   0713 C3              JCP   INO01      ; NO
2540                 ;
2541                 ;
2542   0714 91              LI    1          ; YES
2543                 ;
2544                 INO02:
2545   0715 42              TAZ
2546                 ;
2547   0716 82              LDZ   OUTC0
2548   0717 4F              XHX
2549   0718 47              THX
2550   0719 38              L                ; DATA LOAD
2551   071A 0E              OP               ; OUTPUT PORT C
                                                         (OUTC0-3)
2552                 ;
2553   071B 85              LDZ   OUTF0
2554   071C 4F              XHX
2555   071D 47              THX
2556   071E 38              L                ; DATA LOAD
2557   071F 0E              OP               ; OUTPUT PORT F
                                                         (OUTF0-3)
2558                 ;
2559   0720 4A              XAZ
```

```
STNO E ADRS OBJ.    SOURCE STATEMENTS

2560   0721 42              TAZ
2561   0722 44              OE                  ; TIMING OUT  -T0, T1,
                                                                T2, T3
2562                  ;
2563   0723 40              IA                  ; INPUT PORT A(INA0-3)
2564   0724 89              LDZ   INA0
2565   0725 4F              XHX
2566   0726 47              THX
2567   0727 02              S
2568                  ;
2569   0728 90              LI    0
2570   0729 44              OE                  ; CLEAR PORT E
2571                  ;
2572   072A 157F            LDI   RGX
2573   072C 1D              INM                 ; (X)=(Y)+1
2574                  ;
2575   072D 157A            LDI   RGZ
2576   072F 38              L
2577   0730 08              AD                  ; (Z)+(Z)=0 ?
2578   0731 D5              JCP   INO02         ; N
2579                  ;
2580   0732 1513            LDI   OUTD          ; Y
2581   0734 38              L
2582   0735 0E              OP                  ; OUTPUT PORT D
2583                  ;
2584   0736 86              LDZ   OUTG
2585   0737 38              L
2586   0738 0E              OP                  ; OUTPUT PORT G
2587                  ;
2588   0739 87              LDZ   OUTH
2589   073A 38              L
2590   073B 0E              OP                  ; OUTPUT PORT H
2591                  ;
2592   073C 80              LDZ   SINB1
2593   073D 5B              TMB   ?FIX          ; MR-FIX ON ?
2594   073E A741            JMP   INO03         ; N
2595                  ;
2596   0740 48              RT
2597                  ;
2598                  INO03:
2599   0741 3D              XMI   1             ; DP=INB1
2600   0742 2D              XMD   1             ; DP=SINB1, (A)=(INB1)
2601   0743 02              S
2602   0744 6B              RMB   ?FIX          ; RESET MR-FIX
2603                  ;
2604                  INO04:
2605   0745 38              L
2606                  ;
2607   0746 1529            LDI   INA2
2608   0748 24              TAB   KT            ; KT ON ?
2609   0749 39              LM    1             ; N, DP=INA3
2610                  ;
2611   074A 38              L                   ; Y
2612                  ;
2613   074B 151A            LDI   CNDT
2614   074D 02              S
2615   074E 6B              RMB   PU            ; RESET PU OR PL
```

```
STNO E ADRS OBJ.    SOURCE STATEMENTS

2616   074F 48              RT
2617                ;
2618                ; *** PU OR PL CONTROL
2619                ;
2620                PUPL:
2621   0750 47              THX
2622                ;
2623   0751 5B              TMB   PU        ; PU OR PL ON ?
2624   0752 D9              JCP   PU0       ; N
2625                ;
2626   0753 82              LDZ   OUTC0     ; Y
2627   0754 4F              XHX             ; DP=OUTC2 OR OUTC3
2628   0755 90              LI    0
2629   0756 2A              XM    2         ; DP=OUTC0 OR OUTC1
2630   0757 78              SMB   LMPU      ; SET LAMP-PU OR
                                                      LAMP-PL
2631   0758 48              RT
2632                ;
2633                PU0:
2634   0759 82              LDZ   OUTC0
2635   075A 4F              XHX
2636   075B 3A              LM    2         ; DP=OUTC0 OR OUTC1
2637   075C 68              RMB   LMPU      ; RESET LAMP-PU OR
                                                      LAMP-PL
2638   075D 48              RT
2639                ;
2640                ; *** SU OR SL CONTROL
2641                ;
2642   075E                 ORG   780H
2643                ;
2644                SJ0:
2645   0780 4F              XHX             ; DP=OUTC2 OR OUTC3
2646   0781 90              LI    0
2647   0782 02              S
2648   0783 48              RT
2649                ;
2650                SJ1:
2651   0784 4F              XHX
2652   0785 94              LI    4
2653   0786 02              S
2654   0787 48              RT
2655                ;
2656                SJ2:
2657   0788 4F              XHX
2658   0789 90              LI    0
2659   078A 02              S
2660   078B 48              RT
2661                ;
2662                SJ3:
2663   078C 4F              XHX
2664   078D 92              LI    2
2665   078E 02              S
2666   078F 48              RT
2667                ;
2668                SJ4:
2669   0790 4F              XHX
2670   0791 98              LI    8
```

```
STNO E ADRS OBJ.    SOURCE STATEMENTS

2671   0792 02              S
2672   0793 48              RT
2673                ;
2674                SJ5:
2675   0794 4F              XHX
2676   0795 91              LI     1
2677   0796 02              S
2678   0797 48              RT
2679                ;
2680                SJ6:
2681   0798 4F              XHX
2682   0799 92              LI     2
2683   079A 02              S
2684   079B 48              RT
2685                ;
2686                SJ7:
2687   079C 4F              XHX
2688   079D 90              LI     0
2689   079E 02              S
2690   079F 48              RT
2691                ;
2692                ; * ENTRY OF SUSL
2693                ;
2694                SUSL:
2695   07A0 58              TMB    LMPU       ; LAMP-PU OR LAMP-PL
                                                          ON ?
2696   07A1 E6              JCP    SUS0       ; N
2697                ;
2698   07A2 96              LI     6          ; Y, DUMMY TIME
2699   07A3 0F              DEC
2700   07A4 E3              JCP    $-1
2701   07A5 48              RT
2702                ;
2703                SUS0:
2704   07A6 3A              LM     2          ; DP=OUTC2 OR OUTC3
2705   07A7 47              THX
2706                ;
2707   07A8 89              LDZ    INA0
2708   07A9 4F              XHX               ; DP=INA2 OR INA3
2709   07AA 47              THX
2710   07AB 38              L
2711                ;
2712   07AC 153A            LDI    W1
2713   07AE 02              S
2714   07AF 6B              RMB    PO
2715   07B0 38              L                 ; (A)=SU OR SL
2716                ;
2717   07B1 82              LDZ    OUTC0
2718   07B2 41              JPA
2719                ;
2720                ; *** PORT & LATCH ALL CLEAR
2721                ;
2722                PNLAL:
2723   07B3 88              LDZ    OUT1
2724   07B4 90              LI     0
2725   07B5 0E              OP
2726   07B6 13              DED
```

```
STNO E ADRS OBJ.    SOURCE STATEMENTS

2727   07B7 F5              JCP   $-2
2728                ;
2729   07B8 9F              LI    0FH
2730   07B9 44              OE
2731   07BA 90              LI    0
2732   07BB 44              OE
2733   07BC 48              RT
2734                ;
2735                ; *** RAM CLEAR
2736                ;
2737   07BD                 ORG   7C0H
2738                RCLR:
2739   07C0 90              CLA
2740   07C1 29              XM    1
2741   07C2 90              CLA
2742   07C3 2B              XM    3
2743   07C4 90              CLA
2744   07C5 29              XM    1
2745   07C6 90              CLA
2746   07C7 3F              XMI   3
2747   07C8 C0              JCP   RCLR
2748   07C9 48              RT
2749   0000                 END
ERROR = 0000


** ASSEMBLE END **
0001                ;
0002                ;
0003                ;   EM090-S    (SF4)
0004                ;
0005                ;  < CONSOLE CONTROL >
0006                ;
0007                ;       1979.11.5
0008                ;
0009                ;                    BY A. KATSUMATA
0010                ;
0011   0000         ABUFF  EQU  0
0012   0010         ABUF1  EQU  10H
0013   0020         ABUF2  EQU  20H
0014   0030         ABUF3  EQU  30H
0015   0001         BBUFF  EQU  1
0016   0005         FBUFF  EQU  5
0017   0006         GBUFF  EQU  6
0018   0007         HBUFF  EQU  7
0019   0017         HBUF1  EQU  17H
0020   0027         HBUF2  EQU  27H
0021   0037         HBUF3  EQU  37H
0022   0008         IBUFF  EQU  8
0023   0018         BBUF1  EQU  18H
0024                ;
0025   0003         TNCNT  EQU  03H
0026   000F         CPSE0  EQU  0FH
0027   000E         CPSE1  EQU  0EH
0028   001F         CPCN0  EQU  1FH
0029   001E         CPCN1  EQU  1EH
0030   002F         CPCNX  EQU  2FH
```

```
STNO E ADRS OBJ.    SOURCE STATEMENTS

0031    000D        ISET0   EQU   0DH
0032    000C        ISET1   EQU   0CH
0033    001D        ICN0    EQU   1DH
0034    001C        ICN1    EQU   1CH
0035    002D        ICNX0   EQU   2DH
0036    002C        ICNX1   EQU   2CH
0037    003F        TCN0    EQU   3FH
0038    003E        TCN1    EQU   3EH
0039    004F        TCNX0   EQU   4FH
0040    004E        TCNX1   EQU   4EH
0041                ;
0042    0014        F1      EQU   14H
0043    0024        F2      EQU   24H
0044    0034        F3      EQU   34H
0045    0011        F4      EQU   11H
0046    0021        F5      EQU   21H
0047    0016        F6      EQU   16H
0048    0031        F7      EQU   31H
0049    0004        F8      EQU   04H
0050    0009        ALKY    EQU   9
0051    000A        FKY     EQU   0AH
0052    000B        KEYCT   EQU   0BH
0053    0025        IRDKT   EQU   25H
0054    007F        TIMNG   EQU   7FH
0055    0043        TM60    EQU   43H
0056    0015        TMBZ    EQU   15H
0057    0072        TM2S    EQU   72H
0058                ;
0059    0001        CNT     EQU   1
0060    0000        SWY     EQU   0
0061    0001        SWAD    EQU   1
0062    0002        CN      EQU   2
0063    0003        CNX     EQU   3
0064    0000        OK      EQU   0
0065    0001        LM0     EQU   1
0066    0002        TR      EQU   2
0067    0003        CPX     EQU   3
0068    0000        PU      EQU   0
0069    0001        PL      EQU   1
0070    0002        SC      EQU   2
0071    0003        DK      EQU   3
0072    0000        MTR     EQU   0
0073    0001        J       EQU   1
0074    0002        TN      EQU   2
0075    0003        W       EQU   3
0076    0000        LMPG    EQU   0
0077    0001        BZ      EQU   1
0078    0002        KT      EQU   2
0079    0003        RD      EQU   3
0080    0000        CP      EQU   0
0081    0001        ST      EQU   1
0082    0002        LMPA    EQU   2
0083    0003        LMPB    EQU   3
0084    0000        LMPSC   EQU   0
0085    0001        LMPJ    EQU   1
0086    0002        LMPTN   EQU   2
```

```
STNO E ADRS OBJ.     SOURCE STATEMENTS

0087   0003          LMPDK  EQU  3
0088   0000          LMPW   EQU  0
0089   0001          LMPC   EQU  1
0090   0002          LMPD   EQU  2
0091   0003          LMPE   EQU  3
0092   0000          FGCH   EQU  0
0093   0001          FGCLR  EQU  1
0094   0002          FCPUP  EQU  2
0095   0003          FCPST  EQU  3
0096   0000          FGLM   EQU  0
0097   0001          FGCNT  EQU  1
0098   0002          FGCNX  EQU  2
0099   0003          FGCN   EQU  3
0100   0000          FGEA   EQU  0
0101   0001          FGEB   EQU  1
0102   0002          FGEC   EQU  2
0103   0003          FGED   EQU  3
0104   0000          FGTN1  EQU  0
0105   0001          FGTN2  EQU  1
0106   0002          FGTN3  EQU  2
0107   0003          FG1T1  EQU  3
0108   0000          F60ON  EQU  0
0109   0001          F60UP  EQU  1
0110   0002          F2SON  EQU  2
0111   0003          F2SUP  EQU  3
0112   0002          AKPQ   EQU  2
0113   0002          FKRQ   EQU  2
0114   0000          FAKY   EQU  0
0115   0001          FFKY   EQU  1
0116   0002          DSP0   EQU  2
0117   0003          KYIN   EQU  3
0118   0002          IKT    EQU  2
0119   0003          IRD    EQU  3
0120   0000          T0     EQU  0
0121   0001          T1     EQU  1
0122   0002          T2     EQU  2
0123   0003          T3     EQU  3
0124                 ;
0125   0046          N      EQU  70          ; SCAN 7 MS
0126                 ; C60=60SEC/SCAN TIME
0127   000A          C600   EQU  0AH         ; C60 AND 0FH
0128   000B          C601   EQU  0BH         ; C60 SHR 4 AND 0FH
0129   0001          C602   EQU  0CH         ; C60 SHR 8 AND 0FH
0130   0001          C603   EQU  01H         ; C60 SHR 12
0131   000E          CBZ    EQU  1000/N
0132                 ;
0133   013A          C2P2   EQU  22000/N
0134   000A          C200   EQU  C2P2 AND 0FH
0135   0003          C201   EQU  C2P2 SHR 4 AND 0FH
0136   0001          C202   EQU  C2P2 SHR 8 AND 0FH
0137                 ;
0138                 ;
0139                 ; PROGRAM START
0140                 ;
0141   0000 AC60           CAL  IOCLR
0142   0002 A02A           JMP  START
0143                 ;
```

```
STNO E ADRS OBJ.     SOURCE STATEMENTS

0144                 ; LAMP G ON
0145                 ;
0146   0004 85       GON:    LDZ  FBUFF
0147   0005 78               SMB  LMPG
0148   0006 48               RT
0149   0007 00               NOP
0150                 ;
0151                 ; LAMP G OFF
0152                 ;
0153   0008 85       GOFF:   LDZ  FBUFF
0154   0009 68               RMB  LMPG
0155   000A 48               RT
0156   000B 00               NOP
0157                 ;
0158                 ; KEY COUNTER 2SET
0159                 ;
0160   000C 8B       KYCN2:  LDZ  KEYCT
0161   000D 92               LI   2
0162   000E 02               S
0163   000F 48               RT
0164                 ;
0165                 ; ECPST 1
0166                 ;
0167   0010 1514     CPST1:  LDI  F1
0168   0012 7B               SMB  FCPST
0169   0013 48               RT
0170                 ;
0171                 ; FCPST 0
0172                 ;
0173   0014 1514     CPSTO:  LDI  F1
0174   0016 6B               RMB  FCPST
0175   0017 48               RT
0176                 ;
0177                 ; FCPUP 1
0178                 ;
0179   0018 1514     CPUP1:  LDI  F1
0180   001A 7A               SMB  FCPUP
0181   001B 48               RT
0182                 ;
0183                 ; FCPUP 0
0184                 ;
0185   001C 1514     CUPU0:  LDI  F1
0186   001E 6A               RMB  FCPUP
0187   001F 48               RT
0188                 ;
0189                 ; FGCN 1
0190                 ;
0191   0020 1524     FGCN1:  LDI  F2
0192   0022 7B               SMB  FGCN
0193   0023 48               RT
0194                 ;
0195                 ; FGCN 0
0196                 ;
0197   0024 1524     FGCN0:  LDI  F2
0198   0026 6B               RMB  FGCN
0199   0027 48               RT
0200                 ;
```

```
STNO E ADRS OBJ.    SOURCE STATEMENTS

0201                ;
0202                ;
0203   0028 A200    SCAN:  JMP   SCAN0
0204                ;
0205                ;
0206                ;
0207   002A AB00    START: CAL   CLER
0208   002C ADA3           CAL   LAMPA
0209   002E A808           CAL   GOFF
0210   0030 B4             CZP   CPST1
0211   0031 85      S100:  LDZ   FBUFF
0212   0032 7B             SMB   RD
0213   0033 AC00           CAL   SET1
0214   0035 B3             CZP   KYCN2
0215   0036 A99A    S101:  CAL   TMS60
0216                ;
0217                ;
0218   0038 BA      A:     CZP   SCAN
0219   0039 1521           LDI   F5
0220   003B 5A             TMB   F2SON      ; 2S TIMER SER ?
0221   003C A04A           JMP   A005
0222   003E 90             LI    0
0223   003F 1516           LDI   F6
0224   0041 34             CMB   FGEA
0225   0042 F5             JCP   A003
0226   0043 35             CMB   FGEB
0227   0044 F5             JCP   A003
0228   0045 1531           LDI   F7
0229   0047 5B             TMB   FG1T1
0230   0048 F5             JCP   A003
0231   0049 DE             JCP   A002
0232                ;
0233   004A 1516    A005:  LDI   F6
0234   004C 58             TMB   FGEA       ; FGEA=1 ?
0235   004D CF             JCP   A006
0236   004E D6             JCP   A007
0237                ;
0238   004F 59      A006   TMB   FGEB       ; FGEB=1 ?
0239   0050 DA             JCP   A008
0240   0051 69             RMB   FGEB       ; FGEB<-0
0241   0052 5A             TMB   FGEC       ; FGEC=1 ?
0242   0053 A95E           CAL   SUBB
0243   0055 DA             JCP   A008
0244                ;
0245   0056 68      A007   RMB   FGEA       ; FGEA<-0
0246   0057 5B             TMB   FGED       ; FGED=1 ?
0247   0058 A983           CAL   SUBA
0248                ;
0249   005A 1516    A008   LDI   F6
0250   005C 6A             RMB   FGEC       ; FGEC -0
0251   005D 6B             RMB   FGED       ; FGED<-1
0252   005E 1530    A002   LDI   ABUF3
0253   0060 5A             TMB   TN
0254   0061 E8             JCP   A010
0255   0062 33             IND              ; DP=F7
0256   0063 68             RMB   FGTN1
0257   0064 6A             RMB   FGTN3
```

```
STNO E ADRS OBJ.    SOURCE STATEMENTS

0258   0065 AC6A          CAL  TCNST
0259   0067 F0            JCP  A009
0260   0068 33     A010:  IND
0261   0069 59            TMB  FGTN2
0262   006A EC            JCP  A011
0263   006B F0            JCP  A009
0264   006C 7A     A011:  SMB  FGTN3
0265   006D A99A          CAL  TMS60
0266   006F F5            JCP  A003
0267   0070 1510   A009:  LDI  ABUF1
0268   0072 58            TMB  OK        ; OK ON(L) ?
0269   0073 A081          JMP  A100
0270   0075 B2     A003:  CZP  GOFF
0271   0076 1521   A001:  LDI  F5
0272   0078 59            TMB  F60UP     ; 60 SEC UP ?
0273   0079 BE            CZP  A
0274   007A B4            CZP  CPST1
0275   007B B7            CZP  CPUP0
0276   007C 1517          LDI  HBUF1
0277   007E 6B            RMB  LMPE      ; LMPE OFF
0278   007F A031          JMP  S100
0279                ;
0280   0081 B1     A100:  CZP  GON
0281   0082 80            LDZ  ABUFF
0282   0083 58            TMB  SWY       : Y ON ?
0283   0084 A076          JMP  A001
0284   0086 B2            CZP  GOFF
0285   0087 86            LDZ  GBUFF
0286   0088 78            SMB  CP        ; CP ON
0287   0089 69            RMB  ST        ; ST OFF
0288   008A 150B          LDI  KEYCT
0289   008C 90            CLA
0290   008D 02            S
0291   008E 1514          LDI  F1
0292   0090 69            RMB  FGCLR
0293   0091 1531          LDI  F7
0294   0093 6B            RMB  FG1T1     ; RESET FG1T1
0295   0094 8E            LDZ  CPSE1
0296   0095 91            LI   1
0297   0096 90     A101:  LI   0
0298   0097 0C            CM
0299   0098 DE            JCP  A1001
0300   0099 33            IND
0301   009A D6            JCP  A101
0302   009B 1531          LDI  F7
0303   009D 7B            SMB  FG1T1
0304   009E AC54   A1001: CAL  CNUP
0305   00A0 E2            JCP  A1002
0306   00A1 E6            JCP  A110
0307                ;
0308   00A2 1514   A1002: LDI  F1
0309   00A4 5A            TMB  FCPUP     ; FCPUP=1 ?
0310   00A5 EE            JCP  A111
0311   00A6 B7     A110:  CZP  CPUP0
0312   00A7 B4            CZP  CPST1
0313   00A8 1514          LDI  F1
0314   00AA 68            RMB  FGCH
```

```
STNO E ADRS OBJ.    SOURCE STATEMENTS

0315   00AB AC12            CAL  CNSET
0316   00AD F1              JCP  A112
0317                ;
0318   00AE 58       A111:  TMB  FGCH       ; FGCH=1 ?
0319   00AF F1              JCP  A112
0320   00B0 E6              JCP  A110
0321                ;
0322   00B1 1514     A112:  LDI  F1
0323   00B3 5B              TMB  FCPST      ; FCPST ON ?
0324   00B4 F7              JCP  A113
0325   00B5 AC12            CAL  CNSET
0326                ;
0327   00B7 1517     A113:  LDI  HBUF1
0328   00B9 38              L
0329   00BA 1516            LDI  F6
0330   00BC 27              TAB  LMPE       ; LMP E ON ?
0331   00BD A0C1            JMP  A114
0332   00BF 7B              SMB  FGED       ; FLAG FD<-1
0333   00C0 C2              JCP  A115
0334   00C1 7A       A114:  SMB  FGEC       ; FLAG EC<-1
0335   00C2 BA       A115:  CZP  SCAN
0336   00C3 1510            LDI  ABUF1
0337   00C5 5B              TMB  CPX        ; CPX ON ?
0338   00C6 CA              JCP  A116
0339   00C7 86              LDZ  GBUFF
0340   00C8 68              RMB  CP         ; RESET CP
0341   00C9 D1              JCP  A120
0342   00CA 86       A116:  LDZ  GBUFF
0343   00CB 58              TMB  CP         ; CP ON ?
0344   00CC E4              JCP  A1213
0345   00CD 59              TMB  ST         ; ST ON ?
0346   00CE A0B7            JMP  A113
0347   00D0 E4              JCP  A1213
0348                ;
0349                ;
0350   00D1 BA       A120   CZP  SCAN
0351   00D2 A99A            CAL  TMS60
0352   00D4 BA              CZP  SCAN
0353                ;
0354   00D5 1524     A1202: LDI  F2
0355   00D7 5B              TMB  FGCN       ; FGCN=1 ?
0356   00D8 DA              JCP  A121
0357   00D9 F5              JCP  A128
0358   00DA 80       A121:  LDZ  ABUFF
0359   00DB 5A              TMB  CN         ; CN ON(L) ?
0360   00DC E6              JCP  A122
0361   00DD 1510            LDI  ABUF1
0362   00DF 5B              TMB  CPX
0363   00E0 E2              JCP  A1212
0364   00E1 D1              JCP  A120
0365   00E2 86       A1212: LDZ  GBUFF
0366   00E3 79              SMB  ST         ; SET ST
0367   00E4 A153     A1213: JMP  AAA
0368                ;
0369   00E6 AC2A     A122:  CAL  CPCNT       ; COPY COUNT
0370   00E8 B8              CZP  FGCN1
0371   00E9 1530            LDI  ABUF3
```

```
STNO E ADRS OBJ.    SOURCE STATEMENTS

0372   00EB 5A              TMB   TN
0373   00EC EE              JCP   A126
0374   00ED F5              JCP   A128
0375   00EE AC70     A126:  CAL   TNCHK
0376   00F0 F5              JCP   A128
0377   00F1 1531            LDI   F7
0378   00F3 78              SMB   FGTN1
0379   00F4 69              RMB   FGTN2
0380   00F5 A100     A128:  JMP   A125
0381                ;
0382                ;
0383   00F7                 ORG   100H
0384                ;
0385                ;
0386   0110 80       A125:  LDZ   ABUFF
0387   0101 5A              TMB   CN          ; CN ON(L) ?
0388   0102 C4              JCP   A130
0389   0103 B9              CZP   FGCN0
0390   0104 B5       A130:  CZP   CPST0       ; FCPST=0
0391   0105 86              LDZ   GBUFF
0392   0106 59              TMB   ST          ; ST ON ?
0393   0107 CC              JCP   A1301
0394   0108 1514     A1304: LDI   F1
0395   010A 79              SMB   FGCLR       ; SET FGCLR
0396   010B DC              JCP   A131
0397   910C AC54     A1301: CAL   CNUP        ; COPY COUNT UP ?
0398   010E D0              JCP   A1303
0399   010F D8              JCP   A1302
0400   0110 1531     A1303: LDI   F7
0401   0112 58              TMB   FGTN1
0402   0113 A0D1            JMP   A120
0403   0115 86              LDZ   GBUFF
0404   0116 79              SMB   ST
0405   0117 C8              JCP   A1304
0406   0118 B6       A1302: CZP   CPUP1
0407   0119 86              LDZ   GBUFF
0408   011A 79              SMB   ST          ; ST ON
0409   011B 7E              SFB   DSP0
0410   011C B9       A131:  CZP   FGCN0
0411   011D BA       A135:  CZP   SCAN
0412   011E 1510            LDI   ABUF1
0413   0120 90              LI    0
0414   0121 37              CMB   CPX         ; CPX ON ?
0415   0122 DD              JCP   A135
0416   0123 A9DF            CAL   TMS2S
0417   0125 BA       A133:  CZP   SCAN
0418   0126 1521            LDI   F5
0419   0128 5A              TMB   F2SON
0420   0129 F3              JCP   A138
0421   012A 1516            LDI   F6
0422   012C 58              TMB   FGEA
0423   012D EF              JCP   A132
0424   012E E5              JCP   A133
0425   012F 1531     A132:  LDI   F7
0426   0131 5B              TMB   FG1T1
0427   0132 E5              JCP   A133
0428   0133 6E       A138:  RFB   DSP0
```

```
STNO E ADRS OBJ.    SOURCE STATEMENTS

0429   0134 1510          LDI   ABUF1
0430   0136 5A            TMB   TR
0431   0137 F9            JCP   A139
0432   0138 FD            JCP   A1341
0433   0139 1514   A139:  LDI   F1
0434   013B 59            TMB   FGCLR     ; FGCLR=1 ?
0435   013C FF            JCP   A137
0436   013D A155   A1341: JMP   AA
0437   013F 80     A137:  LDZ   ABUFF
0438   0140 59            TMB   SWAD      ; SWITCH AD ?
0439   0141 D5            JCP   AA
0440                ;
0441   0142 8E            LDZ   CPSE1     ; CPCNX=CPSET
0442   0143 3A            LM    2
0443   0144 3E            XMI   2
0444   0145 3A            LM    2
0445   0146 02            S
0446   0147 D5            JCP   AA
0447                ;
0448                ;
0449   0148 8E     AA0:   LDZ   CPSE1
0450   0149 91            LI    1
0451   014A 90     AA1:   LI    0
0452   014B 0C            CM              ; CPSE1=1 ?
0453   014C 48            RT
0454   014D 33            IND
0455   014E CA            JCP   AA1
0456   014F 8B            LDZ   KEYCT     ; KEY COUNTER SET
0457   0150 92            LI    2
0458   0151 02            S
0459   0152 48            RT
0460                ;
0461   0153 A9DF   AAA:   CAL   TMS2S
0462   0155 A948   AA:    CAL   AA0
0463   0157 86            LDZ   GBUFF
0464   0158 68            RMB   CP        ; CP OFF
0465   0159 1514          LDI   F1
0466   015B 69            RMB   FGCLR     ; RESET FGCLR
0467   015C A036          JMP   S101
0468                ;
0469                ;
0470                ; SUB B
0471                ;
0472   015E 8E     SUBB:  LDZ   CPSE1
0473   015F 4C            XLS
0474   0160 8C            LDZ   ISET1
0475   0161 A9B3          CAL   MOVE
0476                ;
0477   0163 151E          LDI   CPCN1     ; CPCN->TCN
0478   0165 3A            LM    2
0479   0166 3E            XM1   2
0480   0167 E5            JCP   $-2
0481   0168 152E          LDI   CPCNX-1
0482   016A 38            L
0483   016B 154E          LDI   TCNX1
0484   016D 02            S
0485   016E 152F          LDI   CPCNX
```

```
STNO E ADRS OBJ.    SOURCE STATEMENTS

0486   0170 38              L
0487   0171 154F            LDI    TCNX0
0488   0173 02              S
0489                 ;
0490   0174 8B              LDZ    KEYCT      ; KEY CNTR 0
0491   0175 90              LI     0
0492   0176 02              S
0493   0177 A948            CAL    A0
0494   0179 1514            LDI    F1
0495   017B 68              RMB    FGCH       ; RESET FGCH
0496   017C 1534            LDI    F3
0497   017E A982            CAL    SUBB1
0498   0180 1525            LDI    IRDKT
0499   0182 D2       SUBB1: JCP    SUBA1
0500                 ;
0501                 ; SUB A
0502                 ;
0503   0183 8C       SUBA:  LDZ    ISET1
0504   0184 4C              XLS
0505   0185 8E              LDZ    CPSE1
0506   0186 A9B3            CAL    MOVE
0507                 ;
0508   0188 B3              CZP    KYCN2
0509   0189 AC00            CAL    SET1
0510   018B 1514            LDI    F1
0511   018D A992            CAL    SUBA1
0512   018F B7              CZP    CPUP0
0513   0190 B4              CZP    CPST1
0514   0191 85              LDZ    FBUFF
0515   0192 3A       SUBA1: LM     2
0516   0193 7B              SMB    IRD
0517   0194 27              TAB    RD
0518   0195 6B              RMB    IRD
0519   0196 7A              SMB    IKT
0520   0197 26              TAB    KT
0521   0198 6A              RMB    IKT
0522   0199 48              RT
0523                 ;
0524                 ; 60 SEC TIMER SET
0525                 ;
0526   019A 1521     TMS60: LDI    F5
0527   019C 78              SMB    F600N      ; T600N SET
0528   019D 69              RMB    F60UP
0529   019E 1543            LDI    TM60
0530   01A0 9A              LI     C600
0531   01A1 2C              XD
0532   01A2 9B              LI     C601
0533   01A3 2C              XD
0534   01A4 9C              LI     C602
0535   01A5 2C              XD
0536   01A6 91              LI     C603
0537   01A7 02              S
0538   01A8 48              RT
0539                 ;
0540                 ; BZ ON
0541                 ;
0542   01A9 85       BZON:  LDZ    FBUFF
```

```
STNO E ADRS OBJ.     SOURCE STATEMENTS

0543   01AA 79               SMB   BZ        ; BZ ON
0544   01AB 1515             LDI   TMBZ      ; 100 MS SET
0545   01AD 9E               LI    CBZ
0546   01AE 02        S
0547   01AF 86               LDZ   GBUFF
0548   01B0 79               SMB   ST
0549   01B1 68               RMB   CP        ; RESET CP
0550   01B2 48               RT
0551                  ;
0552                  ;
0553                  ; BLOCK MOVE (DP)->(S)
0554                  ;
0555   01B3 38        MOVE:  L
0556   01B4 4C               XLS
0557   01B5 3C               XI
0558   01B6 4C               XLS
0559   01B7 33               IND
0560   01B8 38               L
0561   01B9 4C               XLS
0562   01BA 29               XM    1
0563   01BB 4C               XLS
0564   01BC 38               L
0565   01BD 4C               XLS
0566   01BE 2C               XD
0567   01BF 4C               XLS
0568   01C0 13               DED
0569   01C1 38               L
0570   01C2 4C               XLS
0571   01C3 2B               XM    3
0572   01C4 4C               XLS
0573   01C5 38               L
0574   01C6 4C               XLS
0575   01C7 3C               XI
0576   01C8 4C               XLS
0577   01C9 33               IND
0578   01CA 38               L
0579   01CB 4C               XLS
0580   01CC 28               X
0581   01CD 48               RT
0582                  ;
0583                  ; BLANK (1)
0584                  ;
0585   01CE 22        BLNK0: FBF   DSP0
0586   01CF 48               RT
0587   01D0 152F             LDI   CPCNX
0588   01D2 A9D6             CAL   BLNK1
0589                  ;
0590   01D4 151F             LDI   CPCN0
0591   01D6 90        BLNK1: LI    0
0592   01D7 0C               CM
0593   01D8 48               RT
0594   01D9 13               DED
0595   01DA 0C               CM
0596   01DB 48               RT
0597   01DC 9A               LI    0AH
0598   01DD 02               S
0599   01DE 48               RT
```

```
STNO E ADRS OBJ.    SOURCE STATEMENTS

0600                ;
0601   01DF 1521    TMS2S: LDI   F5
0602   01E1 7A             SMB   F2SON
0603   01E2 6B             RMB   F2SUP
0604   01E3 1572           LDI   TM2S
0605   01E5 9A             LI    C200
0606   01E6 2C             XD
0607   01E7 93             LI    C201
0608   01E8 2C             XD
0609   01E9 91             LI    C202
0610   01EA 02             S
0611   01EB 48             RT
0612                ;
0613                ;
0614   01EC                 ORG   200H
0615                ;
0616                ; SCAN SUBROUTINE
0617                ;
0618   0200 A9CE    SCAN0: CAL   BLNK0
0619   0202 AD49           CAL   INOUT
0620   0204 ADB1           CAL   BLNK2
0621   0206 5F             FBT   KYIN      ; KEY INP ?
0622   0207 A2DB           JMP   SCA40     ; NO
0623   0209 4A             XAZ
0624   020A 42             TAZ
0625   020B 17CF           CI    0FH       ; FKY ?
0626   020D F3             JCP   SCA10
0627   020E 1516           LDI   F6
0628   0210 58             TMB   FGEA      ; FGEA=1 ?
0629   0211 D3             JCP   SCA00
0630   0212 F1             JCP   SCA09
0631   0213 21      SCA00: FBF   FFKY      ; FFKY=0 ?
0632   0214 F1             JCP   SCA09
0633   0215 8A             LDZ   FKY
0634   0216 5A             TMB   FKRQ      ; AT CHATA ?
0635   0217 EE             JCP   SCA03
0636   0218 7D             SFB   FFKY      ; FFKY SET
0637                ;
0638   0219 AC00    KEYF:  CAL   SET1      ; * F-KEY *
0639   021B B3             CZP   KYCN2
0640   021C B6             CZP   CPUP1
0641   021D 6E             RFB   DSP0
0642   021E AC95           CAL   CPXCK
0643   0220 E4             JCP   SCA01
0644   0221 A99A           CAL   TMS60     ; 60S TIMER SET
0645   0223 EA             JCP   SCA02
0646   0224 1514    SCA01: LDI   F1
0647   0226 79             MSB   FGCLR     ; SET FGCLR
0648   0227 1531           LDI   F7
0649   0229 6B             RMB   FG1T1
0650   022A A9A9    SCA02: CAL   BZON
0651   022C 7C      SCA04: SFB   FAKY      ; FAKY SET
0652   022D F1             JCP   SAC09
0653                ;
0654   022E 7A      SCA03: SMB   FKRQ
0655   022F 81             LDZ   BBUFF
0656   0230 02             S
```

```
STNO E ADRS OBJ.     SOURCE STATEMENTS

0657   0231 A30E     SCA09: JMP   SCA50
0658                 ;
0659                 ;
0660   0233 20       SCA10: FBF   FAKY      ; FAKY=0 ?
0661   0234 F1              JCP   SCA09
0662   0235 89              LDZ   ALKY
0663   0236 5A              TMB   AKRQ      ; AT CHATA ?
0664   0237 FD              JCP   SCA11
0665   0238 81              LDZ   BBUFF
0666   0239 0C              CM              ; KEY EQU ?
0667   023A FD              JCP   SCA11
0668   023B A243            JMP   SCA20
0669   023D 81       SCA11: LDZ   BBUFF
0670   023E 02              S
0671   023F 89              LDZ   ALKY
0672   0240 7A              SMB   AKRQ
0673   0241 A30E            JMP   SCA50
0674                 ;
0675   0243 0B       SCA20: CLC             ; * KEY SHORI *
0676   0244 96              LI    6
0677   0245 81              LDZ   BBUFF
0678   0246 09              ADS             ; TEN KEY ?
0679   0247 A296            JMP   KEY10     ; YES
0680   0249 1510     SCA23: LDI   ABUF1
0681   024B 5A              TMB   TR
0682   024C CE              JCP   SCA24
0683   024D DF              JCP   SCA25
0684                 ;
0685   024E 1531     SCA24: LDI   F7
0686   0250 5A              TMB   FGTN3
0687   0251 D3              JCP   SCA26
0688   0252 DF              JCP   SCA25
0689                 ;
0690   0253 1520     SCA26: LDI   ABUF2
0691   0255 5B              TMB   DK
0692   0256 DF              JCP   SCA25
0693   0257 26              TAB   2         ; NO(A-E KEY) KEY=E ?
0694   0258 DB       JCP    SCA22
0695   0259 A2BB            JMP   KEYE
0696   025B 1516     SCA22: LDI   F6
0697   025D 58              TMB   FGEA      ; FGEA ON ?
0698   025E E1              JCP   SCA21
0699   025F A30E     SCA25: JMP   SCA50
0700                 ;
0701   0261 25       SCA21: TAB   1         ; KEY=AB OR CD ?
0702   0262 E4              JCP   KEYAB
0703   0263 F3              JCP   KEYCD
0704                 ;
0705                 ;
0706   0264 85       KEYAB: LDZ   FBUFF     ; * A OR B KEY *
0707   0265 4A              XAZ
0708   0266 17CB            CI    0BH
0709   0268 EE              JCP   KEYA1
0710   0269 5A              TMB   KT        ; * B-KEY *
0711   026A A22C     KEYB1: JMP   SCA04
0712   026C 6A              RMB   KT
0713   026D FC              JCP   SCA33
```

```
STNO E ADRS OBJ.    SOURCE STATEMENTS

0714   026E 5A      KEYA1: TMB   KT        ; * A-KEY *
0715   026F F1             JCP   KEYA2
0716   0270 EA             JCP   KEYB1
0717   0271 7A      KEYA2: SMB   KT
0718   0272 FC             JCP   SCA33
0719                ;
0720                ;
0721   0273 85      KEYCD: LDZ   FBUFF     ; * C OR D KEY *
0722   0274 4A             XAZ
0723   0275 17CD           CI    0DH
0724   0277 FE             JCP   KEYC1
0725   0278 5B             TMB   RD        ; * D-KEY *
0726   0279 EA             JCP   KEYB1
0727   027A 85             LDZ   FBUFF
0728   027B 6B             RMB   RD
0729   027C A285    SCA33: JMP   SCA30
0730   027E 5B      KEYC1: TMB   RD        ; * C-KEY *
0731   027F A283           JMP   KEYC2
0732   0281 A26A           JMP   KEYB1
0733   0283 85      KEYC2: LDI   FBUFF
0734   0284 7B             SMB   RD
0735                ;
0736   0285 AC95    SCA30: CAL   CPXCK
0737   0287 CB             JCP   SCA31
0738   0288 A99A           CAL   TMS60     ; 60S TIMER SET
0739   028A F9             JCP   KEY15
0740   028B 1514    SCA31: LDI   F1
0741   028D 78             SMB   FGCH      ; FGCH=1
0742   028E 79             SMB   FGCLR     ; SET FGCLR
0743   028F 6E             RFB   DSP0
0744   0290 AC80           CAL   CPCX0
0745   0292 1531           LDI   F7
0746   0294 6B             RMB   FG1T1
0747   0295 F9             JCP   KEY15
0748                ;
0749                ;
0750   0296 AC95    KEY10: CAL   CPXCK
0751   0298 ED             JCP   KEY20
0752   0299 8B             LDZ   KEYCT
0753   029A 38             L
0754   029B 0F             DEC             ; KEYCT=0 ?
0755   029C DE             JCP   KEY11
0756   029D ED             JCP   KEY20
0757   029E 0F      KEY11: DEC             ; KEYCT=1 ?
0758   029F E1             JCP   KEY12
0759   02A0 EF             JCP   KEY13
0760   02A1 151E    KEY12: LDI   CPCN1
0761   02A3 90      KEY16: LI    0
0762   02A4                XM    3
0763   02A5 90             LI    0
0764   02A6 3F             XMI   3
0765   02A7 E3             JCP   KEY16
0766   02A8 4A             XAZ
0767   02A9 8E             LDZ   CPSE1
0768   02AA 17C0           CI    0         ; 0-KEY ?
0769   02AC F2             JCP   KEY14
0770   02AD A22C    KEY20: JMP   SCA04
```

```
STNO E ADRS OBJ.    SOURCE STATEMENTS

0771   02AF 4A      KEY13: XAZ
0772   02B0 8E             LDZ    CPSE1
0773   02B1 3C             XI
0774   02B2 02      KEY14: S
0775   02B3 8B             LDZ    KEYCT        ; KEY DATA SET
0776   02B4 1F             DEM
0777   02B5 B4             CZP    CPST1
0778   02B6 B7             CZP    CPUP0
0779   02B7 A99A           CAL    TMS60
0780   02B9 A22A    KEY15: JMP    SCA02
0781                ;
0782                ;
0783   02BB 85      KEYE:  LDZ    FBUFF
0784   02BC 38             L
0785   02BD 1520           LDI    ABUF2
0786   02BF 26             TAB    KT
0787   02C0 A2C5           JMP    KEYE3
0788   02C2 58             TMB    PU
0789   02C3 C8             JCP    KEYE2
0790   02C4 E6             JCP    SCA42
0791   02C5 59      KEYE3: TMB    PL
0792   02C6 C8             JCP    KEYE2
0793   02C7 E6             JCP    SCA42
0794   02C8 1517    KEYE2: LDI    HBUF1
0795   02CA 5B             TMB    LMPE         ; LMP E ON ?
0796   02CB D1             JCP    KEYE0
0797   02CC 6B             RMB    LMPE         ; LMP E OFF
0798   02CD 13             DED                 ; DP=F6
0799   02CE 68             RMB    FGFA         ; FLAG FA<-0
0800   02CF 79             SMB    FGEB         ; FLAG FB<-1
0801   02D0 D5             JCP    KEYE1
0802   02D1 7B      KEYE0: SMB    LMPE         ; LMP E ON ?
0803   02D2 13             DED                 ; DP=F6
0804   02D3 78             SMB    FGEA         ; FLAG EA<-1
0805   02D4 69             RMB    FGEB         ; FLAG EB<-0
0806   02D5 86      KEYE1: LDZ    GBUFF
0807   02D6 79             SMB    ST           ; ST ON
0808   02D7 A99A           CAL    TMS60        ; 60S TIMER SET
0809   02D9 A22A           JMP    SCA02
0810                ;
0811                ;
0812   02DB 5C      SCA40: FBT    FAKY
0813   02DC E6             JCP    SCA42
0814   02DD 89             LDZ    ALKY
0815   02DE 5A             TMB    AKRQ
0816   02DF E4             JCP    SCA41
0817   02E0 6A             RMB    AKRQ
0818   02E1 8A             LDZ    FKY
0819   02E2 6A             RMB    FKRQ
0820   02E3 E6             JCP    SCA42
0821   02E4 6D      SCA41: RFB    FFKY
0822   02E5 6C             RFB    FAKY
0823   02E6 A30E    SCA42: JMP    SCA50
0824                ;
0825   02E8                ORG    300H
0826                ;
0827                ; DATA CLEAR
```

```
STNO E ADRS OBJ.     SOURCE STATEMENTS

0828                 ;
0829   0300 80       CLER:  LDZ   0
0830   0301 AB08             CAL   RCLR
0831   0303 39               LM    1
0832   0304 AB08             CAL   RCLR
0833   0306 1540             LDI   40H
0834   0308 90       RCLR:  CLA
0835   0309 2B               XM    3
0836   030A 90               CLA
0837   030B 3F               XMI   3
0838   030C C8               JCP   $-4
0839   030D 48               RT
0840                 ;
0841                 ;
0842   030E 1514     SCA50: LDI   F1
0843   0310 90               LI    0
0844   0311 34               CMB   FGCH
0845   0312 DF               JCP   SCA53
0846   0313 1518             LDI   BBUF1
0847   0315 59               TMB   CNT        ; CNT ON ?
0848   0316 DF               JCP   SCA53
0849   0317 1524             LDI   F2
0850   0319 90               LI    0
0851   031A 35               CMB   FGCNT
0852   031B DF               JCP   SCA53
0853   031C 79               SMB   FGCNT
0854   031D AC39             CAL   TCCNT      ; TCN(+1), TCNX(-1)
0855   031F 1518     SCA53: LDI   BBUF1
0856   0321 90               LI    0
0857   0322 35               CMB   CNT        ; CNT ON ?
0858   0323 E7               JCP   SCA55
0859   0324 1524             LDI   F2
0860   0326 69               RMB   FGCNT
0861   0327 1510     SCA55: LDI   ABUF1
0862   0329 38               L
0863   032A 1524             LDI   F2
0864   032C 25               TAB   LM0        ; LM ON/OFF
0865   032D F0               JCP   SCA56
0866   032E 68               RMB   FGLM
0867   032F F9               JCP   SCA60
0868   0330 58       SCA56: TMB   FGLM        ; FGLM=1 ?
0869   0331 F3               JCP   SCA57
0870   0332 F9               JCP   SCA60
0871   0333 78       SCA57: SMB   FGLM
0872   0334 85               LDZ   FBUFF
0873   0335 38               L
0874   0336 6A               RMB   KT         ; KT INVERT
0875   0337 26               TAB   KT
0876   0338 7A               SMB   KT
0877   0339 86       SCA60: LDZ   GBUFF       ; LAMP A OR B ON
0878   033A 6A               RMB   LMPA
0879   033B 6B               RMB   LMPB
0880   033C 85               LDZ   FBUFF
0881   033D 38               L
0882   033E 1520             LDI   ABUF2
0883   0340 26               TAB   KT         ; KT ON ?
0884   0341 CC               JCP   SCA61
```

```
STNO E ADRS OBJ.    SOURCE STATEMENTS

0885   0342 58              TMB   PU        ; PU ON ?
0886   0343 C9              JCP   SCA62
0887   0344 A99A    SCA64:  CAL   TMS60
0888   0346 86              LDZ   GBUFF
0889   0347 68              RMB   CP
0890   0348 D1              JCP   SCA65
0891   0349 ADA3    SCA62:  CAL   LAMPA
0892   034B D1              JCP   SCA65
0893   034C 59      SCA61:  TMB   PL        ; PL ON ?
0894   034D CF              JCP   SCA63
0895   034E C4              JCP   SCA64
0896   034F ADDA    SCA63:  CAL   LAMPB
0897   0351 1520    SCA65:  LDI   ABUF2
0898   0353 90              LI    0
0899   0354 36              CMB   SC        ; SC ON ?
0900   0355 E5              JCP   SCA66
0901   0356 1530            LDI   ABUF3
0902   0358 59              TMB   J         ; J ON ?
0903   0359 E6              JCP   SCA66+1
0904   035A 5A              TMB   TN        ; TN ON ?
0905   035B E7              JCP   SCA66+2
0906   035C 1520            LDI   ABUF2
0907   035E 5B              TMB   DK        ; DK ON ?
0908   035F E1              JCP   SCA66-4
0909   0360 E4              JCP   SCA66-1
0910   0361 86              LDZ   GBUFF
0911   0362 68              RMB   CP
0912   0363 98              LI    8
0913   0364 90              LI    0
0914   0365 91      SCA66:  LI    1
0915   0366 92              LI    2
0916   0367 94              LI    4
0917   0368 87              LDZ   HBUFF
0918   0369 02              S
0919   036A 0F              DEC
0920   036B F0              JCP   SCA67
0921   036C 1530            LDI   ABUF3
0922   036F 5B              TMB   W         ; W ON ?
0923   036F F4              JCP   SCA68
0924   0370 1517    SCA67:  LDI   HBUF1
0925   0372 58              RMB   LMPW      ; LMP W OFF
0926   0373 F9              JCP   SCA69
0927   0374 1517    SCA68:  LDI   HBUF1
0928   0376 78              SMB   LMPW      ; LMP W ON
0929   0377 A99A            CAL   TMS60
0930   0379 85      SCA69:  LDZ   FBUFF
0931   037A 38              L
0932   037B 1517            LDI   HBUF1     ; LMP C ON/OFF
0933   037D 6A              RMB   LMPD
0934   037E 27              TAB   RD
0935   037F 7A              SMB   LMPD
0936   0380 79              SMB   LMPC
0937   0381 27              TAB   RD
0938   0382 69              RMB   LMPC
0939   0383 85      SCA70:  LDZ   FBUFF
0940   0384 59              TMB   BZ        ; BZ ON ?
0941   0385 CC              JCP   SCA71
```

```
STNO E ADRS OBJ.    SOURCE STATEMENTS

0942   0386 1515            LDI   TMBZ
0943   0388 1F       DEM
0944   0389 CC              JCP   SCA71
0945   038A 85              LDZ   FBUFF     ; TIME UP (BZ OFF)
0946   038B 69              RMB   BZ
0947   038C 1521     SCA71: LDI   F5
0948   038E 58              TMB   F60ON     ; TM60 COUNT ?
0949   038F DE              JCP   SCA75
0950   0390 1543            LDI   TM60
0951   0392 0B              CLC             ; BIN(-1)TM COUNT
0952   0393 9F       SCA72: LI    0FH
0953   0394 19              ADC
0954   0395 2C              XD
0955   0396 D3              JCP   SCA72
0956   0397 04              TC              ; TIMER UP ?
0957   0398 DA              JCP   SCA73     ; YES
0958   0399 DE              JCP   SCA75
0959   039A 1521     SCA73: LDI   F5
0960   039C 68              RMB   F60ON
0961   039D 79              SMB   F60UP     ; F60UP=1 SET
0962   039E 1521     SCA75: LDI   F5
0963   03A0 5A              TMB   F2SON     ; 2S TIMER SET ?
0964   03A1 F0              JCP   SCA78
0965   03A2 1572            LDI   TM2S
0966   03A4 0B              CLC             ; BIN(-1)TM COUNT
0967                ;
0968   03A5 9F       SCA76: LI    0FH
0969   03A6 19              ADC
0970   03A7 2C              XD
0971   03A8 E5              JCP   SCA76
0972   03A9 04              TC
0973   03AA EC              JCP   SCA77
0974   03AB F0              JCP   SCA78
0975                ;
0976   03AC 1521     SCA77: LDI   F5
0977   03AE 6A              RMB   F2SON
0978   03AF 7B              SMB   F2SUP
0979   03B0 1539     SCA78: LDI   ABUF3
0980   03B2 58              TMB   MTR
0981   03B3 FB              JCP   SCA80
0982                ;
0983   03B4 5A              TMB   TN
0984   03B5 F7              JCP   SCA86
0985   03B6 FB              JCP   SCA80
0986                ;
0987   03B7 1531     SCA86: LDI   F7
0988   03B9 58              TMB   FGTN1
0989   03BA 79              SMB   FGTN2
0990   03BB 80       SCA80: LDZ   ABUFF
0991   03BC 38              L
0992   03BD 1524            LDI   F2
0993   03BF 27              TAB   CNX       ; CNX ON ?
0994   03C0 C3              JCP   SCA81
0995   03C1 6A              RMB   FGCNX
0996   03C2 E5              JCP   SCA90
0997   03C3 5A       SCA81: TMB   FGCNX     ; FGCNX=1 ?
0998   03C4 C6              JCP   SCA82
```

```
STNO E ADRS OBJ.    SOURCE STATEMENTS

0999   03C5 E5              JCP   SCA90
1000   03C6 1514    SCA82: LDI   F1
1001   03C8 5B              TMB   FCPST     ; CPST=1 ?
1002   03C9 CB              JCP   SCA83
1003   03CA E5              JCP   SCA90
1004   03CB 6A      SCA83: RMB   FCPUP     ; FCPUP=0
1005   03CC 1524            LDI   F2
1006   03CE 7A              SMB   FGCNX     ; FGCNX=1
1007                ;
1008   03CF 153F            LDI   TCN0
1009   03D1 3A              LM    2
1010   03D2 2E              XMD   2
1011   03D3 3A              LM    2
1012   03D4 02              S
1013   03D5 154F            LDI   TCNX0
1014   03D7 38              L
1015   03D8 152F            LDI   CPCNX
1016   03DA 02              S
1017   03DB 154E            LDI   TCNX1
1018   03DD 38              L
1019   03DE 152E            LDI   CPCNX-1
1020   03E0 02              S
1021   03E1 AC5D            CAL   CNSTT
1022   03E3 E5              JCP   SCA90
1023   03E4 B4              CZP   CPST1
1024                ;
1025   03E5 1510    SCA90: LDI   ABUF1
1026   03E7 5A              TMB   TR        ; TR ON ?
1027   03E8 48              RT
1028   03E9 B2      SCA91: CZP   GOFF
1029   03EA B9              CZP   FGCN0
1030   03EB A99A            CAL   TMS60
1031   03ED 86              LDZ   GBUFF
1032   03EE 69              RMB   ST        ; ST OFF
1033   03EF 68              RMB   CP        ; CP OFF
1034   03F0 6E              RFB   DSP0
1035   03F1 1531            LDI   F7
1036   03F3 6B              RMB   FG1T1
1037   03F4 48              RT
1038                ;
1039   03F5                 ORG   400H
1040                ;
1041                ; SET BUF (1)
1042                ;
1043   0400 8E      SET1:  LDZ   CPSE1
1044   0401 91              LI    1
1045   0402 90      SET2:  LI    0         ; CPSE=1
1046   0403 29              XM    1         ; CPCN=0
1047   0404 90              LI    0         ; CPCNX=0
1048   0405 2B              XM    3         ; TCN=0
1049   0406 90              LI    0
1050   0407 29              XM    1
1051   0408 90              LI    0
1052   0409 3F              XMI   3
1053   040A C2              JCP   SET2
1054                ;
1055   040B 154F            LDI   TCNX0     ; TCNX
```

```
STNO E ADRS OBJ.    SOURCE STATEMENTS

1056   040D 90              LI    0
1057   040E 2C              XD
1058   040F 91              LI    1
1059   0410 02              S
1060   0411 48              RT
1061                ;
1062                ;
1063                ; CPY COUNTER SET
1064                ;
1065   0412 8F      CNSET: LDZ   CPSE0
1066   0413 3A              LM    2
1067   0414 2E              XMD   2          ; CPCNX=CPSE
1068   0415 3A              LM    2
1069   0416 2B              XM    3
1070   0417 90              LI    0          ; CPCN=1
1071   0418 3C              XI
1072   0419 90              LI    0
1073   041A 2A              XM    2          ; TCN
1074   041B 90              LI    0
1075   041C 2C              XD
1076   041D 90              LI    0
1077   041E 02              S
1078   041F 8F              LDZ   CPSF0
1079   0420 38              L
1080   0421 154F            LDI   TCNX0
1081   0423 02              S
1082   0424 8E              LDZ   CPSE1
1083   0425 38              L
1084   0426 154E            LDI   TCNX1
1085   0428 02              S
1086   0429 48              RT
1087                ;
1088                ;
1089                ; CPY COUNT
1090                ;
1091   042A 152E    CPCNT: LDI   CPCNX-1
1092   042C AC4D            CAL   BCDCX      ; CPCNX(-1)
1093   042E 04              TC
1094   042F F5              JCP   CPC11
1095   0430 B5              CZP   CPST0      ; FCPST RESET
1096   0431 151E            LDI   CPCN1
1097   0433 A446            JMP   BCDCN      ; CPCN(+1)
1098                ;
1099   0435 152F    CPC11: LDI   CPCNX-1
1100   0437 A446            JMP   BCDCN
1101                ;
1102                ; TCN(+1), TCNX(-1) COUNT
1103                ;
1104   0439 154E    TCCNT: LDI   TCNX1
1105   043B AC4D            CAL   BCDCX      ; TCNX(-1)
1106   043D 04              TC
1107   043E A443            JMP   TCCN2
1108   0440 153E            LDI   TCN1
1109   0442 C6              JCP   BCDCN      ; TCN(+1)
1110                ;
1111   0443 154E    TCCN2: LDI   TCNX1
1112   0445 C6              JCP   BCDCN
```

```
STNO E ADRS OBJ.    SOURCE STATEMENTS

1113                ;
1114                ; BCD COUNT (+1)
1115                ;
1116   0446 1B      BCDCN: STC
1117   0447 96             LI     6
1118   0448 09             ADS
1119   0449 0A             DAS
1120   044A 3C             XI
1121   044B C7             JCP    BCDCN+1
1122   044C 48             RT
1123                ;
1124                ; BCD BACK-COUNT (-1)
1125                ;
1126   044D 0B      BCDCX: CLC
1127   044E 9F             LI     0FH
1128   044F 09             ADS
1129   0450 0A             DAS
1130   0451 3C             XI
1131   0452 CE             JCP    BCDCX+1
1132   0453 48             RT
1133                ;
1134                ; CPY COUNT UP CHECK
1135                ;
1136   0454 152F    CNUP: LDI     CPCNX
1137   0456 90             LI     0
1138   0457 0C             CM
1139   0458 48             RT
1140   0459 13             DED
1141   045A 0C             CM
1142   045B 48             RT
1143   045C 49             RTS                ; COUNT UP/ST
1144                ;
1145                ; CPY START CHECK
1146                ;
1147   045D 151F    CNSTT: LDI    CPCN0
1148   045F D6             JCP    CNUP+2
1149                ;
1150                ; I/O RESET
1151                ;
1152   0460 90      IOCLR: CLA                ; A-I OFF
1153   0461 88             LDZ    8
1154   0462 0E             OP
1155   0463 13             DED
1156   0464 E2             JCP    $-2
1157   0465 9F             LI     0FH
1158   0466 44             OE
1159   0467 90             CLA
1160   0468 44             OE
1161   0469 48             RT
1162                ;
1163   046A 83      TCNST: LDZ    TNCNT
1164   046B 98             LI     8
1165   046C 2C             XD
1166   046D 90             CLA
1167   046E 02             S
1168   046F 48             RT
1169                ;
```

```
STNO E ADRS OBJ.    SOURCE STATEMENTS

1170                ;
1171   0460 82      TNCHK: LDZ   TNCNT-1
1172   0471 1B             STC
1173   0472 90             CLA
1174   0473 19             ADC
1175   0474 3C             XI
1176   0475 90             CLA
1177   0476 19             ADC
1178   0477 02             S
1179                ;
1180   0478 9B             LI    50 SHR 4 OR 8
1181   0479 0C             CM
1182   047A 48             RT
1183   047B 13             DED
1184   047C 92             LI    50 AND 0FH
1185   047D 0C             CM
1186   047E 48             RT
1187   047F 49             RTS
1188                ;
1189   0480 151F   CPCX0: LDI   CPCN0
1190   0482 90             LI    0
1191   0483 2C             XD
1192   0484 90             LI    0
1193   0485 2B             XM    3
1194   0486 90             LI    0
1195   0487 3C             XI
1196   0488 90             LI    0
1197   0489 29             XM    1
1198   048A 90             LI    0
1199   048B 2C             XD
1200   048C 90             LI    0
1201   048D 92             S
1202   048E 154F           LDI   TCNX0
1203   0490 90             LI    0
1204   0491 2C             XD
1205   0492 90             LI    0
1206   0493 02             S
1207   0494 48             RT
1208                ;
1209   0495 1510   CPXCK: LDI   ABUF1
1210   0497 5B             TMB   CPX
1211   0498 DA             JCP   CPX0
1212   0499 48             RT
1213   049A 1521   CPX0:  LDI   F5
1214   049C 5A             TMB   F2SON
1215   049D 49             RTS
1216   049E 1516           LDI   F6
1217   04A0 58             TMB   FGEA
1218   04A1 E3             JCP   CPX1
1219   04A2 48             RT
1220   04A3 1531   CPX1:  LDI   F7
1221   04A5 5B             TMB   FG1T1
1222   04A6 48             RT
1223   04A7 49             RTS
1224                ;
1225                ;
```

```
STNO E ADRS OBJ.     SOURCE STATEMENTS

1226                 ;
1227                 ;
1228   04A8                  ORG    500H
1229                 ;
1230                 ; 7 SEGEMENT OUTPUT
1231                 ;
1232   0500 1E3F             OCD    3FH        ; 0
1233   0502 A52A             JMP    IO100
1234   0504 1E06             OCD    6          ; 1
1235   0506 A52A             JMP    IO100
1236   0508 1E5B             OCD    5BH        ; 2
1237   050A A52A             JMP    IO100
1238   050C 1E4F             OCD    4EH        ; 3
1239   050E A52A             JMP    IO100
1240   0510 1E66             OCD    66H        ; 4
1241   0512 A52A             JMP    IO100
1242   0514 1E6D             OCD    6DH        ; 5
1243   0516 A52A             JMP    IO100
1244   0518 1E7D             OCD    7DH        ; 6
1245   051A A52A             JMP    IO100
1246   051C 1E27             OCD    27H        ; 7
1247   051E A52A             JMP    IO100
1248   0520 1E7F             OCD    7FH        ; 8
1249   0522 A52A             JMP    IO100
1250   0524 1E6F             OCD    6FH        ; 9
1251   0526 A52A             JMP    IO100
1252   0528 1E00             OCD    0          ; A (BLANK)
1253   052A 48       IO100:  RT                ; RETURN
1254   052B 80       OPCD:   LDZ    ABUFF
1255   052C 1B               STC
1256   052D 59               TMB    SWAD       ; SWAD ON ?
1257   052E 0B               CLC
1258   052F 157F             LDI    TIMNG
1259   0531 38               L
1260   0532 8F               LDZ    CPSE0
1261   0533 24               TAB    0          ; T0 OR T2 ?
1262   0534 8E               LDZ    CPSE1
1263   0535 25               TAB    1          ; T2 OR T3 ?
1264   0536 F8               JCP    $+2
1265   0537 FB               JCP    OPCD1
1266   0538 3A               LM     2
1267   0539 04               TC                ; SWAD ON ?
1268   053A 3B               LM     3          ; OFF(CPCN), ON(CPCNX)
1269   053B 38       OPCD1:  L
1270   053C A53F             JMP    OPCD2
1271   053E 41               JPA
1272                 ;
1273   053F 17C0     OPCD2:  CI     0          ; BLANKING
1274   0541 C7               JCP    OPCD3
1275   0542 157F             LDI    TIMNG
1276   0544 58               TMB    0
1277   0545 C7               JCP    OPCD3
1278   0546 9A               LI     0AH
1279   0547 A53E     OPCD3:  JMP    OPCD1+3
1280                 ;
1281                 ; INPUT AND OUTPUT
1282                 ;
```

```
STNO E ADRS OBJ.    SOURCE STATEMENTS

1283   0549 6F      INOUT: RFB   KYIN      ; KEY INPUT FG RESET
1284   054A 90             LI    T0
1285   054B 157F           LDI   TIMNG
1286   054D 02             S
1287                ;
1288                ;
1289   054E 90      IOLOP: LI    0         ; E-PORT OFF
1290   054F 44             OE
1291   0550 87             LDZ   HBUFF     ; H-PORT OUT
1292   0551 4F             XHX
1293   0552 47             THX
1294   0553 38             L
1295   0554 0E             OP
1296   0555 86             LDZ   GBUFF     ; G-PORT OUT
1297   0556 38             L
1298   0557 0E             OP
1299   0558 85             LDZ   FBUFF     ; F-PORT OUT
1300   0559 38             L
1301   055A 0E             OP
1302   055B AD2B           CAL   OPCD      ; 7 SEG OUT
1303   055D 157F           LDI   TIMNG     ; E-PORT DATA ADJ
1304   055F 0B             CLC
1305   0560 98             LI    8
1306   0561 59             TMB   1
1307   0562 92             LI    2
1308   0563 58             TMB   0
1309   0564 30             RAR
1310   0565 44             OE              ; E-PORT OUT
1311                ;
1312   0566 90             LI    0
1313   0567 88             LDZ   IBUFF
1314   0568 0E             OP
1315   0569 81             LDZ   BBUF
1316   056A 32             IP              ; CNT INPUT ?
1317   056B 1518           LDI   BBUF1
1318   056D 79             SMB   CNT
1319   056E 25             TAB   CNT
1320   056F 69             RMB   CNT
1321   0570 90             LI    0
1322   0571 88             LDZ   IBUFF
1323   0572 02      IOL10: S
1324   05730E              OP              ; I-PORT OUT
1325   0574 81             LDZ   BBUFF
1326   0575 50             TPB   0         ; B-PORT IN ?
1327   0576 A582           JMP   IOL19
1328   0578 157F           LDI   TIMNG     ; KEY IN
1329   057A 38             L
1330   057B 08             AD
1331   057C 08             AD
1332   057D 08             AD
1333   057E 88             LDZ   IBUFF
1334   057F 08             AD
1335   0580 4A             XAZ             ; KEY DATA SET
1336   0581 7F             SFB   KYIN      ; KYIN SET
1337   0582 88      IOL19: LDZ   IBUFF     ; I-PORT DATA SET
1338   0583 38             L
1339   0584 0D             INC
```

```
STNO E ADRS OBJ.    SOURCE STATEMENTS

1340   0585 17C4            CI     4
1341   0587 A572            JMP    IOL10
1342                ;
1343   0589 157F            LDI    TIMNG      ; TIMNG ADJST
1344   058B 1D              INM
1345   058C 38              L
1346   058D 17C4            CI     4
1347   058F A54E            JMP    IOLOP
1348   0591 90              CLA
1349   0592 44              OE
1350                ;
1351                ;
1352   0593 93              LI     3
1353   0594 88              LDZ    IBUFF
1354   0595 02              S
1355   0596 38      IOL20:  L
1356   0597 0E              OP
1357   0598 157D            LDI    7DH
1358   059A 02              S
1359   059B 40              IA                ; A-PORT IN
1360   059C 80              LDZ    ABUFF
1361   059D 4D              XHR
1362   059E 02              S
1363   059F 88              LDZ    IBUFF
1364   05A0 1F              DEM
1365   05A1 D6              JCP    IOL20
1366   05A2 48              RT
1367                ;
1368                ; LAMP A ON
1369                ;
1370   05A3 86      LAMPA:  LDZ    GBUFF
1371   05A4 7A              SMB    LMPA       ; A ON
1372   05A5 86      LMPFA:  LDZ    GBUFF
1373   05A6 6B              RMB    LMPB       ; B OFF
1374   05A7 85              LDZ    FBUFF
1375   05A8 7A              SMB    KT         ; KT ON
1376   05A9 48              RT
1377                ;
1378                ; LAMP B ON (A OFF)
1379                ;
1380   05AA 86      LAMPB:  LDZ    GBUFF      ; B ON
1381   05AB 7B              SMB    LMPB
1382   05AC 86      LMPFB:  LDZ    GBUFF      ; A OFF
1383   05AD 6A              RMB    LMPA
1384   05AE 85              LDZ    FBUFF
1385   05AF 6A              RMB    KT         ; KT OFF
1386   05B0 48              RT
1387                ;
1388                ; BLANK (2)
1389                ;
1390   05B1 152E    BLNK2:  LDI    CPCNX-1
1391   05B3 9A              LI     0AH
1392   05B4 0C              CM
1393   05B5 F8              JCP    $+3
1394   05B6 90              LI     0
1395   05B7 02              S
1396   05B8 3B              LM     3
```

```
STNO E ADRS OBJ.     SOURCE STATEMENTS

1397    05B9 9A              LI     0AH
1398    05BA 0C              CM
1399    05BB 48              RT
1400    05BC 90              LI     0
1401    05BD 02              S
1402    05BE 48              RT
1403                 ;
1404    0000                 END
ERROR = 0000
```

Preferred embodiments of a cleaning apparatus which constitutes the gist of the present invention will be described hereinafter.

Figure 92:
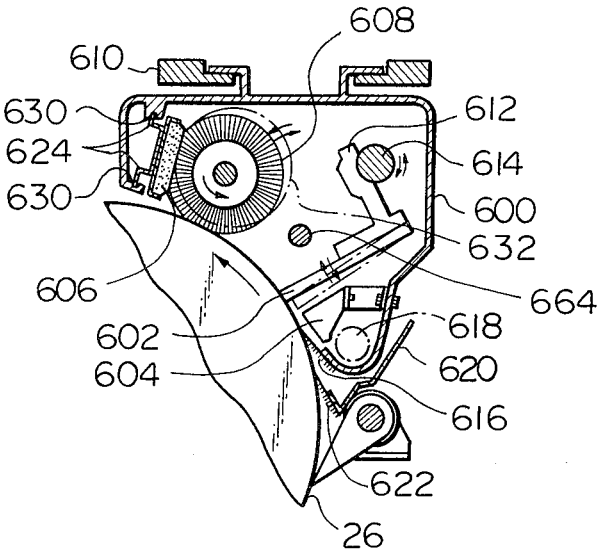
FIG. 92 is a sectional side elevation of a cleaning apparatus embodying the present invention.

A first embodiment of the cleaning apparatus is illustrated in FIG. 92. The cleaning apparatus includes a casing 600 to which a cleaning blade 602, an agitator 604 and others are rigidly mounted. A block or mass of film-forming material 606 having a small coefficient of friction is supported by means which is mounted to the casing 600 as will be described. A cylindrical rotatable brush 608 is driven by drive means, which will be discussed with reference to FIG. 93, into and out of pressing contact with a photosensitive drum 26 and the block 606 of film-forming material. The block 606, block support means, brush 608 and brush drive means form an essential part of the cleaning apparatus. The casing 600 is detachable from the machine body along elongate guides 610 integral with the machine body in a direction perpendicular to the surface of the drawing.

Before describing the essential part of the present invention, a general arrangement and operation of the cleaning apparatus will be outlined.

The cleaning blade 602 is supported by a holder 612 within the casing 600 to clear a worked part of a toner powder which remains on the surface of the drum 26. The holder 612 is rigidly mounted on a shaft 614 which is rotatable at an appropriate timing. A rotation of the shaft 614 will move the cleaning blade 602 into or out of pressing contact with the drum 26 through the holder 612. Toner particles scraped by the blade 602 off the drum 26 flows down along an upper surface of a first inlet seal member 616 which comprises a thin resilient plate which is rigidly connected to the unit casing 600 at one end and held in contact with the drum 26 at the other end. Then the toner particles reach a collector coil 618 which serves as a screw conveyor. The collector coil 618 in rotation moves the toner particles in a predetermined direction parallel to its axis whereafter the toner particles are advanced through a predetermined path until they are collected in a toner tank within a developing unit 30 to be used again. As shown, the first inlet seal 616 is provided with bristles on a lower end thereof (facing the drum 26) for the purpose of attaining a sealing effect. The agitator 604 is interposed between the coil 618 and blade 602 and located above the first inlet seal 616 in order to prevent toner particles from stopping up the space between the coil 618 and blade 602. More specifically, the agitator 604 is suitably driven for oscillation at a high frequency to break up gathered toner particles and thereby surely feed them to the coil 618. A seal guide 620 is disposed below the casing 600 in such a manner as to surround a lower portion of the latter. The seal guide 620 carries at an end thereof a second inlet seal member 622 which is constructed and arranged in exactly the same way as the first inlet seal 616. The second inlet seal 622 has a function of receiving toner particles which may fall while the cleaning apparatus is being mounted to or demounted from the machine body.

Figure 94:
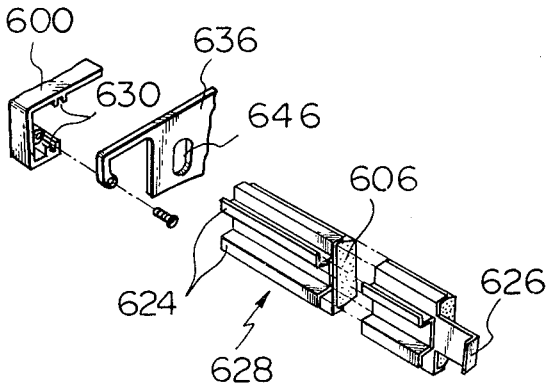
FIG. 94 is a perspective view of means for supporting a block of film-forming material which has a small coefficient of friction.

As viewed in FIG. 94, the block 606 of film-forming material is adhered or otherwise secured to a holder 628 which comprises guides 624 and a knob 626. The casing 600 on the other hand is formed with guide channels 630. Thus, the block 606 can be placed in a predetermined position on the casing 600 by holding the knob 620 with a hand and inserting the guides 624 on the holder 628 into the guide channels 630 on the casing 600. In this respect, the holder 628 and guide channels 630 constitute support means for the block 606 in combination. With this arrangement, the block 606 on the holder 628 can be easily replaced with another as desired.

The brush 608 is located in a position within the casing 600 and downstream of the cleaning blade 602 with respect to the direction of rotation of the drum 26; it is rotatable in a direction which opposes the rotation of the drum 26 (see FIG. 92). The brush 608 is employed to apply the film-forming material evenly onto a surface of the drum 26 which is cleared of residual toner particles by the cleaning blade 602. In an application mode of operation, the brush 608 is positioned as indicated by a solid line in FIG. 92 to pressingly contact the peripheries of the drum 26 and block 606. The brush 608 in this position will apply the film-forming material 606 onto the drum 26 therethrough. In a non-application mode, the brush 608 is shifted to a position 632 indicated by a phantom line in FIG. 92 where it becomes spaced at least from the drum 26. These application and non-application modes are controllably switched from one to the other to match a condition of the layer of the film-forming material on the drum 26. For example, a time period for an application mode may be prolonged if an amount of the material on the drum 26 is short and a time period for a non-application mode may be prolonged if an amount of the material is excessive. The condition of the film on the drum 26 continuously varies rubbed by the cleaning blade 602 for instance. Additionally, the film has its thickness increased little by little over a long time of operation of the copying machine. For these reasons, it is very important to control the film on the drum 26 by switching the application and non-application modes from one to the other.

Figure 93:
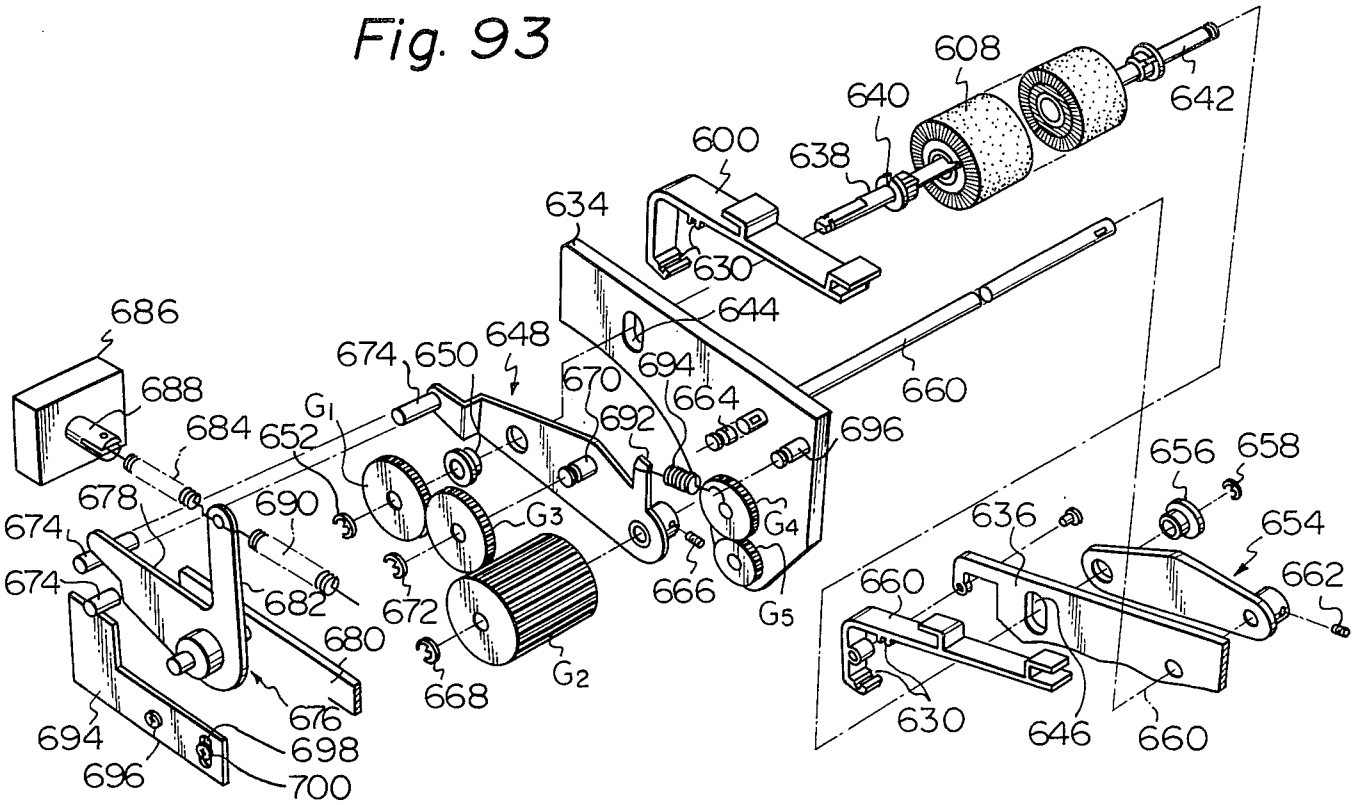
FIG. 93 is an exploded perspective view of an essential part of the cleaning apparatus.

Selection of an application mode or a non-application mode is made by moving the rotatable brush 608. Reference will be made to FIG. 93 for describing the means for shifting the brush 608 into and out of contact with the drum 26. As shown in FIG. 93, the casing 600 is provided with a front side panel 634 and a rear side panel 636 which individually closes openings formed at front and rear ends of the casing 600 with respect to the axial direction of the drum 26. The brush 608 is mounted on a shaft 642 by pins 638 and brushes 640. The front and rear side panels 634 and 636 are formed with elongate slots 644 and 646, respectively; each of these elongate slots is sufficiently larger than the diameter of the shaft 642. The shaft 642 extends throughout the elongate slots 644 and 646 to protrude outward therefrom at its opposite ends. Passed through the front side panel 634, the shaft 642 is further passed rotatably through a bearing 650 which is fitted in one or free end of a swingable lever 648. This end of the shaft 642 carries a gear element $G_1$ rigidly therewith. A snap ring 652 is attached to the shaft 642 to prevent the gear element $G_1$ from slipping out of the shaft 642. Likewise, the other end of the shaft 642 passed through the rear side panel 636 is further passed rotatably through a bearing 656 fitted in one or free end of a second swingable lever 654. Separation of the shaft 642 at said other end from the panel 636 is prevented by a snap ring 658.

The other or base end of the first swingable lever 648 is coupled on a connecting shaft 664 which rotatably extends through the front side panel 634. A set screw 666 keeps the lever 648 from rotation relative to the shaft 664. The other or base end of the second swingable lever 654 is coupled on an end of a connecting shaft 660 which extends rotatably through the rear side panel 636. The lever 654 is prevented by a set screw 662 from rotating relative to or separating from the shaft 660. A gear element $G_2$ is mounted on the other end of the shaft 660 and prevented by a snap ring 668 from separating therefrom. This gear element $G_2$ is in driven connection with a drive line adapted to drive the copying machine and, in this respect, it functions as a drive gear. A stub shaft 670 is studded on the swingable lever 648 intermediate between the gear elements $G_1$ and $G_2$. An intermediate gear element $G_3$ is mounted on the stub shaft 670 and meshed with 60th of the gear elements $G_1$ and $G_2$. A snap ring 672 keeps the gear element $G_3$ from separating from the stub shaft 670.

Other two gear elements $G_4$ and $G_5$ are rotatably mounted to the front side panel 634 and meshed with each other. The gear element $G_4$ is adapted to impart power to the agitator 604 for causing it to oscillate while the gear element $G_5$ is adapted to transmit power to the collector coil 618 to rotate it. A rotational movement generated by a drive line (not shown) is delivered first to the gear $G_2$ and therefrom to the gear $G_1$ via the intermediate gear $G_3$. The rotation is also transmitted to the intermeshed gears $G_4$ and $G_5$ whereby the agitator 604 is oscillated and the coil 618 rotated. As already mentioned, the base ends of the swingable levers 648 and 664 are integral with the shafts 664 and 660, respectively. The levers 648 and 654 therefore are caused to swing individually about the shaft 660, accompanying a swinging action of the brush 608. It is noteworthy here that despite such actions of the swingable members the gears $G_1$–$G_5$ are kept in the same meshing relations.

A pin 674 extends out from the free end of the swingable lever 648 into engagement with one arm 678 of an L-shaped lever 676 which is provided to a stationary side plate 680 integral with the machine body. A first tension spring 684 is anchored at one end to the free end of the other arm 682 of the lever 676 and at the other end to a plunger 688 of a solenoid 686 which is rigid on a stationary member such as the side plate 680. A second tension spring 690 is retained at one end by said one end of the arm 682 and at the other end by a pin studded on the side plate 680 though not shown in the drawing. As will become apparent from the following description, the spring 684 serves as a pressure applying spring and the spring 690 as a pressure releasing spring.

The swingable lever 648 has an upright lug 692 disposed generally above that portion of the lever through which the shaft 660 extends. The top of the lug 692 retains one end of a tension spring 694 the other end of which is anchored to a pin 696 studded on the front side panel 634. Serving as a release spring as will be described, the spring 694 constantly biases the swingable lever 648 clockwise about the shaft 660. This clockwise motion of the lever 648 is limited when the pin 644 is engaged with the arm 678 of the L-shaped lever 676 or when the shaft 642 abuts against the upper end of the slot 644. When the shaft 642 abuts against the upper end of the slot 644, the brush 608 is disengaged from both the drum 26 and block 606 setting up a non-application mode.

When the solenoid 686 is deenergized, the spring 690 pulls the plunger 688 out of the solenoid 686 to its stroke end against the action of the spring 684 while, at the same time, moving the L-shaped lever 676 clockwise. This movement of the L-shaped lever 676 is stopped when the plunger 688 reaches a stroke end position thereof. In this situation, the arm 678 of the lever 676 is positioned above and spaced a little from the pin 674 which is then stationary in an uppermost position defined by the slot 644. Stated another way, the pin 674 and arm 678 do not interfere with each other under the condition mentioned above and such positions of the pin 674 and arm 678 will facilitate easy removal of the casing 600 bodily from the machine body.

When the solenoid 686 is energized, the plunger 688 is drawn into the solenoid 686 to swing the L-shaped lever 676 counterclockwise against the action of the spring 690 and the arm 678 of the lever 676 soon comes to abut against the pin 674. Thereafter, the swingable lever 648 is rotated counterclockwise about the shaft 660 not only against the force of the spring 690 but against the force of the spring 694 this time, conditioning the cleaning apparatus for a non-application mode. The counterclockwise movement of the lever 648 is limited by a stop 694 against which the lever 648 abuts. It will be noted that the brush 608 is engaged with both the drum 26 and block 606 when the pin 674 abuts against the stop 694. The stop 694 is connected to the side plate 680 at an intermediate part thereof by an adjusting screw 696. A set screw 700 is threaded into the side plate 680 through an elongate slot 698 formed in the stop 694. A position the stop 694 limits the action of the lever 648 as mentioned is adjustable by loosening the set screw 700, moving the stop 694 about the screw 696 to a desired position and tightening the set screw 700 at the desired position. By so adjustably positioning the stop 694, the brush 608 can be held in pressing contact with the drum 26 and block 606 for a controlled period of time, by a controlled amount, etc.

The cleaning blade 602 is so controlled as to remain engaged with the drum 26 only when the drum 26 is in rotation. The brush 608 is controlled such that it contacts the drum 26 only when the cleaning blade 602 is kept in contact with the drum 26. This manner of control will prevent the brush 608 from being contaminated by toner particles and thereby preserve the expected function of the brush 608 over a long time of use.

It will be understood from the foregoing that the cleaning apparatus constantly maintains an appropriate amount of application of the film-forming material by on-off controlling the solenoid 686 to shift the brush 608 between two different positions.

In the embodiment described, an automatic control of the thickness of the film is possible as by controlling the solenoid 686 such that it is deenergized to move the brush 608 out of contact with the drum 26 when a given number of copies or that of rotations of the drum is reached and is energized again to bring the brush 608 into contact with the drum 26 and block 606 when a given number of copies or that of rotations of the drum 26 is reached after the deenergization of the solenoid 686. For this purpose, the cleaning apparatus will be operatively connected with a counter for counting copies produced or rotations of the drum 26.

Figure 95:
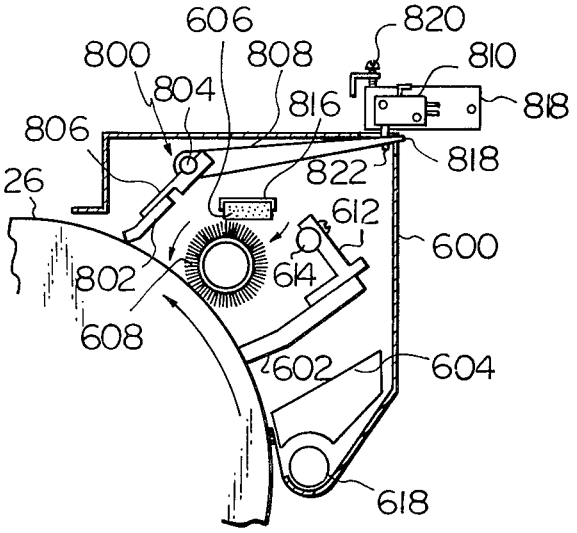
FIG. 95 is an enlarged section of a cleaning apparatus according to another embodiment of the present invention.
Figure 96:
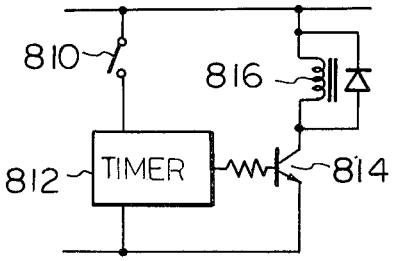
FIG. 96 is a diagram representing an electric circuit associated with the apparatus of FIG. 95 to apply a controlled amount of film-forming material onto a photosensitive drum.

Another embodiment of the present invention is shown in FIGS. 95 and 96. A major difference of this embodiment from the embodiment described with reference to FIGS. 92–94 is that a member 800 serving as a friction coefficient sensor is located in a position downstream of the film-forming material applying device with respect to the direction of rotation of the drum 26. As shown, the member 800 comprises a blade 802, a blade holder 806 carrying the blade 802 integrally therewith and rotatable about a shaft 804, a lever 808 integral with the blade holder 806 and extending upward and rightward away therefrom, and a switch 810 engagable with a free end 818 of the lever 808.

FIG. 96 illustrates an electric circuit for operating the film-forming material applying device. The switch 810 is connected in series with a timer circuit 812 which comprises a monostable multivibrator circuit or the like. A coil 816 is connected to the collector of a transistor or equivalent switching element 814. The coil 816 constitutes an electromagnetic switch which intervenes between the brush 608 and a drive source for the brush 608.

The blade 802 is engaged with the drum 26 either constantly or only during copying cycles under a predetermined pressure to function as a feeler of the friction coefficient sensor. The blade 802 therefore varies its position depending on the varying coefficient of friction on the surface of the drum 26. The switch 810 has a specific position which is determined such that the switch turns on when the coefficient of friction on the drum surface is large and turns off when it is small. This is attainable by determining a position of the blade 802 on the drum 26 before application of the film-forming material and then a relation between a position of the lever 808 of that instant and an amount of stroke of the lever 808 caused by a decrease in the coefficient of friction on the drum. The switch 810 comprises a normally open switch which preferably has as small a tolerance as possible. FIG. 95 represents a situation in which the coefficient of friction on the drum is large and the material applying device is operative. A large coefficient of friction causes the sensor blade 802 to rotate clockwise about the shaft 804 as viewed in FIG. 95 so that the lever 808 integral with the blade 802 is rotated also clockwise about the shaft 804 with its free end 818 moved downward. Then the switch 810 shown in FIG. 96 is opened to activate the timer 812 which in turn renders the switching element 814 conductive. This activates the electromagnetic clutch adapted to drive the brush 608 of the material applying device for rotation. The conduction period of time of the switching element 814 after each opening of the switch 810 is determined by the timer 812. As the brush 608 is driven for rotation, it scrapes a necessary amount of film-forming material 606 from a source 816 and supplies the material onto the surface of the drum 26 carrying the material on its filaments. As will be recalled, the film-forming material 606 has a small coefficient of friction. Concerning the necessary amount of application of the material, an optimum amount can be determined through experiments.

The switch 810 is mounted to a board 818 which is movable up and down through an adjusting screw 820 as seen in FIG. 95. The board 818 thus joins in the adjustment of a position of the switch 810 where the switch 810 will be actuated.

When the sensor blade 802 and lever 808 is rotated clockwise about the shaft 804 by a large coefficient of friction on the drum 26, the contact pressure between the blade 802 and drum 26 tends to be decreased. With this in view, a stop 822 is provided to the casing 600 to be abutted by the free end of the lever 808. When engaged by the lever 808, the stop 822 gives the blade 802 a force large enough to bring it back to the original position when the material 606 is applied to the drum 26 to reduce the coefficient of friction on the drum 26. Upon a decrease in the coefficient of friction, the blade 802 rotates slightly counterclockwise from the position illustrated in FIG. 95 whereby the free end 818 of the lever 808 is moved upward turning on the switch 810.

As has been discussed, the film-forming material is supplied onto a surface of the drum 26 when the coefficient of friction on the drum surface increases. The blade 802 positioned just past of the brush 608 immediately senses the application of the material and, therefore, the resulting decrease in the coefficient of friction. However, a major part of the periphery of the drum 26 is still left bare and, particularly, the coefficient of friction is still large in an area of the drum 26 at and adjacent to the cleaning blade 602 which is positioned ahead of the brush 608. The timer 812 is thus designed to activate the material applying device for a given period of time which is long enough to supply the material over the entire surface of the drum 26. More specifically, the timer 812 operates for each predetermined period of time necessary for the drum 26 to complete one full rotation.

In any of the foregoing embodiments, the operation of the device for supplying the film-forming material may be controlled on the basis of an on-off control of the brush 608, shift of the brush into or out of contact with the film-forming material, rotation of the brush at a controlled speed, variation of the time periods of contact and non-contact of the brush with the drum 26, or the like, all in accordance with the varying coefficient of friction on the drum 26.

While the switch 810 is shown in FIG. 96 connected with the timer 812, the timer 812 may be omitted so that the material applying device is operated directly in response to an action of the switch 810.

The sensor blade 802 may be located ahead of the brush 608 or the cleaning blade 602 with respect to the direction of rotation of the drum 26. This will surely make up for the omission of the timer 812. Also, the material applying device may be positioned past the sensor blade 802.

The rotary brush serving as the material applying device in the drawings may be replaced by a magnetic brush or a suitable arrangement which lets a material concerned fall onto the drum 26 by gravity.

In summary, it will be seen that the present invention provides a cleaning apparatus for electrophotography which maintains a substantially constant coefficient of friction between a photosensitive element and a cleaning blade and thereby minimizes wear of the photosensitive element while reducing wear of the cleaning blade down to 1/10 or less compared with wear thereof which would result from non-application of a material concerned. Additionally, the material is supplied in a controlled volume to avoid an excessive supply which would otherwise bring about various problems including a fall of the image density, degradation of a reproduced image and a fall of the developing ability.

Various modifications will become possible for those skilled in the art after receiving the teachings of the present disclosure without departing from the scope thereof.

What is claimed is:

1. A cleaning apparatus for an electrophotographic copying machine including a photosensitive member, the cleaning apparatus removing residual toner particles from the photosensitive member and comprising;

scraper blade means engaging with the photosensitive member to scrapingly remove residual toner particles therefrom:

applicator means for applying a film-forming material onto the circumference of the photosensitive member; and drive means for moving the applicator means into and out of contact with the photosensitive member in dependence on a parameter indicating a varying operating condition of the photosensitive member;

whereby a proper amount of the film-forming material is applied onto the circumference of the photosensitive member under a varying operating condition of the photosensitive member; and sensor means for sensing a coefficient of friction of the circumference of the photosensitive member, the parameter comprising the sensed coefficient of friction of the circumference of the photosensitive member.

2. A cleaning apparatus as claimed in claim 1, in which the parameter further comprises a length of operating time of the photosensitive member.

3. A cleaning apparatus as claimed in claim 2, in which the parameter further comprises the number of copies produced by the photosensitive member.

4. A cleaning apparatus as claimed in claim 1, in which the sensor means comprises switching means for actuating the drive means to so control the applicator means as to apply the film-forming material onto the circumference of the photosensitive member when the sensed coefficient of friction of the circumference of the photosensitive member is greater than a predetermined value.

5. A cleaning apparatus as claimed in claim 4, in which the sensor means is disposed downstream of the applicator means in the direction of rotation of the photosensitive member.

6. A cleaning apparatus as claimed in claim 4, in which the sensor means is disposed upstream of the applicator means in the direction of rotation of the photosensitive member, the sensor means further comprising a timer for actuating the applicator means to apply the film-forming material onto the circumference of the photosensitive member during at least one full rotation of the photosensitive member.

7. A cleaning apparatus as claimed in claim 1, in which the applicator means comprises a rotating brush and a holder for supporting the film-forming material.

8. A cleaning apparatus as claimed in claim 7, further comprising a housing, the holder being detachably mounted to the housing.

9. A cleaning apparatus as claimed in claim 1, in which the applicator means comprises a rotating brush.

10. A cleaning apparatus as claimed in claim 9, in which the brush is rotatably engaged with the film-forming material.

11. A cleaning apparatus as claimed in claim 1, in which the film forming material is composed of a material having a small coefficient of friction.

* * * * *